US006089563A

United States Patent [19]

Takashimizu et al.

[11] Patent Number: 6,089,563

[45] **Date of Patent: *Jul. 18, 2000**

[54] PAPER SUPPLY APPARATUS FOR IMAGE READING APPARATUS AND IMAGE READING APPARATUS WITH PAPER SUPPLY APPARATUS AS WELL AS PAPER SUPPLY APPARATUS

[75] Inventors: Yoshihiro Takashimizu; Toshiaki Anzai; Seigo Umeda; Hiroyuki Maruyama; Tadayoshi Nakata; Toshiaki Kumagai; Rika Nishiwaki, all of Kawasaki, Japan

[73] Assignee: Fujitsu, Ltd., Kawasaki, Japan

[ * ] Notice: This patent is subject to a terminal disclaimer.

[21] Appl. No.: 09/016,730

[22] Filed: Jan. 30, 1998

Related U.S. Application Data

[63] Continuation of application No. 08/407,408, Mar. 20, 1995, Pat. No. 5,715,071.

[30] Foreign Application Priority Data

Apr. 7, 1994 [JP] Japan ..... 6-069829
May 19, 1994 [JP] Japan ..... 6-105796

[51] Int. Cl.[7] ..... B65H 3/06

[52] U.S. Cl. ..... 271/117; 271/121; 271/122

[58] Field of Search ..... 271/117, 121, 271/122

[56] References Cited

U.S. PATENT DOCUMENTS 4,718,655 1/1988 Okayama et al. ..... 271/117
5,244,197 9/1993 Helmstadter ..... 271/11
5,678,817 10/1997 Saito et al. ..... 271/122
5,715,071 2/1998 Takashimizu et al. ..... 358/498

FOREIGN PATENT DOCUMENTS 401285537A 11/1989 Japan ..... 271/117
405032356A 2/1993 Japan ..... 271/121

*Primary Examiner*—H. Grant Skaggs
*Attorney, Agent, or Firm*—Armstrong, Westerman, Hattori, McLeland and Naughton

[57] ABSTRACT

The invention provides a paper supply apparatus for an image reading apparatus, an image reading apparatus with a paper supply apparatus and a paper supply apparatus which can be used suitably with an image scanner wherein a large amount of paper sheets can be taken out one by one with certainty and read successively and rapidly. The paper supply apparatus successively supplies paper sheets accommodated therein to a paper transport mechanism along which an optical image reading mechanism is disposed, and comprises a paper supply hopper, a paper supply roller located above the paper supply hopper for forwarding the paper sheets accommodated in the paper supply hopper, a paper supply roller driving mechanism for rotating the paper supply roller, and a paper separation mechanism for preventing two or more paper sheets forwarded by the paper supply roller from being sent to the paper transport mechanism. The paper separation mechanism includes a paper skew prevention mechanism for holding down a passing paper sheet with a higher paper holding down force at a central location in the widthwise direction of the paper sheet but with lower paper holding down forces at the opposite end locations in the widthwise direction of the paper sheet.

3 Claims, 77 Drawing Sheets

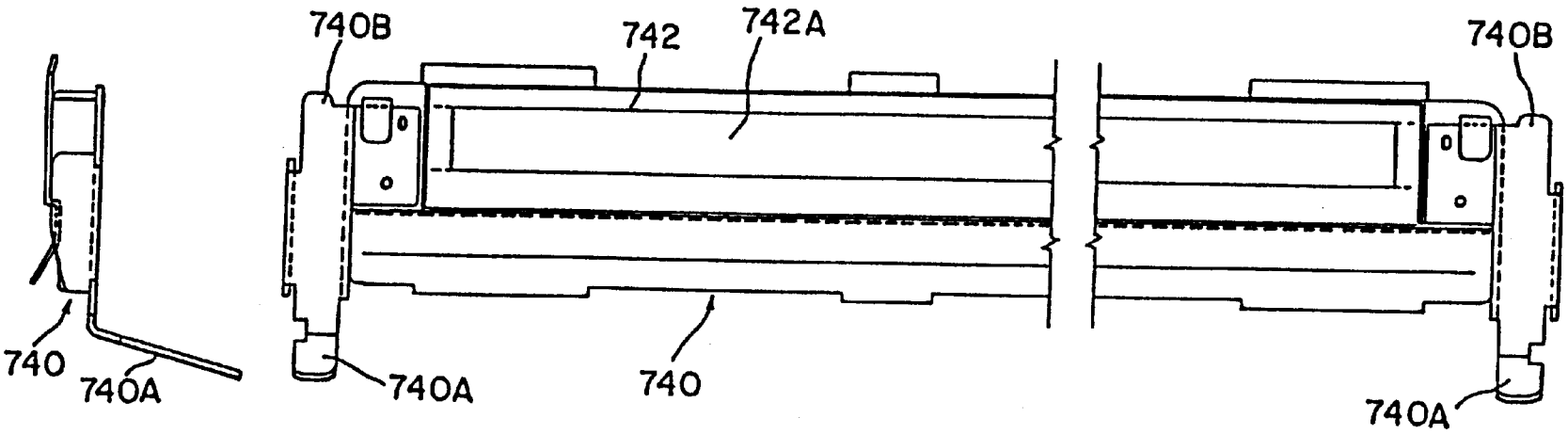
FIG. 27(A)
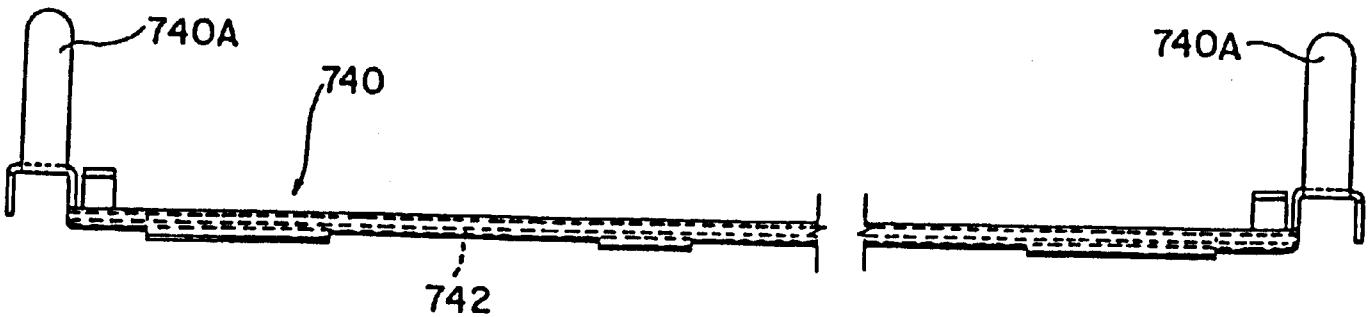
FIG. 27(B)
FIG. 27(C)

L2: MANUAL INSERTION OVERRUN AMOUNT
T3: MANUAL INSERTION START TIME
T4: STACKER DISCHARGE TIME AFTER START OF PAPER SUPPLY

FIG. 41

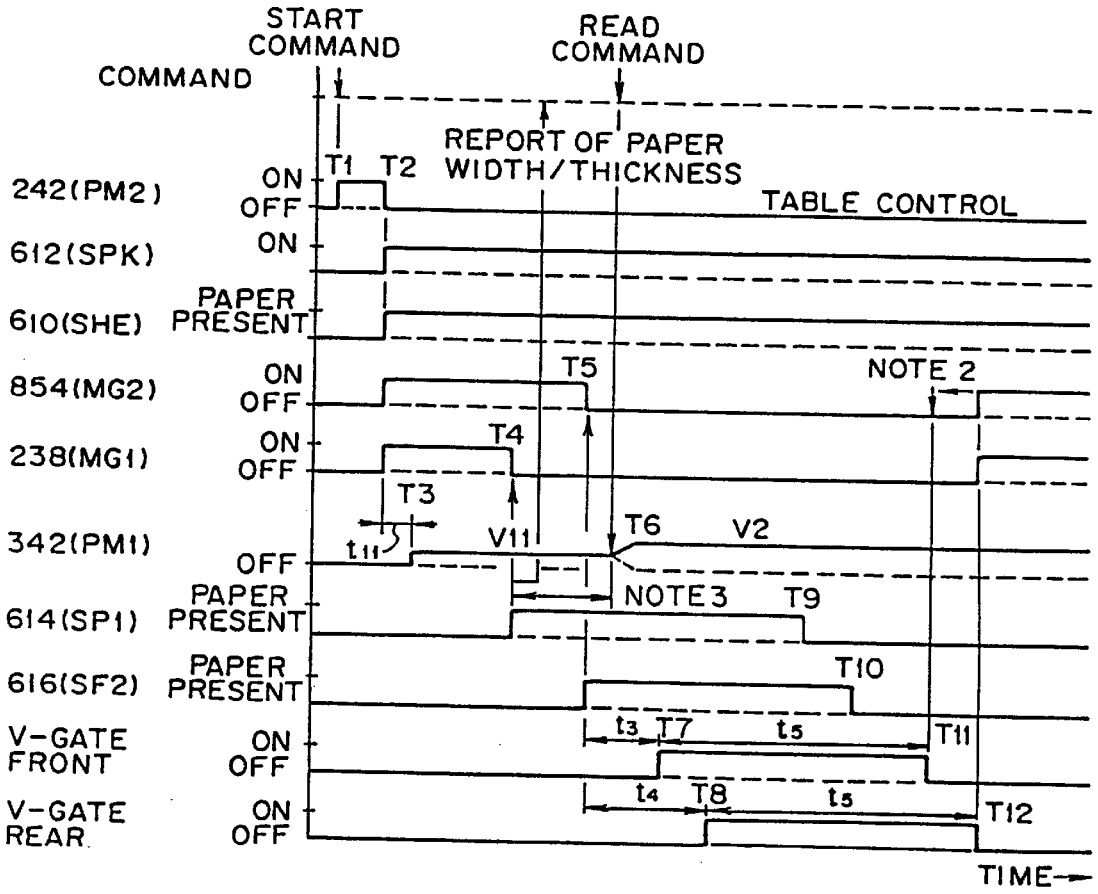

$t_3$ ----TIME REQUIRED FOR PAPER TO PASS FROM SF2 TO READING POINT R1 $t_3 = L_2 / V_2$ $t_4$ ----TIME REQUIRED FOR PAPER TRAILING END TO PASS FROM SF2 TO READING POINT R2 $t_4 = L_1 / V_2$ $t_5$ ----TIME REQUIRED TO FETCH IMAGE
$t_5$=READ LINE NUMBER×INTEGRATION TIME $V_1$ ----PAPER TRANSPORT VELOCITY OF SEPARATE ROLLER (SR)
WHEN VELOCITY FOR FIRST PAPER SHEET IS $V_{11}$, VELOCITY FOR SECOND OR FOLLOWING PAPER SHEET OF THICKNESS WITHIN SPECIFICATIONS IS SET HIGHER THAN $V_{11}$, BUT VELOCITY FOR PAPER SHEET OUTSIDE SPECIFICATIONS IS SET TO $V_{11}$ $V_2$ ----PAPER TRANSPORT VELOCITY OF FR1 TO FR5 ROLLERS

NOTE 2, NOTE 3----REFER TO FIG. 42

FIG.42

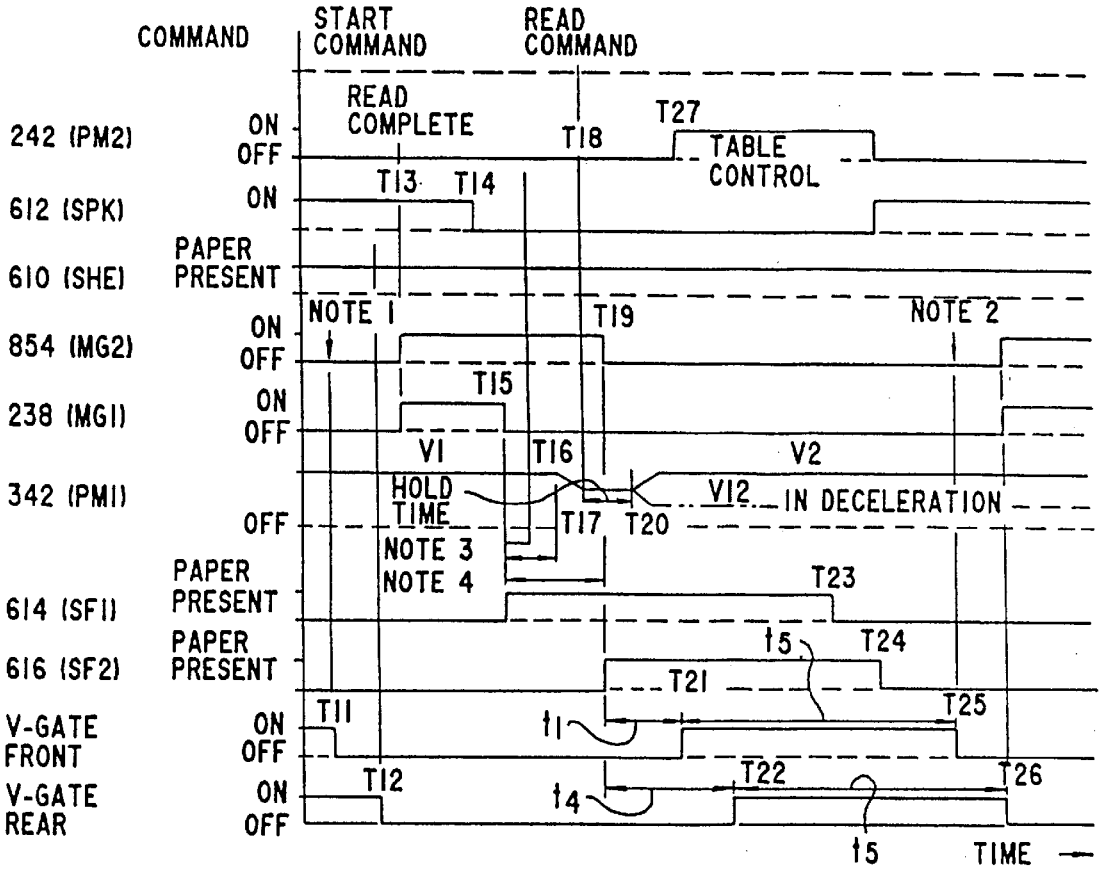

NOTE 1 : FOR ONE-FACE READING, READ COMPLETE IS RETURNED WHEN V-GATE IS TURNED OFF

NOTE 2 : FOR ONE-FACE READING, CLUTCH IS ENGAGED SIMULTANEOUSLY WITH TURNING OFF OF V-GATE

NOTE 3 : AFTER PS1 PULSES AFTER PAPER LEADING END PASSES SF1, DECELERATION IS STARTED, & DECELERATION IS CONTINUED TO V12

NOTE 4 : WHEN NO READ COMMAND IS RECEIVED WITHIN PS2 (>PS1) PULSES AFTER PAPER LEADING END PASSES SF1, TRANSPORTATION IS STOPPED TO WAIT READ COMMAND. WHEN READ COMMAND IS RECEIVED WITHIN THAT PERIOD, MOTOR IS ACCELERATED OR DECELERATED IN RESPONSE TO READING SPEED.

t8---TIME REQUIRED TO TRANSPORT PAPER FROM SF3 TO STACKER

PAPER SUPPLY APPARATUS FOR IMAGE READING APPARATUS AND IMAGE READING APPARATUS WITH PAPER SUPPLY APPARATUS AS WELL AS PAPER SUPPLY APPARATUS

This application is a continuation of U.S. patent application Ser. No. 08/407,408, filed Mar. 20, 1995, now U.S. Pat. No. 5,715,071.

BACKGROUND OF THE INVENTION

1. Field of the Invention

This invention relates to an image reading apparatus which can be suitably used as an image scanner and can be used also to read an image in an apparatus, such as a facsimile apparatus, and more particularly to a paper supply apparatus for an image reading apparatus and an image reading apparatus with a paper supply apparatus which are improved in terms of paper supply.

2. Description of the Related Art

In recent years, image reading apparatus, such as image scanners, have been and are being developed in order to input image information to a computer, or like apparatus. Image reading apparatus of the type mentioned include a paper supply apparatus of the type mentioned include a paper supply apparatus which takes out and supplies paper sheets accommodated in position, for example, in a hopper one by one to an image reading mechanism.

Such conventional image reading apparatus, however, have a problem to be solved in that the reading speed is not sufficiently high and the capacity for information (quantity of paper sheets) which can be read at a time is not sufficiently high. In order to solve the problem, not only is it important to improve the performance of an image reading mechanism, itself, which is a principal portion of an image reading apparatus, but also it is also important to develop a mechanism which can accommodate a large amount of paper sheets to be read in position and can also transport the paper sheets accommodated in position in this manner with certainty.

In particular, a large number of paper sheets accommodated in position in a hopper and making an object for reading are taken out one-by-one with certainty and supplied to a paper transport mechanism of an image reading mechanism so that an image of a paper sheet is read by the image reading mechanism while the paper sheet is being transported by the paper transport mechanism. Such paper supplying operation must be performed rapidly and with certainty.

Particularly, if a paper sheet is not taken out with certainty by the paper supply apparatus, it is a matter of course that a subsequent transportation of the paper and reading of an image from the paper cannot be performed.

SUMMARY OF THE INVENTION

It is an object of the present invention to provide a paper supply apparatus for an image reading apparatus and an image reading apparatus with a paper supply apparatus, as well as a paper supply apparatus which can be applied not only to an image reading apparatus but also to various other apparatus wherein a large amount of paper sheets can be taken out one-by-one with certainty and read rapidly at a stretch.

In order to attain the object described above, according to an aspect of the present invention, there is provided a paper supply apparatus for an image reading apparatus for successively supplying paper sheets accommodated therein to a paper transport mechanism along which an optical image reading mechanism is disposed, comprising a paper supply hopper for accommodating paper sheets therein, a paper supply roller located at a central location in a widthwise direction of and above the paper supply hopper for forwarding one of the paper sheets accommodated in the paper supply hopper, a paper supply roller driving mechanism for driving the paper supply roller to rotate, and a paper separation mechanism located on the downstream side, in the transportation sense, of a paper sheet by the paper transport mechanism with respect to the paper supply roller for preventing two or more paper sheets forwarded by the paper supply roller from being sent to the paper transport mechanism, the paper separation mechanism including a paper skew prevention mechanism for holding down a paper sheet or sheets, which pass the paper skew prevention mechanism, with a higher paper holding down force at a central location in the widthwise direction of the paper sheet or sheets but with lower paper holding down forces at the opposite end locations in the widthwise direction of the paper sheet or sheets.

With the paper supply apparatus for an image reading apparatus, since two or more paper sheets are prevented from being forwarded to the paper transport mechanism by the paper separation mechanism, transportation of paper sheets one-by-one is performed with certainty. Further, since the paper skew prevention mechanism prevents paper skew, a paper sheet can be transported with certainty in a correct posture, which facilitates appropriate smooth reading of an image on the paper sheet at a high speed.

According to another aspect of the present invention, there is provided an image reading apparatus with a paper supply apparatus, comprising a paper supply mechanism for accommodating paper sheets therein and successively supplying the paper sheets, a paper transport mechanism for transporting a paper sheet supplied thereto from the paper supply mechanisms, and an optical image reading mechanism for optically reading information on the paper sheet being transported by the paper transport mechanism, the paper supply mechanism including a paper supply hopper for accommodating paper sheets therein, a paper supply roller located above the paper supply hopper for forwarding one of the paper sheets accommodated in the paper supply hopper toward the paper transport mechanism, a paper supply roller driving mechanism for driving the paper supply roller to rotate, and a paper separation mechanism located on the downstream side, in the transportation sense, of a paper sheet by the paper transport mechanism with respect to the paper supply roller for preventing two or more paper sheets forwarded by the paper supply roller from being sent to the paper transport mechanism, the paper separation mechanism including a paper skew prevention mechanism for holding down a paper sheet or sheets, which pass the paper skew prevention mechanism, with a higher paper holding down force at a central location in the widthwise direction of the paper sheet or sheets but with lower paper holding down forces at the opposite end locations in the widthwise direction of the paper sheet or sheets.

With the image reading apparatus with a paper supply apparatus, transportation of paper sheets one-by-one is performed with certainty. Further, a paper sheet can be transported with certainty in a correct posture, which facilitates appropriate smooth reading of an image on the paper sheet at a high speed.

According to a further aspect of the present invention, there is provided a paper supply apparatus for successively supplying paper sheets accommodated therein to a paper transport mechanism, comprising a paper supply hopper for accommodating paper sheets therein, a paper supply roller located at a central location in a widthwise direction of and above the paper supply hopper for forwarding one of the paper sheets accommodated in the paper supply hopper, a paper supply roller driving mechanism for driving the paper supply roller to rotate, and a paper separation mechanism located on the downstream side, in the transportation sense, of a paper sheet by the paper transport mechanism with respect to the paper supply roller for preventing two or more paper sheets forwarded by the paper supply roller from being sent to the paper transport mechanism, the paper separation mechanism including a paper skew prevention mechanism for holding down a paper sheet or sheets, which pass the paper skew prevention mechanism, with a higher paper holding down force at a central location in the widthwise direction of the paper sheet or sheets but with lower paper holding down forces at the opposite end locations in the widthwise direction of the paper sheet or sheets.

With the paper supply apparatus, transportation of paper sheets one-by-one is performed with certainty. Further, a paper sheet can be transported with certainty in a correct posture. Besides, an increase in speed of transportation of a paper sheet can be anticipated.

According to a still further aspect of the present invention, there is provided a paper supply apparatus for successively supplying paper sheets accommodated therein to a paper transport mechanism, comprising a paper supply hopper for accommodating paper sheets therein, a paper supply roller located at a central location in a widthwise direction of and above the paper supply hopper for forwarding one of the paper sheets accommodated in the paper supply hopper, a paper supply roller driving mechanism for driving the paper supply roller to rotate, a separation roller located on the downstream side, in the transportation sense, of a paper sheet by the paper transport mechanism with respect to the paper supply roller for preventing tow or more paper sheets forwarded by the paper supply roller from being sent to the paper transport mechanism, the paper supply roller including a left paper supply roller and a right paper supply roller paired with each other, a left arm member supported on a rotary shaft for the separation roller for rocking movement to move an end portion thereof in a thicknesswise direction of a paper sheet forwarded by the paper supply mechanism and having the left paper supply roller for rotation at the end thereof, a right arm member supported on the rotary shaft for the separation roller for rocking movement to move an end portion thereof in the thicknesswise direction of the paper sheet independently of the rocking movement of the left arm member and having the right paper supply roller for rotation at the end thereof, and a resilient member interposed between the left arm member and the right arm member for exerting a resilient force to the left arm member and the right arm member in the thicknesswise direction of the paper sheet.

With the paper supply apparatus, even if paper sheets suffer from deformation, such as inclination or swelling, they can be supplied one-by-one with certainty, and each paper sheet can be transported appropriately in a correct posture while suppressing skew of the paper sheet. Consequently, a paper sheet can be transported with certainty preventing paper jamming which arises from skew of a paper sheet. Also an increase in speed of transportation of a paper sheet can be anticipated.

Further objects, features and advantages of the present invention will become apparent from the following detailed description when read in conjunction with the accompanying drawings in which like parts or elements are denoted by like reference characters.

BRIEF DESCRIPTION OF THE DRAWINGS

FIGS. 27(A), 27(B) and 27(C) are a plan view, a front elevational view and a side elevational view, respectively, showing the sheet guide system of the paper transport system of FIG. 4;

FIG. 41 is a sequence diagram illustrating operation of a transport system of the image reading apparatus of FIG. 4 and particularly showing a transport starting sequence for a first paper sheet;

FIG. 42 is a similar view but particularly showing a transport starting sequence for a second or following paper sheet;

Figure 1:
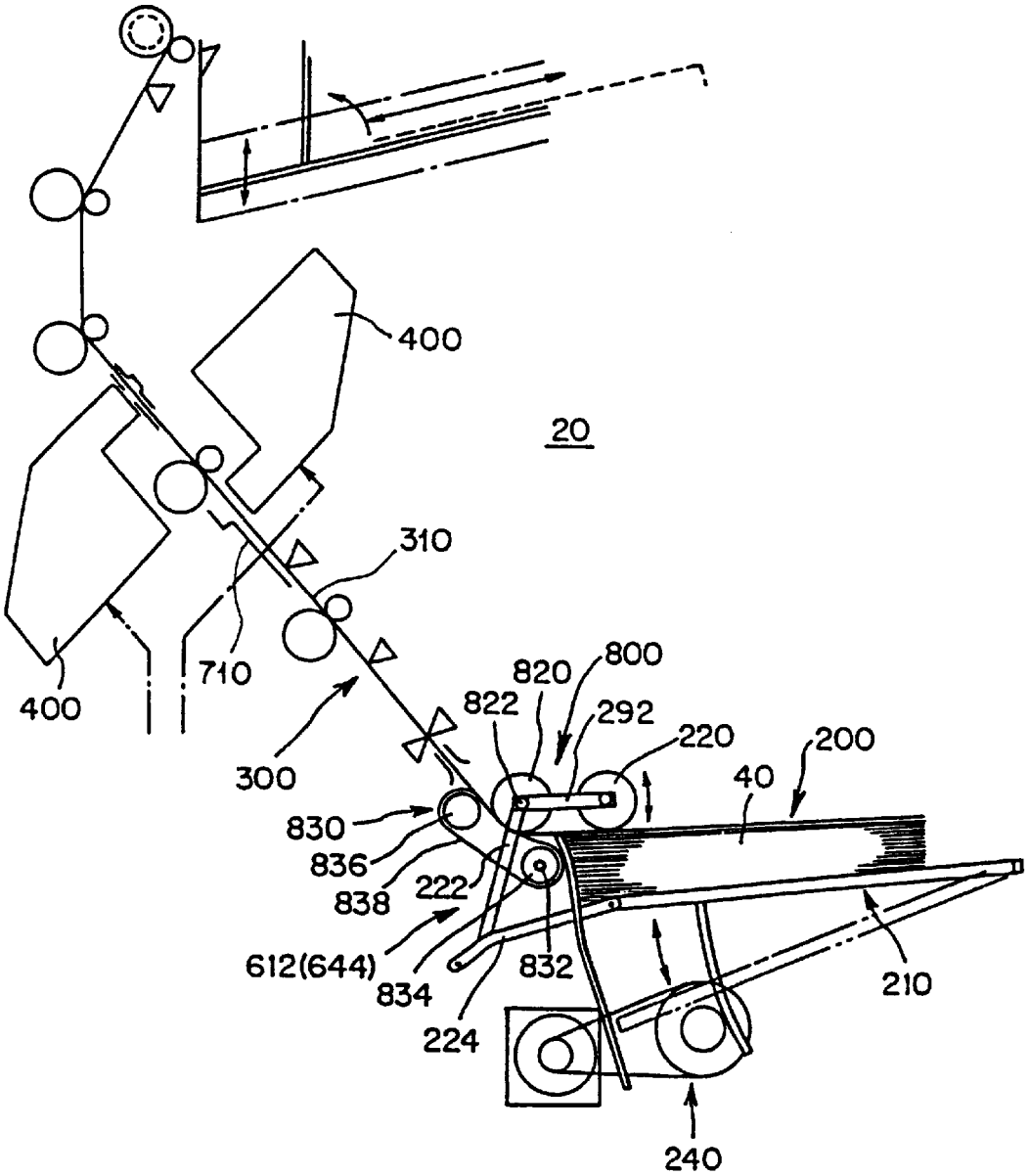
FIG. 1 is a schematic view showing, in side elevation, an arrangement of principal components of an image reading apparatus according to the present invention.

DESCRIPTION OF THE PREFERRED EMBODIMENTS a. Aspect of the Invention

Referring first to FIGS. 1 to 3(C), there are shown a paper supply apparatus for an image reading apparatus and an image reading apparatus with a paper supply apparatus according to the present invention. The paper supply apparatus (paper supply mechanism) for an image reading apparatus is generally denoted at 200, and the image reading apparatus includes a paper transport mechanism 300. The paper supply apparatus 200 successfully supplies paper sheets 40 accommodated in advance therein to the paper transport mechanism 300 along which an optical image reading mechanism 400 is disposed, and the paper transport mechanism 300 transports a paper sheet 40 supplied thereto in this manner.

Figures 3A, 3B, 3C:
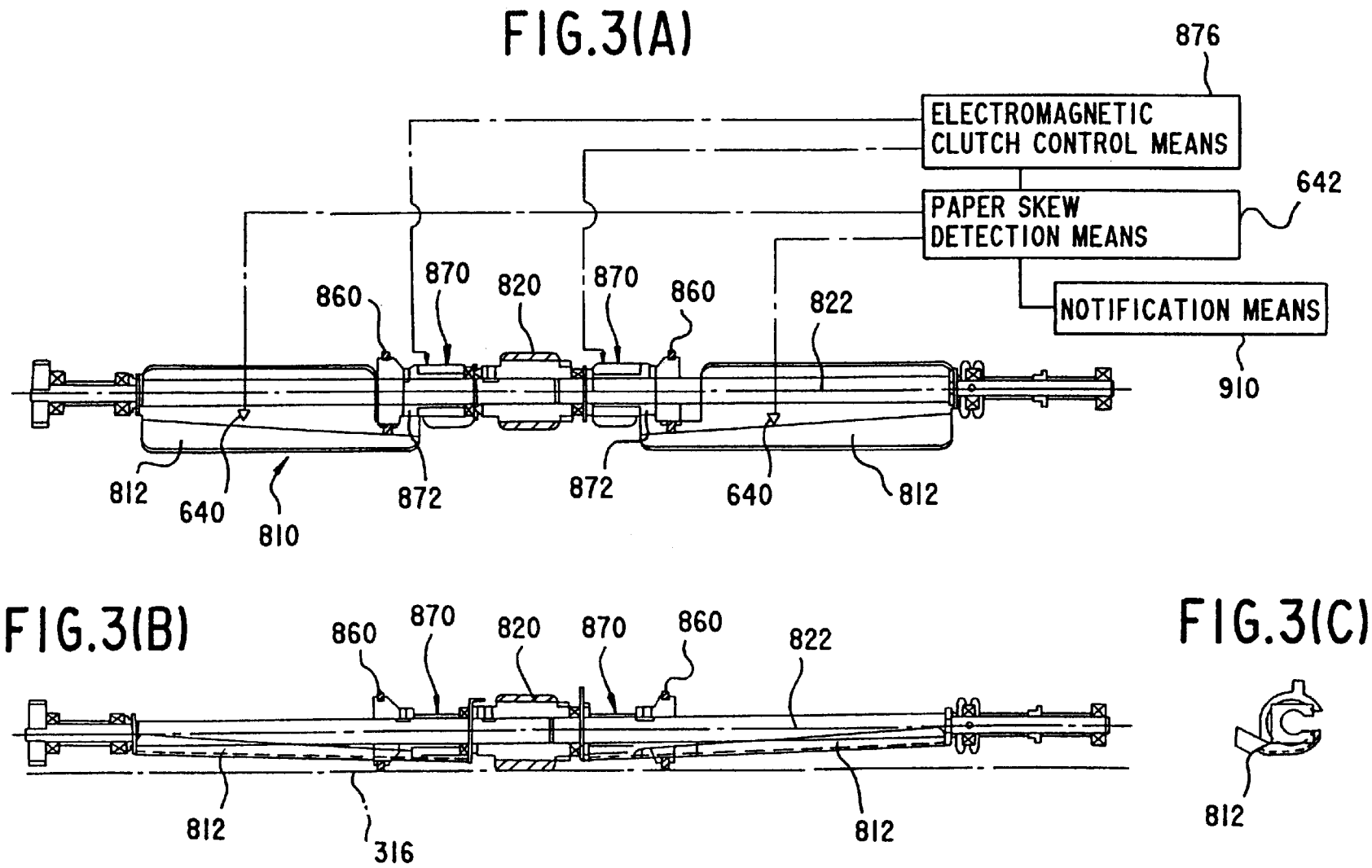
FIG. 3(A) is a diagrammatic schematic view showing, in plan, a paper separation mechanism of the image reading apparatus of FIG. 1, and FIGS. 3(B) and 3(C) are a front elevational view and a side elevational view, respectively, of the paper separation mechanism of FIG. 3(A)

The paper supply mechanism 200 includes a paper supply hopper 210 for accommodating paper sheets 40 therein, a paper supply roller 220 located at a central location in a widthwise direction of, and above, the paper supply hopper 210 for forwarding one of the paper sheets 40 accommodated in the paper supply hopper 210 toward the paper transport mechanism 300, a paper supply roller driving mechanism 230 for driving the paper supply roller 220 to rotate, and a paper separation mechanism 800 located on the downstream side in transportation of a paper sheet 40 by the paper transport mechanism 300 with respect to the paper supply roller 220 for preventing two or more paper sheets 40 forwarded by the paper supply roller 220 from being sent to the paper transport mechanism 300. Particularly, as shown in FIGS. 3(A) to 3(C), the paper separation mechanism 800 includes a paper skew prevention mechanism 810 for holding down a paper sheet or sheets 40, which pass the paper skew prevention mechanism 810, with a higher paper holding down force at a central location in the widthwise direction of the paper sheet or sheets 40 but with lower paper holding down forces at the opposite end locations in the widthwise direction of the paper sheet or sheets 40.

In the paper supply mechanism for an image reading apparatus, paper sheets 40 accommodated in advance in the paper supply hopper 210 are successively supplied toward the paper transport mechanism 300 by the paper supply mechanism 200. While a paper sheet 40 is being transported by the paper transport mechanism 300, information recorded on the paper sheet 40 is optically read by the optical image reading apparatus 400.

In this instance, in the paper supply apparatus 200, one or more of the paper sheets 40 accommodated in the paper supply hopper 210 are forwarded toward the paper transport mechanism 300 by the paper supply roller 220 located at a central location in a widthwise direction of, and above, the paper supply hopper 210. The paper supply roller 220 is driven to rotate by the paper supply roller driving mechanism 230. If two or more sheets 40 are forwarded by the paper supply roller 220, then only one of the paper sheets 40 is permitted to be sent to the paper transport mechanism 300 while the remaining paper sheet or sheets 40 are prevented from being sent to the paper transport mechanism 300 by the paper separation mechanism 800.

Further, in the paper separation mechanism 800, since a paper sheet 40 passing it is transported by being driven at a central portion of an upper face thereof in its widthwise direction by the paper supply roller 220, it is not held down at the opposite end portions thereof in the widthwise direction by the paper supply roller 220 and consequently exhibits such a geometry that the opposite end portions thereof in the widthwise direction are turned upwardly, and consequently, paper skew is likely caused by a resistance of transportation of the paper. However, the paper skew prevention mechanism 810 provided in the paper separation mechanism 800 holds down the paper sheet 40 with a higher paper holding down force at the central location in the widthwise direction of the paper sheet 40 but with lower holding down forces at the opposite end locations in the widthwise direction of the paper sheet 40 thereby to prevent skew of the paper sheet 40.

With the paper supply apparatus for an image reading apparatus, since two or more paper sheets are prevented from being forwarded to the paper transport mechanism by the paper separation mechanism, transportation of paper sheets one by one is performed with certainty. Further, since the paper skew prevention mechanism prevents paper skew, a paper sheet can be transported with certainty in a correct posture, which facilitates appropriate smooth reading of an image of the paper sheet at a high speed.

The paper supply apparatus may be constructed such that the paper separation mechanism 800 includes, as shown in FIG. 3, a separation roller 820, a rotary member 830 disposed in an opposing relationship to the separation roller 820, and a separation roller driving mechanism 850 for driving the separation roller 820 to rotate, and that the paper skew prevention mechanism 810 includes a pair of movable guide members 812 mounted on a rotary shaft 822 of the separation roller 820 on the opposite left and right sides of the separation roller 820 while each of the movable guide members 812 is shaped so as to provide, at a portion thereof adjacent the separation roller 820, a higher paper holding down force but provide, at another portion thereof remote from the separation roller 820, a lower paper holding down force. In the paper supply apparatus of the construction just described, as the separation roller 820 of the paper separation mechanism 800 is driven to rotate by the separation roller driving mechanism 850, when two or more paper sheets 40 are forwarded by the paper supply roller 220, the separation roller 820 and the rotary member 830 disposed in an opposing relationship to the separation roller 820 cooperate to permit only one of the paper sheets 40 to be sent to the paper transport mechanism 300 while preventing the other paper sheet or sheets 40 from being sent to the paper transport mechanism 300. Further, skew of a paper sheet 40 is prevented by the movable guide members 812 of the paper skew prevention mechanism 810 since each of the movable guide members 812 guides the paper sheet 40 while it applies a higher paper holding down force to a central portion of the paper sheet 40 in the widthwise direction but applies a lower paper holding down force in the corresponding end portion of the paper sheet 40 in the widthwise direction in accordance with deformation of the paper sheet 40. The paper sheet 40 may be guided by the movable guide members 812 while the movable guide members 812 suitably move following the shape of the paper sheet 40. Consequently, two or more paper sheets 40 are prevented from being sent to the paper transport mechanism with certainty by the paper separation mechanism, and consequently, they can be transported one-by-one with certainty. Further, the paper skew prevention mechanism prevents paper skew while the movable guide members thereof hold down a paper sheet in accordance with deformation of the paper sheet, and consequently, a paper sheet can be transported with certainty in a correct posture, which facilitates appropriate smooth reading of an image of the paper at a high speed.

The paper separation mechanism 800 may further include a pair of auxiliary rollers 860 located coaxially on the rotary shaft 822 of the separation roller 820 on the opposite left and right sides of the separation roller 820 as shown in FIG. 3. The auxiliary rollers 860 help separation and transportation of a paper sheet performed by the separation roller 820. This is advantageous for transportation of a paper sheet in a correct posture and/or at a high speed, which facilitates appropriate smooth reading of an image of the paper sheet at a high speed.

The auxiliary rollers 860 may be loosely fitted coaxially on the rotary shaft 822 of the separation roller 820, and the paper separation mechanism 800 may further include a driving system 870 for driving the auxiliary rollers 860 while the driving system 870 includes a one-way clutch 872 as seen in FIGS. 3(A) and 3(B). In the construction just described, since the auxiliary rollers 860 are driven by the driving system 870, separation and transportation of a paper sheet is positively helped by the auxiliary rollers 860. Further, the one-way clutch 872 allows the auxiliary rollers 860 to help separation and transportation of a paper sheet by the separation roller 820 without interfering with the separation and transportation. Since separation and transportation of a paper sheet is helped positively by the auxiliary rollers, transportation of a paper sheet in a correct posture and/or at a high speed can be promoted. Further, since the one-way clutch allows the separation and transportation to be performed by the auxiliary rollers without being obstructed by the auxiliary rollers, transportation of a paper sheet in a correct posture and/or at a high speed can be further promoted, which facilitates appropriate smooth reading of an image of the paper sheet at a high speed.

The paper supply apparatus for an image reading apparatus may further comprise, as shown in FIG. 3, a pair of paper guiding condition detection means 640 for detecting moving conditions of a paper sheet at left and right positions of the movable guide members 812, paper skew detection means 642 for detecting a paper skew condition based on a difference between the moving conditions of the paper sheet detected at the left and right positions of the movable guide members 812 by the paper guiding condition detection means 640, and notification means 910 operable in response to a result of detection of the paper skew detection means 642 for notifying, when the result of detection indicates a paper skew condition, such paper skew condition. In the paper supply apparatus of the construction, the paper guiding condition detection means 640 detect moving conditions of a paper sheet 40 at the left and right positions of the movable guide members 812 while the paper skew detection means 642 detects a paper skew condition based on a difference between the moving conditions of the paper sheet detected at the left and right positions of the movable guide members 812 by the paper guiding condition detection means 640. Then, the notification means 910 operates in response to a result of detection of the paper skew detection means 642 to notify, when the result of detection indicates a paper skew condition, such paper skew condition. Accordingly, when a paper sheet is in a skew condition, this is notified rapidly. Consequently, management of the apparatus in operation is facilitated.

The paper supply apparatus for an image reading apparatus may be constructed such that, as shown in FIG. 3, the paper separation mechanism 800 includes an auxiliary roller 860 loosely fitted coaxially on a rotary shaft 822 of the separation roller 820 and a driving system 870 including an electromagnetic clutch 874 for driving the auxiliary roller 860, and that it further comprises a pair of paper guiding condition detection means 640 for detecting moving conditions of a paper sheet at left and right positions of the movable guide members 812, paper skew detection means 642 for detecting a paper skew condition based on a difference between the moving conditions of the paper sheet detected at the left and right positions of the movable guide members 812 by the paper guiding condition detection means 640, and electromagnetic clutch control means 876 controlling the electromagnetic clutch 874 by on/off control in response to a result of detection of the paper skew detection means 642. In the paper, supply apparatus, the auxiliary roller 860 is driven by the driving system 870. In this instance, the paper guiding condition detection means 640 detect moving condition of a paper sheet 40 at the left and right positions of the movable guide members 812, and the paper skew detection means 642 detects a paper skew condition based on a difference between the moving conditions of the paper sheet detected at the left and right positions of the movable guide members 812 by the paper guiding condition detection means 640. Then, the electromagnetic clutch control means 876 controls the electromagnetic clutch 874 by on/off control in response to a result of detection of the paper skew detection means 642 to control the driving condition of the auxiliary roller 860. Consequently, occurrence of paper skew is suppressed, and transportation of a paper sheet in a correct posture and/or at a high speed can be promoted, which facilitates appropriate smooth reading of an image of the paper sheet at a high speed.

Also in this instance, the driving system 870 for the auxiliary roller 860 may further include a one-way clutch 872 provided in series to the electromagnetic clutch 874. Due to the presence of the one-way clutch 872, the auxiliary roller 860 can positively help separation and transportation of a paper sheet by the separation roller 820 without obstructing the separation and transportation. Since the one-way clutch allows the auxiliary roller to help separation and transportation of a paper sheet without obstructing the separation and transportation in this manner, transportation of a paper sheet in a correct posture and/or at high speed can be further promoted, which facilitates appropriate smooth reading of an image of the paper sheet at a high speed.

The paper supply apparatus for an image reading apparatus may be constructed such that the paper separation mechanism 800 includes an auxiliary roller 860 loosely fitted coaxially on a rotary shaft 822 of the separation roller 820 and a motor (not shown) for driving the auxiliary roller 860, and that it further comprises a pair of paper guiding condition detection means 640 for detecting moving conditions of a paper sheet at left and right positions of the movable guide members 812, paper skew detection means 642 for detecting a paper skew condition based on a difference between the moving conditions of the paper sheet detected at the right and left positions of the movable guide members 812 by the paper guiding condition detection means 640, and motor control means (not shown) for controlling the electric motor in response to a result of detection of the paper skew detection means 642 at the left and right positions. In the paper supply apparatus of the construction just described, the auxiliary roller 860 is driven by the electric motor. In this instance, the paper guiding condition detection means 640 detect moving conditions of a paper sheet at the left and right positions of the movable guide members 812, and the paper skew detection means 642 detects a paper skew condition based on a difference between the moving conditions of the paper sheet detected at the left and right positions of the movable guide members 812 by the paper guiding condition detection means 640. Then, the motor control means controls the electric motor in response to a result of detection of the paper skew detection means 642 at the left and right positions. Consequently, occurrence of paper skew is suppressed, and transportation of a paper sheet in a correct posture and/or at a high speed can be promoted, which facilitates appropriate smooth reading of an image of the paper sheet at a high speed.

The paper supply apparatus for an image reading apparatus may be constructed such that, as shown in FIG. 1, the paper supply hopper 210 is mounted for pivotal motion around a fixed point, and that it further comprises a paper supply hopper driving mechanism 240 for pivoting the paper supply hopper 210, the paper supply roller 220 being mounted for rocking motion around another fixed point so as to be moved by a paper sheet or sheets 40 in the paper supply hopper 210 when the paper supply hopper 210 is pivoted, paper supply position detection means 644 for detecting a paper supply position of the paper supply hopper 210 from a pivoted position of the paper supply hopper 210 or a rocked position of the paper supply roller 220, and paper supply roller driving mechanism control means 250 for controlling the paper supply roller driving mechanism 230 in response to a result of detection of the paper supply position detection means 644. In the paper supply apparatus of the construction just described, the paper supply hopper 210 is pivoted around the fixed point by the paper supply hopper driving mechanism 240. Meanwhile, the paper supply roller 220 can be moved to be rocked around the fixed point by a paper sheet or sheets 40 in the paper supply hopper 210 when the paper supply hopper 210 is pivoted. The paper supply position detection means 644 detects the paper supply position of the paper supply hopper 210 from the pivoted position of the paper supply hopper 210 or the pivoted or rocked position of the paper supply roller 220. Then, the paper supply roller driving mechanism control means 250 controls operation of the paper supply roller driving mechanism 230 in response to a result of detection of the paper supply position detection means 644 so that the paper supply hopper 210 assumes, for example, the paper supply position. Accordingly, the positions of the paper supply hoper and the paper supply roller can be adjusted to suitable positions, which facilitates transportation of paper sheets with certainty one by one and facilitates appropriate smooth reading of an image of the paper sheet at a high speed.

In this instance, the paper supply apparatus for an image reading apparatus may further comprise, as shown in FIG. 1, a first interlocking member 222 which operates in an interlocking relationship with the rocking motion of the paper supply roller 220, and a second interlocking member 224 which operates in an interlocking relationship with the pivotal motion of the paper supply hopper 210 while the paper supply position detecting means 644 detects the paper supply position of the paper supply hopper 210 from the motion of the first interlocking member 222 and the second interlocking member 224. In the paper supply apparatus of the construction just described, the paper supply position detection means 244 detects the paper supply position of the paper supply hopper 210 from the motion of the first interlocking member 222, which operates in an interlocking relationship with the rocking motion of the paper supply roller 220, and the second interlocking member 224, which operates in an interlocking relationship with the pivoting movement of the paper supply hopper 210. Thus, the positions of the paper supply hopper and the paper supply roller can be adjusted to suitable positions with certainty by a simple mechanism, which facilitates transportation of paper sheets with certainty one-by-one and facilitates appropriate smooth reading of an image of the paper sheet at a high speed.

Or, the paper supply apparatus for an image reading apparatus may be constructed such that the paper supply position detection means 644 detects an amount of pivotal motion from a reference position of the paper supply hopper 210 based on a driving control signal for the paper supply hopper driving mechanism 240 and detects the paper supply position of the paper supply hopper 210 from a result of detection of the amount of pivotal motion. In the paper supply apparatus of the construction just described, the paper supply position detection means 644 detects an amount of pivotal motion from the reference position of the paper supply hopper 210 based on a driving control signal for the paper supply hopper driving mechanism 240 and then detects the paper supply position of the paper supply hopper 210 from a result of detection of the amount of pivotal motion. Consequently, the positions of the paper supply hopper and the paper supply roller can be adjusted to suitable positions, which facilitates transportation of paper sheets with certainty one by one and facilitates appropriate smooth reading of an image of the paper sheet at a high speed.

The paper supply apparatus for an image reading apparatus may be constructed such that it further comprises a rotary shaft 822 having the separation roller 820 provided at a central portion thereof, the rotary shaft 822 being supported on a bearing (not shown) which is capable of being removed by a movement of the separation roller 820 in a radial direction, and a rotary shaft locking mechanism (not shown) provided at the bearing for normally preventing such movement of the rotary shaft 822. In the paper supply apparatus of the construction just described, the rotary shaft 822 having the separation roller 820 provided at a central portion thereof is fixed so that movement thereof is prevented by the rotary shaft locking mechanism provided at the bearing. Further, the bearing is capable of being removed by a movement of the separation roller 820 in a radial direction, and if locking by the rotary shaft locking mechanism is canceled, then the rotary shaft 822 can be removed readily. Consequently, removal of the separation roller is facilitated, and even if trouble, such as paper jamming, occurs, such trouble can be eliminated readily and rapidly and management of the apparatus is facilitated.

The paper supply apparatus for an image reading apparatus may further comprise a rotary member 830 disposed adjacent an apparatus body 10 with respect to the separation roller 820 in an opposing relationship to the separation roller 820, the rotary member 830 including a rotary shaft 832 supported for rotation on a bearing (not shown) which is capable of being removed by a movement thereof in a radial direction of the rotary member 830. In the paper supply apparatus of the construction just described, since the bearing for supporting for rotation thereon, the rotary shaft 832 of the rotary member 830 disposed in an opposing relationship to the separation roller 820 is capable of being removed by a movement thereof in a radial direction of the rotary member 830, removal of the rotary shaft 832 can be performed readily. Consequently, removal of the rotary member is facilitated, and even if trouble, such as paper jamming, occurs, such trouble can be eliminated readily and rapidly and management of the apparatus is facilitated.

The rotary member 830 may include a pair of pulleys 834 and 836 spaced from each other in the paper transporting direction, and an endless belt 838 extending between and around the pulleys 834 and 836. In the paper supply apparatus of the construction just described, as the pair of pulleys 834 and 836 of the rotary member 830 spaced from each other in the paper transporting direction are rotated, the endless belt 838 extending between and around the pulleys 834 and 836 is circulated and cooperates with the separation roller 820 to prevent two or more paper sheets 40 forwarded thereto by the paper supply roller 220 from being sent to the paper transport mechanism 300. Accordingly, since separation of a paper sheet is performed by the endless belt 838 extending between and around the pulleys 834 and 836 and the separation roller 820, the endless belt 838 and the separation roller 820 are contacted with each other over a great area. Consequently, separation of a paper sheet from the other paper sheets is performed with certainty and transportation of a paper sheet is performed appropriately, which facilitates appropriate smooth reading of an image of the paper sheet at a high speed.

In this instance, the pulleys 834 and 836 may be connected to each other by way of a leaf spring (not shown) which applies a tensile force to the endless belt 838, each of the pulleys 834 and 836 being supported for rotation on a bearing (not shown) which is capable of being removed by a deforming operation of the leaf spring. In the paper supply apparatus of the construction just described, the pulleys 834 and 836 can be removed from the bearings for the pulleys 834 and 836 by a deforming operation of the leaf spring for applying a tensile force to the endless belt 838. Accordingly, the leaf spring serves as both of a member for applying a tensile force to the endless belt and a removing structure for the bearings for the two pulleys in the endless belt, and consequently, the structure is simplified. Further, since removal of the bearings of the two pulleys can be performed making use of the resiliency of the leaf spring, also there is another advantage in that such removing and mounting operations can be performed readily.

Or, the rotary shaft locking mechanism may include separation roller moving away means for moving the separation roller 820 away from the position of the rotary member 830 at which the rotary member 830 is opposed to the separation roller 820 in response to an unlocking operation of the rotary shaft locking mechanism to unlock the rotary shaft 822. In the paper supply apparatus of the construction just described, the separation roller moving away means moves the separation roller 820 away from the position of the rotary member 830 at which the rotary member 830 is opposed to the separation roller 820 in response to an unlocking operation of the rotary shaft locking mechanism to unlock the rotary shaft 822. Accordingly, since the separation roller moving away means moves the separation roller away from the position of the rotary member at which the rotary member is opposed to the separation roller in response to an unlocking operation of the rotary shaft locking mechanism to unlock the rotary shaft, even if a trouble such as paper jamming occurs, such trouble can be eliminated readily and rapidly and management of the apparatus is facilitated.

Or else, the paper supply apparatus for an image reading apparatus may further comprise a shaft guide 710 located along a paper transport path 310 in an opposing relationship to the optical image reading mechanism 400 for providing a color reference to a paper sheet 40 transported along the paper transport path 310 by the paper transport mechanism 300, and sheet guide moving away means (not shown) for moving the sheet guide 710 away from the paper transport path 310 in response to an unlocking operation of the rotary shaft locking mechanism to unlock the rotary shaft 822. In the paper supply apparatus of the construction just described, the sheet guide 710 located along the paper transport path 310 in an opposing relationship to the optical image reading mechanism 400 for providing a color reference to a paper sheet 40 transported along the paper transport path 310 by the paper transport mechanism 300 is moved away from the paper transport path 310 by the sheet guiding moving away means in response to an unlocking operation of the rotary shaft 822. Accordingly, since the sheet guide moving away means moves the sheet guide away from the paper transport path in response to an unlocking operation of the rotary shaft locking mechanism to unlock the rotary shaft, even if trouble such as jamming occurs, such trouble can be eliminated readily and rapidly and management of the apparatus is facilitated.

The paper supply apparatus for an image reading apparatus may be constructed such that the paper supply roller 220 is mounted for rocking motion around the rotary shaft 822 of the separation roller 820, and that it further comprises a first interlocking member 222 which operates in an interlocking relationship with the rocking motion of the paper supply roller 220, and a second interlocking member 224 which operates in an interlocking relationship with the pivotal motion of the paper supply hopper 210, the paper supply position detection means 644 detecting the paper supply position of the paper supply hopper 210 from the motion of the first interlocking member 222 and the second interlocking member 224, the paper supply position detection means 644 serving also as means for detecting that the rotary shaft 822 is locked but incompletely by the rotary shaft locking mechanism. In the paper supply apparatus of the construction just described, the paper supply position detection means 644 detects the paper supply position of the paper supply hopper 210 and also detects that the rotary shaft 822 is locked but incompletely by the rotary shaft locking mechanism. Accordingly, management of the apparatus is facilitated.

The paper supply apparatus for an image reading apparatus may be constructed such that the paper supply roller 220 is mounted for rocking motion around the rotary shaft 822 of the separation roller 820, and that it further comprises a first interlocking member 222 which operates in an interlocking relationship with the rocking motion of the paper supply roller 220, and a second interlocking member 224 which operates in an interlocking relationship with the pivotal motion of the paper supply hopper 210, the paper supply position detection means 644 detecting the paper supply position of the paper supply hopper 210 from the motion of the first interlocking member 222 and the second interlocking member 224, the paper supply position detecting means 644 serving also as means for detecting that a sheet guide 710 provided along a paper transport path 310 in an opposing relationship to the optical image reading mechanism 400 for providing a color reference to a paper sheet 40 transported along the paper transport path 310 by the paper transport mechanism 300 is not positioned accurately. In the paper supply apparatus of the construction just described, the paper supply position detection means 644 detects the paper supply position of the paper supply hopper 210 from the motion of the first interlocking member 222 and the second interlocking member 224 and further detects that the sheet guide 710 provided along the paper transport path 310 in an opposing relationship to the optical image reading mechanism 400 for providing a color reference to a paper sheet 40 transported along the paper transport path 310 by the paper transport mechanism 300 is not positioned accurately. Since the paper supply position detection means detects not only the paper supply position but also that the time sheet guide is not positioned accurately, management of the apparatus is facilitated.

The paper supply hopper driving mechanism 240 may include a paper supply hopper excessive pivotal motion prevention mechanism for preventing the paper supply hopper 210 from being pivoted excessively. In the paper supply apparatus of the construction just described, the paper supply hopper 210 is prevented from being pivoted excessively by the paper supply hopper excessive pivotal motion prevention mechanism provided in the paper supply hopper driving mechanism 240. Since the paper supply hopper is prevented from being pivoted excessively, failure of or damage to the apparatus is prevented, by which the reliability of the apparatus can be improved.

The paper supply hopper 210 may include a tiltable paper edge guide member (not shown) for guiding side edges of paper sheets accommodated in the paper hopper 210, the tiltable paper edge guide member being mounted for sliding movement in a widthwise direction of the paper sheets in the paper supply hopper 210. In the paper supply apparatus of the construction just described, the tiltable paper edge guide member provided on the paper supply hopper 210 guides side edges of paper sheets accommodated in the paper supply hopper 210. Further, in this instance, the tiltable paper edge guide member can be slidably moved in a widthwise direction of the paper sheets in the paper supply hopper 210 in accordance with the width of the paper sheets. Consequently, the side edges of the paper sheets accommodated in the hopper are guided by the tiltable paper edge guide member so that each paper can be supplied and transported in an appropriate condition, which facilitates appropriate smooth reading of an image of the paper sheet at a high speed.

The paper supply hopper 210 may include a paper trailing edge guide member for guiding rear end edges of paper sheets 40 accommodated in the paper supply hopper 210 and have a plurality of mounting portions for mounting the paper trailing edge guide member, paper trailing edge guide member being capable of being mounted at one of the mounting portions in accordance with a magnitude of the paper sheets 40 accommodated in the paper supply hopper 210. In the paper supply apparatus of the construction just described, the paper trailing edge guide member provided on the paper supply hopper 210 guides rear end edges of paper sheets 40 accommodated in the paper supply hopper 210. Since the plurality of mounting portions for mounting the paper trailing edge guide member are provided, rear end edges of paper sheets 40 of various sizes can be guided by mounting the paper trailing edge guide member at one of the mounting portions in accordance with a magnitude of the paper sheets 40 accommodated in the paper supply hopper 210. Since the rear end edges of the paper sheets accommodated in the paper supply hopper are guided either by the paper trailing edge guide member, a paper sheet can be supplied and transported in an appropriate condition, which facilitates appropriate smooth reading of an image of the paper sheet at a high speed.

The paper supply apparatus for an image reading apparatus may further comprise a paper supply roller retraction mechanism (not shown) for moving the paper supply roller 220 upwardly when paper sheets are to be accommodated into the paper supply hopper 210. In the paper supply apparatus of the construction just described, since, when paper sheets are to be accommodated into the paper supply hopper 210, the paper supply roller 220 is moved upwardly by the paper supply roller retraction mechanism, the paper sheets can be accommodated readily, and the convenience in use of the apparatus is improved.

The paper supply apparatus for an image reading apparatus may further comprise insertion mode selection means (not shown) for selecting an automatic paper insertion mode or a manual paper insertion mode, and paper supply hopper position control means for causing the paper supply hopper driving mechanism 240 to move the paper supply hopper 210 to the paper supply position when the manual paper insertion mode is selected by the insertion mode selection means. In the paper supply apparatus of the construction just described, the automatic paper insertion mode or the manual paper insertion mode can be selected by the insertion mode selection means. If the manual paper insertion mode is selected by the insertion mode selection means, then the paper supply hopper position control means causes the paper supply hopper driving mechanism 240 to move the paper supply hopper 210 to the paper supply position. Accordingly, also in the manual insertion mode, the paper supply hopper 210 can be set to an appropriate paper supply position. Consequently, a paper sheet can be supplied and transported in an appropriate condition, and image reading of the paper sheet can be performed appropriately.

Figure 2:
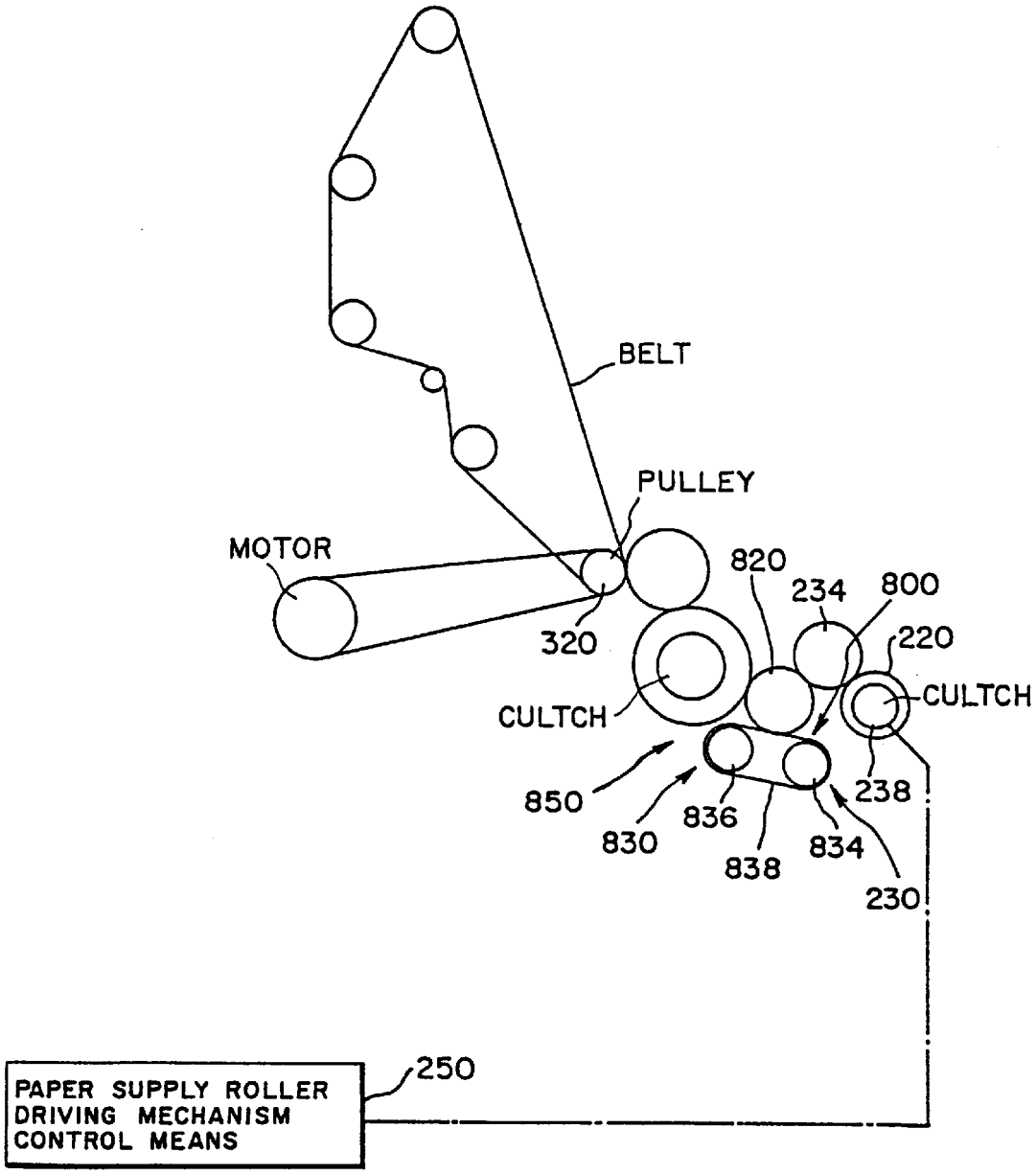
FIG. 2 is a schematic view showing, in side elevation, a driving system of the image reading apparatus of FIG. 1.

An image reading apparatus with a paper supply apparatus of the present invention will be described below. Referring to FIGS. 1 to 3, the image reading apparatus includes a paper supply mechanism 200 for accommodating paper sheets 40 therein and successively supplying the paper sheets 40, a paper transport mechanism 300 for transporting a paper sheet 40 supplied thereto from the paper supply mechanism 200, and an optical image reading mechanism 400 for optically reading information on the paper sheet 40 being transported by the paper transport mechanism 300.

The paper supply mechanism 200 includes a paper supply hopper 210 for accommodating paper sheets 40 therein, a paper supply roller 220 located above the paper supply hopper 210 for forwarding one of the paper sheets 40 accommodated in the paper supply hopper 210 toward the paper transport mechanism 300, a paper supply roller driving mechanism 230 (FIG. 8) for driving the paper supply roller 220 to rotate, and a paper separation mechanism 800 located on the downstream side in transportation of a paper sheet 40 by the paper transport mechanism 300 with respect to the paper supply roller 220 for preventing two or more paper sheets 40 forwarded by the paper supply roller 220 from being sent to the paper transport mechanism 300. The paper separation mechanism 810 includes a paper skew prevention mechanism 810 for holding down a paper sheet or sheets 40, which pass the paper skew prevention mechanism 810. with a higher paper holding down force at a central location in the widthwise direction of the paper sheet or sheets 40 but with lower paper holding down forces at the opposite end locations in the widthwise direction of the paper sheet or sheets 40.

In the image reading apparatus with a paper supply mechanism, paper sheets 40 accommodated in advance in the paper supply hopper 210 are successively supplied toward the paper transport mechanism 300 by the paper supply mechanism 200. While a paper sheet 40 is being transported by the paper transport mechanism 300, information recorded on the paper sheet 40 is optically read by the optical image reading apparatus 400.

In this instance, in the paper supply apparatus 200, one or more of the paper sheets 40 accommodated in the paper supply hopper 210 are forwarded toward the paper transport mechanism 300 by the paper supply roller 220 located at a central location in a widthwise direction of and above the paper supply hopper 210. The paper supply roller 220 is driven to rotate by the paper supply roller driving mechanism 230. If two or more sheets 40 are forwarded by the paper supply roller 220, then only one of the paper sheets 40 is permitted to be sent to the paper transport mechanism 300 while the remainder paper sheet or sheets 40 are prevented from being sent to the paper transport mechanism 300.

Further, in the paper separation mechanism 800, since a paper sheet passing it is transported by being driven at a central portion of an upper face thereof in its widthwise direction by the paper supply roller 220, it is not held down at the opposite end portions thereof in the widthwise direction by the paper supply roller 220 and consequently exhibits such a geometry that the opposite end portions thereof in the widthwise direction are turned upwardly, and consequently, paper skew is likely caused by a resistance to transportation of the paper. However, the paper skew prevention mechanism 810 provided in the paper separation mechanism 800 holds down the paper sheet 40 with a higher paper holding down force at the central location in the widthwise direction of the paper sheet 40 but with lower paper holding down forces at the opposite end locations in the widthwise direction of the paper sheet 40 thereby to prevent skew of the paper sheet 40.

With the image reading apparatus with a paper supply apparatus, transportation of paper sheets one by one is performed with certainty in a correct posture, which facilitates appropriate smooth reading of an image of the paper sheet at a high speed.

The construction of the paper supply apparatus for an image reading apparatus described above can be applied not only to an image reading apparatus but also to any other apparatus wherein sheets are fed one-by-one.

In particular, a paper supply apparatus (paper supply mechanism) 200 comprises a paper supply hopper 210 for accommodating paper sheets 40 therein, a paper supply roller 220 located at a central location in a widthwise direction of and above the paper supply hopper 210 for forwarding one of the paper sheets 40 accommodated in the paper supply hopper 210, a paper supply roller driving mechanism 230 for driving the paper supply roller 220 to rotate, and a paper separation mechanism 800 located on the downstream side in transportation of a paper sheet 40 by the paper transport mechanism 300 with respect to the paper supply roller 220 for preventing two or more paper sheets 40 forwarded by the paper supply roller 220 from being sent to the paper transport mechanism 300. The paper separation mechanism 800 includes, as shown in FIG. 3, a paper skew prevention mechanism 810 for holding down a paper sheet or sheets 40, which pass the paper skew prevention mechanism 810, with a higher paper holding down force at a central location in the widthwise direction of the paper sheet or sheets 40 but with lower paper holding down forces at the opposite end locations in the widthwise direction of the paper sheet or sheets 40. The construction described can be applied widely to various apparatus wherein paper sheets are fed one by one.

In the paper supply apparatus described just above, paper sheets 40 accommodated in the paper supply hopper 210 are successively supplied toward the paper transport mechanism 300 by the paper supply mechanism 200.

In this instance, in the paper supply apparatus 200, one or more of the paper sheets 40 accommodated in the paper supply hopper 210 are forwarded toward the paper transport mechanism 300 by the paper supply roller 220 located at a central location in a widthwise direction of and above the paper hopper 210. The paper supply hopper 220 is driven to rotate by the paper supply roller driving mechanism 230. If two or more sheets 40 are forwarded by the paper supply roller 220, the only one of the paper sheets 40 is permitted to be sent to the paper transport mechanism 300 while the remaining paper sheet or sheets 40 are prevented from being sent to the paper transport mechanism 300.

Further, in the paper separation mechanism 800, since a paper sheet 40 passing it is transported by being driven at a central portion of an upper face thereof in its widthwise direction by the paper supply roller 220, it is not held down at the opposite end portions thereof in the widthwise direction by the paper supply roller 220 and consequently exhibits such a geometry that the opposite end portions thereof in the widthwise direction are turned upwardly, and consequently, paper skew is likely caused by a resistance to transportation of the paper. However, the paper skew prevention mechanism 810 is provided in the paper separation mechanism 800 holds down the paper sheet 40 with a higher paper holding down force at the central location in the widthwise direction of the paper sheet 40 but with lower paper holding down forces at the opposite end locations in the widthwise direction of the paper sheet 40 thereby to prevent skew of the paper sheet 40.

With the paper supply apparatus described above, transportation of paper sheets one-by-one is performed with certainty and a paper sheet can be transported with certainty in a correct posture. Also an increase in speed of transportation can be anticipated.

Figure 80:
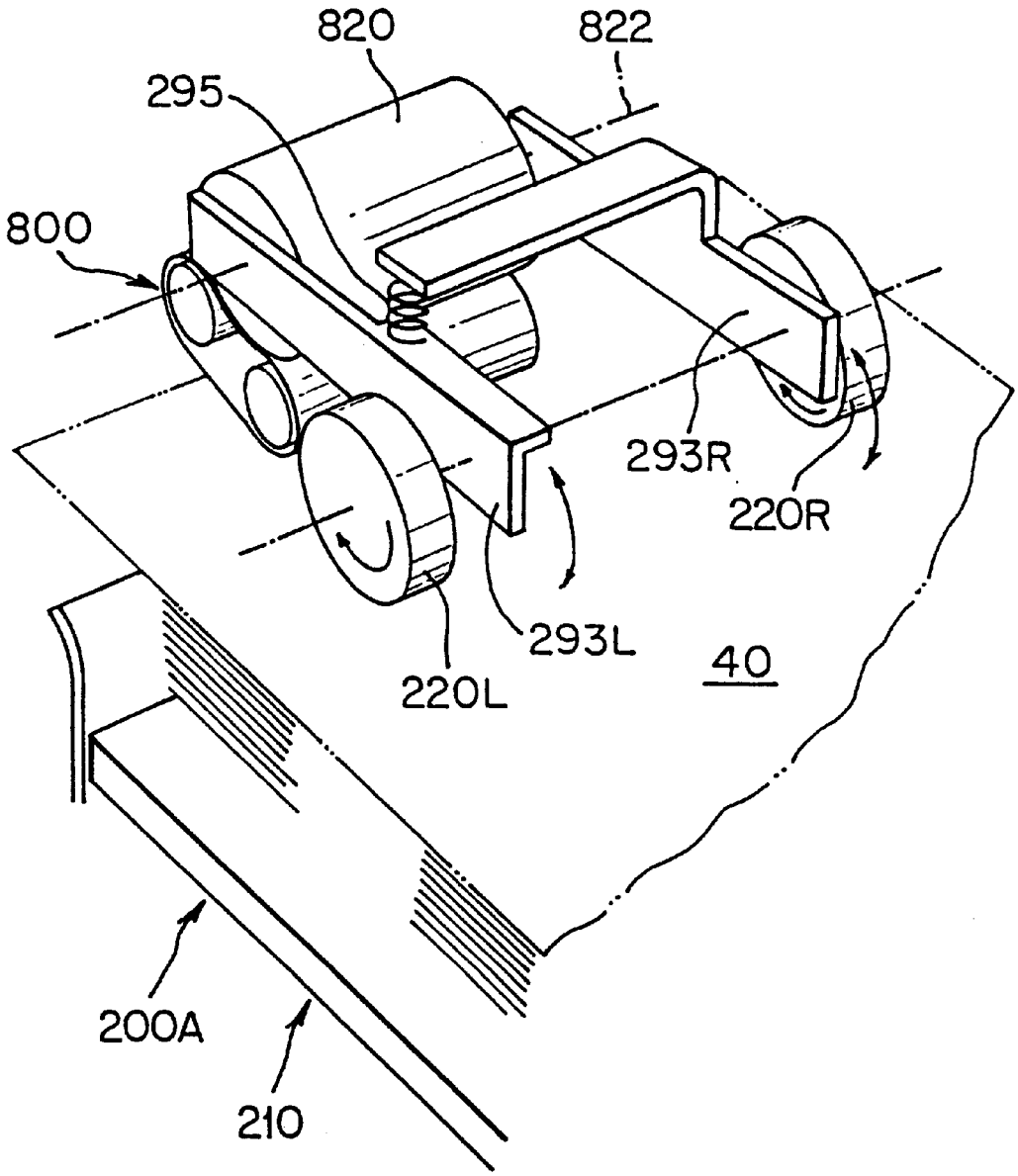
FIG. 80 is a perspective view schematically showing part of a paper supply apparatus according to another aspect of the present invention.

FIG. 80 shows, in perspective view, a construction of essential part of another paper supply apparatus according to the present invention.

Referring to FIG. 80, the paper supply apparatus (paper supply mechanism) 200A comprises a paper supply hopper 210 for accommodating paper sheets 40 therein, a paper supply roller 220 located at a central location in a widthwise direction of and above the paper supply hopper 210 for forwarding one of the paper sheets 40 accommodated in the paper supply hopper 210, a paper supply roller driving mechanism 230 for driving the paper supply roller 220 to rotate, and a separation roller 820 located on the downstream side in transportation of a paper sheet 40 by the paper transport mechanism 300 with respect to the paper supply roller 220 for preventing two or more paper sheets 40 forwarded by the paper supply roller 220 from being sent to the paper transport mechanism 300.

The paper supply roller 220 includes a left paper supply roller 220L and a right paper supply roller 220R paired with each other. Further, in order to support the left paper supply roller 220L and the right paper supply roller 220R for rotation, a left arm member 293L and a right arm member 293R are provided. The arm members 293L and 293R are each supported on a rotary shaft 822 for the separation roller 820 for rocking movement to move an end portion thereof in the thicknesswise direction of the paper sheet 40 such that they can be rocked independently of each other.

A resilient member 295 is interposed between the left arm member 293L and the right arm member 293R for exerting a resilient force to the relative motion of the end portions of the left arm member 293L and the right arm member 293R in the thicknesswise direction of the paper sheet 40.

In the paper supply apparatus described above, paper sheets 40 accommodated in the paper supply hopper 210 are successively supplied toward the paper transport mechanism 300 by the paper supply mechanism 200A.

In this instance, in the paper supply apparatus 200A, one or more of the paper sheets 40 accommodated in the paper supply hopper 210 are forwarded toward the paper transport mechanism 300 by the paper supply roller 220 located at a central location in a widthwise direction of and above the paper supply hopper 210. The paper supply roller 220 is driven to rotate by the paper supply roller driving mechanism 230. If two or more sheets 40 are forwarded by the paper supply roller 220, then only one of the paper sheets 40 is permitted to be sent to the paper transport mechanism 300 while the remaining paper sheet or sheets 40 are prevented from being sent to the paper transport mechanism 300.

Meanwhile, since the paper supply roller 220 includes the left paper supply roller 220L and the right paper supply roller 220R paired with each other and besides the paper supply rollers 220L and 220R are provided at the rocking end portions of the left arm member 293L and the right arm member 293R, respectively, which are supported for rocking movement in the thicknesswise direction of the paper sheet 40 independently of each other, the paper supply rollers 220L and 220R can move in the thicknesswise direction of the paper sheet independently of each other.

However, since the resilient member 295 is interposed between the left arm member 293L and the right arm member 293R for exerting a resilient force to the relative motion of the end portions of the arm members 293L and 293R in the thicknesswise direction of the paper sheet, rocking movements of the end portions of the arm members 293L and 293R are resiliently controlled by way of the resilient member 295.

Accordingly, the paper supply rollers 220L and 220R can move in the thicknesswise direction of the paper sheet independently of each other. Consequently, even if the positions of end portions of the paper sheet at which the paper supply rollers 220L and 220R are contacted with the paper sheet are different from each other due to deformation of the paper sheet such as, for example, inclination or swelling, the paper supply rollers 220L and 220R drive the paper sheet following the deformed geometries at the end portions of the paper sheet. When the paper rollers 220L and 220R are displaced in different conditions from each other in the thicknesswise direction of the paper sheet in this manner, the resilient member 295 resiliently controls the relative movement of them with an increasing controlling force as the relative movement increases. Consequently, the forces (paper driving forces) of the end portions of the paper supply rollers 220L and 220R acting upon the paper sheet are made uniform, and as a result, paper skew when the paper sheet is forwarded is suppressed.

With the paper supply apparatus described above, even if the paper sheets suffer from deformation, such as inclination or swelling, they can be transported one-by-one with certainty. Consequently, a paper sheet can be transported appropriately in a correct posture while suppressing paper skew, and paper jamming which arises from paper skew can be prevented, resulting in assurance of reliable transportation. Also an increase in speed of transportation can be anticipated.

The paper supply apparatus may further comprise a relative position controlling mechanism interposed between the left arm member 293L and the right arm member 293R for controlling the relative motion of the end portions of the left arm member 293L and the right arm member 293R in the thicknesswise direction of the paper sheet 40. In the paper supply apparatus of the construction just described, since the relative movements of the end portions of the left arm member 293L and the right arm member 293R in the thickness wise direction of the paper sheet are controlled by the relative position controlling mechanism, the positions of the paper supply rollers 220L and 220R in the thicknesswise direction of the paper sheet can be made uniform. Consequently, the paper driving forces of the paper supply rollers 220L and 220R are made uniform, and accordingly, when a paper sheet is forwarded, paper skew is suppressed. Naturally, since, within a range within which the control by the relative position controlling mechanism is ineffective, the paper supply rollers 220L and 220 R can be moved in different conditions in the thicknesswise direction of the paper sheet and besides the relative movements of them are resiliently controlled by the resilient member 295, the paper driving forces of the paper supply rollers 220L and 220 R are made uniform, and paper skew is suppressed when a paper sheet is forwarded. Accordingly, the positions of the paper supply rollers in the thicknesswise direction of the paper sheet can be balanced on the left and the right, and paper skew can be suppressed with a higher degree of certainty. Consequently, a paper sheet can be transported in a correct posture, and paper jamming which arises from paper skew can be prevented effectively, resulting in reliable transportation of a paper sheet. Also an increase in speed o transportation can be anticipated.

The relative position controlling mechanism may include an adjustment screw provided on one of the arm members 293L and 293R in such a manner as to allow adjustment of the position thereof in the thicknesswise direction of the paper sheet, and mans defining a contacting face provided on the other of the arm members 293L and 293R for contacting with a contact end of the adjustment screw. In this instance, the resilient member 295 is set so as to exert a resilient force to contact the adjustment screw and the contacting face with each other. In the paper supply apparatus of the construction just described, the relative movement of the end portions of the arm members 293L and 293R in the thicknesswise direction of the paper sheet by the relative position controlling mechanism 297 is controlled by contact between a contacting end of the adjustment screw provided on one of the arm members 293L and 293R and the contacting face provided on the other of the arm members 293L and 293R. In particular, since the resilient member 295 exerts a resilient force to contact the adjustment screw and the contacting face with each other, the contacting end of the adjustment screw and the contacting face are contacted with each other under the biasing force of the resilient member 295. The adjustment screw and the contacting face cannot approach each other any more from the contacting positions, and consequently, the relative positions of the end portions of the arm members 293L and 293R in the thicknesswise direction of the paper sheet are controlled. Consequently, the paper driving forces of the paper supply rollers 220L and 220R are made uniform, and paper skew is suppressed when a paper sheet is forwarded. Further, since the position of the adjustment screw can be adjusted in the thicknesswise direction of the paper sheet, the controlling condition of the relative positions can be adjusted suitably. For example, is an error is produced between the positions of the paper supply rollers 220L and 220R provided at the rocking ends of the arm members 293L and 293R in the thicknesswise direction of the paper sheet, the error can be corrected by adjusting the position of the adjustment screw so that a paper sheet can be forwarded by uniform forces so as to suppress paper skew when the paper sheet is forwarded. Accordingly, the positions of the left and right paper supply rollers in the thicknesswise direction of the paper sheet can be balanced positively by way of artificial adjustment, and paper skew can be suppressed with a higher degree of certainty. Consequently, a paper sheet can be transported appropriately in a correct posture, and paper jamming which arises from paper skew can be prevented effectively, resulting in reliable transportation of a paper sheet. Also an increase in speed of transportation can be anticipated.

The paper supply apparatus of the construction described above may be employed in an image reading apparatus. In the image reading apparatus, due to suppression of paper skew, a paper sheet is transported in a correct posture, which assures that a high degree of accuracy in the reading of an image of the paper sheet by the image reading apparatus is improved remarkably. Consequently, the image can be read appropriately. Further, since the speed of transportation can be raised readily, image reading can be performed at a higher speed.

The paper supply apparatus may be employed in a printer apparatus. In the image printer apparatus, due to suppression of paper skew, a paper sheet is transported in a correct posture, which assures appropriate printing, and so forth, by the printer apparatus. Consequently, an image can be printed at a predetermined position of the paper sheet with certainty by the printer apparatus. Further, since the speed of transportation can be raised readily, printing can be performed at a higher speed.

b. Embodiment of the Invention

An image reading apparatus according to a preferred embodiment of the present invention will be described in detail below with reference to the accompanying drawings.

1. General Construction of the Image Reading Apparatus

Referring first to FIGS. 4 to 7, there is shown an image reading apparatus according to a preferred embodiment of the present invention. The general structure of the image reading apparatus shown can be divided into an apparatus body 10 and an apparatus lid unit 20. The apparatus lid unit 20 is mounted for pivotal motion around a fulcrum 32 to open or close the apparatus body 10. When the image reading apparatus is used, the apparatus lid unit 20 is fixed to such a closing condition, as indicated by solid lines in FIGS. 4 to 6 by a body-lid unit locking mechanism 30. Various other components of the image reading apparatus are mounted on the apparatus body 10 and the apparatus lid unit 20.

Figure 4:
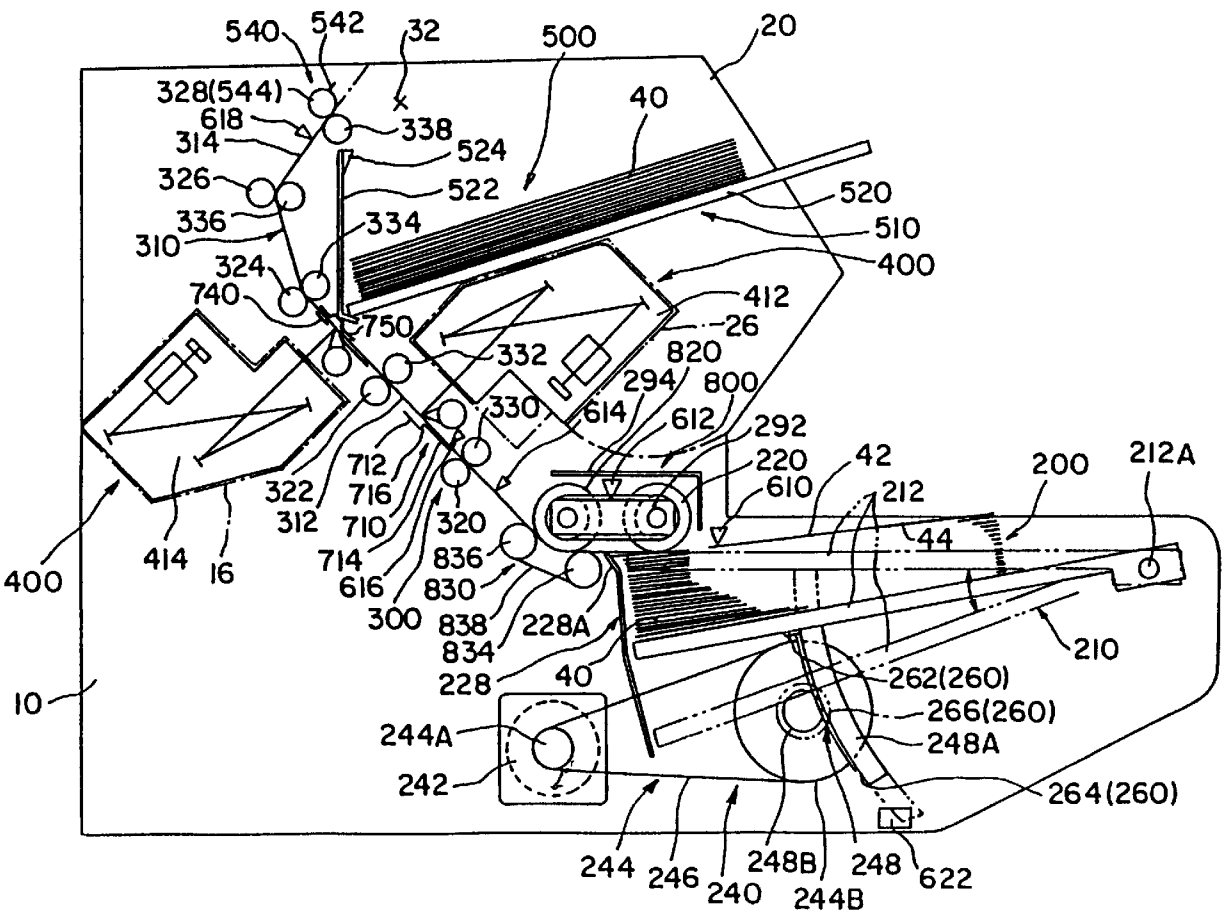
FIG. 4 is a schematic side elevational sectional view of an image reading apparatus showing a preferred embodiment of the present invention.
Figure 7:
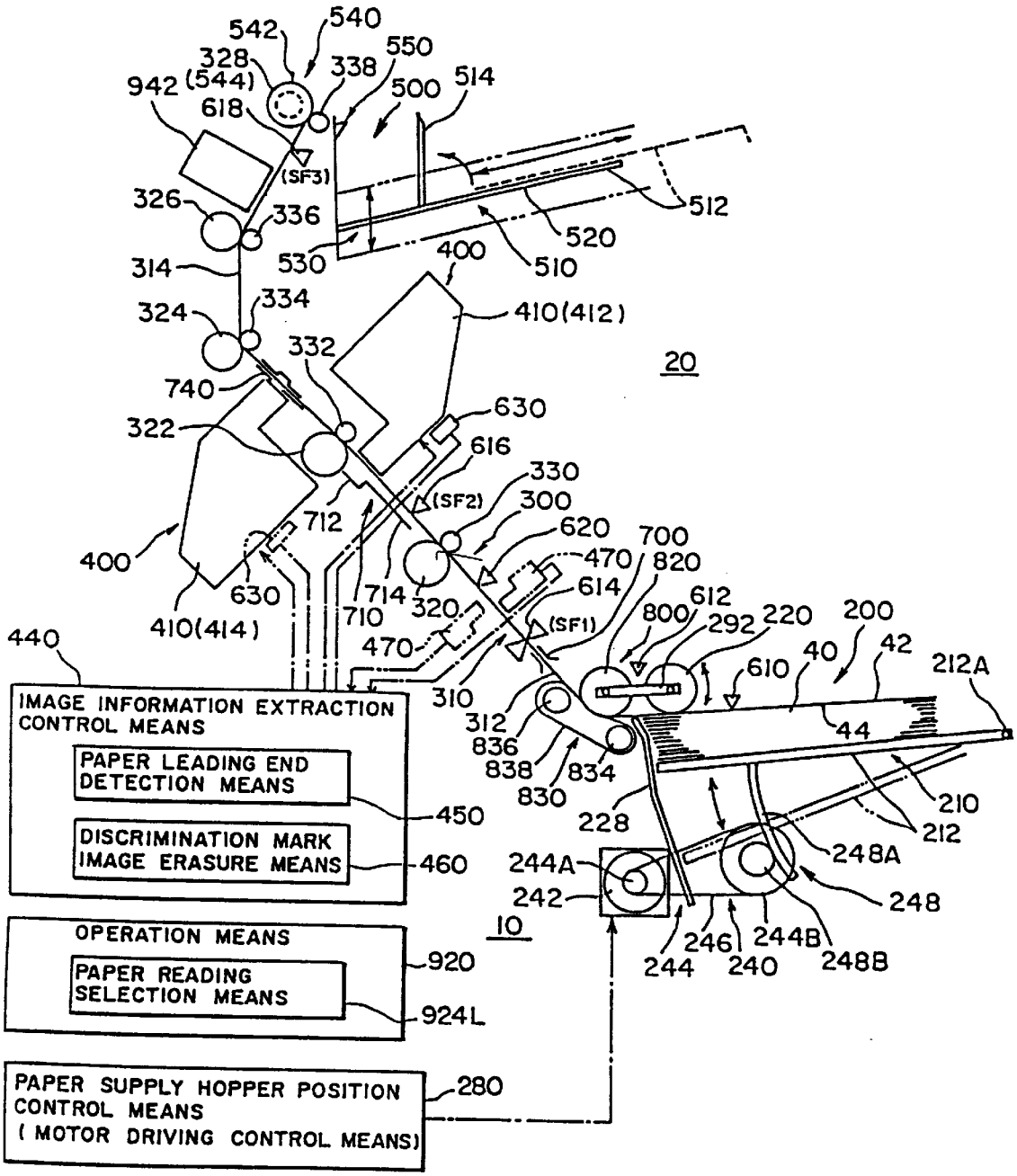
FIG. 7 is a diagrammatic view schematically showing, in side elevation, an arrangement of principal components of the image reading apparatus of FIG. 4.

Referring to FIGS. 4 and 7, the image reading apparatus includes, as components thereof, a paper supply mechanism 200 which can successively supply paper sheets 40 accommodated therein, a paper transport mechanism 300 for transporting a paper sheet 40 supplied from the paper supply mechanism 200, an optical image reading mechanism 400 for optically reading information on a paper sheet 40 being transported by the paper transport mechanism 300, and a paper stacking mechanism 500 for receiving a paper sheet 40 discharged from the paper transport mechanism 300 to stack such paper sheets 40.

The paper supply mechanism 200 includes a paper supply hopper 210, which can accommodate therein paper sheets 40 to be read; a paper supply roller 220 located about the paper supply hopper 210 for supplying one of paper sheets 40 accommodated in the paper supply hopper 210 toward the paper transport mechanism 300, which will be hereinafter described; a paper supply roller driving mechanism 230 for driving the paper supply roller 220 to rotate; a paper supply hopper driving mechanism 240 for driving the paper supply hopper 210 to an inclined position in response to the amount of paper sheets 40 accommodated in the paper supply hopper 210; and a paper separation mechanism 800 located on the downstream side of the paper supply hopper 210 in the paper transporting direction for preventing two or more paper sheets supplied by the paper supply roller 220 from being fed to the paper transport mechanism 300.

Figure 5:
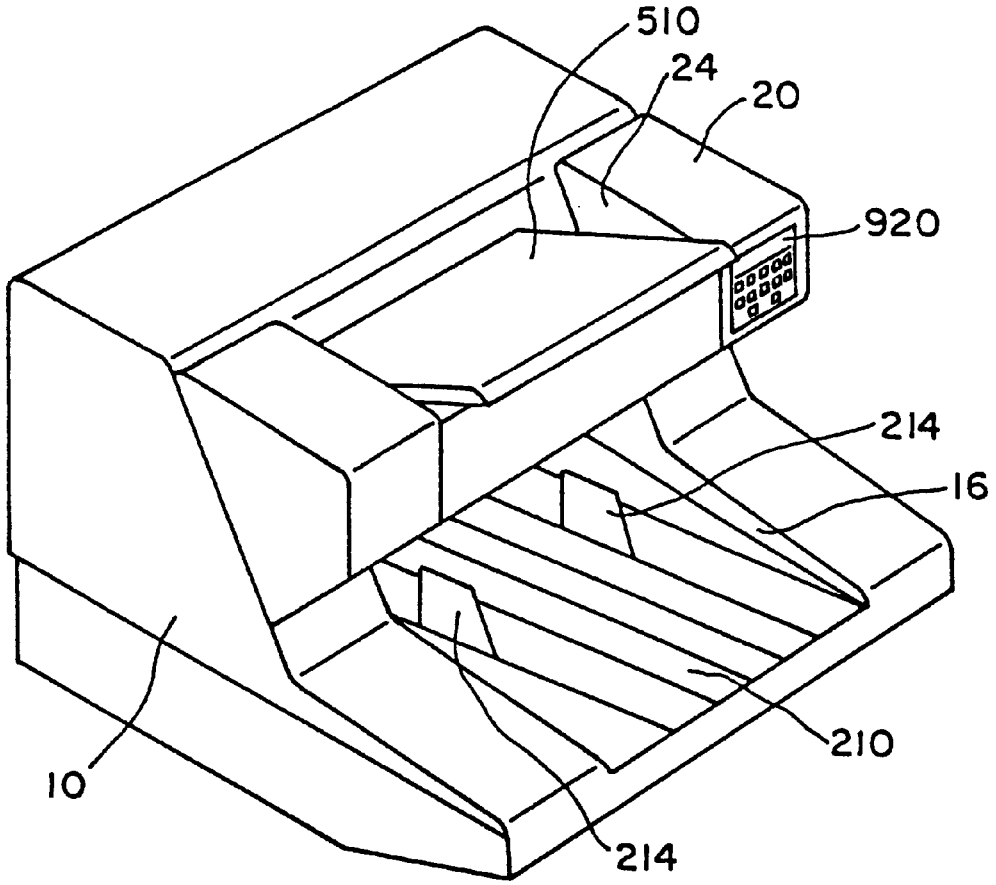
FIG. 5 is a perspective view showing an outer profile of the image reading apparatus of FIG. 4.
Figure 6:
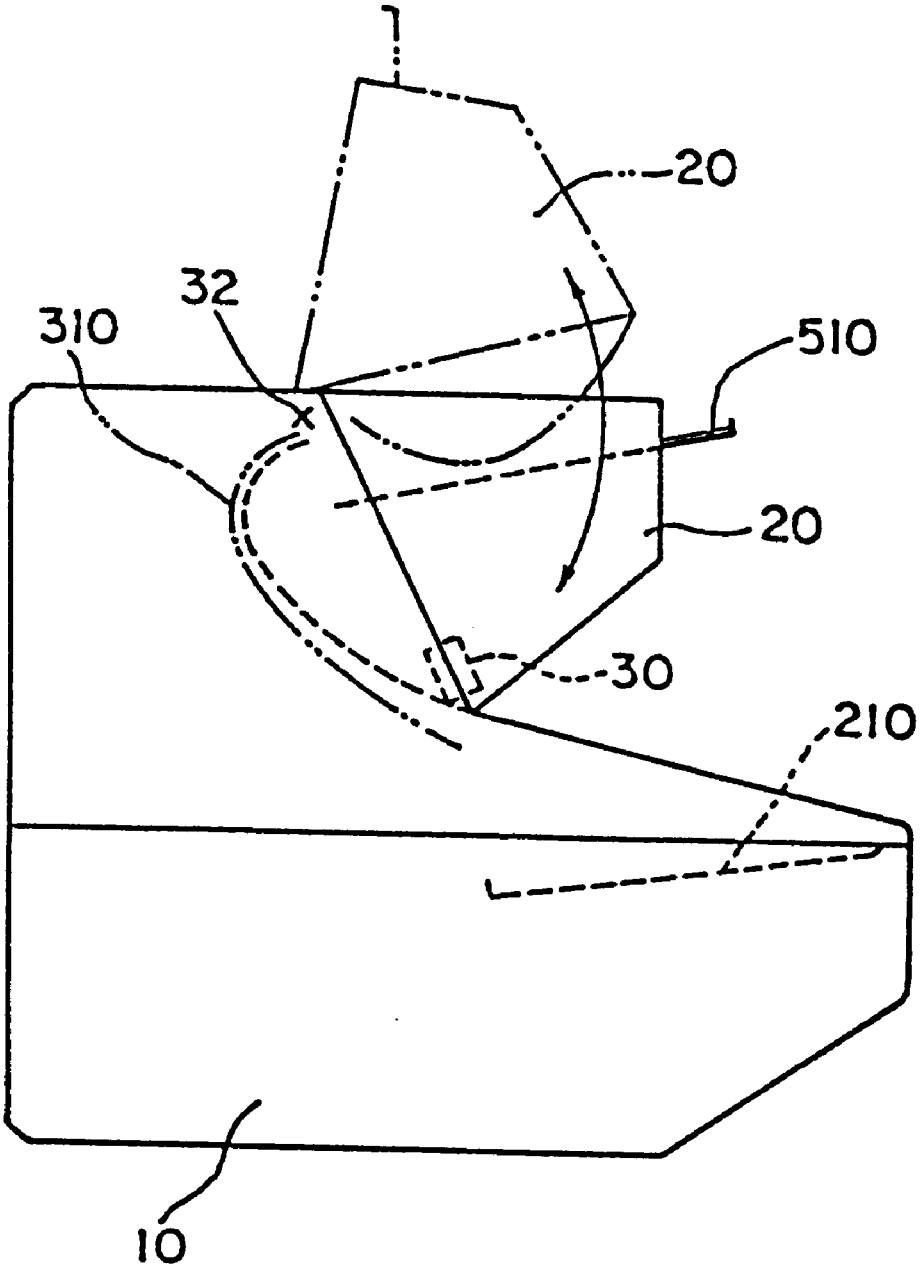
FIG. 6 is a schematic side elevational view showing an outer profile of the image reading apparatus of FIG. 4.

The paper supply hopper 210 includes a hopper table 212 supported for pivotal motion on a rotatable shaft 212A located at a rear end portion (right end portion in FIGS. 4 and 7) of the image reading apparatus. The hopper table 212 is driven at an end portion (left end portion in FIGS. 4 and 7) thereof by a rack-and-pinion mechanism 248 of the paper supply hopper driving mechanism 240 so that it is pivoted upwardly and downwardly adjusted to a predetermined inclined position. The hopper table 212 includes, as shown in FIG. 5, a pair of tiltable paper edge guide members 214 for guiding the opposite side edges of the paper sheets 40 accommodated in the paper supply hopper 210.

The paper supply hopper driving mechanism 240 includes, as a driving source, a hopper motor 242 constituted from a stepper motor. The driving force of the hopper motor 242 is transmitted to the rack-and-pinion mechanism 248 by way of belt-and-pulley mechanism 244.

Meanwhile, the paper supply roller 220 is supported for rocking motion around an axis of a separation roller 820, which will be hereinafter described, by way of a rockable arm 292 such that it can be retracted upwardly from a space above the paper supply hopper 210. Particularly, here, a rocking arm position control member (not shown), which can contact with the rockable arm 292 so as to define an uppermost position of the paper supply roller 220, is provided. The rocking arm position control member is projected, for example, when the paper supply hopper 210 is moved down to its lowermost or bottom position, to restrict the rockable arm 292, but when the image reading apparatus is started, the rocking arm position control member is retracted to cancel the restriction of the rockable arm 292.

Thus, a paper supply roller retraction mechanism 270 is constituted from the rocking structure for the rockable arm 292 and the rocking arm position control member described above.

When it is tried to accommodate paper sheets 40 into the paper supply hopper 210, the paper supply roller 220 is automatically retracted upwardly from the space above the paper supply hopper 210 by the paper supply roller retraction mechanism to facilitate such accommodation of paper sheets.

On the other hand, when the image reading apparatus is operative, unless the paper supply roller 220 is artificially retracted upwardly, the paper supply roller 220 is normally at a position suitably moved down by the weight of the paper supply roller 220 itself or by means of a spring not shown. Then, when the paper supply hopper 210 is pivoted, the paper supply roller 220 is moved upwardly by a required amount in response to the position of the upper face of the paper sheets 40 accommodated in the hopper table 212 which is moved upwardly or downwardly by pivotal motion of the paper supply hopper 210.

Referring now to FIGS. 4 and 7 to 9, the paper supply roller driving mechanism 230 for driving the paper supply roller 220 to rotate includes, as a driving source, a transport motor 342 constituted from a stepper motor. The paper supply driving mechanism 230 further includes a first belt-and-pulley mechanism 344 and first to third gear mechanisms 852, 856 and 232 interposed between the transport motor 342 and the paper supply roller 220. A pick clutch 238 constituted from an electromagnetic clutch is provided at an inputting portion of the driving force to the paper supply roller 220 from the third gear mechanism 232.

The paper supply roller driving mechanism 230 is controlled by paper supply roller driving mechanism control means 250 in response to the paper supplying position (hopper paper supplying position) of the paper supply hopper 210. More particularly, the paper supply roller driving mechanism control means 250 controls the pick clutch 238 between on and off states to control operation of the paper supply roller driving mechanism 230, that is, the rotation condition of the paper supply roller 220.

The paper separation mechanism 800 includes a separation roller 820, a rotation member 830 disposed in an opposing relationship to the separation roller 820, and a separation roller driving mechanism 850 for driving the separation roller 820 to rotate.

The rotation member 830 is located below the separation roller 820 and includes a pair of pulleys 834 and 836 disposed in a spaced relationship from each other in the paper transporting direction and an endless belt 838 wound between and around the pulleys 834 and 836.

The separation roller driving mechanism 850 is constituted from components substantially common to those of the paper supply roller driving mechanism 230 described hereinabove. In particular, as shown in FIGS. 4 and 7 to 9, the separation roller driving mechanism 850 includes the transport motor 342 described hereinabove as a driving source and further includes the first belt-and-pulley mechanism 344 and the first and second gear mechanisms 852 and 856 interposed between the transport motor 342 and the paper supply roller 220. A separation clutch 854 constituted from an electromagnetic clutch is interposed in the first gear mechanism 852. In short, the paper supply roller driving mechanism 230 has a construction wherein the third gear mechanism 232 is provided in addition to the separation roller driving mechanism 850. It is to be noted that the operation of the separation clutch 854 is controlled by separation clutch control means 858.

Meanwhile, the paper transport mechanism 300 includes a paper transport path 310 for transporting a paper sheet 40 supplied thereto from the paper supply mechanism 200, a plurality of paper transporting rollers 320 to 328 disposed along the paper transport path 310, a roller driving mechanism 340 for driving the paper transporting rollers 320 to 328, and roller driving mechanism control means 350 for controlling the roller driving mechanism 340. Idler rollers 330 to 338 are provided corresponding to the paper transporting rollers 320 to 328, respectively.

The paper transport path 310 includes an inclined transport path 312 for transporting a paper sheet 40 supplied thereto from the paper supply mechanism 200 in an inclined condition, and a paper reversing transport path 314 provided contiguously to the inclined transport path 312 for reversing the paper sheet 40 transported by the inclined transport path 312.

Due to the construction of the paper transport path 310, the posture of one of the paper sheets 40 supplied from the paper supply hopper 210 is changed first from a substantially horizontal posture in the paper supply hopper 210 to a rearwardly inclined posture in the inclined transport path 312 and is then reversed by the paper reversing transport path 314, and then, in this posture, the paper sheet 40 is discharged to the paper stacking mechanism 500.

Consequently, a paper sheet which is directed upwardly in the paper supply hopper 210 is directed downwardly in the paper stacking mechanism 500, and the paper sheets 40 accommodated one on another in the paper supply hopper 210 are successively stacked into the paper stacking mechanism 500 without changing the order of them.

Meanwhile, the paper transporting rollers 320 to 328 and the idler rollers 330 to 338 are disposed in a condition distributed discretely at a distance smaller than the length of the paper sheets 40 in the transporting direction as seen from FIGS. 4 and 7 to 9.

The roller driving mechanism 340 includes the transport motor 342 described above as a driving source and further includes a second belt-and-pulley mechanism 348 in addition to the first belt-and-pulley mechanism 344. The first and second belt-and-pulley mechanisms 344 and 348 will be described here. The first belt-and-pulley mechanism 344 includes a pulley 344A mounted on a rotary shaft of the transport motor 342, another pulley 344B mounted on a rotary shaft 320A of the paper transporting roller 320, and a belt 346A wound between and around the pulleys 344A and 344B. The second belt-and-pulley mechanism 348 includes pulleys 320B to 328B mounted on the rotary shafts 320A to 328A of the paper transporting rollers 320 to 328, and a belt 346B wound between and around the pulleys 320B to 328B.

Accordingly, when the transport motor 342 operates, the driving force is transmitted from the rotary shaft of the transport motor 342 to the pulley 344B by way of the pulley 344A and the belt 346A so that the rotary shaft 320A of the paper transporting roller 320 is driven to rotate. Further, from the pulley 320B, the rotary shafts 322A to 328A of the other paper transporting rollers 322 to 328 are driven to rotate by way of the belt 346A and the pulleys 322B to 328B so that the paper transporting rollers 320 to 328 are driven to rotate simultaneously. It is to be noted that reference numeral 360 denotes a tension pulley which applies a suitable tensile fore to the belt 346A so that the driving force may be transmitted with certainty between the belt 346A and the pulleys 320B to 328B.

Figure 10:
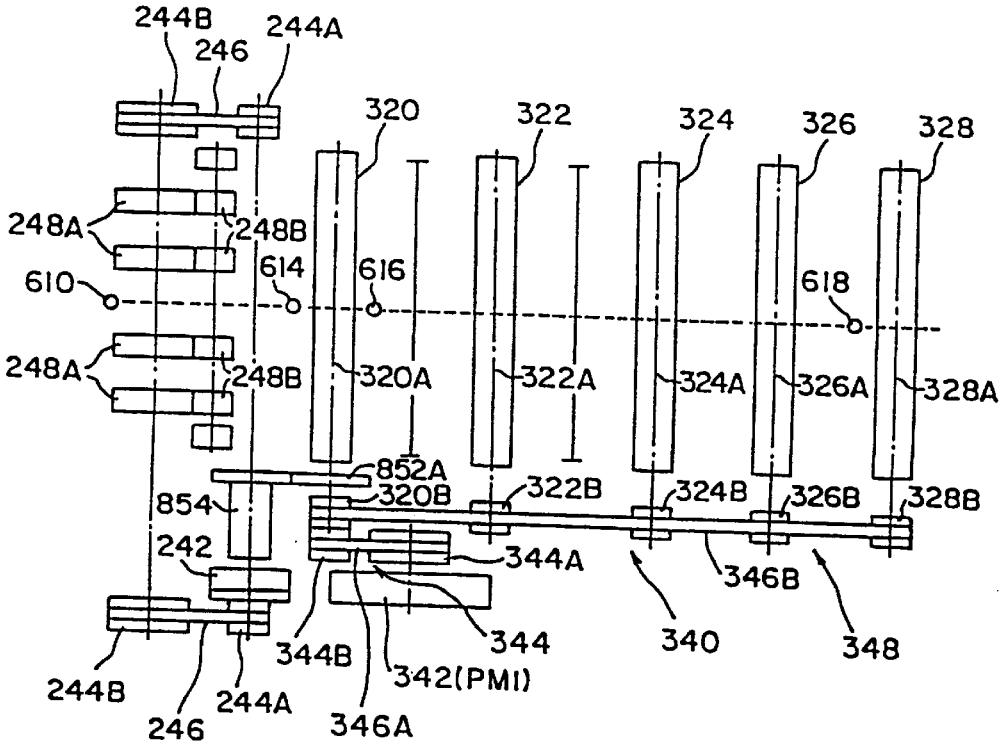
FIG. 10 is a diagrammatic view schematically showing, in plan, the driving system shown in FIG. 8.
Figure 11A:
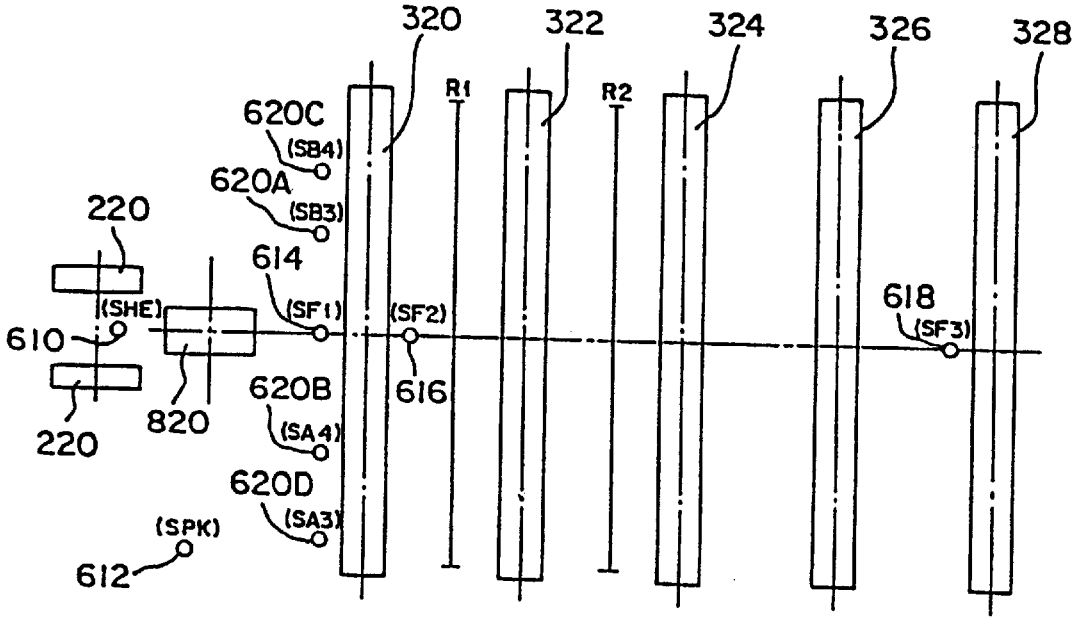
FIG. 11 is a diagrammatic view schematically showing, in plan, a paper transport system of the image reading apparatus of FIG. 4.
Figure 11B:
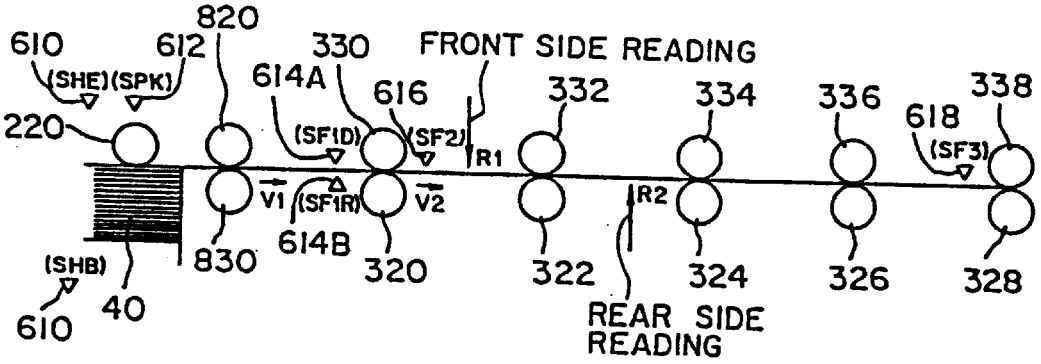

The paper transport mechanism 300 described above is schematically shown in FIGS. 10 and 11. Referring to FIGS. 10 and 11, the components are shown such that the paper supply hopper 210 is positioned on the left side while a paper stacker 510 is positioned on the right side and a paper sheet 40 is transported from the left side to the right side reversely to those in FIGS. 4 to 9 so as to conform to time charts (sequence diagrams shown in FIGS. 38 to 43) which will be hereinafter described.

Figure 12:
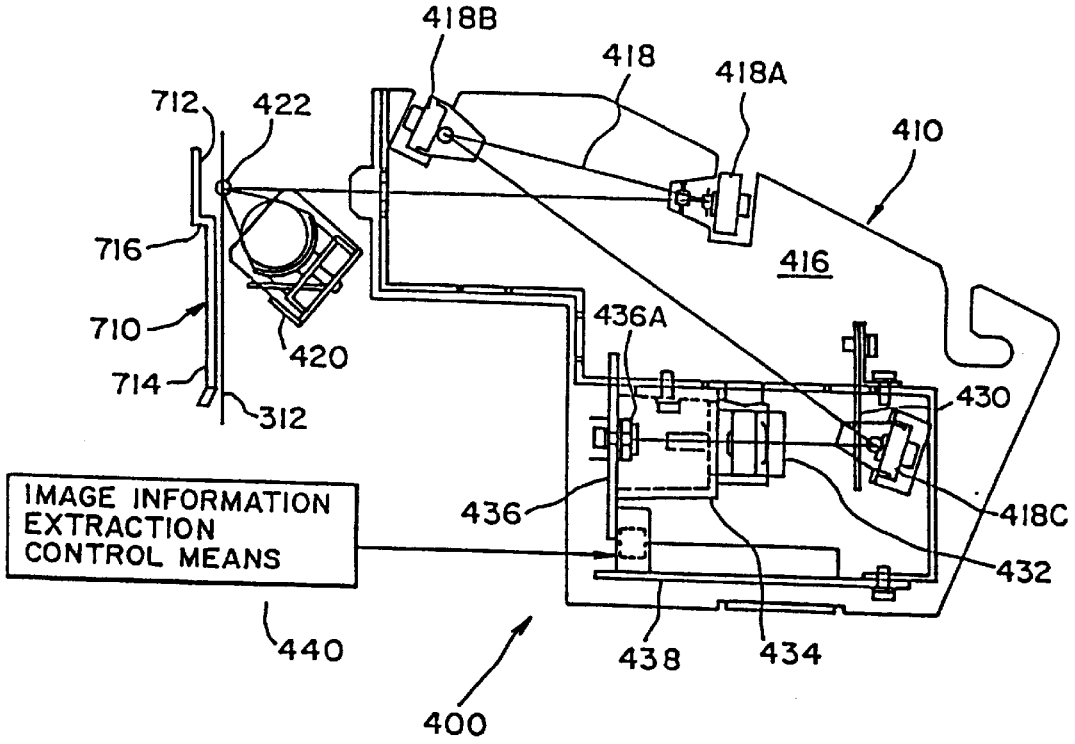
FIG. 12 is a schematic side elevational view showing the construction of an image reading unit of the image reading apparatus of FIG. 4.

Referring now to FIG. 12, the optical image reading mechanism 400 includes an optical image reading unit 410 having a reading point 422 located on the inclined transport path 312 for optically reading information on a paper sheet 40, and image information extraction control means 440 for controlling extraction of image information read by the optical image reading unit 410.

Referring to FIGS. 4 and 7, the optical image reading unit 410 includes, in the arrangement shown, two units of a first optical image reading unit 412 and a second optical image reading unit 414. The optical image reading units 412 and 414 are located intermediately of the inclined transport path 312, and the first optical image reading unit 412 optically reads information on the front face 42 of a paper sheet 40 while the second optical image reading unit 414 optically reads information on the rear face 44 of the paper sheet 40.

Here, each of the optical image reading unit 412 and 414 is constituted as an image reading unit of common specifications. For example, FIG. 12 is a side elevational view showing the construction of the image reading unit of common specifications. Referring to FIG. 12, the optical image reading unit 410 includes a fluorescent lamp unit 420 serving as a lighting element for irradiating light upon the reading point 422 on the inclined transport path 312, a CCD (charge coupled device) circuit board 436 including a CCD camera 436A for optically reading information on a paper sheet 40, and a video circuit board 438 for processing information from the CCD camera 436A.

A light path 418 from the reading point 422 to the CCD camera 436A is constituted from a plurality of (three in the arrangement shown) mirrors 418A, 418B and 418C for reflecting light. A shading plate 430 and a lens 432 are located intermediately of the light path 418 between the mirror 418C and the CCD camera 436A so that an image from the mirror 418C may be introduced into the CCD camera 436A by way of the lens 432 after peripheral portions thereof, which are liable to be distorted, are corrected by the shading plate 430.

Since the light path 418 is formed by the plurality of mirrors 418A, 418B and 418C for reflection of light in this manner, the light path 418 can have a sufficient length while the reading point 422 and the CCD circuit board 436 are located at comparatively near locations to each other. Consequently, even where the lens 432 has a great focal length, the reading point 422 can be disposed at a focus position of the lens 432.

A paper sheet 40 from which information has been read by the optical image reading mechanism 400 in this manner is discharged from the paper transport mechanism 300 to the paper stacking mechanism 500. Here, at the terminal end of the paper transport mechanism 300, a paper discharge roller mechanism 540 is located so that the paper sheet 40 may be discharged to the paper stacking mechanism 500 while being driven by the paper discharge roller mechanism 540.

The paper stacking mechanism 500 includes a stacker table 520 having, at the bottom thereof, the paper stacker 510 on which paper sheets 40 can be stacked. A paper trailing end guide mechanism 550 for guiding the rear end 48 of a paper sheet 40 to be stacked into the paper stacker 510.

Referring back to FIGS. 4, 7 and 11, several sensors 610 to 618, 620A to 620D and 622 are provided. Thus, operations of the driving systems described above, that is, operations of the hopper motor 242 of the paper supply hopper mechanism 240, the pick clutch 238 of the paper supply roller driving mechanism 230, the separation clutch 854 and the roller driving mechanism 340 of the separation roller driving mechanism 850, and the transport motor 342 for the separation roller driving mechanism 850 and the paper supply roller driving mechanism 230 and extraction operations of the image information extraction control means 440 of the first optical image reading unit 412 and the second optical image reading 414 are controlled in response to detection signals from the sensors 610 to 618 and 620A to 620D.

The sensor (SHE) 610 is a hopper empty sensor for detecting whether or not the paper supply hopper 210 is empty. The sensor (SPK) 612 is a paper supply sensor for detecting whether or not the posture of the paper supply hopper 210 is in an optimum condition (that is, a hopper paper supplying position) for supplying a paper sheet. Here, since the paper supply roller 220 is put into a paper supplying position (optimum condition) in response to the paper supplying position of the paper supply hopper 210, the sensor 612 actually detects whether or not the paper supply hopper 210 and the paper supply roller 220 are in their individual paper supplying positions. The hopper empty sensor 610 and the paper supplying sensor 612 may each be constituted from, for example, a photo-interrupter.

The sensor (SF1) 614 and the sensor (SF2) 616 are transport sensors for detecting a paper sheet 40 is transported by the paper transport mechanism 300. Of the two sensors 614 and 616, the transport sensor 616 detects a reading timing for an image. Meanwhile, the sensor (SF3) 618 is a discharge sensor for detecting whether or not a paper sheet 40 is discharged from the paper transport mechanism 300 to the paper stacking mechanism 500. The transport sensors 614 and 616 and the discharge sensor 618 may each be constituted from, for example, a photo-sensor. Here, the transport sensor 614 is a transmission type photo-sensor which includes a light emitting element and a light receiving element located on the opposite sides of the paper transport mechanism 300, and each of the transport sensor 616 and the discharge sensor 618 is a reflection type sensor wherein a light emitting element and a light receiving element are provided as a unitary member.

The sensor (SB5) 620A, the sensor (SA4) 620B, the sensor (SB4) 620C and the sensor (SA3) 620D are sheet width detection sensors constituting paper size detection means 620. In particular, the sensor 620A is a B5 width detecting sensor provided for detection of a paper width of a paper sheet of the "B5 size"; the sensor 620B is an A4/LT width detection sensor provided for detection of a paper width of a paper sheet of the "A4 size" or "LT size"; the sensor 620C is a B4 width detection sensor provided for detection of a paper width of a paper sheet of the "B4 size"; and the sensor 620D is an A4/DL width sensor provided for detection of a paper width of a paper sheet of the "A3 size" or "DL size". The sensors 620A to 620D may each be constituted from, for example, a photo-sensor. In the arrangement shown, a reflection type photo-sensor is employed for the sensors 620A to 620D.

Meanwhile, the sensor 622 is a bottom sensor for discriminating whether or not the hopper table 212 of the paper supply hopper 210 is at its lowermost position (bottom position). The sensor 622 may be, for example, a photo-interrupter. The sensors mentioned above will be hereinafter described in detail.

For starting and stopping operations, setting of an operation condition and so forth of the image reading apparatus described above, an operation panel 920 is provided at the front of the image reading apparatus as shown, for example, in FIG. 5.

2. Construction of Essential Part of the Image Reading Apparatus

In the following, the construction of essential part of the image reading apparatus will be described in detail for the individual components.

2-1. Paper Supply Mechanism

A. Paper Hopper System

The paper supply hopper driving mechanism 240 for driving the paper supply hopper 210 will first be described in detail. Referring to FIGS. 4 and 7, the paper supply hopper driving mechanism 240 includes, as described hereinabove, the hopper motor 242 constituted from a stepper motor, the belt-and-pulley mechanism 244 and the rack-and pinion mechanism 248.

The belt-and-pulley mechanism 244 includes a pair of pulleys 244A and 244B and a belt 246. The pulley 244A is mounted on a rotary shaft of the hoper motor 242, and the pulley 244B is provided coaxially with a pinion 248B.

The rack-and-pinion mechanism 248 includes a rack 248A and the pinion 248B mentioned above which are held in meshing engagement with each other. The rack 248A is formed along an arc and mounted on the hopper table 212 such that, when the pinion 248B is rotated, the hopper table 212 is pivoted around an axis of the rotary shaft 212A together with the rack 248A by the rotation of the rack-and-pinion mechanism 248 to move the free end portion thereof upwardly or downwardly.

The hopper motor 242 is controlled in operation by motor control means 280 serving as paper supply hopper position control means in response to information from the paper supply sensor 612 serving as paper supply position detection means to adjust the inclined position of the hopper table 212 so that the uppermost one of the paper sheets 40 accommodated on the hopper table 212 of the paper supply hopper 210 may be positioned optimally to supply the paper sheet (this is the hopper paper supply position mentioned hereinabove).

Such control of the hopper motor 242 by the motor control means 280 is performed normally during reading operation. However, upon paper accommodation wherein paper sheets 40 are accommodated into the paper supply hopper 210, control of an initialization mode is performed. In particular, in response to an operation starting instructions (that is, a control starting instruction) provided by, for example, throwing in of the power supply to the image reading apparatus, the motor control means 280 controls so that the hopper motor 242 is rotated in a direction to move the hopper table 212 downwardly, and then when the hopper table 212 reaches its lowermost position, whereupon the bottom sensor 622 is switched to an on-state, the motor control means 280 controls so that the hopper motor 242 is stopped.

Thereafter, the motor control means 280 controls the hopper motor 242 so that the paper supply hopper 210 in which the paper sheets 40 are accommodated is moved to its hopper paper supply position.

Here, the hopper paper supply position will be described. A gate 228 is provided at the end of the paper supply hopper 210 in the paper supplying direction adjacent the front end of the hopper table 212 such that leading ends 46A of the paper sheets 40 may be restricted within the paper supplier hopper 210. The gate 228 is formed such that an upper end portion 228A thereof is inclined a little in the paper supplying direction so as to approach the separation roller 820 at a location a little downstream (in the paper supplying direction) of the paper supply roller 220 so that the paper sheets 40 in the paper supply hopper 210 may be supplied smoothly one-by-one toward the separation roller 820 side.

The paper supply roller 220 drives the top face of the paper sheets 40 in the paper supply hopper 210 to supply the top one paper sheet 40. In order to drive, upon such paper supplying operation, the paper sheets 40 smoothly one-by-one from the top of the paper sheets 40, the top one of the paper sheets 40 in the paper supply hopper 210 is supplied preferably riding over the upper end portion 228A of the gate 228, and the position of the top face of the paper sheets 40 must not be excessively high nor low with respect to the upper end portion 228A of the gate 228. The inclined position of the hopper table 212 which is suitable to such paper supplying operation is defined as hopper paper supply position.

Figure 14:
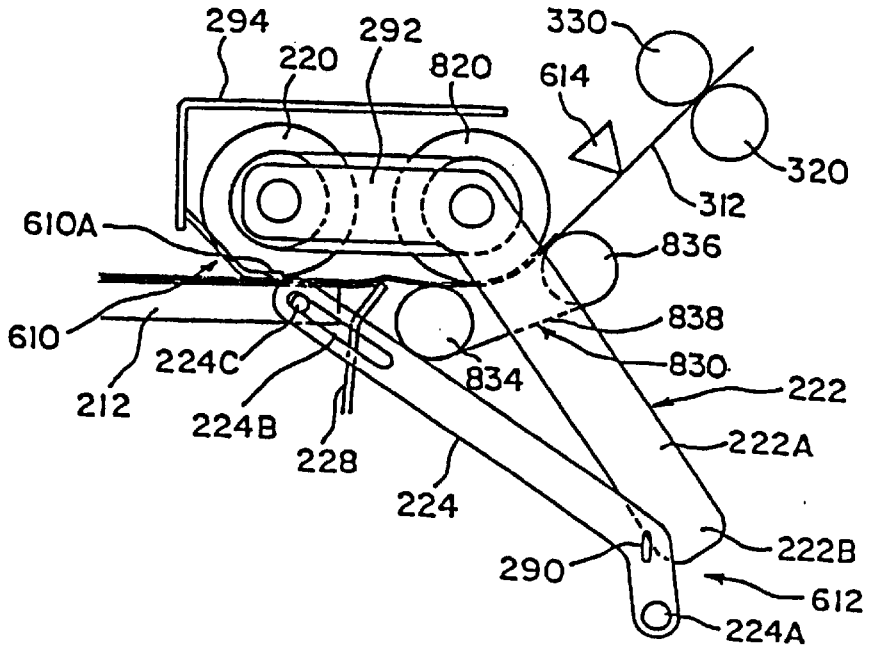
FIG. 14 is a side elevational view of part of a paper supply mechanism in the image reading apparatus of FIG. 4 when paper sheets remain by a small amount in a paper supply hopper.

By the way, the paper sheets 40 in the paper supply hopper 210 lie substantially horizontally as shown in FIG. 14 when the quantity (number) thereof is small, and as the quantity (number) thereof increases, they are inclined forwardly downwardly in the paper supplying direction with the trailing ends thereof in the paper feeding direction raised relative to the leading ends thereof. Accordingly, the hopper paper supply position varies in response to the quantity (number) of the paper sheets 40. Meanwhile, since the paper supply roller 220 is rocked to a position corresponding to the height of the top of the paper sheets 40 to incline the paper supply hopper 210, the position (height) and/or the posture of the paper sheets 40 can be detected as the rocking position of the paper supply roller 220. Accordingly, the hopper paper supply position can be detected from the rocking position of the paper supply roller 220 and the inclination of the paper supply hopper 210 itself.

Figure 15:
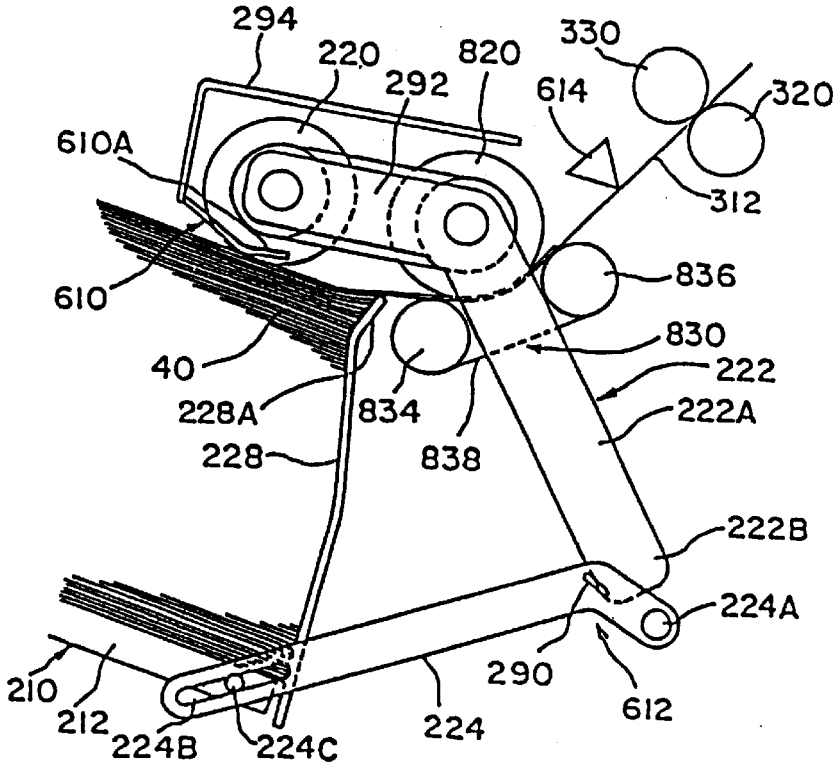
FIG. 15 is a side elevational view showing part of the paper supply mechanism of FIG. 14 but when paper sheets remain by a large amount in the paper supply hopper.

Therefore, in the present embodiment, the paper supply sensor 612 serving as paper supply position detection means includes, as shown in FIGS. 14 and 15, a first interlocking member 222 which operates in response to a rocking movement (rocking position) of the paper supply roller 220, a second interlocking member 224 which operates in response to a pivotal movement (inclined position) of the hopper table 212 itself of the paper supply hopper 210, and a switch 290 which operates on or off in response to a relative movement between the first and second interlocking members 222 and 224.

Referring to FIGS. 14 to 16, the first interlocking member 222 includes a switch arm 222A which is provided integrally with, and extends obliquely downwardly from, the rocking arm 292 on which the center of rotation of the paper supply roller 220 is supported for rotation so that the paper supply roller 220 may be rocked around the axis of rotation of the separation roller 820. Due to the construction of the first interlocking member 222, when the paper supply roller 220 is rocked, also the switch arm 222A of the first interlocking member 222 is rocked in response to the rocking movement of the first interlocking member 222.

Meanwhile, the second interlocking member 224 is formed as an L-shaped arm which is supported for pivotal motion around an arm fulcrum 224A at a location forwardly of a lower portion of the gate 228 in the paper supplying direction (rightwardly in FIGS. 14 and 15). A pin 224C is provided at a side portion of a front end portion of the hopper table 212 and is loosely fitted in an elongated hole 224B formed at a rocking end portion of the second interlocking member 224 such that the second interlocking member 224 may be rocked around the pin 224C when the hopper table 212 is moved upwardly or downwardly.

The switch 290 may be a photo-interrupter. The photo-interrupter switch 290 is provided at an intermediate portion (bent portion) of the second interlocking member 224 adjacent the arm fulcrum 224A. When a rocking end portion 222B of the switch arm 222A of the first interlocking member 222 comes to a position on an optic axis of the photo-interrupter switch 290, the photo-interrupter switch 290 is switched on, but when the rocking end portion 222B moves out of the optic axis of the photo-interrupter switch 290, the photo-interrupter switch 290 is switched off.

Accordingly, when the hopper table 212 is raised to a high position as seen in FIG. 14, the second interlocking member 224 is pivoted in the clockwise direction in FIG. 14 so that the switch 290 approaches the rocking end portion 222B of the first interlocking member 222. Consequently, even if the paper supply roller 220 is rocked little and the first interlocking member 222 is pivoted little, the rocking end portion 222B of the first interlocking member 222 reaches the switch 290 to switch the switch 290 on.

On the other hand, when the hopper table 212 is moved down to a low position as seen in FIG. 15, the second interlocking member 224 is pivoted in the counterclockwise direction in FIG. 15 so that the switch 290 is spaced away from the rocking end portion 222B of the first interlocking member 222. Consequently, unless the paper supply roller 220 is rocked by a certain amount, the rocking end portion 222B of the first interlocking member 222 does not reach the switch 290 to switch the switch 290 on.

The hopper motor 242 operates to drive the hopper table 212 of the paper supply hopper 210 to move upwardly until the paper supply sensor 612 detects the hopper paper supply position. Naturally, immediately after paper supply sheets 40 are accommodated into the paper supply hopper 210, the paper supply hopper 210 is at a sufficiently lowered position, and accordingly, the hopper motor 242 drives the hopper table 212 of the paper supply hopper 210 to move to the hopper paper supply position.

Then, when paper is supplied, since the quantity of the paper sheets 40 in the paper supply hopper 210 decreases each time a paper sheet 40 is supplied, also the hopper paper supply position varies accordingly. Also in this instance, the hopper motor 242 operates in response to such detection information of the paper supply sensor 612 so that the paper supply hopper 210 is always adjusted to the hopper paper supply position (that is, the position optimum to supply the paper sheets 40).

Meanwhile, the bottom sensor 622 mentioned hereinabove may be a photointerrupter and is provided at a lower location in the apparatus body 10. The rack 248A is positioned so that, when the hopper table 212 comes to its lowermost position (bottom position), the lower end of the rack 248A comes to an optic axis of the photo-interrupter of the bottom sensor 622. In this instance, the bottom position can be detected as the photo-interrupter is switched on.

Since operation of the paper supply hopper 210 is normally controlled in response to the hopper empty sensor 610, the paper supply sensor 612 and the bottom sensor 622, the paper supply hopper 210 is pivoted within a fixed range. In order to prevent the paper supply hopper 210 from being pivoted beyond the fixed range due to a malfunction of an associated control system or driving system, the image reading apparatus of the present embodiment includes a paper supply hopper excessive pivotal motion prevention mechanism 260.

The paper supply hopper excessive pivotal motion prevention mechanism 260 includes a stopper 262 provided at an upper end portion of the rack 248A, a non-toothed portion 264 provided at an upper end portion of the rack 248A, and a torque limiter 266 provided between the pulley 244B and the pinion 248B.

In particular, when the paper supply hopper 210 comes to its lowermost position, the upper stopper 262 is contacted with an abutting portion (not shown) on the pinion 248B to stop pivoting motion of the pinion 248B thereby to stop the paper supply hopper 210 at the lowermost position (bottom position). Further, in this instance, the input power from the hopper motor 242 to the pinion 248B is limited within a fixed range by an action of the torque limiter 266 so that the rack-and-pinion mechanism 248 may not be damaged inadvertently.

Meanwhile, the non-toothed portion 264 is formed by removing some teeth of the rack 248A provided for meshing engagement with the pinion 248B. Thus, when the paper supply hopper 210 comes to the uppermost position, the pinion 248B comes to the non-toothed portion 264 so that further rotation of the pinion 248B is not transmitted to the rack 248A anymore. Consequently, the paper supply hopper 210 is stopped at the uppermost position.

By the way, the image reading apparatus of the present embodiment not only has an automatic mode in which an image is read while the paper sheets 40 in the paper supply hopper 210 are automatically supplied and transmitted successively one-by-one but also has a manual paper insertion mode in which paper sheets are manually inserted one-by-one into the image reading apparatus. The manual paper insertion mode can be set by way of insertion mode selection means 924C provided on the operation panel 920 which will be hereinafter described.

When such manual paper insertion mode is set, the motor control means 280 controls so that the hopper table 212 of the paper supply hopper 210 may be driven by the paper supply hopper driving mechanism 240 to move to the paper supply position and thereafter keep the paper supply position. In the manual paper insertion mode, since paper sheets are inserted one-by-one, if the hopper table 212 is held at the paper supply position in this manner, the paper sheet always keeps an optimum height with respect to the gate 228.

B. Paper Supply Roller System

Figure 16A:
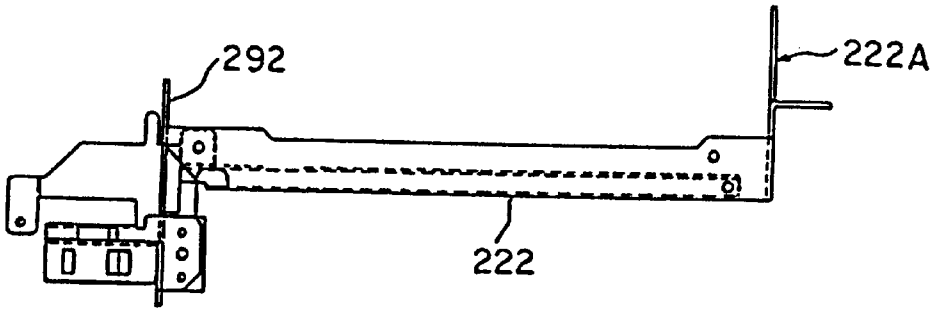
FIGS. 16(A) and 16(B) are a plan view and a front elevational view, respectively, of a paper supply roller system of the paper supply mechanism of FIG. 14.
Figure 16B:
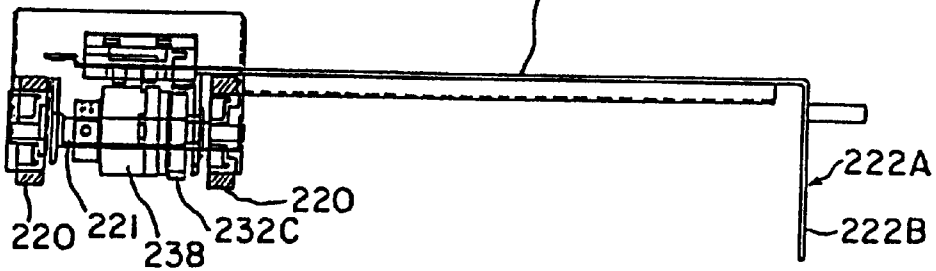
Figure 16C:
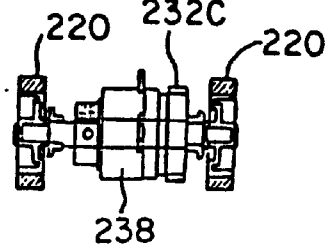
FIG. 16(C) is a front elevational view showing only part of the paper supply roller system.
Figure 16D:
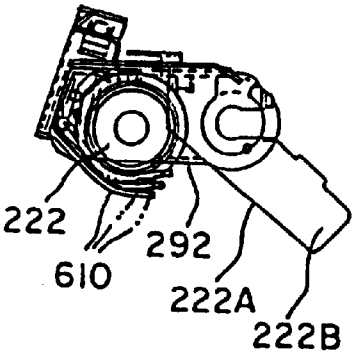
FIG. 16(D) is a side elevational view showing, in an enlarged scale, the paper supply roller system.

The paper supply roller 220 is supported for rocking motion on the separation roller 820 by way of the rocking arm 292 as described above. Actually, however, the paper supply roller 220 is provided by a pair of rollers located in a leftwardly and rightwardly symmetrical position with respect to the center line of the paper supplying direction as seen in FIGS. 16(B) and 16(C). The left and right paper supply rollers 220 are disposed in a mutually neighboring relationship in the proximity of the center line of the paper supplying direction so that also a paper sheet of a comparatively small width can be supplied with certainty.

The paper supply roller driving mechanism control means 250 controls operation of the pick clutch 238 of the paper supply roller driving mechanism 230 in response to a result of detection of the paper supply sensor 612 described above. Accordingly, the paper supply roller driving mechanism control means 250 is referred to herein also as pick clutch control means. In particular, if it is determined by the paper supply sensor 612 that the paper supply hopper 210 is at the hopper paper supply position, then also the positions of the paper supply rollers 220 in their rocking direction are the hopper paper supply positions, and the paper supply roller driving mechanism control means 250 controls the pick clutch 238 of the paper supply roller driving mechanism 230 so as to drive the paper supply rollers 220.

Otherwise, if it is not determined by the paper supply sensor 612 that the paper supply hopper 210 is at the hopper paper supply position (that is, if it is discriminated that the paper supply hopper 210 is not at the hopper paper supply position), then also the positions of the paper supply rollers 220 themselves in the rocking direction are not the hopper paper supply positions, and the paper supply roller driving mechanism control means 250 controls the pick clutch 238 of the paper supply roller driving mechanism 230 so as to stop driving of the paper supply rollers 220.

For example, if it is determined that the paper supply hopper 210 is at the hopper paper supply position, then the paper supply roller driving mechanism control means 250 couples the pick clutch 238 so that the paper supply rollers 220 are driven by the paper supply roller driving mechanism 230 to operate to supply the top one of the paper sheets 40 in the paper supply hopper 210. After the top paper sheet 40 is supplied from the paper supply hopper 210, the paper supply rollers 220 are rocked downwardly by a distance equal to the thickness of the paper sheet 40.

As such downward rocking movement of the paper supply rollers 220 occurs and is accumulated successively, the switch arm 222A of the first interlocking member 222 is finally spaced away from the switch 290, whereupon the switch 290 is switched off. Consequently, it is discriminated now that the paper supply hopper 210 is not at the hopper paper supply position, and the paper supply roller driving mechanism control means 250 disconnects the pick clutch 238 to stop the paper supply roller driving mechanism 230. Simultaneously, the motor control means 280 renders the hopper motor 242 operative in response to information from the paper supply sensor 612 so that the paper supply hopper 210 is driven to move to the hopper paper supply position.

As a result, the paper supply roller driving mechanism control means 250 controls so that the paper supply roller driving mechanism 230 may operate again. As such, a sequence of operations as just described is repeated; the position of the top face of the paper sheets 40 is always kept within an optimum range; and in this condition, the paper supply rollers 220 operate. Otherwise, if the position of the top face of the paper sheets 40 does not remain within such optimum range, the paper supply rollers 220 do not operate.

Referring to FIGS. 14 to 16(D), a cover 294 is provided integrally with the rocking arm 292 such that it covers over the paper supply rollers 220 and the separation roller 820 from the side adjacent the paper supply hopper 210. The hopper empty sensor 610 mentioned hereinabove is provided on the cover 294. The hopper empty sensor 610 includes a rockable arm 610A mounted for movement, for example, such that an end portion thereof can be moved down into a groove (not shown) formed on the hopper table 212, and a photo-interrupter (not shown) provided at a rocking portion of the rockable arm 610A. The photo-interrupter is disposed such that it is switched on (closed) when the end of the rockable arm 610A is moved down.

The rockable arm 610A is so light in weight that, even if only one paper sheet 40 is present on the hopper table 212, downward movement of the end of the rockable arm 610A is prevented by the paper sheet 40 so that the photo-interrupter remains in an off-state, but if all of the paper sheets 40 on the hopper table 212 are supplied from the hopper table 212, then the end of the rockable arm 610A is moved down so that the photo-interrupter is turned on.

The hopper empty sensor 610 may alternatively constructed in such a manner as described below. In particular, the hopper empty sensor 610 may be constructed as a transmission type photo-sensor including a light emitting element 614A and a light receiving element 614B disposed in a pair on the front face and the rear face of the hopper table 212, respectively. Meanwhile, the hopper table 212 has a hole (not shown) perforated therein so that, if a paper sheet 40 is placed on the hopper table 212, transmission of light from the light emitting element 614A to the light receiving element 614B through the hole is prevented by the paper sheet 40, and consequently, accommodation of the paper sheet 40 is detected. However, if no paper sheet 40 remains on the hopper table 212, light is transmitted from the light emitting element 614A to the light receiving element 614B through the hole. Consequently, absence of any paper sheet 40 is detected.

C. Paper Separation Mechanism System

As described hereinabove, the paper separation mechanism 800 includes the separation roller 820, the rotation member 830 disposed in an opposing relationship to, and below, the separation roller 820, and the separation roller driving mechanism 850 for driving the separation roller 820 to rotate. The paper separation mechanism 800 is constructed such that, when a plurality of paper sheets 40 are supplied from the paper supply rollers 220, it separates only an uppermost one of the paper sheets 40 from the other paper sheet or sheets 40 between the separation roller 820 and the rotation member 830 and takes out and transports the thus separated one paper sheet 40.

The rotation member 830 is located below the separation roller 820, that is, adjacent the apparatus body 10 with respect to the separation roller 820, with a small gap left from the separation roller 820. The rotation member 830 includes the pair of pulleys 834 and 836 disposed in a spaced relationship from each other in the paper transporting direction and the endless belt 838 wound between and around the pulleys 834 and 836.

The separation roller driving mechanism 850 is constituted from components substantially common to those of the paper supply roller driving mechanism 230 described hereinabove. In particular, the separation roller driving mechanism 850 includes the transport motor 342 described hereinabove as a driving source and further includes the first belt-and-pulley mechanism 344 and the first and second gear mechanisms 852 and 856 interposed between the transport motor 342 and the paper supply rollers 220. The separation clutch 854 is interposed in the first gear mechanism 852. In short, the paper supply roller driving mechanism 230 has a construction wherein the third gear mechanism 232 is provided in addition to the separation roller driving mechanism 850. The first gear mechanism 852 includes gears 852A to 852D; the second gear mechanism 856 includes gears 856A and 856B; and the third gear mechanism 232 includes gears 232A to 232C. in FIGS. 9 and 10, some of the gear mentioned above are omitted.

Figure 8:
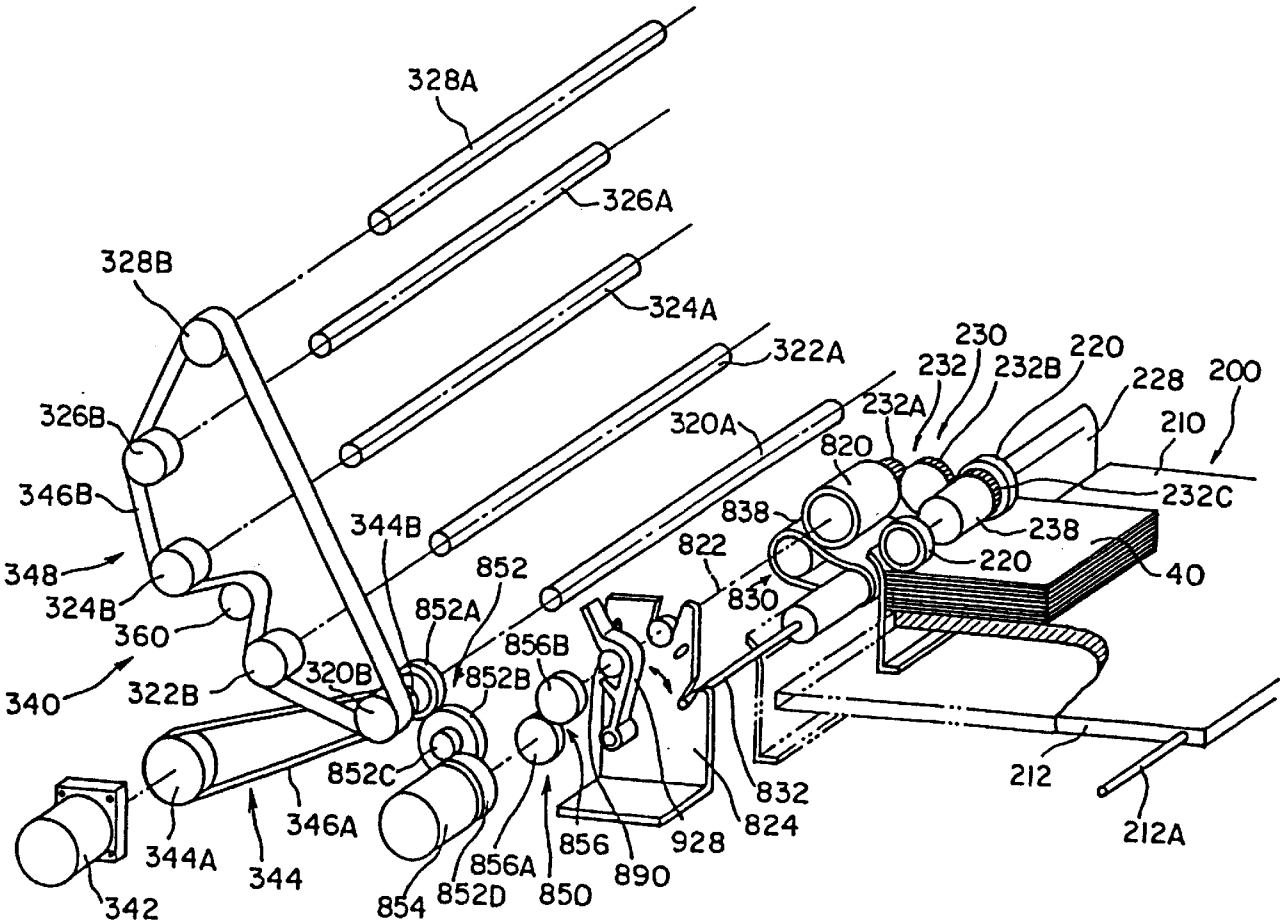
FIG. 8 is an exploded perspective view schematically showing a driving system of the image reading apparatus of FIG. 4.

In the image reading apparatus of the present embodiment, the rotary shaft 822 of the separation roller 820 is supported for rotation on a pair of separation roller system bearing members 824 provided outwardly of the left and right ends of a front portion of the paper supply hopper 210 on the apparatus body 10 as seen in FIG. 8. The separation roller 820 is provided at a central portion of the rotary shaft 822 as seen from FIG. 17(A) and 17(B).

Figure 17:
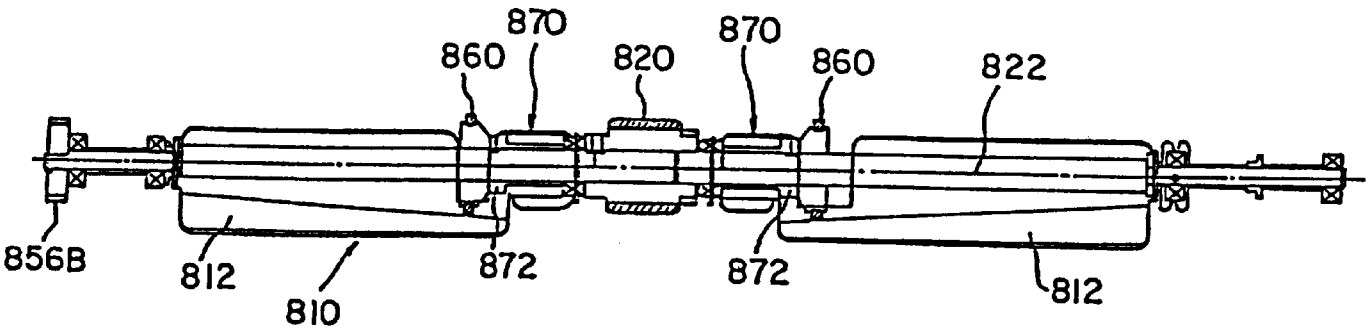
FIGS. 17(A), 17(B) and 17(C) are a plan view, a front elevational view and a side elevational view, respectively, of a separation roller system of the image reading apparatus of FIG. 4.
Figure 17:
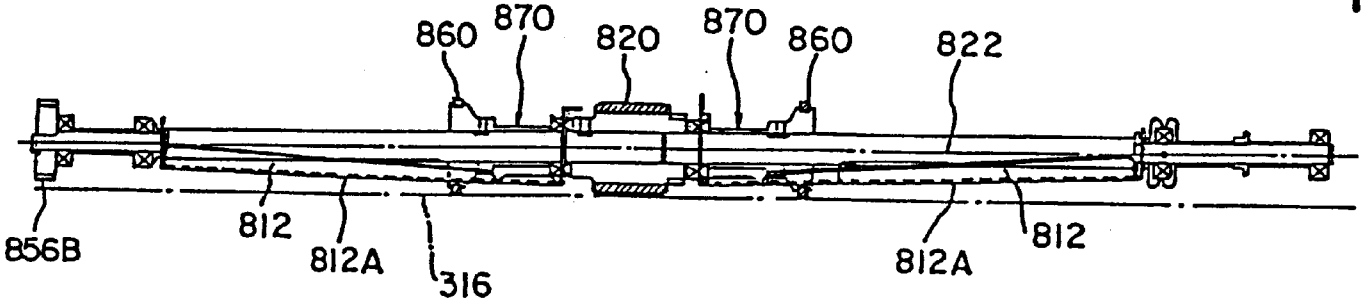
Figure 17:
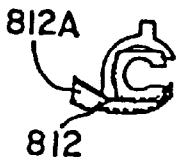
Figure 18A:
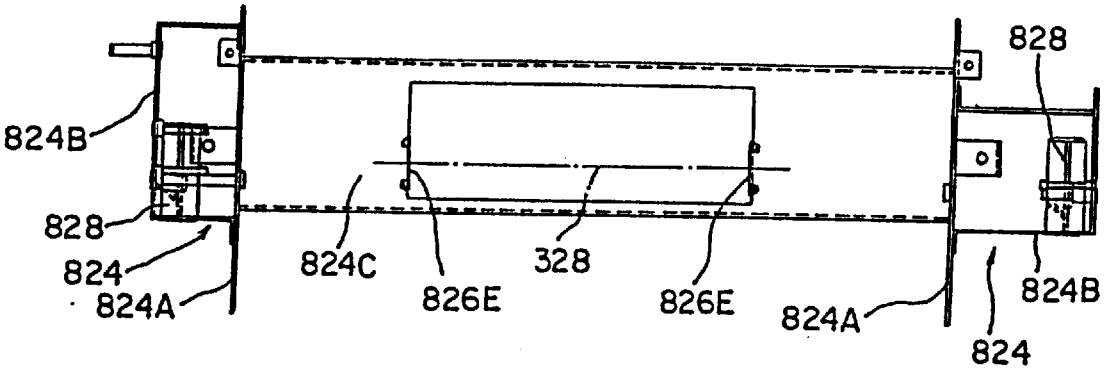
FIGS. 18(A) and 18(B) are a plan view (a view as viewed in the direction of an arrow mark A in FIG, 19) and an oblique front elevational view (a view as viewed in the direction of an arrow mark B in FIG. 19), respectively, showing a bearing system of the separation roller system shown in FIGS. 17(A) to 17(D)
Figure 18B:
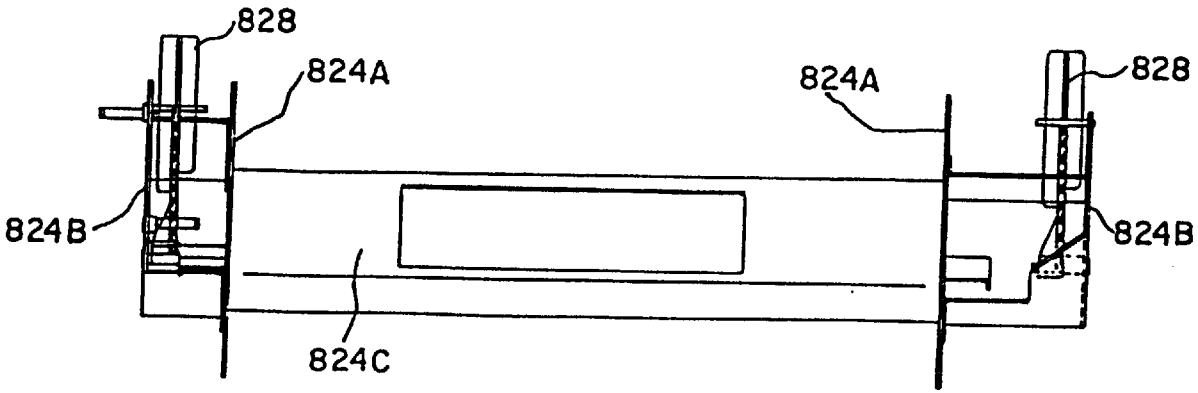

The paper separation mechanism 800 includes a paper skew prevention mechanism 810 as shown in FIG. 17(A) and 17(B). The paper skew prevention mechanism 810 includes a pair of movable guide members 812 provided at left and right locations with respect to the separation roller 820.

The movable guide members 812 are plate-like members mounted on the rotary shaft 822 of the separation roller 820 in an opposing relationship to a paper-passing region below the separation roller 820. The movable guide members 812 restrict otherwise possible upward lateral floating movement or deformation of a paper sheet driven by the paper supply rollers 220 so that the paper sheet may be transported at a high speed and in a stable posture.

In particular, since a paper sheet driven by the paper supply rollers 220 becomes liable to move laterally as the speed increases and it is driven by the paper supply rollers 220 while it is pressed at central portions thereof in its widthwise direction from above by the paper supply rollers 220, it is fed to the separation roller 820 in such a deformed condition that the opposite left and right end portions thereof are turned up laterally. Since such lateral movement or deformation of a paper sheet causes a skew, the paper sheet must be introduced to the separation roller 820 while suppressing such lateral movement or deformation of the paper sheet.

To this end, the movable guide members 812 are provided, and a guide face 812A for guiding a paper sheet is formed on the lower face of each of the movable guide members 812. The movable guide members 812 are loosely fitted on the rotary shaft 822 such that they can be rocked around the rotary shaft 822 or moved upwardly or downwardly within a fixed range so that the guide faces 812A thereof may follow up the type of deformation of a paper sheet transported thereto.

The guide faces 812A of the movable guide members 812 are formed such that, taking possible upward lateral movement of the opposite left and right end portions of a paper sheet into consideration, portions thereof in the proximity of the center of the paper sheet in its widthwise direction are positioned in the proximity of a paper passage reference plane 316, but portions thereof adjacent the opposite ends of the paper sheet in the widthwise direction remote from the separation roller 820 are spaced away from the paper passage reference plane 316.

Since the guide faces 812A of the movable guide members 812 hold down a paper sheet by a greater amount (paper holding down amount) at a position nearer to the paper passage reference plane 316, they are shaped such that a greater paper holding amount is obtained at central portions in the widthwise direction, but a smaller paper holding amount is obtained at the opposite end portions in the widthwise direction.

Further, the guide faces 812A of the movable guide members 812 are inclined such that they are spaced, at entrance portions thereof adjacent the paper supply rollers 220, by a greater distance from the paper passage reference plane 316 so that the end portion 46A of a paper sheet 40 is an upwardly laterally curved condition may be caught with certainly by the guide faces 812A (refer to FIG. 17(C)). Accordingly, the distance of the guide faces 812A of the movable guide member 812 from the paper passage reference plane 316 decreases gradually toward the paper supplying and transporting direction. Consequently, the paper sheet 40 is reformed against deformation and controlled from lateral movement which it passes along the guide faces 812A.

Figure 19:
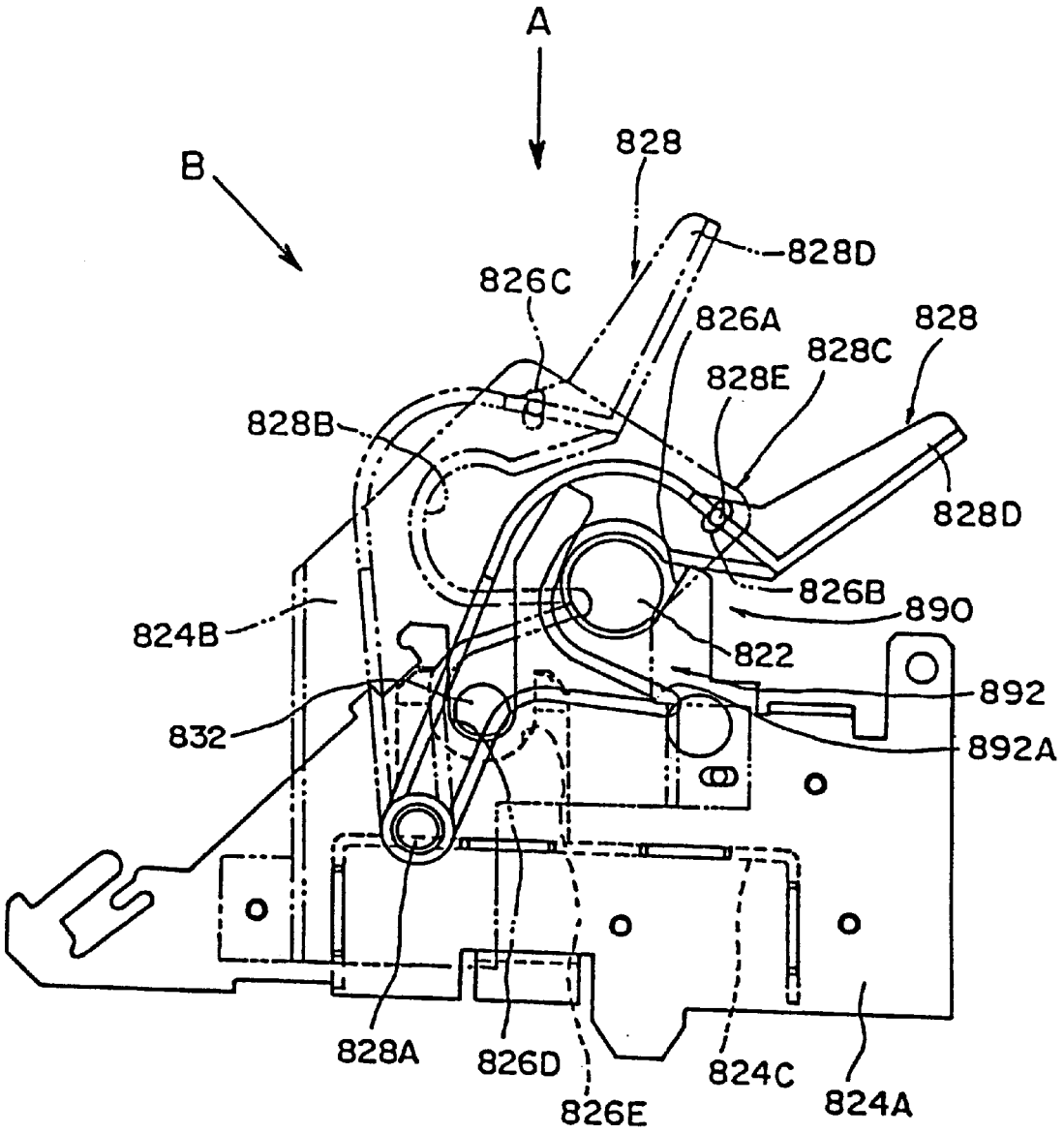
FIGS. 19 is a side elevational view of the bearing system of the separation roller system shown in FIGS. 18(A) and 18(B) showing a rotary shaft of a separation roller in a fixed condition.
Figure 20:
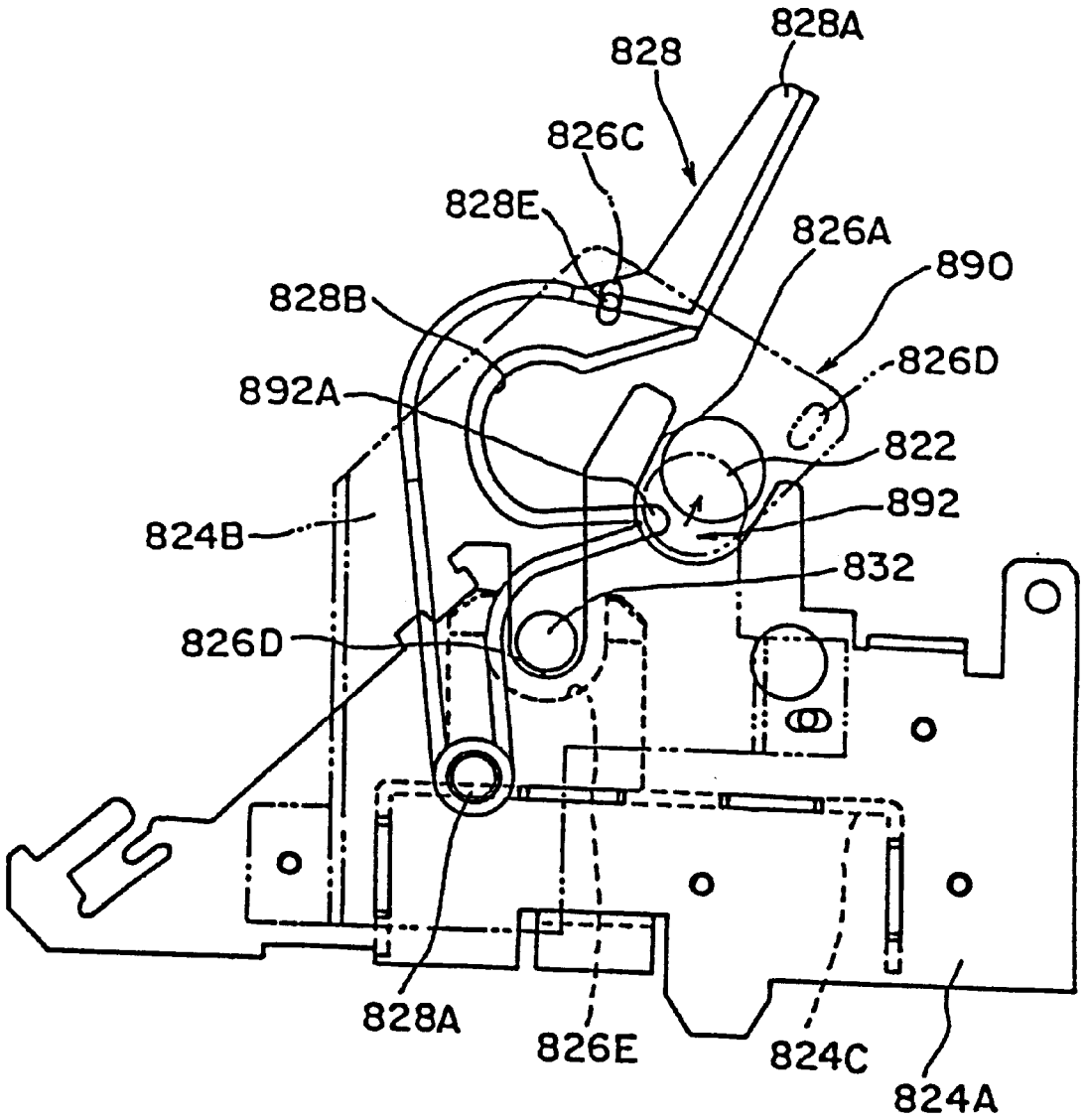
FIG. 20 is a similar view but showing the rotary shaft of the separation roller in a displaced condition.

Referring now to FIGS. 19 and 20, the separation roller system bearing members 824 include a pair of body plates 824A provided uprightly in the vertical direction adjacent the opposite left and right ends of the paper transport path 310, a pair of side plates 824A coupled to the outer faces of the body plates 824A, and a base plate 824C having a channel-shaped cross section and coupling the left and right body plates 824A to each other. A rotary shaft locking mechanism 890 for locking the rotary shaft 822 of the separation roller 820 from movement is provided between each of the body plates 824A and an associated one of the side plates 824A.

Referring to FIGS. 8 and 18 to 20, each of the rotary shaft locking mechanisms 890 includes a bearing hole 826A formed at an upper portion of an associated one of the body plates 824A in such a manner as to open upwardly, a rockable lever 826 supported for rocking motion on an associated one of the separation roller system bearing members 824 by means of a pin 828A, a bearing hole 828B formed in the rockable lever 828 and having an opening, and a latch mechanism 828C for latching the rockable lever 828 between a locking position and an unlocking position.

The rockable lever 828 can be pivoted between such a locking position as, indicated by a solid line in FIG. 19, and such an unlocking position, as indicated by a chain line in FIG. 19. The rockable lever 828 can be manually pivoted at a tongue 828D formed at a rocking end portion thereof. Further, the latch mechanism 828C includes a resilient pin 828E extending from the rockable lever 828 toward an associated one of the side plates 824A, and a pair of pin holes 826B and 826C formed in the side plate 824A.

When the rockable lever 828 is moved to its locking position, the pin 828E is engaged in the pin hole 826B to lock the rockable lever 828. However, when the rockable lever 828 is moved to its unlocking position, the pin 828E is engaged in the other pin hole 826C to lock the rockable lever 828. On the other hand, if an operation force is applied to the rockable lever 828 against the resilient force for biasing the pin 828E in its projecting direction, then the pin 828E is resiliently retracted and is now contacted with a wall face of the side plate 824A. In this condition, the rockable lever 828 can be pivoted freely between the locking position and the unlocking position.

The rotary shaft 822 is supported, when it is mounted in such a fixed condition that, as indicated by a solid line in FIG. 19, it is held between the bearing holes 826A of the body plates 824A and the bearing holes 828B of the rockable levers 828 in the locking position.

Each of the locking mechanisms further includes separation roller moving away means 892 for moving the separation roller 820 in a direction in which it is spaced away from the rotation member 83. The separation roller moving away means 892 is constituted from a projection 892A formed on the rockable lever 828 such that an opening end portion of the bearing hole 828B of the rockable leer 828 adjacent the center of rotation of the rotary shaft 822 extends laterally by a great extent. The projection 892A is formed such that, when the rockable lever 828 is pivoted toward the unlocking position, it is contacted with the lower face of the rotary shaft 822 of the separation roller 820 to push up the rotary shaft 822.

Consequently, if paper jamming should occur, for example, between the separation roller 820 and the belt 838 of the rotation member 830, then if the rockable levers 828 are pivoted to the individual unlocking positions as seen in FIG. 20, the projections 892A of the separation roller moving away means 892 move the rotary shaft 822 upwardly from a position indicated by a chain line in FIG. 20 to another position indicated by a solid line in FIG. 20. Consequently, the separation roller 820 and the belt 838 are spaced away from each other, and accordingly, the paper can be taken out readily. In this instance, the rotary shaft 822 is naturally held in a floating condition in the bearing hole 826A.

Referring to FIGS. 18(A) to 20, a bearing portion 826D is formed on each of the left and right body plates 824A, and a pair of bearing portions 826E are provided projectingly at upper left and right locations of the base plate 824C. The bearing portions 826D and 826E support, from below, a shaft 832 of the rotation member 830, which will be hereinafter described, located below the separation roller 820.

Referring to FIGS. 17(A) to 17(C), a pair of auxiliary rollers 860 are supported for rotation on, and coaxially with, the rotary shaft 822 at left and right positions sidewardly of the separation roller 820. In the image reading apparatus of the present embodiment, the auxiliary rollers 860 are positioned between the separation roller 820 and the movable guide members 812. The auxiliary rollers 860 act to help transportation of a paper sheet by the separation roller 820 to enhance the paper transporting force. To this end, a driving system 870 for driving the auxiliary rollers 860 is provided.

The driving system 870 serves also as a driving system for the separation roller driving mechanism 850 from the transport roller 342 to the rotary shaft 822, and from the driving systems, the auxiliary rollers 860 are driven by way of the rotary shaft 822 together with the separation roller 820. Further, the driving system 870 includes a pair of one-way clutches 872.

The one-way clutches 872 are interposed, for example, between the rotary shaft 822 and the auxiliary rollers 860 and allow the auxiliary rollers 860 to rotate at a higher speed than that at which they are driven to rotate by way of the driving system 870.

Accordingly, the auxiliary rollers 860 can help a paper sheet to be transported without making an obstacle to transportation of the paper sheet to provide a resistance to transportation of the paper sheet to provide a resistance to transportation of the paper sheet or without causing paper jamming.

Figure 21A:
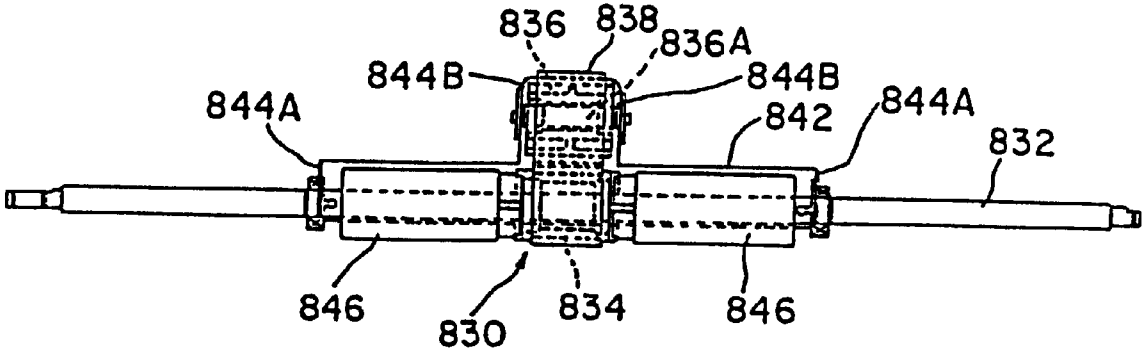
FIGS. 21(A), 21(B) and 21(C) are a plan view, a front elevational view and a side elevational view, respectively, showing a rotary member of the separation roller system shown in FIGS. 17(A) to 17(C)
Figure 21B:
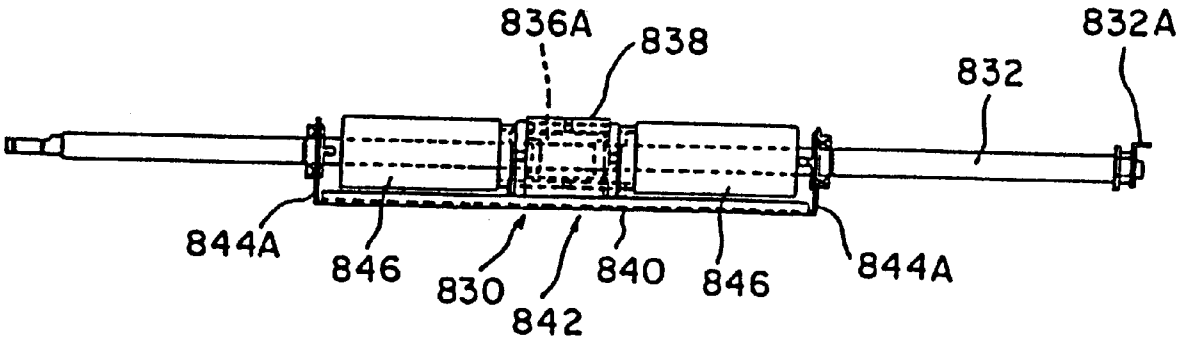
Figure 21C:
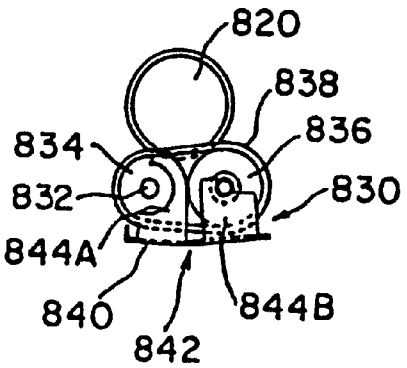

Referring to FIGS. 21(A) to 21(C), the rotation member 830 located below the separation roller 820 includes the pair of pulleys 834 and 836 spaced away from each other in the paper transporting direction at a central portion in the widthwise direction in an opposing relationship to the separation roller 820. Of the pulleys 834 and 836, the pulley 834 adjacent the paper supply rollers 220 is supported for rotation on, and with respect to, the shaft 832. A torque limiter 846 is interposed between the shaft 832 and the pulley 834 so that rotation of the pulley 834 may be restricted suitably.

Referring to FIGS. 8, 19 and 20, the shaft 832 is supported on the bearing portions 826D and 826E of the pair of left and right separation roller system bearing members 824. The bearing portions 826D and 826E are open at the tops thereof. However, when the separation roller 820 is fixed in a use condition, the shaft 832 is fixed at a lower portions in the bearing portions 826D and 826E since it is acted upon by a downwardly pressing force from the separation roller 820 by way of the pulley 834. Accordingly, if the separation roller 820 is removed upwardly, then also the shaft 832 an be removed from the separation roller system bearing members 824.

The other pulley 836 is supported for rotation on and relative to a bearing member 842 which is removably mounted on the shaft 832 as shown in FIGS. 21(A) to 21(C). The bearing member 842 includes a pair of base leaf springs 840 each formed from a leaf spring and serving as a base portion of the bearing member 842, a fitting arm portions 844A formed projectingly at an end of each of the base leaf springs 840 such that it is fitted on the shaft 832 of the pulley 834, and a bearing arm portion 844B provided projectingly at the other end of each of the base leaf springs 840 for supporting the pulley 836 for rotation thereon.

Each of the base leaf springs 840 is formed in an L-shape and applies a biasing force in a direction to move the axes of the pulleys 834 and 836 away from each other to provide a suitable tensile force to the belt 838 wound between and around the pulleys 834 and 836. The biasing forces of the base leaf springs 840 are set so that the base leaf springs 840 may be suitably resiliently deformed artificially in the direction in which the axes of the pulleys 834 and 836 are spaced away from each other.

Figure 22A:
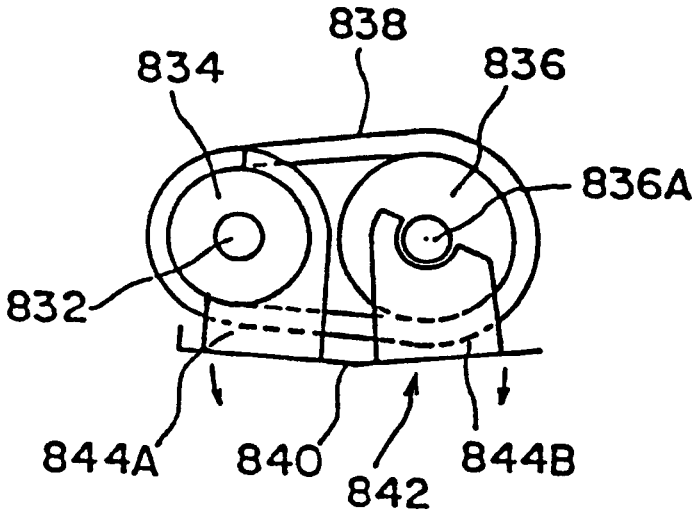
FIG. 22(A) is a side elevational view showing the rotary member of the separation roller system of FIGS. 21(A) to 21(C) in a mounted condition.
Figure 22B:
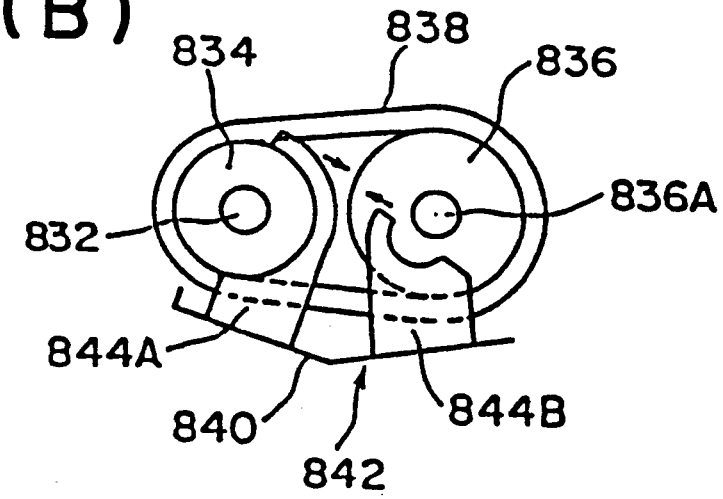
FIG. 22(B) is a similar view but showing the rotary member in a removed condition.

Therefore, if the base leaf springs 840 are resiliently deformed from such a mounted condition as seen in FIGS. 21(A) and 22(A) to such a condition as shown in FIG. 22(B) to move the arm portions 844A and 844B toward each other, then at least one of the arm portions 844A and 844B is removed from the shaft 832 or a shaft portion of the pulley 836 so that the pulley 836 can be removed readily.

On the other hand, in order to mount the pulley 836, the pulley 836 is first positioned in the inside of the belt 838 wound around the pulley 834, as shown in FIG. 22(B), and then the base leaf springs 840 are resiliently deformed to move the arm portions 844A and 844B toward each other, and in this condition, the arm portions 844A and 844B are fitted onto the shaft 832 and a shaft portion 836A of the pulley 836.

As a result, the pulley 836 is mounted in such a manner as shown in FIG. 22(A). In this mounted condition, the base leaf springs 840 exert a resilient force to move the arm portions 844A and 844B away from each other. Meanwhile, the belt 838 acts to restrict such movement of the arm portions 844A and 844B away from each other. Consequently, the pulley 836 is supported on the shaft 832 in a condition wherein the force of the base leaf springs 840 and the force of the belt 838 are balanced with each other. Also the tensile force of the belt 838 is adjusted by the resilient force of the base leaf springs 840.

2-2. Paper Transport Mechanism

A. Paper Transport Path and Paper Transporting Roller System

Figure 9:
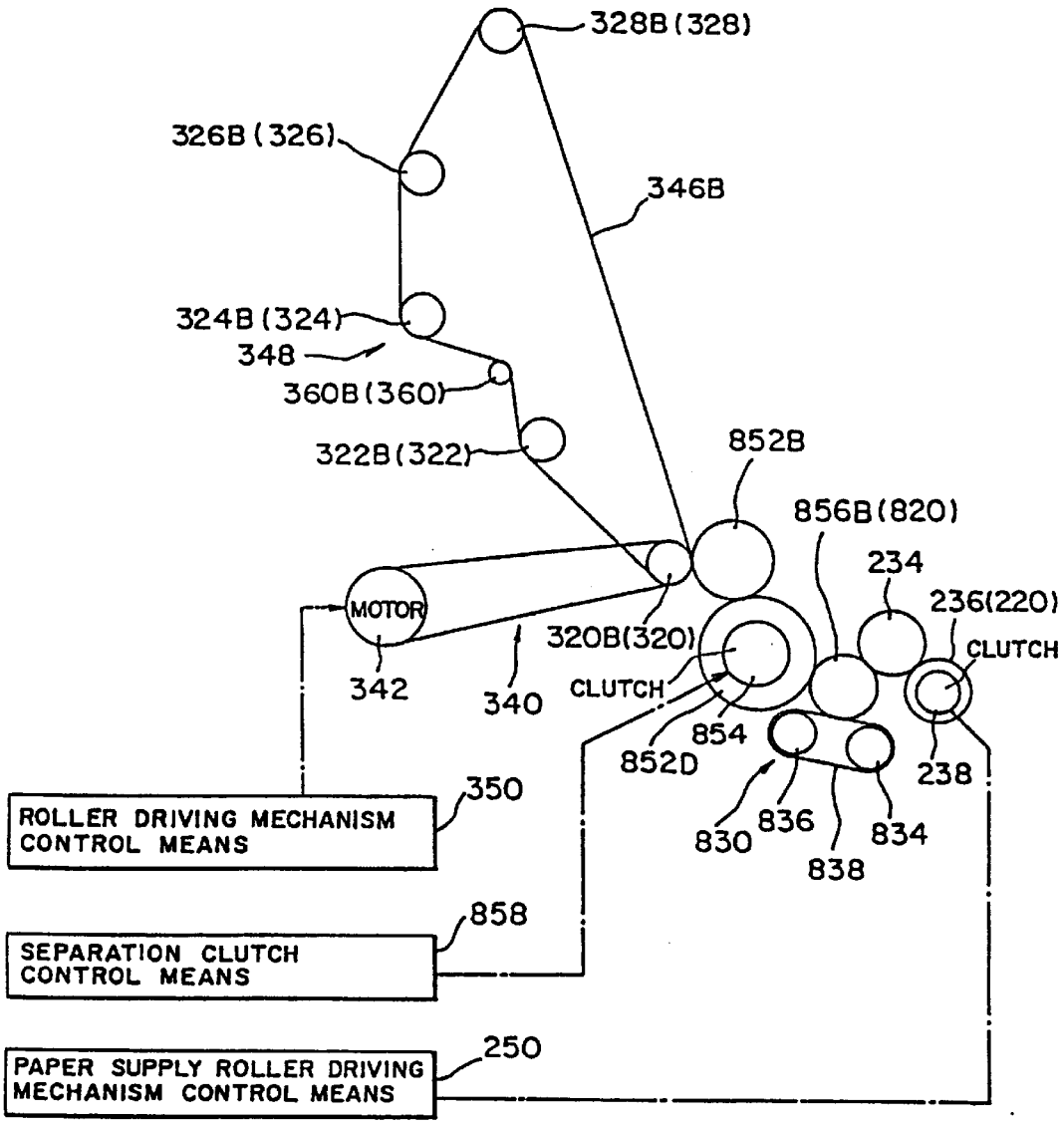
FIG. 9 is a diagrammatic view schematically showing, in side elevation, the driving system shown in FIG. 8.

Referring to FIGS. 7 and 9, the paper transport path 310 is defined by the plurality of paper transporting rollers 320 to 328 and the plurality of idler rollers 330 to 338, sheet guides 700, 710, 740 and 750 provided between adjacent ones of the paper transporting rollers 320 to 328 and between adjacent ones of the idler rollers 330 to 338, and so forth.

The rotary shafts 320A to 324A and 330A to 334A of the rollers 320, 322, 324 and 330, 332, 334 of the paper transport path 310 on the upstream side are disposed along a straight line as viewed from a side and from the inclined transport path 312. Meanwhile, the rotary shafts 324A to 328A and 334A to 338A of the rollers 324, 326, 328 and 334, 336, 338 of the paper transport path 310 on the downstream side are disposed along a curved line as viewed from the side and form the paper reversing transport path 314.

Figure 23:
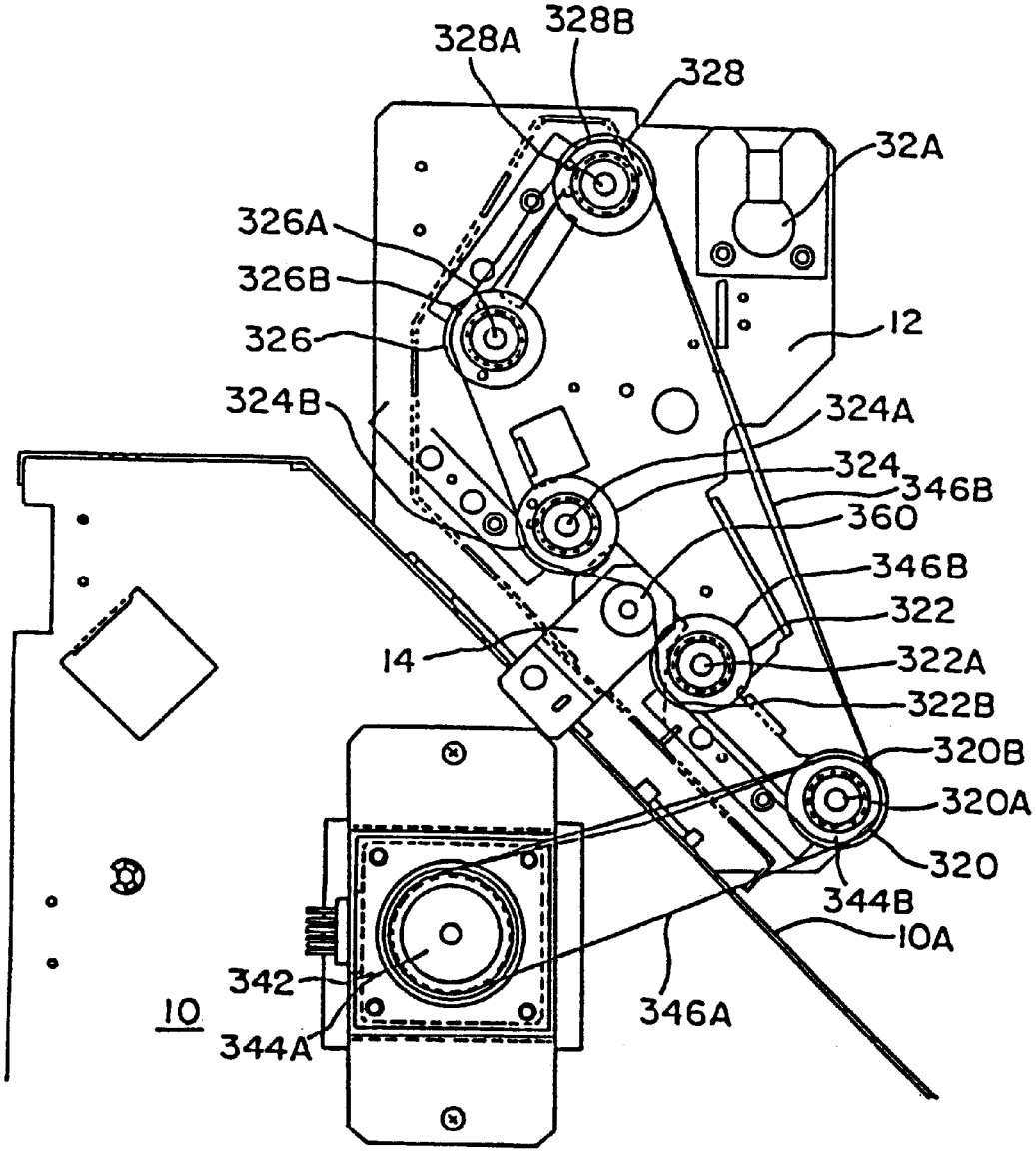
FIG. 23 is a side elevational view of an upper portion of an apparatus body showing the paper transport system of the image reading apparatus of FIG. 4.

The rotary shafts 320A to 328A of the paper transporting rollers 320 to 328, which are driven by the transport roller 342 to rotate to transport a paper sheet, are provided on the apparatus body 10 as seen in FIG. 23. In particular, an upper portion 10A of the apparatus body 10 is inclined toward the paper supply hopper 210 side or the paper stacker 510 side (rightwardly in FIG. 23), and a pair of bearing walls 12 are provided uprightly at upper left and right end portions of the body inclined portion 10A. The rotary shafts 320A to 328A of the rollers 320 to 328 are supported on the bearing walls 12.

The paper transporting rollers 320 to 328 are provided on the rotary shafts 320A to 328A described above, respectively. Each of the paper transporting rollers 320 to 328 is provided by a plural number in a suitably spaced relationship from each other on the respective rotary shaft.

Each of the paper transporting rollers 320 to 328 has fme particles of alumina, or some other suitable material, deposited on part of the surface, or the entire surface thereof, so that the surface of the roller may have a sufficiently high coefficient of friction.

Also, the tension pulley 360 is supported on a bearing member 14 provided projectingly on the apparatus body 10. A pine hole 32A for supporting the apparatus lid 20 for rotation is formed at an upper end portion of each of the bearing walls 12.

Figure 24:
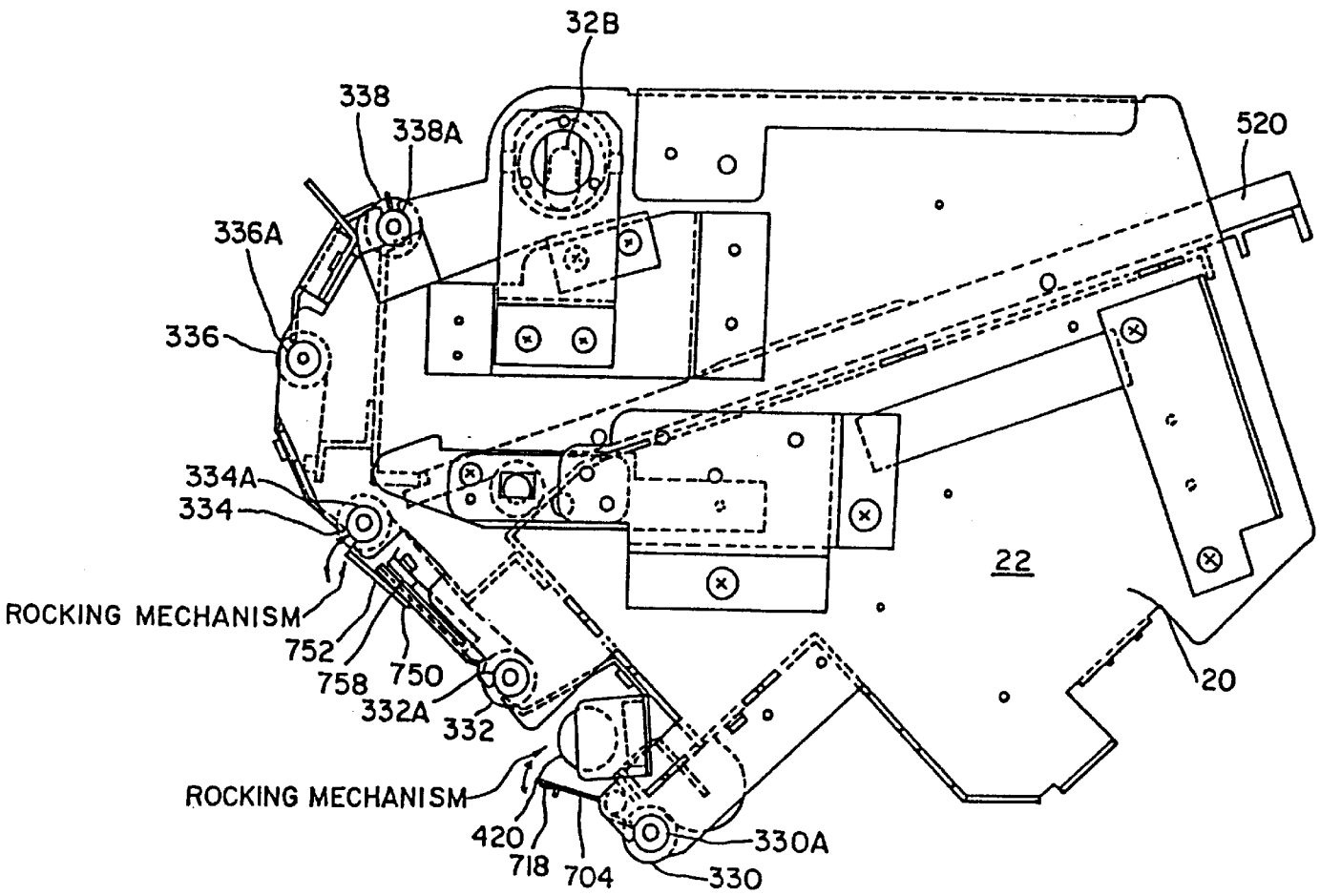
FIG. 24 is a side elevational view of an apparatus lid unit showing the paper transport system of the image reading apparatus of FIG. 4.

In contrast, the idler rollers 330 to 338 are provided on the apparatus lid 20 as seen in FIG. 24. In particular, a pair of walls 22 are provided uprightly at the left and right end portions of the apparatus lid 20, and the rotary shafts 330A to 338A of the idler rollers 330 to 338 are supported at end edges of the walls 22 adjacent the body inclined portion 10A.

Also the idler rollers 330 to 338 are provided on the rotary shafts 330A to 338A in an opposing relationship to the paper transporting rollers 320 to 328, respectively, and each of the idler rollers 330 to 338 is provided by a plural number in a suitably spaced relationship from each other on the respective rotary shaft.

Further, the rotary shafts 330A to 338A are supported by way of resilient members, such as leaf springs, so that the idler rollers 330 to 338 may be resiliently contacted with the corresponding paper transporting rollers 320 to 328, respectively.

Figure 25:
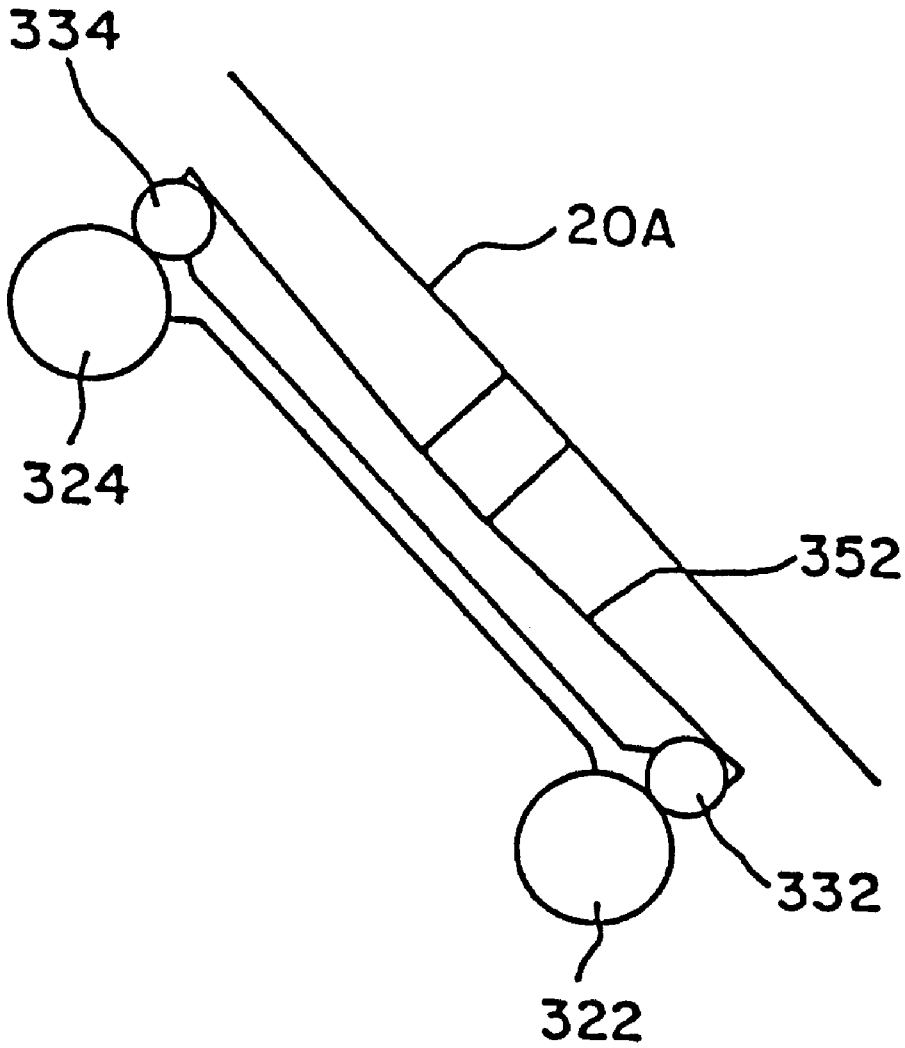
FIG. 25 is a schematic side elevational view showing a roller contacting structure in the paper transport system shown in FIG. 24.

For example, FIG. 25 is a schematic side elevational view showing the supported conditions of the idler rollers 332 and 334. Referring to FIG. 25, the idler rollers 332 and 334 are supported on a frame 20A of the apparatus lid 20 by way of a leaf spring 352 so that they may be resiliently contacted with the corresponding paper transporting rollers 322 and 324, respectively.

Since the body-lid locking mechanism 30 for holding the apparatus body 10 and the apparatus lid 20 in a closed condition can hold the closed condition at any of a plurality of stages, the biasing forces of the idler rollers 330 to 338 toward the paper transporting rollers 320 to 328 and the contacting condition between the sheet guides and the auxiliary sheet guides are adjusted by way of the body-lid locking mechanism 30.

A pin 32B is provided at an upper portion of each of the walls 22. The apparatus lid 20 is mounted on the apparatus body 10 with the pins 32B fitted for rotation in the pin holes 32A of the apparatus body 10.

B. Sheet Guide System

The sheet guides 700, 710, 740 and 750 are provided between adjacent ones of the paper transporting rollers 320 to 328 and between adjacent ones of the idler rollers 330 to 38 arranged along the paper transport path 310 and define the paper transport path 310. Within the range of the inclined transport path 312 which extends substantially linearly, the sheet guides 700, 710, 740 and 750 are located below the inclined transport path 312 in the vertical direction, but within the paper reversing transport path 314 which extends a long a curve, the sheet guides 700, 710, 740 and 750 are provided at least on the outside of the curved portion of the paper reversing transport path 314. Naturally, sheet guides (which will be referred to as auxiliary sheet guides) are provided at required locations above the inclined transport path 312 in the vertical direction and on the inner side of the curved portion of the paper reversing transport path 314.

Figure 26A:
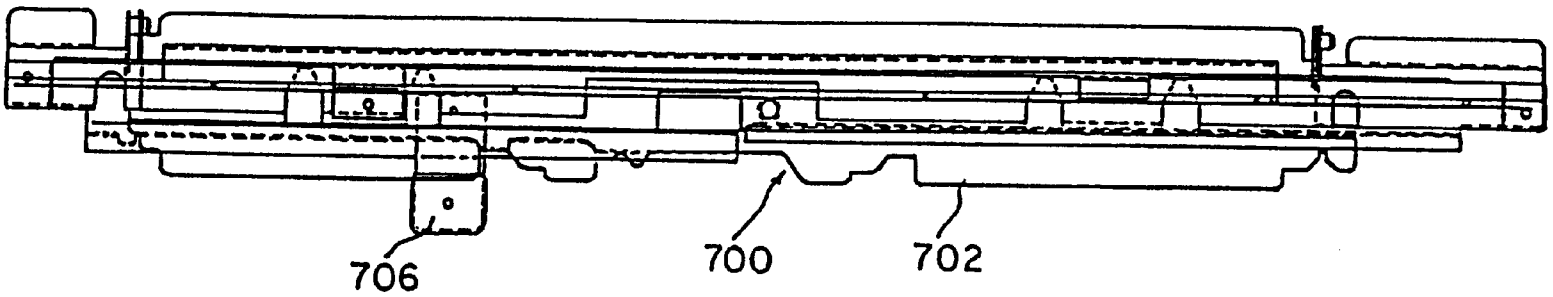
FIGS. 26(A), and 26(B) are a plan view and a side elevational view, respectively, showing a sheet guide system of the paper transport system of the image reading apparatus of FIG. 4.
Figure 26B:
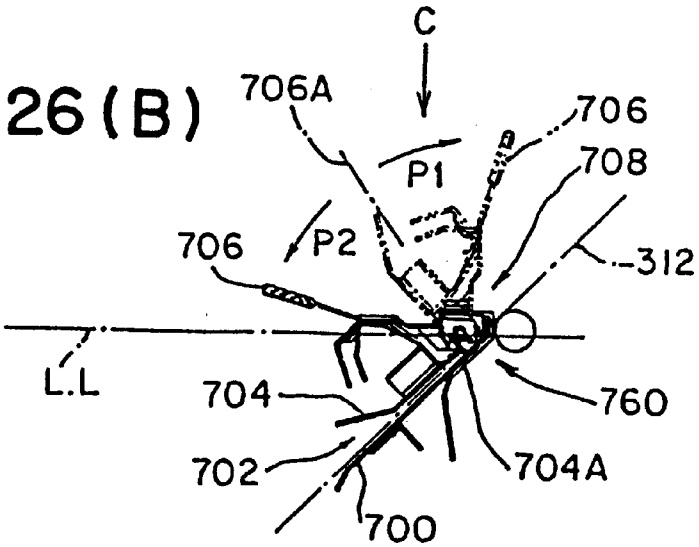

For example, such a sheet guide 700 as shown in FIG. 4 is provided in the proximity of an exit of the separation roller 820. The sheet guide 700 is secured to the apparatus body 10 such that it is inclined in conformity with the inclined transport path 312 as shown in FIG. 26(B). Here, the sheet guide 700 is constructed as a sheet guide apparatus 702 which includes an integral auxiliary sheet guide 704 mounted for pivotal motion around a shaft 704A to open or close the sheet guide 700. It is to be noted that L.L in FIG. 26(B) denotes a horizontal line.

The sheet guide 700 and the auxiliary sheet guide 704 are opposed in parallel to each other with guide faces thereof located adjacent each other. However, end portions (left lower ends in FIG. 26(B)) of the sheet guide 700 and the auxiliary sheet guide 704 adjacent the separation roller 820 are bent outwardly from the paper transport path 310 such that they are spaced away from each other to form an opening therebetween so that a paper sheet from the separation roller 820 may be introduced with certainty between the sheet guide 700 and the auxiliary sheet guide 704.

The auxiliary sheet guide 704 is mounted for movement on the shaft 704A such that is resiliently fixed, during use, at such a closed position in the proximity of the sheet guide 700, as indicated by a solid line in FIG. 26(B), but when not in use, it can be pivoted to its open position spaced away from the sheet guide 700, as indicated by a chain line in FIG. 26(B). In particular, the auxiliary sheet guide 704 includes sheet guide moving away means 760 by which the auxiliary sheet guide 704 can be pivoted from the closed position to the open position so that it is spaced away from the opposing sheet guide 700.

The sheet guide moving away means 760 includes a pair of levers 706 provided integrally at the opposite end portions of the auxiliary sheet guide 704, and a spring mechanism 708 for resiliently fixing the auxiliary sheet guide 704 at the closed position. The spring mechanism 708 is formed as such an over-center or toggle spring that, when the levers 706 shown in FIG. 26(B) are moved a little toward the closed position with respect to an intermediate position or dead center 706A thereof, the spring mechanism 708 exerts a biasing force toward the closed position, but when the levers 706 are moved a little toward the open position with respect to the intermediate location 706A, the spring mechanism 708 exerts a biasing force toward the open position.

Accordingly, the auxiliary sheet guide 704 at the closed position is moved to its open position by moving the lever 706 in the direction indicated by an arrow mark P1 in FIG. 26(B) until they exceed the intermediate position 706A. On the contrary, by moving the levers 706 in the opposite direction indicated by another arrow mark P2 in FIG. 26(B) until they exceed the intermediate position 706A, the auxiliary sheet guide 704 is moved to the closed position and thereafter held at the closed position by the biasing force of the spring mechanism 708.

For example, when paper jamming occurs, the auxiliary sheet guide 704 can be opened in this manner and the paper can be removed readily.

Such sheet guides, as described above, are located between adjacent ones of the rollers on the paper transport path 310. However, the sheet guides 710 and 740 which are located at the reading points 422 of the optical image reading unit 410 act not only to guide a paper sheet to also to provide a color reference (generally a white reference) for a paper sheet 40 to be read by the optical image reading unit 410.

For example, the sheet guide 710 provided at the reading point 422 of the first optical image reading unit 412 is provided on the opposite side to the first optical image reading unit 412 with respect to the inclined transport path 312 and opposed to the first optical image reading unit 412 as shown in FIGS. 4, 7 and 12. The sheet guide 710 has, at a position opposed to, but remote from, the reading point 422, a stepped portion 716 by which a backing portion 712 which provides a color reference to a paper sheet 40 is offset with respect to a paper guiding portion 714 for guiding the paper sheet 40.

The reason why the packing portion 712 is offset in this manner is that it is intended to prevent possible soiling to the backing portion 712. In particular, if the backing portion 712 otherwise guides a paper sheet like the paper guiding portion 714, then paper powder of the paper sheet or ink printed on the paper sheet sometimes sticks to soil the backing portion 712, and soiling of such paper powder or ink to the backing portion 712, which provides a color reference for a paper sheet 40, results in variation or degradation of the color reference. Thus, in order to eliminate such a possible trouble, the backing portion 712 is offset so that it may not contact directly with a paper sheet.

Figure 32A:
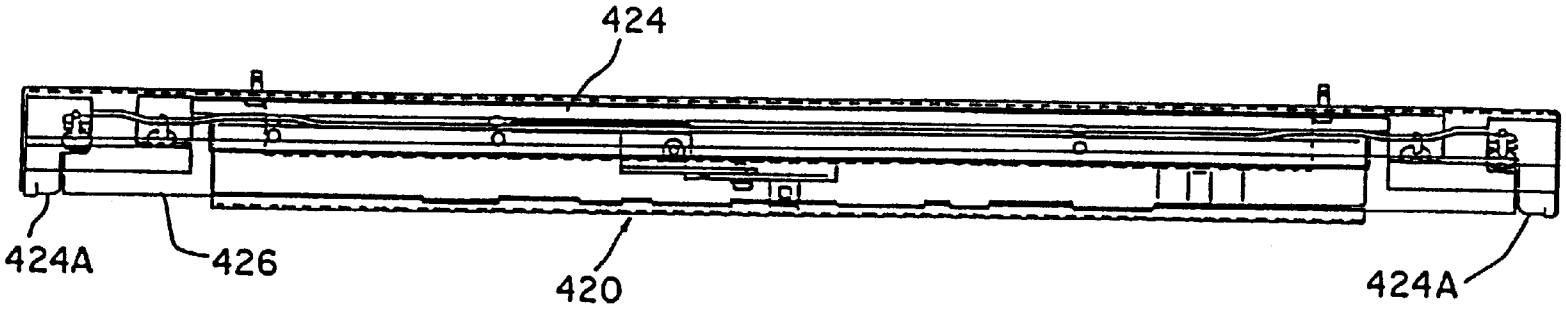
FIGS. 32(A) and 32(B) are a plan view and a front elevational view, respectively, showing a fluorescent lamp unit of the optical image reading mechanism of the image reading apparatus of FIG. 4.
Figure 32B:
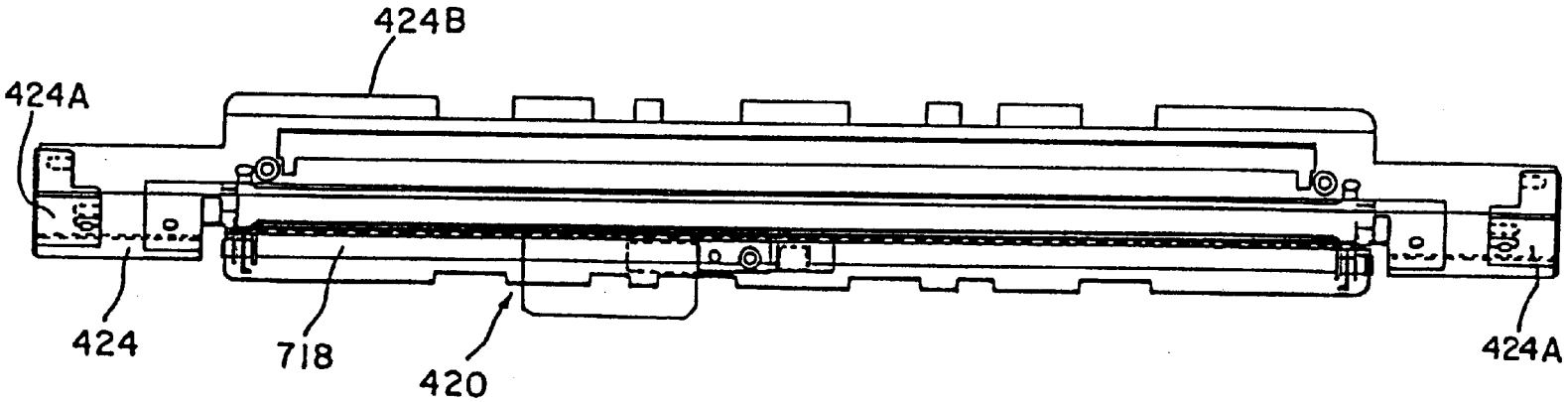

The sheet guide 710 is resiliently pressed toward the first optical image reading unit 412 while it is contacted with a contacting member 718 (FIG. 32(B)) on the first optical image reading unit 412 so that it is controlled to a predetermined position. By the sheet guide 710 controlled to its appropriate position in this manner, a paper sheet 40 is guided so that it may pass an appropriate position conforming to a local length of the first optical image reading unit 412. It is to be noted here that the contacting member 718 is provided, as shown in FIG. 32(B), on the fluorescent lamp unit 420 of the first optical image reading unit 412, which will be hereinafter described.

Meanwhile, for example, the sheet guide 740 provided at the reading point 422 of the second optical image reading unit 414 is constructed, as shown in FIGS. 4 and 7, as a sheet guide with an opening provided on the same side as the first optical image reading unit 412 with respect to the inclined transport path 312 and opposed to the second optical image reading unit 414, and has an opening 742 at a location thereof opposing to the reading point 422. A backing member 752 for providing a color reference to a paper sheet 40 is provided in an opposing relationship to the opening 742 at a position corresponding to the reading point 422 on the opposite side to the first optical image reading unit 412 with respect to the inclined transport path 312.

In particular, since the second optical image reading unit 414 is provided below the inclined transport path 312 in the vertical direction, the sheet guide 740 is naturally positioned between the second optical image reading unit 414 and the inclined transport path 312. Accordingly, the sheet guide 740 makes an obstacle to reading of information of the rear face 44 of a paper sheet by the second optical image reading unit 414. Therefore, the sheet guide 740 is formed as a sheet guide with an opening wherein it is removed to open at the portion thereof which makes the obstacle so that it can read information of the rear face 44 of a paper sheet through the opening 742.

The sheet guide 740 is constructed, for example, in such a manner as shown in FIGS. 27(A) to 27(C). Referring to FIGS. 27(A) and 27(C), a glass plate 742A is mounted in the opening 742 of the sheet guide 740 so that it may guide a paper sheet being transmitted while information on the rear face of the paper sheet is read through the glass plate 742A. The sheet guide 740 is positioned in register with the reading point 422 of the second optical image reading unit 414 with the opposite ends thereof attached to the apparatus body 10. The sheet guide 740 can be mounted onto, and removed from, the apparatus body 10 by operation of a pair of lever portions 740A provided at the opposite end portions of the sheet guide 740.

In the meantime, the backing member 752 for providing a color reference to a paper sheet must be provided on the opposite side of the second optical image reading unit 414 with respect to the inclined transport path 312. Here, the backing member 752 is constructed as a portion (accordingly as a backing portion) of the sheet guide 750 opposed to the sheet guide 740.

Figure 28:
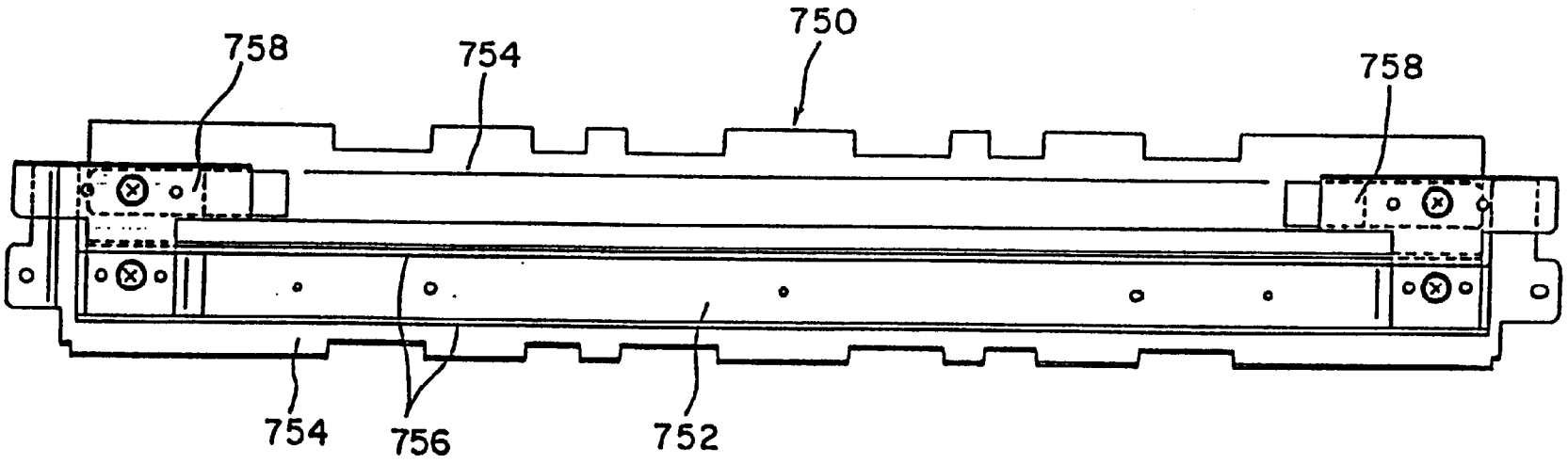
FIG. 28 is a plan view showing the sheet guide system of the paper transport system of FIG. 4.

The sheet guide 750 is constructed, for example, in such a manner as shown in FIG. 28 and is mounted on the apparatus lid 20 such that, as shown in FIG. 24, a downstream side portion (left upper portion in FIG. 24) thereof can be pivoted in a direction toward and away from the inclined transport path 312 around an upstream side portion (right lower portion in FIG. 24) thereof in the paper transporting direction which is secured to the apparatus lid 20. The backing member 752 is offset, similarly to the backing portion 712 of the sheet guide 710, by forming a step 756 on a paper guiding portion 754 for guiding a paper sheet.

A pair of contacting elements 758, each formed from a leaf spring, are provided at the opposite ends of an auxiliary sheet guide 746 and resiliently contact with a pair of contacting faces 740B at the opposite ends of the sheet guide 740 (refer to FIGS. 27(A) to 27(C)) to restrict rocking motion of the downstream side portion of the sheet guide 750 in the paper transporting direction. Consequently, the sheet guide 750 is fixed to an appropriate position with respect to the inclined transport path 312 by a resilient biasing force.

It is to be noted that, while the biasing force for contacting each of the sheet guides and an associated auxiliary sheet guide with each other is set to such a low level as will not provide transportation resistance to a paper sheet being transported, it can be adjusted in a similar manner to the biasing forces between the rollers 330 to 338 and the rollers 320 to 328 by adjusting the closed condition between the apparatus body 10 and the apparatus lid 20 by way of the body-lid locking mechanism 30 described hereinabove.

C. Paper Discharge Roller Mechanism

Figure 29:
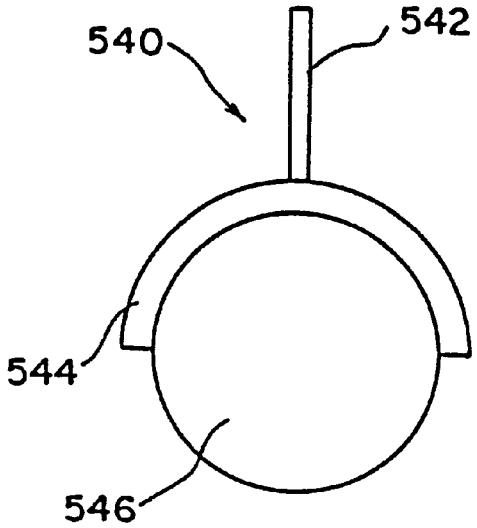
FIG. 29 is schematic side elevational view showing a paper discharge roller mechanism in the paper transport system of FIG. 4.

The paper discharge roller mechanism 540 is provided at a trailing end portion of the paper transport mechanism 300, as described hereinabove, and includes, as shown in FIG. 29, a paper discharge roller 544 mounted on a rotary shaft 546 which receives, and is rotated by, a driving force. Here, the rotary shaft 328A of the paper transport roller 328 serves also as the rotary shaft 546 of the paper discharge roller 544, and driving of the paper discharge roller 544 is performed together with driving of the paper transport roller 328 by the roller driving mechanism 340.

The paper discharge roller 544 is provided between each adjacent ones of a plurality of paper transport rollers 328 disposed in a suitably spaced relationship from each other on the rotary shaft 328A.

The paper discharge roller 544 has an outwardly projecting projection 542 which is in the form of a tab extending outwardly from an outer periphery of the paper discharge roller 544 and formed from such a resilient flexible material as to allow the projection 542 to be yieldably deformed when it is contact by he opposing idler roller 338.

Figure 30:
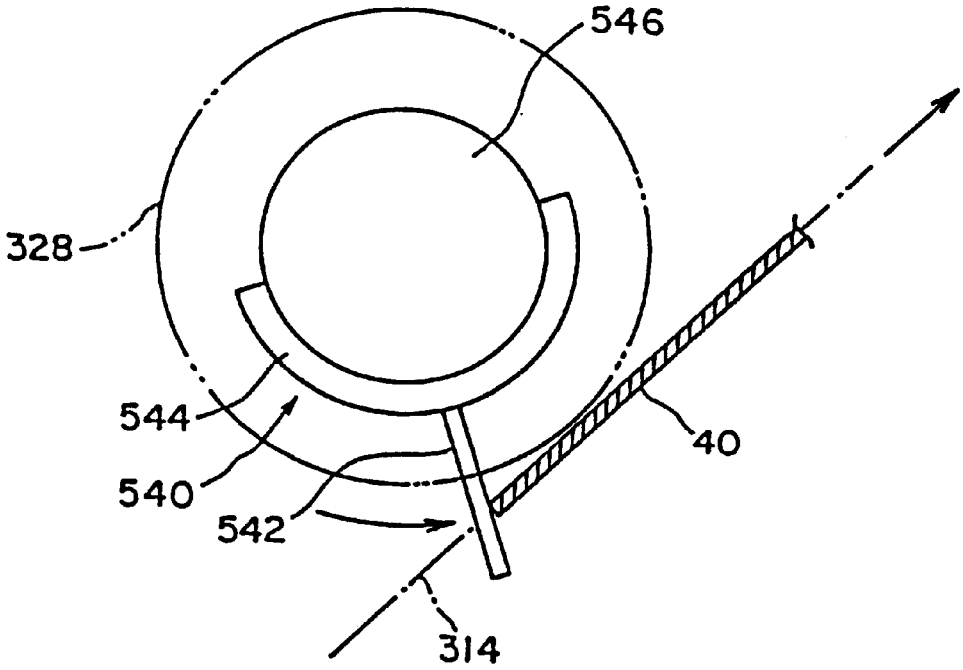
FIG. 30 is a schematic side elevational view illustrating a movement of the paper discharge roller mechanism shown in FIG. 29.

As shown in FIG. 30, when it projects toward the paper reversing transport path 314 of the paper transport path 310, it pushes up the trailing end of a paper sheet 40 being transported along the paper reversing transport path 314 to guide the paper sheet 40 being discharged to the paper stacking mechanism 500.

2-3. Image Reading Mechanism

Figure 31:
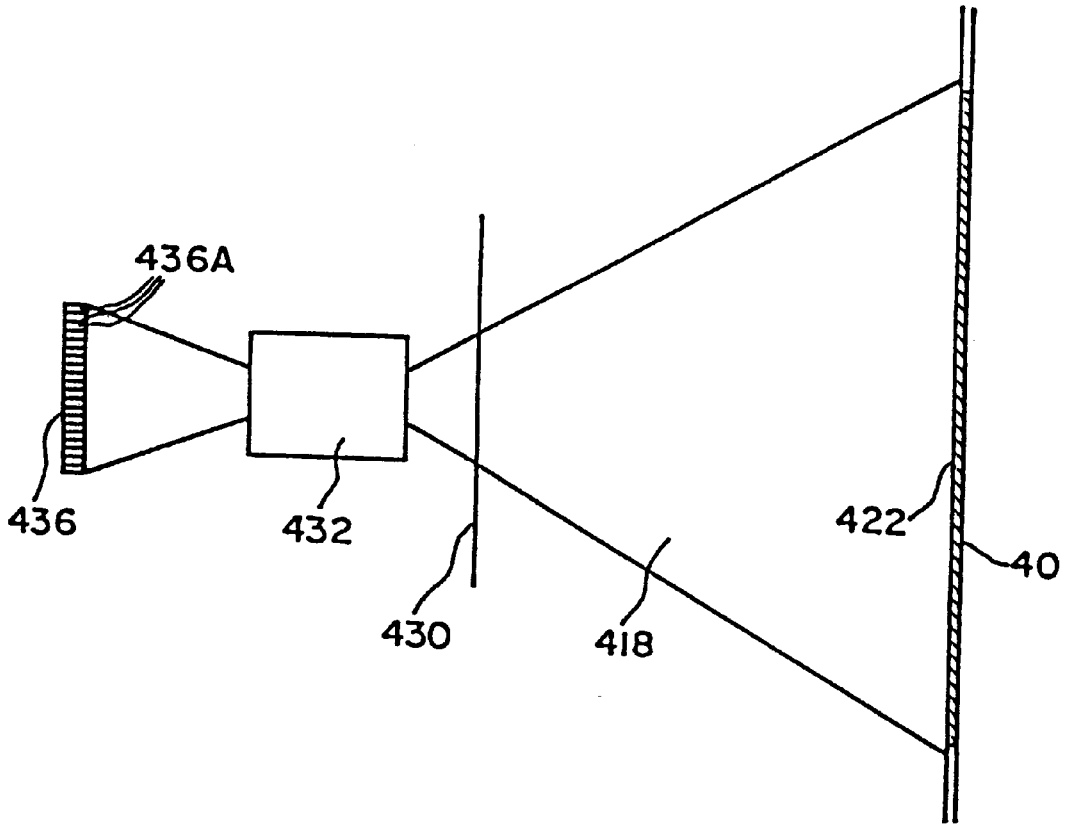
FIG. 31 is a diagrammatic view schematically showing the construction of an optical image reading mechanism of the image reading apparatus of FIG. 4.

The light path 418 from the reading point 422 to the CCD circuit board 336 in the optical image reading unit 410 is schematically shown in FIG. 31 in such a manner that expansion of the light path 418 in the widthwise direction of the paper sheet may be seen omitting the reflections by the mirrors 418, 418B and 418C and representing the light path 418 generally as a straight line. Referring to FIG. 31, pieces of image information arranged in the widthwise direction of a paper sheet 40 are collected by the lens 432 and come to the CCD circuit board 436. The CCD circuit board 436 is constituted from a plurality of CCD cameras 436A arranged in a juxtaposed relationship to each other so as to catch the pieces of information arranged in the widthwise direction.

The shading plate 430 located forwardly of the lens 432 corrects the image information since the image information is distorted by a greater amount toward the opposite left and right ends 40A and 40B of the paper sheet 40.

The CCD cameras 436A are located in a black box 434 and are controlled by respective CCD drivers to put video gate thereof (not shown) into an on-state to detect information. The CCD cameras 436A stop detection of image information by putting the video gate into an off-state. The thus detected image information is sent to and processed by a video circuit (not shown) provided on the video circuit board 438. It is to be noted that the on/off control of the video gate is performed in response to detection of passage of a paper sheet by the transport sensor 616 which detects a reading timing.

Image information obtained by the optical image reading unit 412 and 414 in this manner is extracting under the control of the image information extraction control means 440 as seen from FIG. 7. In this instance, the image information extract control means 440 performs extraction control of image information in response to detection by paper end detection means 450. In particular, the paper end detection means 450 detects a leading end 46 from an amount of variation of the output of the optical image reading unit 410 and is provided in the image information extraction control means 440. Extraction of image information is performed when the leading end 46 of a paper sheet 40 advances into the optical image reading unit 410.

Further, in the image reading apparatus of the present embodiment, since the two optical image reading units 412 and 414 are provided near to each other, image reading may possibly be performed simultaneously by the two optical image reading units 412 and 414. Therefore, the image information extract control means 440 controls so that information from the second optical image reading unit 414 which reads information of the rear face of a paper sheets is stored once into a buffer storage apparatus of a reading board 984 (refer to FIG. 37) and is then recalled from the buffer storage apparatus after information of the front face of the paper sheet from the first optical image reading unit 412 is sent out.

The image information extraction control means 440 is further constructed such that extraction control of image information obtained by the first optical image reading unit 412 and the second optical image reading unit 414 is performed in response to a result of selection by an original selection switch 924L serving as paper reading selection means which will be hereinafter described and a discrimination mark 50 applied to a paper sheet 40.

Figure 13:
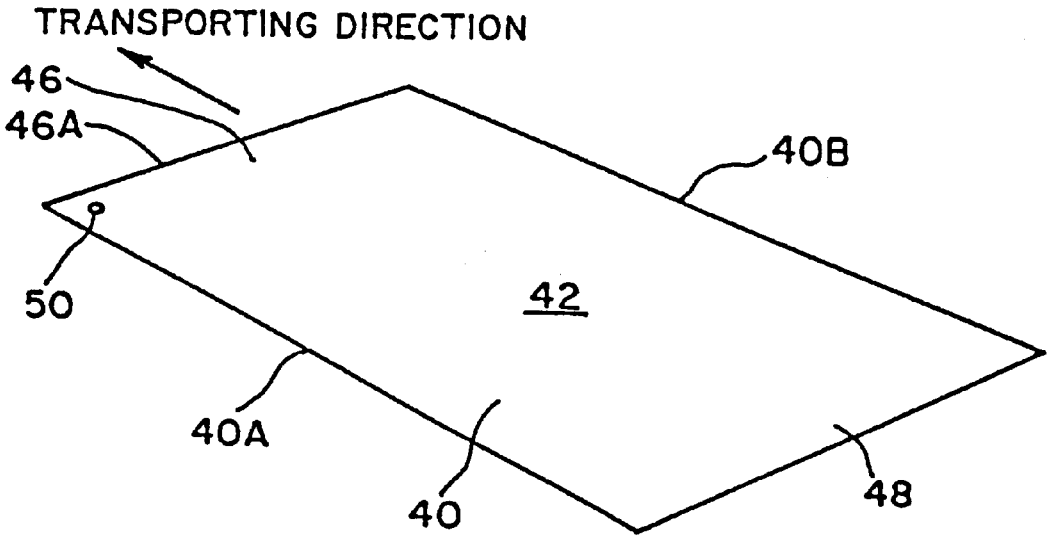
FIG. 13 is a schematic perspective view of a paper sheet employed in the image reading apparatus of FIG. 4.

In particular, it can be selected by the original selection switch 924L whether both-face reading should be performed or one-face reading should be performed, and the image information extraction control means 440 performs reading control in response to a result of the selection by the original selection switch 924L. However, paper sheets which require both-face reading and paper sheets which allow one-face reading may possibly be present in a mixed condition. In this instance, when paper sheets should be read in a different manner from other paper sheets in which the paper sheets are mixed, a discrimination mark 50 is applied to each of the paper sheets so that they may be read in a different manner. The discrimination mark 50 is provided for designation of whether the paper sheet should be read by one-face reading or by both-face reading, and is applied to a location outside an original reading area such as, for example, a corner of the leading end of the paper sheet 40 as shown in FIG. 13 so that it may be distinguished from image information in the original reading area which should originally be read.

Therefore, for example, when one-face reading originals are mixed in both-face reading originals, if a discrimination mark 50 which designates one-face reading is applied to each of the one-face reading originals the quantity of which is smaller than that of the both-face reading originals and it is selectively set by way of the original selection switch 924L that both faces of each paper sheet 40 should usually be read, then image information on both faces of a paper sheet 40 is normally read by both of the first optical image reading unit 412 and the second optical image reading unit 414. However, when a discrimination mark 50 is detected image information only on the front face or the rear face of the paper sheet 40 is read by the first optical image reading unit 412 or the second optical image reading unit 414.

Alternatively, when both-face reading originals are mixed with one-face reading originals, if a discrimination mark 50 which designates double face reading is applied to each of the double face reading originals the quantity of which is smaller than that of the one-face reading originals and it is selectively set by way of the original selection switch 924L that one face of each paper sheet 40 should usually be read, then image information only on the front face or the rear face of paper sheet 40 is normally read by the first optical image reading unit 412 or the second optical image reading unit 414.

The image information extraction control means 440 further includes discrimination mark image erasure means 460 so that the image of such discrimination mark 50 applied to a paper sheet 40 may be erased and only image information to be read originally may be outputted.

By the way, the apparatus body 10 or the apparatus lid 20 assures an upper mounting space (space for the front face reading unit) 26 and a lower mounting space (space for the rear face reading unit) 16 having substantially similar sizes and shapes to each other to allow the optical image reading units 412 and 414 to be mounted in them, respectively (refer to FIG. 4). In the meantime, the optical image reading unit 410 is prepared by a plural number having different specifications having different performances but having substantially common sizes and profiles.

While, in the image reading apparatus of the present embodiment, the first optical image reading unit 412 and the second optical image reading unit 414 are constructed with common specifications, it is easy to construct the first optical image reading unit 412 and the second optical image reading unit 414 so as to have different specifications such that, for example, the optical image reading unit for front face reading of the construction described above has higher performances than the optical image reading unit for rear face reading of the construction described above.

Further, each of the optical image reading units 410 includes detection means (front/rear face detection means) 630 which can detect that it is installed as a unit for front face reading when it is installed in the upper mounting space 26 but detect that it is installed as a unit for rear face reading when it is installed in the lower mounting space 16.

Information detected by the detection means 630 is sent to the image information extraction control means 440 and used for extraction control of image information.

It is to be noted that the detection means 630 may be constructed in the following manner. For example, a front surface detection projection (not shown) is provided only in the upper mounting space 26 while a rear face detection projection (not shown) is provided only in the lower mounting space 16, and a front face detection switch (not shown) which is automatically contacted, when it is installed in the upper mounting space 26, by the front face detection projection to switch to an on-state and a rear face detection switch (not shown) which is automatically contacted, when it is installed in the lower mounting space 16, by the rear face detection projection to switch to an on-state are provided on each of the optical image reading units 410.

By the way, in each of the optical image reading units 410, the fluorescent lamp unit 420 is provided in order to make the reading point 422 light. The fluorescent lamp unit 420 is constructed, for example, as shown in FIGS. 32 and 33.

In particular, the fluorescent lamp unit 420 includes a mounting base 424 and a fluorescent lamp 426 mounted on the mounting base 424. As shown in FIG. 32, a pair of sockets 424A are provided proJectingly at the opposite ends of the mounting base 424, and the mounting base 424 is mounted on, and between, the sockets 424A. The mounting base 424 itself is mounted in an inclined relationship to the inclined transport path 312, as seen in FIG. 33, to assure the light path 418 to the CCD cameras 436A.

Figure 33:
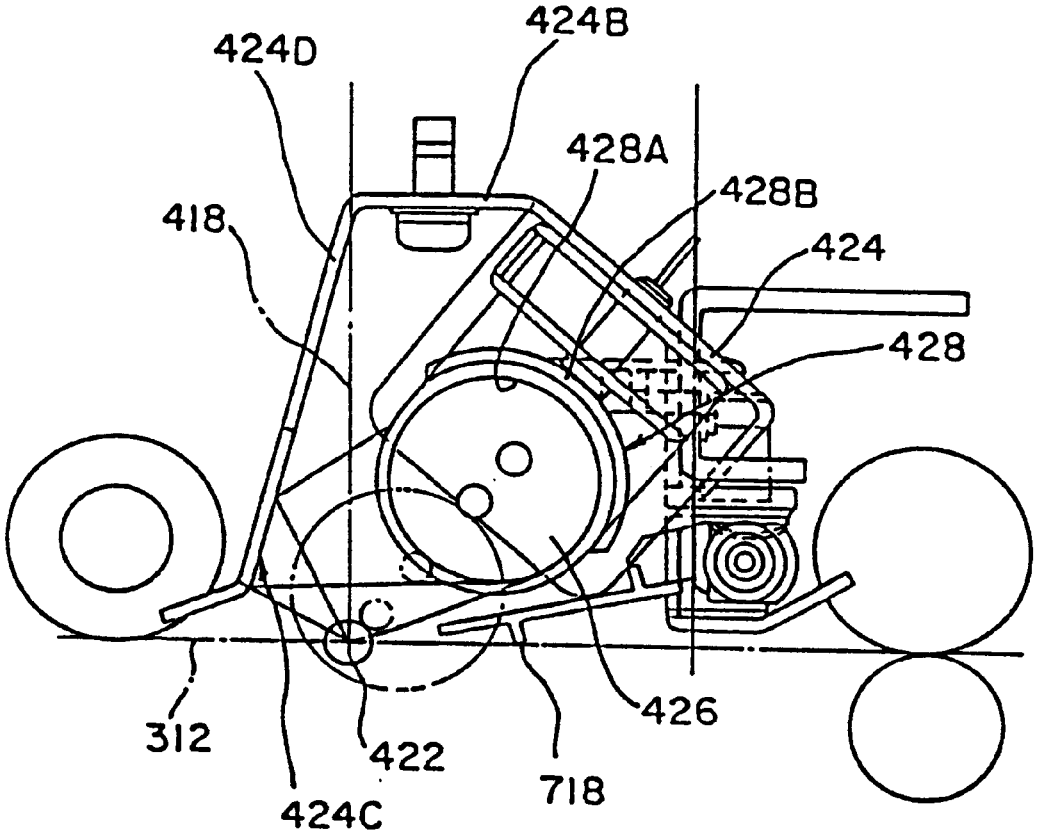
FIG. 33 is a side elevational view showing the fluorescent lamp unit shown in FIGS. 32(A) and 32(B)

A heater 428 is provided along the rear face of fluorescent the fluorescent lamp 426 and covers over the lamp 426 as seen in FIG. 33. The inner face of the heater 428 adjacent the fluorescent lamp 426 is formed as a reflection plate 428A which converges light of the fluorescent lamp 426 to the reading point 422, and a heat generation element 428B is provided on the rear face side of the heater 428. Generally, since the fluorescent lamp 426 does not emit much light at a low temperature, it cannot illuminate the reading point 422 sufficiently until the fluorescent lamp 426 becomes warm after it is started. However, with the present fluorescent lamp unit 420, since the fluorescent lamp 426 is warmed up by the heat generation element 428B, after it is started, the fluorescent lamp 426 becomes warm rapidly and can illuminate the reading point 422 with a sufficient amount of light.

A lamp house 424B is provided on the mounting base 424 adjacent the light path 418 such that it covers over the fluorescent lamp 426, and the inner face of the lamp house 424B is formed as a reflection plate 424C which converges light of the fluorescent lamp 426 to the reading point 422. Naturally, the lamp house 424B has a slit 424D formed therein so that it does not intercept the light path 418.

Further, the contacting member 718 mentioned hereinabove is mounted and resiliently supported on the mounting base 424 adjacent the inclined transport path 312 such that it may be rocked toward the inclined transport path 312. The contacting member 718 restricts the sheet guide 710 to a predetermined position as described hereinabove, and a face of the contacting member 718 adjacent the fluorescent lamp 426 functions also as a reflection plate which reflects light of the fluorescent lamp 426 so that the light may not be projected other than to the reading point 422.

2-4. Stacking Mechanism

Figure 34:
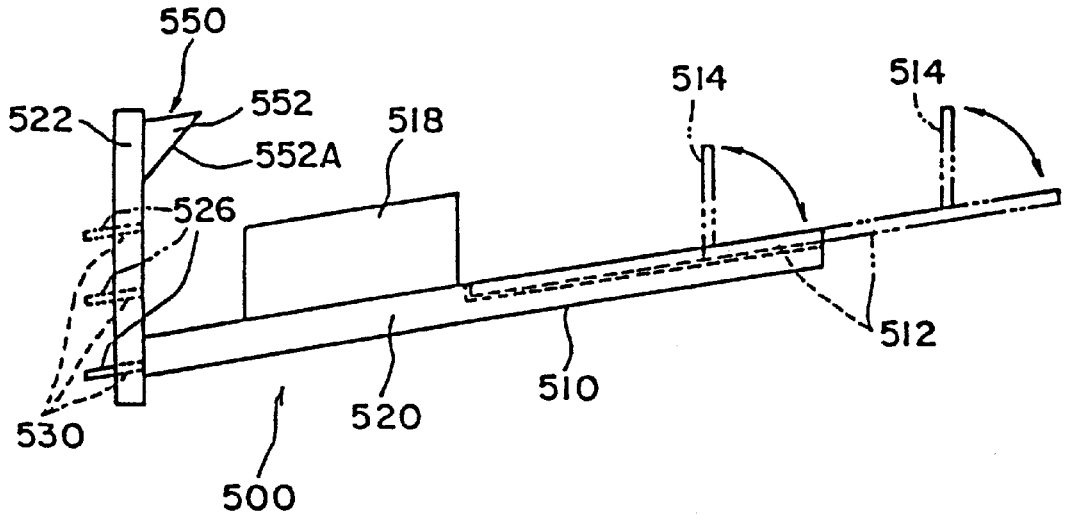
FIG. 34 is a schematic side elevational view showing a stacker mechanism of the image reading apparatus of FIG. 4.
Figure 35:
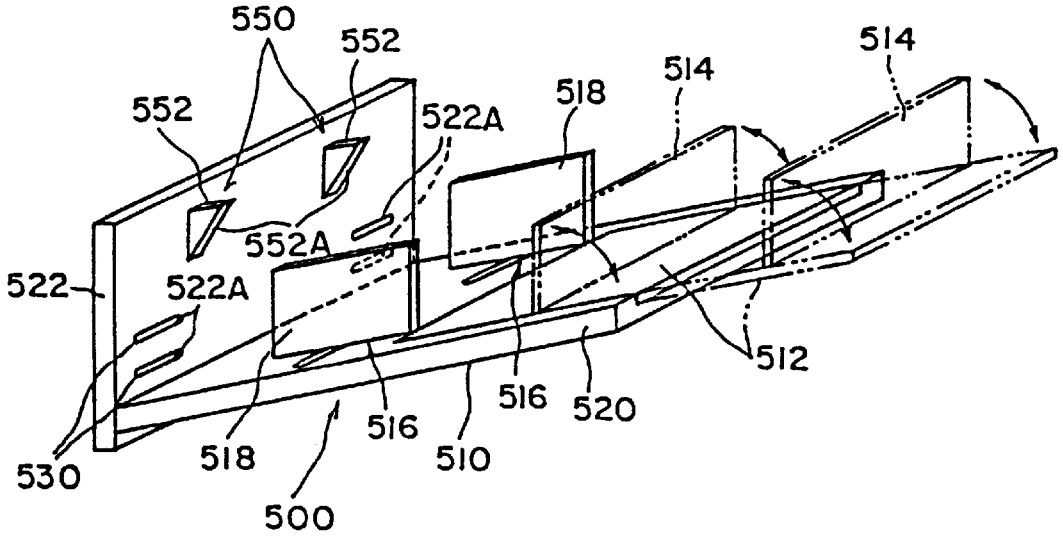
FIG. 35 is a schematic perspective view showing the stacker mechanism shown in FIG. 34.

Referring now to FIGS. 34 and 35, the paper stacker 510 of the paper stacking mechanism 500 includes a stacker table 520 at the bottom thereof and further includes an end frame 522 at an interior end thereof from which a paper sheet 40 is discharged. A pair of paper trailing end guide members 552, which constitute a paper trailing end guide mechanism 550, are provided projectingly at upper portions of the end frame 522.

The paper trailing end guide members 552 guide, at guide faces 552A thereof, the trailing end 48 of a paper sheet 40 to be stacked into the paper stacker 510 so that paper sheets 40 may be stacked in a predetermined posture on the stacker table 520.

A paper stacker position variation mechanism 530 is provided on the stacker table 520 so that the vertical position of the stacker table 520 may be adjusted. Here, while the stacker table 520 is mounted on the end frame 522, the paper stacker position variation mechanism 530 is constructed so that the vertical position of the stacker table 520 may be adjusted by removing and mounting the stacker table 520 from, and onto, the end frame 522.

In particular, pairs of left and right fitting projections 526 are formed at a front end (paper discharging side end) of the stacker table 520 while pairs of left and right insertion holes 522A are formed in the end frame 522 corresponding to the fitting projections 526. Then, the stacker table 520 is mounted onto the end frame 522 by inserting the fitting projections 526 into the insertion holes 522A, but the stacker table 520 is removed from the end frame 522 by pulling off the fitting projections 526 from the insertion holes 522A.

The paper stacker position variation mechanism 530 is constituted from such mounting structure of the stacker table 520 and the structure including the plurality of (three in the arrangement shown) left and right pairs of insertion holes 522A. In particular, the vertical position of the stacker table 520 can be adjusted by selectively inserting the fitting projections 526 into the insertion holes 522A provided at the different heights.

The stacker table 520 further includes a slide element 512 provided thereon for sliding movement in the paper discharging direction, and a paper stopper 514 is mounted for up and down pivotal motion on the slide element 512.

The paper stopper 514 is located at a paper discharging side end portion of the stacker table 520 and prevents, when it is at an uprightly pivoted position as indicated by chain lines in FIG. 35, the stacked paper sheets 40 from moving in the discharging direction. When such prevention of movement of the paper sheets is not required, the paper stopper 514 will be pivoted down so that the stacker table 520 can be used wide.

Further, if the paper sheets have a great length in the discharging direction, then the slide element 512 will be drawn out, as indicated by chain lines in FIG. 35, so that the stacker table 520 may present a greater area. Also in this instance, if the paper stopper 514 is pivoted to the upright position, movement of the paper sheets is prevented by the paper stopper 514, but when it is not particularly necessary to prevent movement of the paper sheets, the paper stopper 514 will be pivoted down to its horizontal position so that the stacker table 520 may be used with a wider area.

The stacker table 520 further has a pair left and right slide elements 516 mounted thereon for sliding movement in the paper width direction, and a paper stopper 518 is mounted for up and down pivotal motion on each of the slide elements 516. Thus, by moving the slide elements 516 to adjust the paper stoppers 518 to the width of a paper sheet 40, also the position in the widthwise direction of a discharged paper sheet is controlled appropriately. Naturally, if the width of the paper sheet 40 is so large that movement of the slide elements 516 to maximum limit positions does not allow accommodation of the paper sheet 40 between the left and right paper stoppers 518, the paper stoppers 518 will be pivoted down so that the maximum width of the stacker table 520 may be utilized. In this instance, wall faces 24 (refer to FIG. 5) of the apparatus lid which are provided uprightly on the opposite sides of the stacker table 520 control the position of a paper sheet in the widthwise direction in place of the left and right paper stoppers 518.

2-5. Control System

A. Operation Panel

Figure 36:
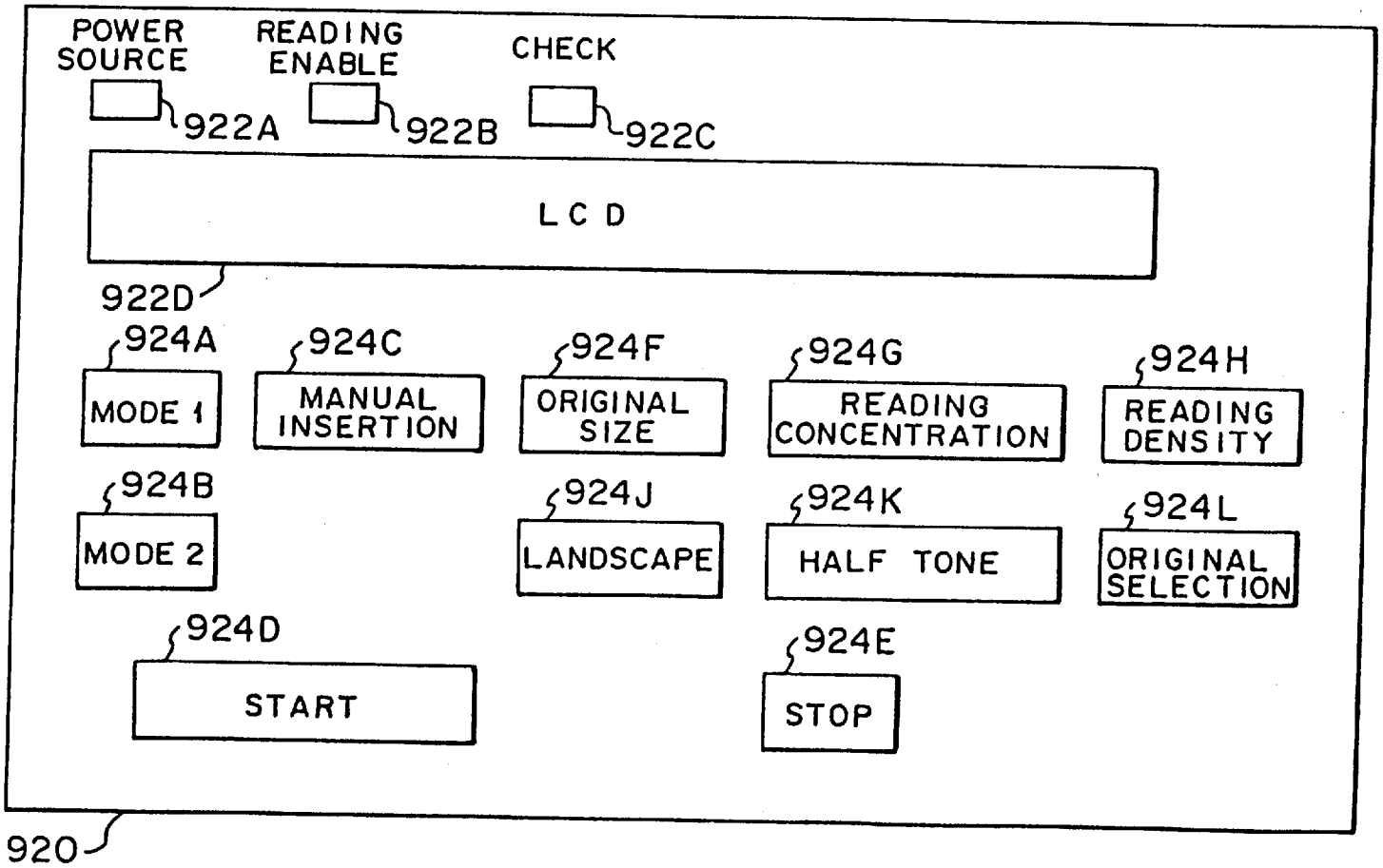
FIG. 36 is a front elevational view showing an operation panel of the image reading apparatus of FIG. 4.

Referring now to FIG. 36, the operation panel 920 has provided thereon various indication lamps including a power source input indication lamp 922A, a reading enable indication lamp 922B and a check lamp 922C, and a liquid crystal display unit 922D for displaying various information by characters. The liquid crystal display unit 922D suitably displays, for example, information of an operation input, an error message, and so forth.

The operation panel 920 further has provided thereon a plurality of automatic reading mode setting switches 924A and 924B each serving as insertion mode selection means for selectively setting one of a plurality of (two including a mode 1 and a mode 2 here) automatic reading modes, a manual insertion mode setting switch 924C serving as insertion mode selection means for setting a manual insertion mode, a start switch 924D for starting the image reading apparatus in an automatic reading mode, and a stop switch 924E for stopping the image reading apparatus.

It is to be noted that the mode 1 and the mode 2 are different, for example, in terms of the transport speed (reading speed). When automatic reading should be performed, the mode 1 or the mode 2 will be selected first, and then the start switch 924D will be depressed to start the image reading apparatus. However, for manual insertion, the manual insertion mode setting switch 924C will be depressed to start the image reading apparatus.

The operation panel 920 further has provided thereon an original size inputting switch 924F, a reading concentration setting switch 924C, a reading density setting switch 924H, a landscape switch 924J, a half tone setting switch 924K, and the original selection switch (paper reading selection means) 924L. The original selection switch 924L is a switch by which it can be set whether both-face reading of an original should be performed or one-face reading only of the front face or the rear face should be performed.

B. General Construction of the Control System

Figure 37:
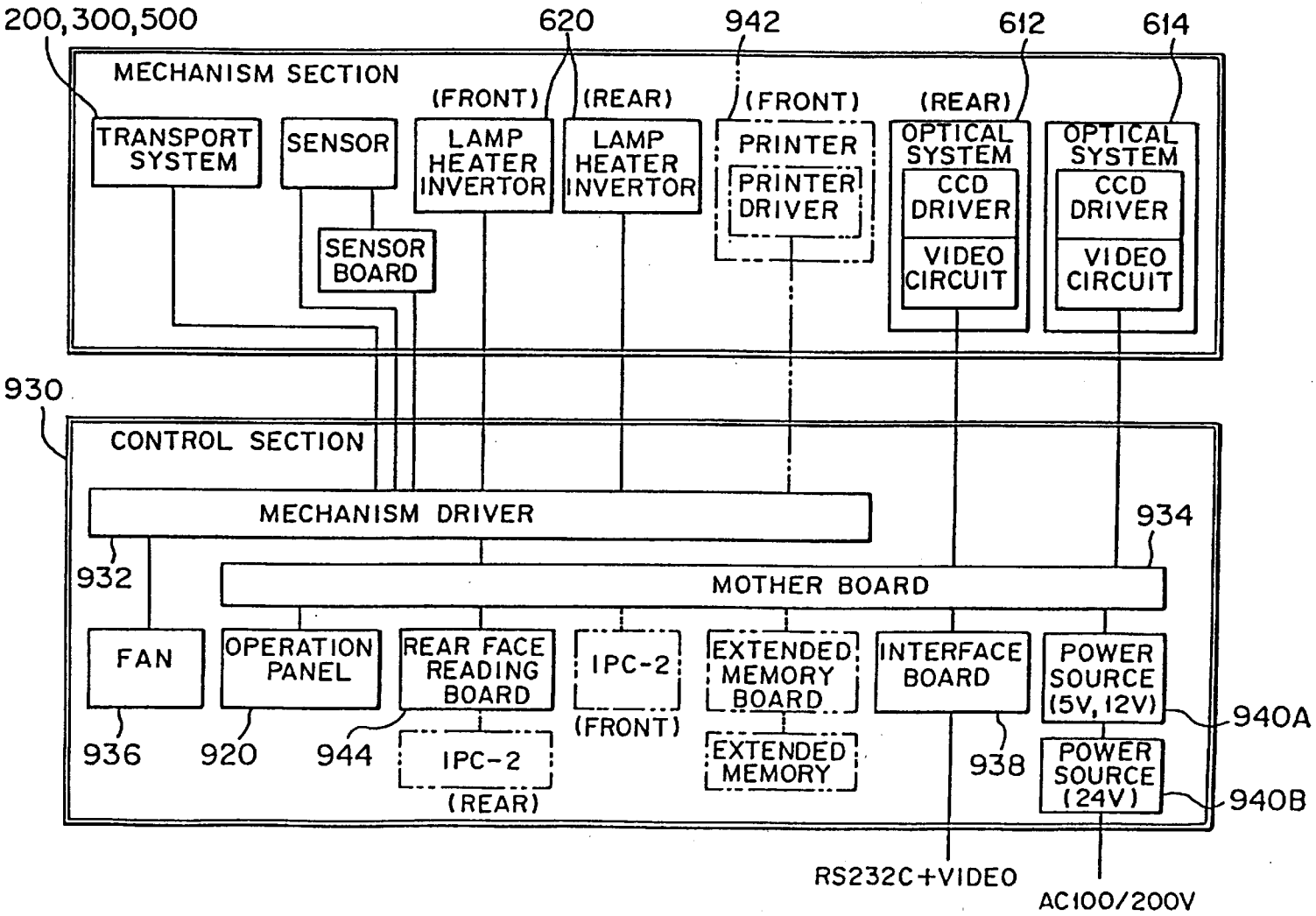
FIG. 37 is a block diagram schematically showing the construction of the image reading apparatus of FIG. 4.
Figure 38:
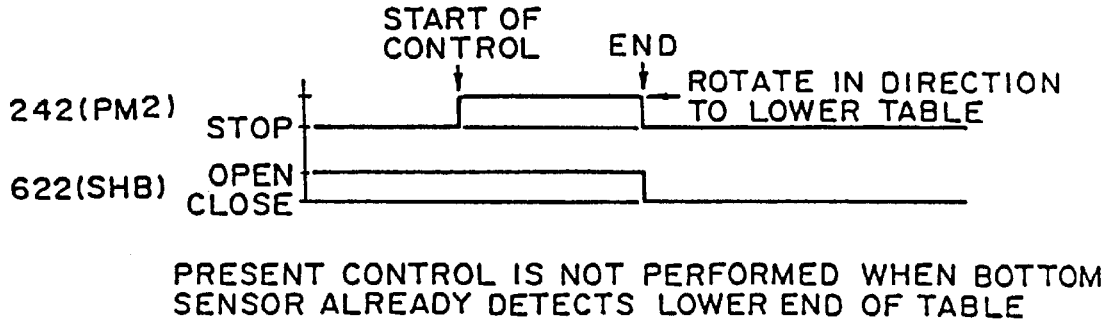
FIG. 38 is a sequence diagram illustrating initialization operation of a hopper system of the image reading apparatus of FIG. 4.

Referring now to FIG. 37 which schematically shows the mechanical components described above and control sections for controlling the mechanical components, a control section 930 includes a mechanical section control means (mechanism driver) 932 including a control circuit for controlling mechanical operations of the mechanical components, and image reading system control means (mother board) 934 including a control circuit for controlling operation of the image reading system. A pair of power source adjustment sections 940A and 940B for transforming an external power source to required voltages are connected to the image reading system control means 934.

The mechanical section control means 932 controls operation of the transport systems (that is, the paper supply mechanism 200, the paper transport mechanism 300, the paper stacking mechanism 500, and so forth) and the heater 428 of the fluorescent lamp unit 420 and an invertor of the fluorescent lamp 426 in accordance with an instruction signal received by way of the image reading system control means 934 and detection information from the various sensors of the mechanical components. The mechanical section control means 932 also controls operation of a cooling fan 936 for the control section 930 itself. The paper supply hopper position control means (motor control means) 280, the pick clutch control means 250 serving as paper supply roller driving mechanism control means, the separation clutch control means 858 and the roller driving mechanism control means 350 described hereinabove are included in the mechanical section control means 932.

The image reading system control means 934 controls operation of CCD driver units of the first optical image reading unit 412 and the second optical image reading unit 414, a video circuit and a rear face reading board 944 and outputting to an outputting interface board 938 in response to setting information of the operation panel 920 and information from the mechanical section control means 932. The image information extraction control means 440, the paper end detection means 450 and the discrimination mark image erasure means 460 described hereinabove are provided in the image reading system control 934.

Thus, the paper supply hopper position control means 280, the pick clutch control means 250, the separation clutch control means 858 and the roller driving mechanism control means 350 perform various controls in a synchronized relationship with a control timing of the image information extraction control means 440 by way of the mechanical section control means 932 and the image reading system control means 934.

Where an endorser (endorsing printer) 942 is provided in the proximity of the terminal end of the paper transport path 310 as shown in FIG. 7, also a driver for the endorser 942 is controlled by the image reading system control means 934 as seen from FIG. 37. Also where an extension memory board and/or an auxiliary printed circuit board (IPC-2) are provided, they are controlled by the image reading system control means 934.

3. Operation

The image reading apparatus constructed in such a manner as described above operates in the following manner.

Operations of the hopper motor 242, the pick clutch 238, the separation clutch 854 and the transport motor 342 and control by the image information extraction control means 440 proceed, for example, in such a manner as illustrated in time charts of FIGS. 38 to 43.

First, control of the hopper motor 242 will be described. Upon starting of the control, control of an initialization mode is performed, as seen from FIG. 38. In particular, in response to an operation starting instruction (that is, a control starting instruction) for the image reading apparatus such as, for example, throwing in of a power source to the apparatus, the hopper motor 242 is rotated in a direction to lower the hopper table 212. Then, when the hopper table 212 comes to its lowermost position, the bottom sensor 622 switches from an off-state (open) to an on-state 25 (closed), and the hopper motor 242 stops in response to such detection signal of the bottom sensor 622. Naturally, the control is not performed if, upon reception of the control starting instruction, the hopper table 212 is already at the lowermost position and the bottom sensor 622 is in an on-state (closed).

The control of the hopper motor 242 after this is different between an automatic reading mode and the manual insertion mode in response to setting information of the switches.

Figure 39:
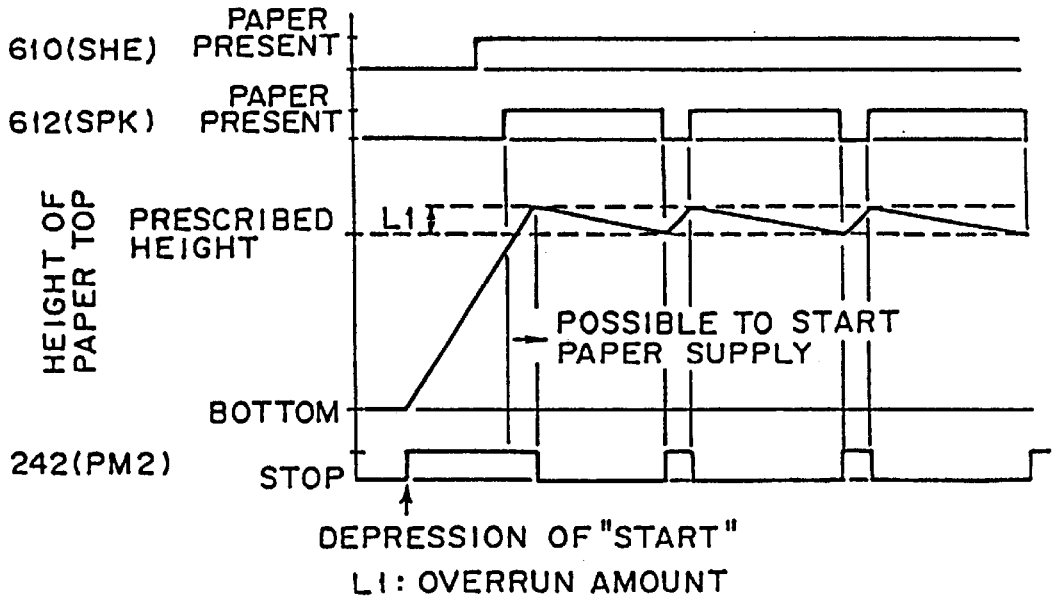
FIG. 39 is a sequence diagram illustrating operation of the hopper system in an automatic reading mode.

In particular, if paper sheets 40 are accommodated into the hopper table 212 and an automatic reading mode is selected and then a starting operation (depression of the start button) is performed, then the hopper motor 242 is rotated in a direction to raise the hopper table 212 as seen from FIG. 39. Then, when the top of the paper sheets 40 in the hopper table 212 rises from a position (bottom position) corresponding to the lowermost position of the hopper table 212, whereupon the hopper empty sensor 610 is turned on ("presence of a paper sheet"), to a prescribed height at which the paper supply sensor 612 is turned on ("presence of a paper 0 sheet").

When the hopper table 212 is raised by an overrun amount $L_1$ after the paper supply sensor 612 is turned on, the hopper motor 242 is stopped. Thereafter, image reading is performed while paper supplying and transporting operations, which will be hereinafter described, are performed. During the process, as the paper sheets 40 are supplied, the height of the top of the stack of paper sheets 40 decreases. Consequently, the paper supply sensor 612 is turned off finally, and in response to this, the hopper motor 242 is rotated in the direction to raise the hopper table 212.

Then, as the height of the toll of the stack of paper sheets 40 in the hopper table 212 rises again, it finally reaches the prescribed height, whereupon the paper supply sensor 612 is turned on ("presence of a paper sheet"). While such a sequence of operations as described above is repeated to control the height of the top of the paper sheets within a fixed range (within the range of the overrun amount $L_1$), image reading operation is performed together with paper supplying and transporting operations.

Figure 40:
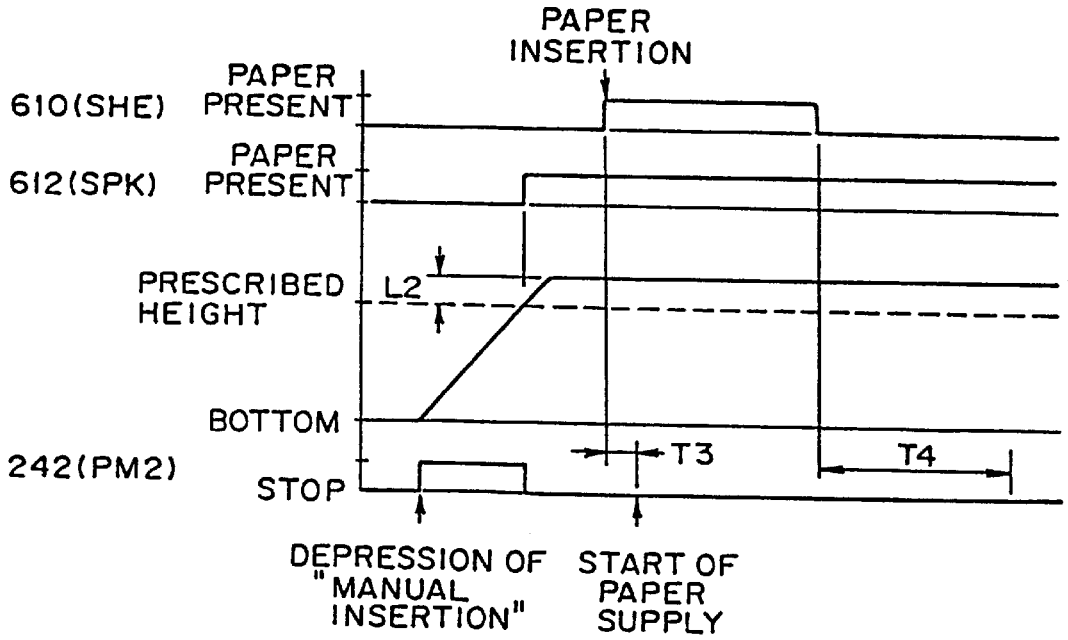
FIG. 40 is a sequence diagram illustrating operation of the hopper system in a manual insertion mode.

On the other hand, if a switch operation for the manual insertion mode (depression of the manual insertion button) is performed, then the hopper motor 242 is rotated in the direction to raise the hopper table 212 as seen from FIG. 40. Then, when the hopper table 212 is raised until the height of the top end thereof comes to a prescribed height, then the paper supply sensor 612 is turned on ("presence of a paper sheet"). When the hopper table 212 is further raised a little by an overrun amount $L_2$ after the paper supply sensor 612 is turned on, the hopper motor 242 is stopped. Thereafter, the hopper motor 242 is kept stopped and the hopper table 212 keeps the position. Then, manual insertion of a paper sheet is performed as in be seen also from an on/off condition of the hopper empty sensor 610.

Subsequently, operations of the pick clutch 238, the separation clutch 854 and the transport motor 342 and control by the image information extraction control means 440 will be described together with operation of the hopper motor 242. Referring to FIG. 41, paper sheets 40 are first accommodated into the paper supply hopper 210 and a read command to instruct starting of image reading is developed (point T1). At this initial stage, since the paper supply hopper 210 is not at the paper supply position, the paper supply sensor 612 is in an off-state. The hopper empty sensor 610 also provides a signal indicating absence of a paper sheet.

Since the paper supply sensor 612 is in an off-state, the hopper motor 242 is rendered operative to raise the paper supply hopper 210 to the paper supply position (point T2). Consequently, the paper supply sensor 612 is turned on. As a result, the hopper motor 242 is stopped, and the pick clutch 238 and the separation clutch 854 are engaged. Thereafter, the transport motor 342 is started (point T3) after a small time lag (30 ms in the example shown) until the pick clutch 238 and the separation clutch 854 are engaged firmly. By the operation of the transport motor 342, the pick rollers 220 and the separation roller 820 are rotated by way of the pick clutch 238 and the separation clutch 854 to supply and transport a first paper sheet 40.

The transport motor 342 can be selectively set to one of a low speed mode of a velocity V, (for example, 12 to 13 cm/s), a high speed mode of another velocity $V_2$ (for example, about 50 cm/s) and an intermediate speed or mid speed mode of an intermediate velocity. For the first paper sheet upon starting of paper supply, the transport motor 342 operates in the low speed mode. Accordingly, also the transportation speeds of the pick rollers 220 and the separation roller 820 are low.

When the leading end of the paper sheet 40 being transported in this manner passes the transport sensor 614, the transport sensor 614 detects this and is turned on (point T4), and the pick clutch 238 is disengaged. At this point of time, the paper sheet 40 is already at a position at which it can be driven by the separation roller 820, and consequently, the paper sheet 40 is thereafter driven by the separation roller 820.

Then, when the leading end of the paper sheet 40 being transported passes the transport sensor 616, the transport sensor 616 detects this and is turned on (point T5), and the separation clutch 854 is disengaged. At this point of time, the paper sheet 40 is already at a position at which it can be driven by the transport roller 320, and consequently, the paper sheet 40 is thereafter driven by the transport roller 320. Thereafter, the paper sheet 40 is successively driven by the succeeding transport rollers 322 to 328. At the point of time T5, since the transport motor 342 is in the low speed mode, the transportation velocity of the transport roller 320 itself is low.

The transport sensor 616 serves also as a sensor for detecting a reading timing, and when the passage of the leading end of the paper sheet 40 is detected by the transport sensor 616, a read command is developed in response to the detection (point T6). Upon reception of the read command, the transport motor 342 is accelerated from the low speed mode (velocity $V_1$) to the high speed mode (velocity $V_2$). Accordingly, also the speed of rotation of the transport rollers 320 to 328, that is, the transportation speed, increases until high speed transportation is reached.

Then, at a point of time T7 after lapse of a predetermined time $T_3$ after the leading end of the paper sheet 40 passes the transport sensor 616, the first optical image reading unit 412 for reading information of the front face of the paper sheet 40 is put into a reading condition (that is, a video gate on-state). Thereafter, at another point of time T8 after lapse of another predetermined time $t_4$ after the leading end of the paper sheet 40 passes the transport sensor 616, the second optical image reading unit 414 for reading information on the rear face of the paper sheet 40 is put into a reading condition (that is, a video gate on-state).

It is to be noted that the predetermined times $t_3$ and $t_4$ are times required for a paper sheet to pass to the reading points 412A and 412A of the optical image reading units 412 and 414, respectively, and are given, from the distances $L_1$ and $L_2$ from the transport sensor 616 to the reading points 412A and 414A and the transportation speed $V_2$ by the transport roller 320, by the following equations, respectively;

$$t_3=L_1/V_2,\ t_4=L_2/V_2$$

During such image reading (at points of time T9 and T10), the transport sensors 614 and 616 are switched from on to off when the trailing end of the paper sheet 40 passes the transport sensors 614 and 616, respectively.

The image information read in this manner is extracted under the control of the image information extraction control means 440. In particular, extraction of the image information is performed by the paper end detection means 450 when the leading end 46 of the paper sheet 40 advances into the optical image reading unit 410.

Then, in each of the optical image reading units 412 and 414, when a time $t_5$ required for image reading passes (point T11 or T12), the video gate is switched from on to off, thereby completing reading (Read Complete). It is to be noted that the time $t_5$ is given as a product between the reading line number and the integration time ($t_5$=reading line number x integration time).

In this manner, while the first paper sheet 40 is transported in the high speed mode by the transport rollers 320 to 328, image reading of the front face and the rear face of the paper sheet 40 is performed by the optical image reading units 412 and 414, respectively, and thereafter, the paper sheet 40 is driven by the paper transport roller 328 and the paper discharge roller 544 and stacked into the paper stacker 510.

After reading of the first paper sheet 40 is completed, a start command is developed immediately, and in response to the start command, transportation and reading of a second paper sheet are started. In the operation for the second, or following, paper sheet, the image reading apparatus operates in such a manner as illustrated in FIG. 42.

In particular, in the present example, since the paper supply hopper 210 is at the paper supply position (that is, the paper supply sensor 612 is in an on-state) when the start command is instructed (point T13), the pick clutch 238 and the separation clutch 854 are engaged simultaneously with the instruction of the start command. Since the transport motor 342 continues to operate in the high speed mode, the pick roller 220 and the separation roller 820 are rotated at a comparatively high speed due to the engagement of the clutches 238 and 854 to transport the second paper sheet. Naturally, in this instance, also the transport rollers 320 to 328 are being rotated by the transport motor 342.

Thereafter, transportation and reading of the second paper sheet are performed in a similar manner to the first paper sheet. However, in transportation and reading of the second, or following, paper sheet, since the transport motor 342 is operating in the high speed mode from the beginning, the transport motor 342 is controlled to temporarily lower the speed thereof at a point of time when the main element for driving the paper sheet changes over from the separation roller 820 to the transport roller 320, different from the transportation and reading of the first paper sheet.

In particular, when the leading end of the second paper sheet, which is supplied and transported at a comparatively high speed by the pick roller 220 and the separation roller 820, passes the transport sensor 614, the transport sensor 614 detects this and is turned on (point T15). Consequently, the pick clutch 238 is disengaged and the paper sheet is thereafter driven by the separation roller 820.

Then, when the leading end of the second paper sheet passes the transport sensor 616, the transport sensor 616 detects this and is turned on (point T19), and the separation clutch 854 is disengaged. Around the point of time T19 (between the points of time T17 to T20), the speed of the transport motor 342 is reduced temporarily from the high speed mode to the intermediate speed mode.

Such speed reduction control is started at a point of time T16 when a required time elapses after the transport sensor 614 is turned on (at a point of time before the leading end of the paper sheet passes the transport sensor 616) and is performed by holding, after the point of time T17 at which the speed drops to an intermediate speed, the intermediate speed until a point of time T20 at which a predetermined time (for example, 50 ms) elapses after the point of time T17.

Due to the speed reduction control, when the main element for driving the roller sheet changes over from the separation roller 820 to the transport roller 320, the transportation speed of the separation roller 820 and the transport roller 320 is suppressed, and consequently, changing over from the separation roller 820 to the transport roller 320 proceeds smoothly. This reduces a cause of trouble, such as paper jamming.

Within the period, a read command is developed (point T18), and similarly as in transportation of the first paper sheet, the first optical image reading unit 412 for reading information of the front face of a paper sheet is put into a reading condition (video gate on-state) at a point of time T21 at which the predetermined time ta elapses after the leading end of the paper sheet passes the transport sensor 616. Then, at another point of time T22 when the predetermined time $t_4$ elapses after the leading end of the paper sheet passes the transport sensor 616, the second optical image reading unit 414 for reading information on the rear face of a paper sheet is put into a reading condition (video gate on-state). It is to be noted that the predetermined times $t_3$ and $t_4$ mentioned above are given similarly as described hereinabove.

During such image reading, the transport sensors 614 and 616 are changed over from an on-state to an off-state (points T23 and T24) as the trailing end of the paper sheet passes the transport sensors 614 and 616, respectively.

Then, in each of the optical image reading units 412 and 414, the video gate is changed over from an on-state to an off-state to complete the reading (Read Complete) when the time $t_5$ required for image reading elapses. Also the time $t_5$ is given similarly as described hereinabove.

In this manner, while the second or following paper sheet is transported in the high speed mode by the transport rollers 320 to 328, image reading of the front face and the rear face of the paper sheet is performed by the optical image reading units 412 and 414, respectively, and thereafter, the paper sheet is driven by the paper transport roller 328 and the paper discharge roller 544 and stacked into the paper stacker 510 in a similar manner to the first paper sheet.

If the paper supply sensor 612 is turned off as a result of reduction in quantity of the paper sheets 40 in the paper supply hopper 210 (point T14 in FIG. 42), then the hopper motor 242 is rendered operative at a point of time (T27) at which the operations of the pick roller 220 and the separation roller 820 and the speed reduction control of the transport motor 342 are completed to raise the paper supply hopper 210 to the paper supply position (point T2). Such height control of the paper supply hopper 210 is performed each time the paper supply sensor 612 is turned off as a result of reduction in quantity of the paper sheets 40 while the paper supplying and transporting operations are performed.

Figure 43:
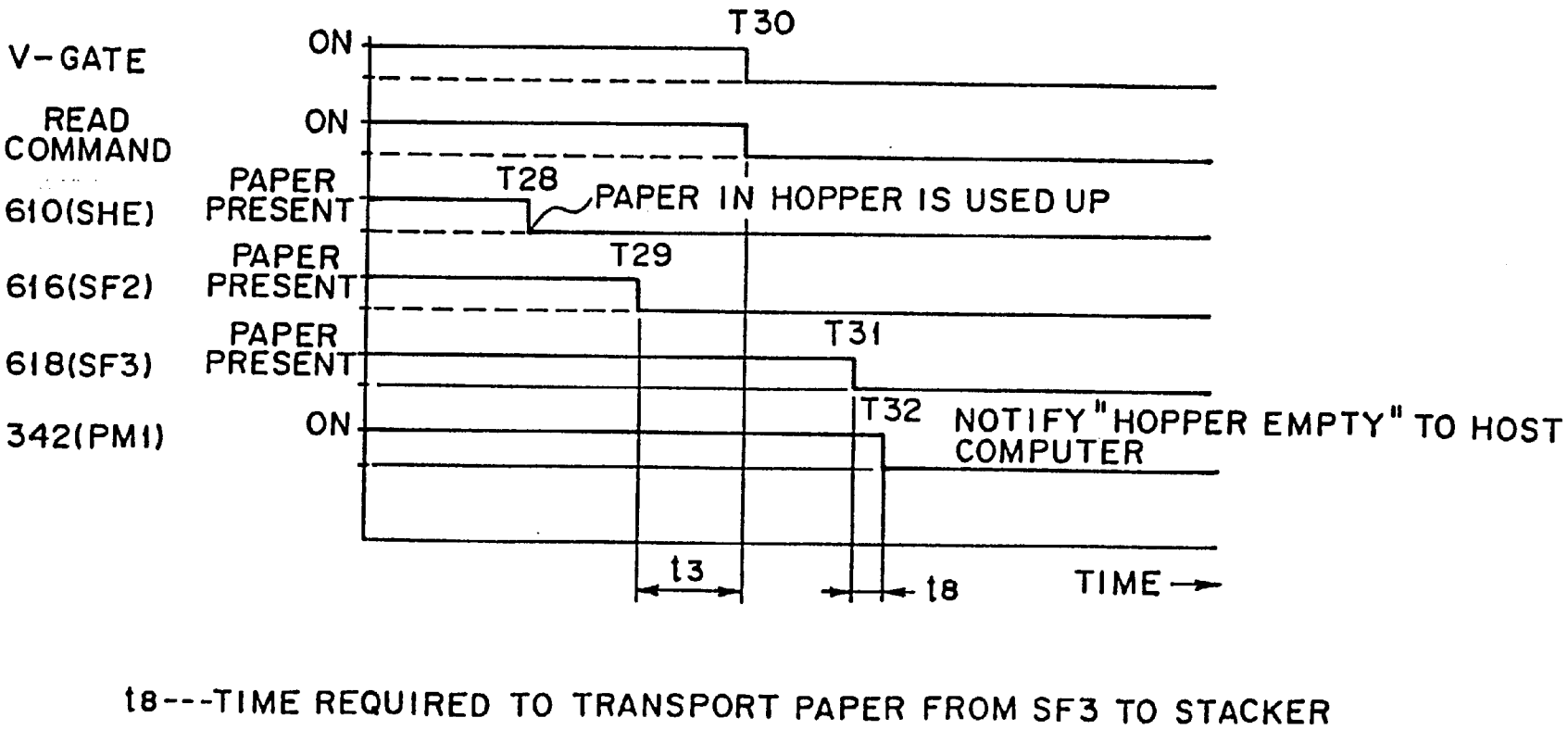
FIG. 43 is a similar view but particularly showing a transport starting sequence upon end of transportation.

Then, when the paper sheets 40 in the paper supply hopper 210 are reduced in quantity until the paper supply hopper 210 becomes empty, the hopper empty sensor 610 changes over from an off-state ("paper present") to an on-state ("paper absent") (point T28) as seen from FIG. 43, and then the transport sensor 616 changes over from an on-state ("during paper passage") to an off-state ("completion of paper passage") (point T29). Thereafter, the video gate of the second optical image reading unit 414 on the downstream side of the transport path is changed over from an on-state to an off-state and, simultaneously, the read command is changed over from an on-state to an off-state (point T30), and then the discharge sensor 618 changes over from an on-state ("during paper passage") to an off-state ("completion of paper passage") (point T31). The power supply to the transport motor 342 is cut to stop the transport motor 342 after lapse of a predetermined time t8 after the discharge sensor 618 changes over to an off-state. The predetermined time $t_8$ corresponds to a time within which a paper sheet 40 is transported from the discharge sensor 618 to the stacker 500.

It is to be noted that, if a paper sheet to be read requires image reading of only one face thereof and it is intended to read, for example, only the front face of the paper sheet, when reading of the video gate of the first optical image reading unit 412 in FIGS. 41 and 42 comes to an end, it is determined that reading for the paper sheet is completed (Read Complete), and next control is started immediately.

Since transportation and image reading of paper sheets is performed in response to the hopper empty sensor 610, the paper supply sensor 612, the transport sensors 614 and 616 and the discharge sensor 618 in this manner, the image reading operation can be performed appropriately in accordance with a transportation condition of a paper sheet, which is suitable to high speed image reading. Further, if paper jamming should occur intermediately of the paper transport path, this can be detected promptly and the operation of the image reading apparatus can be stopped immediately.

Further, since the control timings by the roller driving mechanism control means 350 and the image information extraction control means 440 are synchronized with each other, even if the processing speed for image reading is increased, the paper transportation operation and the image reading operation can be performed with certainty.

Furthermore, since reading of information of the front face of a paper sheet 40 is performed optically by the first optical image reading unit 412 and reading of information of the rear face of the paper sheet 40 is performed optically by the second optical image reading unit 414, reading of image information on the opposite faces of the paper sheet 40 can be performed rapidly, and the processing speed of a double-side original is improved significantly.

Meanwhile, since extraction of an image is performed when it is detected by the paper leading end detection means 450 that the leading end 46 of a paper sheet 40 advances into the optical image reading unit 410, extraction of the image can be performed rapidly and efficiently.

Further, since the image information extraction control means 440 performs extraction control of image information obtained by the first optical image reading unit 412 and the second optical image reading unit 414 in response to a result of selection by the original selection switch 924L serving as paper reading selection means and the discrimination mark 50 applied to a paper sheet 40, the image reading apparatus is advantageous in that extraction of an image can be performed rapidly and efficiently and the processing speed in image reading can be raised readily.

For example, when one-face reading originals are mixed with both-face reading originals, if the discrimination mark 50 which designates one-face reading is applied to each of the one-face reading originals the quantity of which is smaller than that of the both-face reading originals and it is selectively set by way of the original selection switch 924L that both faces of each paper sheet 40 should usually be read, then image information on both faces of a paper sheet is normally read by both of the first optical image reading unit 412 and the second optical image reading unit 414. However, when a discrimination mark 50 is detected, image information only on the front face or the rear face of the paper sheet 40 is read by the first optical image reading unit 412 or the second optical image reading unit 414.

As a result, extraction of an image can be performed rapidly and efficiently. Naturally, when both-face reading originals are mixed with one-face reading originals, similar advantages can be obtained by applying a discrimination mark 50 which designates double face reading to each of the double face reading originals, the quantity of which is smaller than that of the one-face reading originals, and selectively setting by way of the original selection switch original selection switch 924L that one face of each paper sheet 40 should usually be read.

Naturally, if both-face reading originals and one-face reading originals are not mixed, extraction of image information can be performed rapidly and efficiently by way of selection by the original selection switch 924L.

Further, since the image of the discrimination mark 50 applied to a paper sheet 40 is erased by the discrimination mark image erasure means 460 while only image information which should originally be read is outputted, the discrimination marks will not make an obstacle to extraction of image information.

Further, in the image reading apparatus of the embodiment described above, since the first optical image reading unit 412 for front face reading and the second optical image reading unit 414 for rear face reading are constructed with common specifications, front face information and rear face information of a paper sheet are read in uniform accuracy. Further, common parts can be employed for both of the optical image reading units 412 and 414, and consequently, the cost required for production of the image reading apparatus can be reduced.

Further, since the first optical image reading unit 412 for front face reading and the second optical image reading unit 414 for rear face reading can be constructed readily with different specifications, the reading accuracy and the cost can be balanced well by constructing the image reading apparatus, for example, such that an optical image reading unit, which is lower in terms of the accuracy but superior in terms of the cost, is employed to read a reading face for which a high degree of accuracy in reading of image information is not required. The image reading apparatus is further advantageous in that various models can be provided readily at a low cost in accordance with applications.

Further, it is appropriately discriminated by the front/rear face detection means 630 whether each optical image reading unit is for front face reading or for rear face reading of a paper sheet, and information thus read can be processed appropriately.

Further, with the image reading apparatus of the present embodiment, the following advantages can be achieved due to its structural characteristics.

In particular, since the paper transport path 310 connected to the paper supply mechanism 200 is constituted from the inclined transport path 312 and the paper reversing transport path 314 without involving a horizontal transport path, the paper transport path 310 requires a comparatively small depthwise space, and accordingly, the image reading apparatus can be reduced in size as much. Further, there is another advantage in that a paper sheet can be transported rapidly from the paper supply mechanism 200 to the stacker mechanism 300 and image reading can be performed at a high speed. Naturally, the reduction in space allows an increase in size of the paper sheet hopper or the paper stacker, which allows reading of a paper sheet of a greater size.

Further, since fine particles are deposited on the surfaces of the transport rollers 320 to 328, the coefficients of friction of the outer surfaces of the transport rollers 320 to 328 are increased by the fine particles. Consequently, an otherwise possible slip of a paper sheet upon transportation is prevented, and accordingly, image reading can be performed smoothly even during transportation of a paper sheet at a high speed.

Furthermore, since a paper sheet 40 is guided during transportation by the paper guiding portions of the sheet guides 700, 710, 740, 750 and so forth, paper jamming is less likely to occur. Further, while a color reference for a paper sheet 40 is provided by the backing portions 712 and 752 provided on such sheet guides, since the backing portions 712 and 752 are offset from the paper guiding portions 714 and 754 by way of the steps 716 and 756, a paper sheet 40 will not contact directly with the backing portion 712 or 752. Consequently, soiling of the backing portions 712 and 752 upon passage of a paper sheet 40 is prevented, and a color reference for a paper sheet 40 is provided appropriately. Accordingly, the accuracy in image reading can be assured for a long period of time and also maintenance of the image reading apparatus is facilitated.

Further, since the sheet guides 710 and 750 are resiliently pressed toward the optical image reading unit 410 and contacted with the contacting members, the sheet guides 710 and 750 are controlled with certainty to the predetermined positions with respect to the optical image reading unit 410, and a paper sheet 40 is guided to an appropriate position conforming to a focal length of the optical image reading unit 410. Consequently, an error in reading resolution or magnification of information of a paper sheet 40 by the optical image reading unit 410 is prevented. Naturally also, the positions of the backing portions 712 and 752 provided on the sheet guides 710 and 750 are held appropriately with respect to the optical image reading unit 410, and also the color difference for a paper sheet 40 can be provided appropriately.

Furthermore, while the second optical image reading unit 414 is provided vertically downwardly of the inclined transport path 312, since the sheet guide 740 provided between the second optical image reading unit 414 and the inclined transport path 312 has the opening 742 provided therein, information on the rear face 44 of a paper sheet can be read through the opening 742 while the paper sheet is guided by the sheet guide 740.

Particularly, in the image reading apparatus of the present embodiment, since the glass plate 742A is provided in the opening 742, a paper sheet can be guided also along the opening 742 by the glass plate 742A. Accordingly, the paper transportation performance is improved as much.

By adjusting the manner in which the apparatus body 10 and the apparatus lid 20 are held in a closed condition by way of the body-lid locking mechanism 30, the biasing forces of the idler rollers 330 to 338 to the transport rollers 320 to 328 and the contacting conditions between the sheet guides and the auxiliary sheet guides are adjusted. Consequently, an appropriate transporting force can be obtained readily in accordance with a type of a paper sheet by such adjustment. Accordingly, the image reading apparatus can achieve reliable transportation of a paper sheet free from an error.

Further, since the paper separation mechanism 800 in the present embodiment is constructed such that the top one of paper sheets is taken out separately from the other paper sheets by and between the separation roller 820 and the rotation member 830 disposed below and, in an opposing relationship to, the separation roller 820, the image reading apparatus is advantageous in that the top paper sheet can be separated from the other paper sheets with a very high degree of certainty.

Operation of the paper separation mechanism and the advantage in paper separation will be described with reference to FIG. 81(A) in contrast with another paper separation mechanism 800A of a different structure shown in FIG. 81(B).

First, a paper separation mechanism 800-1 for contrast will be described with reference to FIG. 81(B). The paper separation mechanism 800-1 is constructed so as to supply a paper sheet from the bottom of paper sheets accommodated in position. In particular, while the number of paper sheets to be picked up is restricted by a pick spring 220-2, a paper sheet or paper sheets are picked up by a paper supply roller 220-1 and then one of the paper sheets is separated from the other paper sheets by and between a separation roller 820-1 and a pad 820-2.

Figure 81A:
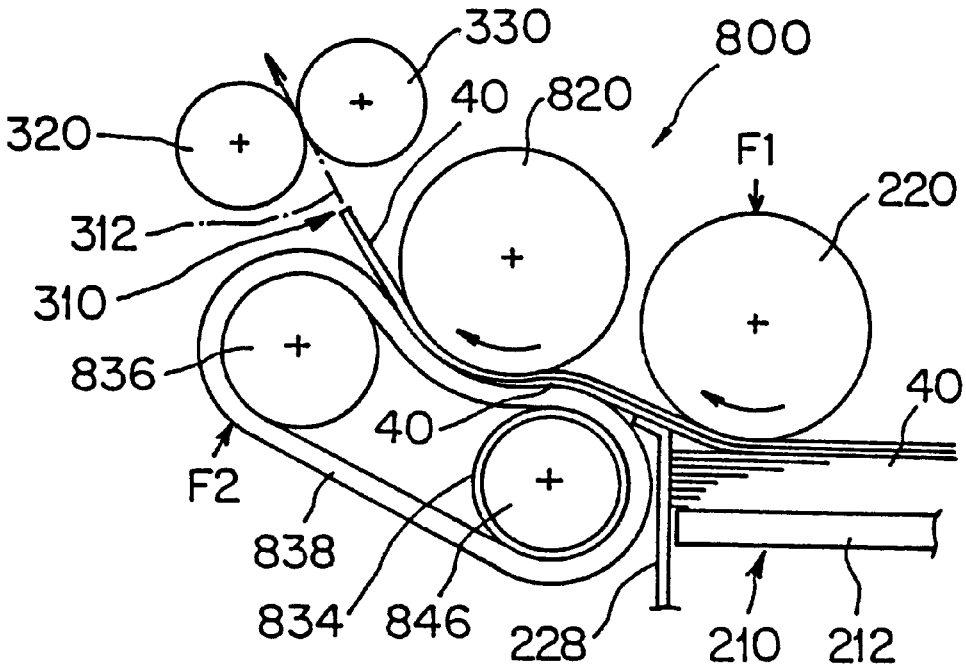
FIG. 81 (A) is a side elevational view of a paper separation mechanism of the paper supply apparatus of FIG. 80 illustrating an advantage of the paper separation mechanism.
FIG. 81(B) is a side elevational view showing another paper separation mechanism for comparison.
Figure 81B:
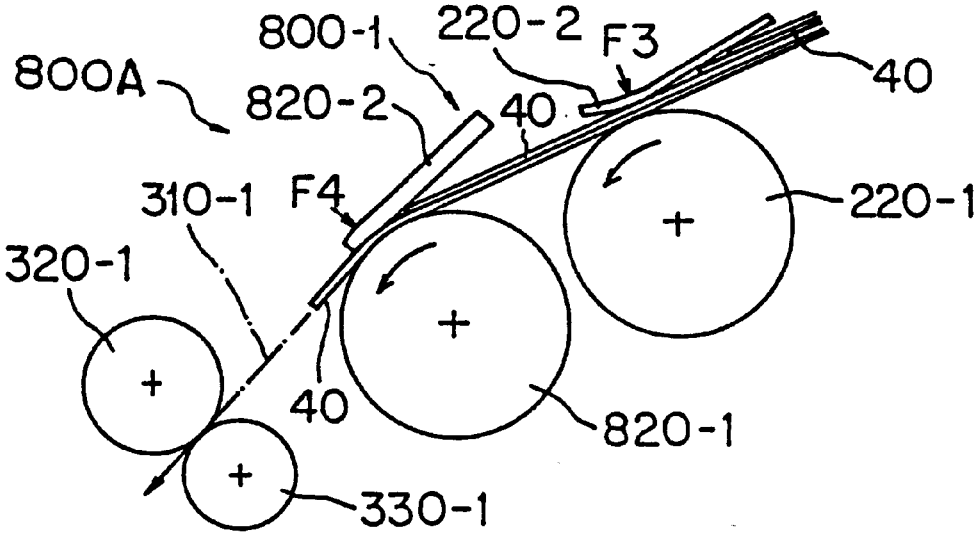

More particularly, the pad 820-2 is normally held in contact with the separation roller 820-1 or a paper sheet 40 under a resilient biasing force, and if, for example, two paper sheets 40 tend to advance between the separation roller 820-1 and the pad 820-2 as seen in FIG. 81(B), then the upper one of the paper sheets 40 is stopped by the pad 820-2 while only the lower paper sheet 40 is sent toward a paper transporting roller 320-1 and an idler roller 330-1 by the separation roller 820-1.

In the paper separation mechanism 800-1, however, since a paper sheet or sheets slip in their movement on the surfaces of the pick spring 220-2 and the pad 820-2 while they are acted upon by pressing forces (refer to arrow marks F3 and F4) acting upon the pick spring 220-2 and the pad 820-2, abrasion proceeds gradually at the slipping contact portions of the pick spring 220-2 and the pad 820-2 to reduce the paper separation capacity as transportation of paper sheets is repeated. Therefore, such abraded parts must be exchanged based on the amount of paper sheets processed by the Pfizer separation mechanism.

In contrast, in the paper separation mechanism 800 in the present embodiment, leaper sheets 40 are first picked up by the paper supply roller 220 and then one of them is separated from the other or others by and between the separation roller 820 and the belt 838 as seen in FIG. 81(A). The separation proceeds in the following manner.

In particular, while the separation roller 820 is always driven to rotate, the belt 838 is circulated in response to rotation of the pulley 834 interposed in the torque limiter 846. The belt 838 is held pressed against the separation roller 820 by a suitable pressing force so that, if, for example, two or more paper sheets advance between the separation roller 820 and the belt 838, then the torque limiter 846 stops the pulley 834 and the belt 838 in response to the torque which increases in response to such advancement of the two or more paper sheets. In other words, if two or more paper sheets advance between the separation roller 820 and the belt 838, then the belt 838 is stopped by way of the torque limiter 846. Further, the surfaces of the separation roller 820 and the belt 838 are processed so as to have suitable coefficients of friction due to fine particles of, for example, alumina, or some other suitable material, deposited on the surfaces.

Therefore, if, for example, two paper sheets 40 try to advance between the separation roller 820 and the belt 838 as seen in FIG. 81(A), then the frictional forces between the opposite top and bottom faces of the paper sheets 40 and the surfaces of the separation roller 820 and the belt 838 become higher than the frictional force between the two paper sheets 40. Consequently, while the upper paper sheet 40 which contacts with the separation roller 820 is driven by the separation roller 820, the belt 838 is stopped by way of the torque limiter 846 and the lower paper sheet 40 which contacts with the belt 838 is stopped together with the belt 838 due to the frictional force of the surface of the belt 838. As a result, only the top one of paper sheets 40 is separated from the other paper sheets 40 and supplied to the paper transport mechanism 300.

Naturally, if more than two paper sheets 40 advance between the separation roller 820 and the belt 838, only the top one of paper sheets is separated from the other paper sheets due to the action described above and supplied to the paper transport mechanism 300.

In this manner, since separation of a paper sheet is performed without causing much slip between the surfaces of the separation roller 820 and the belt 838 and the surfaces of the paper sheet or sheets 40 making the most of a slip between the leaper sheets, abrasion of parts by transportation of a palmer is so little that a large amount paper sheets can be processed appropriately for a long period of time without the necessity of exchanging a part.

4. Modifications and Alternative Forms

In the following, various modifications and alternative forms of several components of the image reading apparatus of the present embodiment will be described.

4-1. Structure of the Paper Hopper

Figure 44:
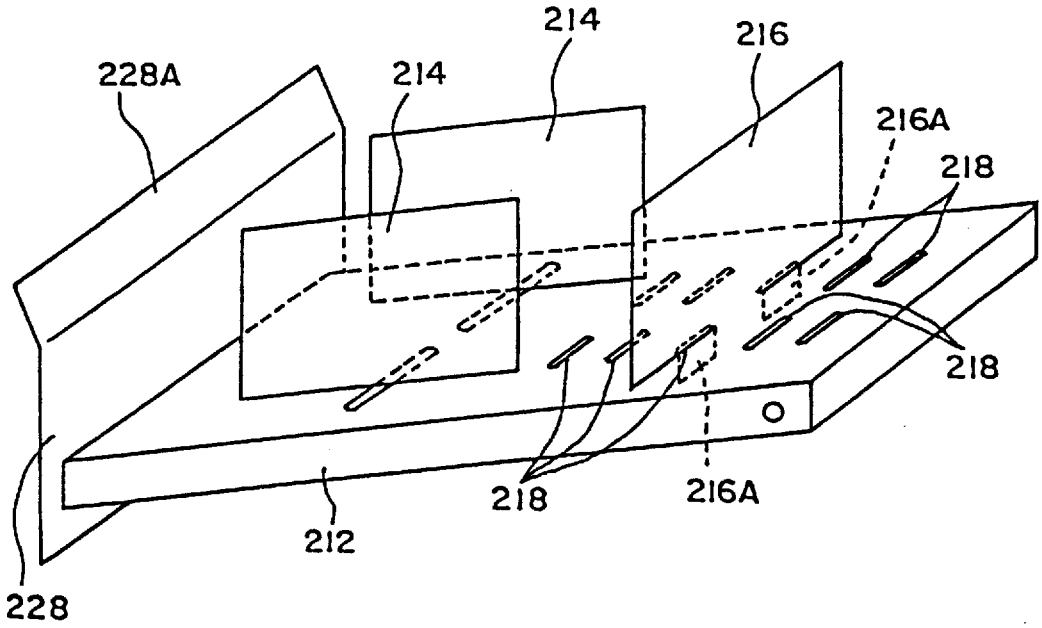
FIG. 44 is a perspective view showing a detailed structure of the paper supply hopper of the image reading apparatus of FIG. 4.

Though not described in detail in the description of the image reading apparatus of the preferred embodiment, a pair of tiltable paper edge guide members 214 for guiding the opposite side edges of paper sheets accommodated in the paper supply hopper 210 are provided in the paper supply hopper 210 as shown in FIG. 44. The tiltable paper edge guide members 214 are mounted on the hopper table 212 of the paper supply hopper 210 for tilting movement and for sliding movement in the widthwise direction of a paper sheet. While the tiltable paper edge guide members 214 are naturally provided in pair at left and right locations, the left and right tiltable palmer edge guide members 214 are slidably moved in widthwise directions in an interlocking relationship with each other to positions at which they contact with the side edges of the paper sheets 40 from the left and right sides to hold the paper sheets 40 at an appropriate position in the widthwise direction of the paper sheets 40.

Consequently, the paper sheets 40 can be guided to an appropriate position in the widthwise direction in accordance with the widthwise size of the paper sheets 40 whatever widthwise size the paper sheets 40 may have from a small size to a large size. Further, where the paper width is larger than the range of movement of the tillable paper edge guide members 214, the tillable paper edge guide members 214 can be tilted down so that they may not protrude from the hopper table 212, and accordingly, the hopper table 212 can be used with its maximum width. It is to be noted that, in this instance, the left and right wall faces 16 (refer to FIG. 5) of the hopper section of the apparatus body, which are provided uprightly on the opposite side portions of the hopper table 212, can be used in place of the left and right tillable paper edge guide members 214.

Further, a paper trailing end guide member 216 for guiding the trailing end edges of paper sheets 40 accommodated in the paper supply hopper 210 is provided in the paper supply hopper 210. While the paper trailing end guide member 216 is provided in the hopper table 212, the hopper table 212 has a plurality of fitting holes 218 formed therein and serving as mounting portions for mounting the paper trailing end guide member 216.

In particular, the paper trailing end guide member 216 has a fitting projection 216A provided at a lower end thereof and is fixed to the hopper table 212 by fitting the fitting projection 216A of the paper trailing end guide member 216 into one of the fitting holes 218 of the hopper table 212. Here, a pair of left and right fitting projections 216A are provided at the lower end of the paper trailing end guide member 216 while the fitting holes 218 of the hopper table 212 are provided in left and right pairs correspondingly. The plurality of pairs of fitting holes 218 are provided at different locations in the lengthwise direction of a paper sheet (paper supplying direction) so that the paper trailing end guide member 216 can be selectively fixed to a suitable position on the hopper table 212 in accordance with a size of paper sheets to be accommodated onto the hopper table 212. Accordingly, the paper trailing end guide member 216 can guide the trailing ends of paper sheets of various sizes.

4-2. Paper Supply Roller System

Figure 45:
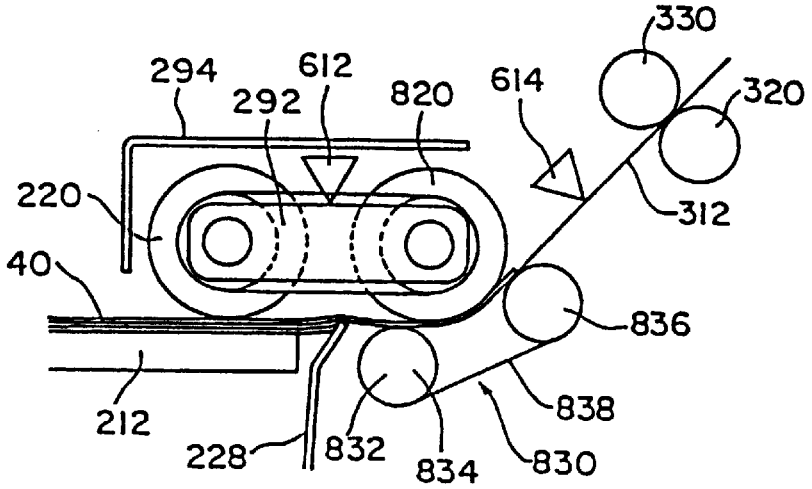
FIG. 45 is a side elevational view showing the paper supply mechanism shown in FIG. 14 at a position when the amount of paper sheets in the paper supply hopper is small where the paper supply mechanism is constructed such that the paper supply roller is not rocked.
Figure 46:
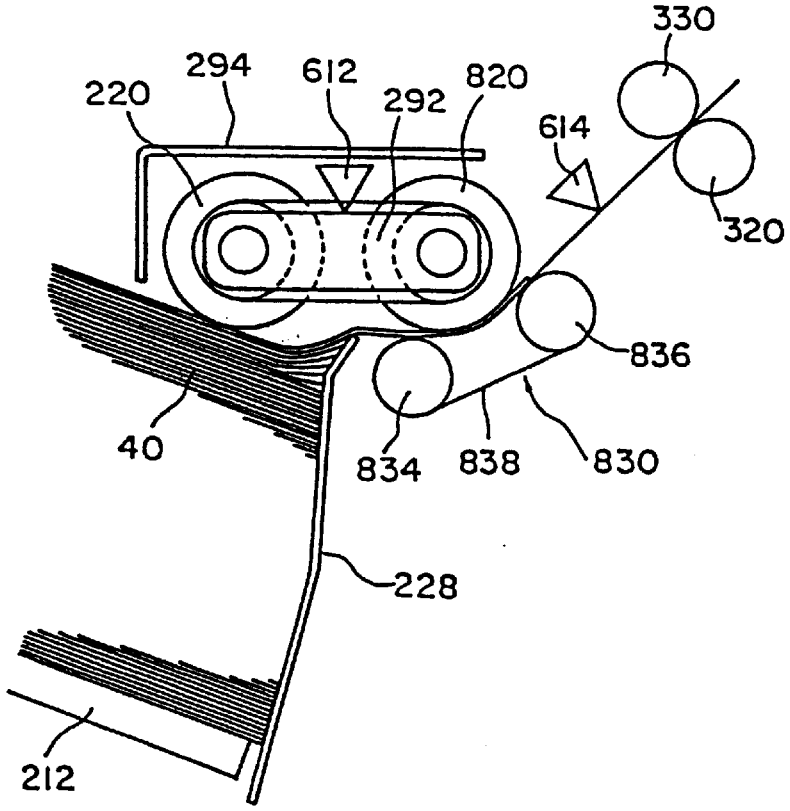
FIG. 46 is a side elevational view showing the paper supply mechanism shown in FIG. 14 at another position when the amount of paper sheets in the paper supply hopper is large where the paper supply mechanism is constructed such that the paper supply roller is not rocked.

By the way, as the height (thickness) of the paper sheets accommodated in the paper supply hopper 210 increases, the amount of pivotal motion by which the paper supply hopper 210 pivots the hopper table 212 so as increase its forward tilt in the paper supplying direction. In this instance, naturally the paper sheets accommodated in the hopper table 212 are tilted forwardly, whereupon the top of the paper sheets is naturally tilted forwardly with the front or leading end thereof positioned at a lowermost position. Meanwhile, since the gate 228 constituting the front end of the paper supply hopper 210 is fixed, if the axis of rotation of the paper supply rollers 220 is not rocked and, consequently, the position of the paper supply rollers 220 is fixed, whether the position of the paper supply hopper 210 is higher or lower, then if the gate 228 and the hopper table 212 are set such that the height of the upper end of the gate 228 and the height of the leading end of the top of the paper sheet coincide with each other when the paper supply hopper 210 is, for example, at a high position as shown in FIG. 45, then, when the paper supply hopper 210 comes to a low position, the top of the paper sheets is restricted by the paper supply rollers 220, as shown in FIG. 46, so that the height of the front end of the paper sheets becomes lower than the height of the upper end of the gate 228. Consequently, an appropriate paper supplying operation cannot be performed.

In the present apparatus, however, the paper supply rollers 220 are supported for rocking motion around the axis 822 of the separation roller 820 by way of the rockable arm 292, and when the hopper table 212 is driven by the paper supply hopper 210 of the paper supply hopper position control means 280 so that it comes to its high position, as shown in FIG. 45, the paper supply rollers 220 assume a substantially horizontal position, but when the hopper table 212 comes to a low position, as shown in FIG. 46, the paper supply rollers 220 are rocked upwardly in response to the low position of the hopper table 212.

Figure 47:
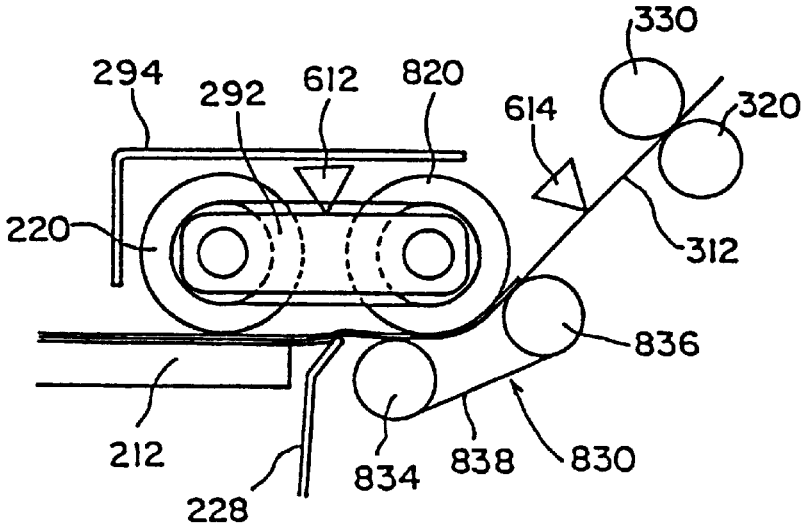
FIG. 47 is a side elevational view showing the paper supply mechanism shown in FIG. 14 at a position when the amount of paper sheets in the paper supply hopper is small where the paper supply mechanism is constructed such that the paper supply roller is rocked.
Figure 48:
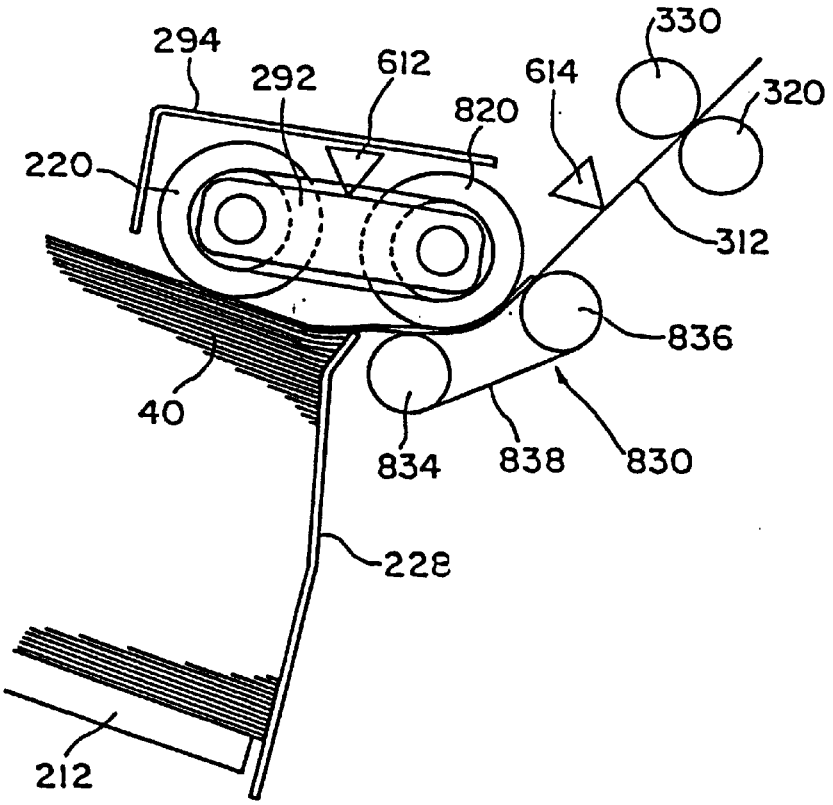
FIG. 48 is a side elevational view showing the paper supply mechanism shown in FIG. 14 at another position when the amount of paper sheets in the paper supply hopper is large where the paper supply mechanism is constructed such that the paper supply roller is rocked.

Accordingly, when the amount of the paper sheets 40 in the paper supply hopper 210 is comparatively small, the hopper table 212 assumes a comparatively high position and the paper supply rollers 220 assume a substantially horizontal position at which the height of the front or leading end of the top of the paper sheets 40 coincides with the height of the upper end of the gate 228, as shown in FIG. 47. In contrast, when the amount of the paper sheets 40 in the paper supply hopper 210 is comparatively large, the hopper table 212 assumes a comparatively low position and the paper supply rollers 220 assume a position rocked upwardly in response to the low position of the hopper table 212 so that, also in this instance, the height of the front end of the top face of the paper sheets coincides with the height of the upper end of the gate 228, as shown in FIG. 48.

In this manner, the top face of the paper sheets 40 normally assumes an appropriate position with respect to the upper end of the gate 228 by the driving control of the paper supply hopper 210 and the interlocking control of the rocking position of the axis of rotation of the paper supply rollers 220 with the paper supply hopper 210. Consequently, there is an advantage in that an appropriate paper supplying operation can be achieved.

4-3. Paper Supply Sensor

By the way, the paper supply sensor 612 is provided in order to adjust the position of the paper supply hopper 210 by way of the paper supply hopper position control means 280. In the embodiment described above, the paper supply sensor 612 detects from the posture of the paper supply rollers 220 and the posture of the paper supply hopper 210, itself, whether the paper supply rollers 220 and the paper supply hopper 210 are in respective appropriate positions, that is, in an appropriate paper supplying condition, and the paper supply hopper position control means 280 drives the paper supply hopper 210 in response to a result of detection of the paper supply sensor 612 until the paper supplying condition is detected. The paper supply sensor 612 in the embodiment may be replaced by the following alternative arrangements.

Figure 49:
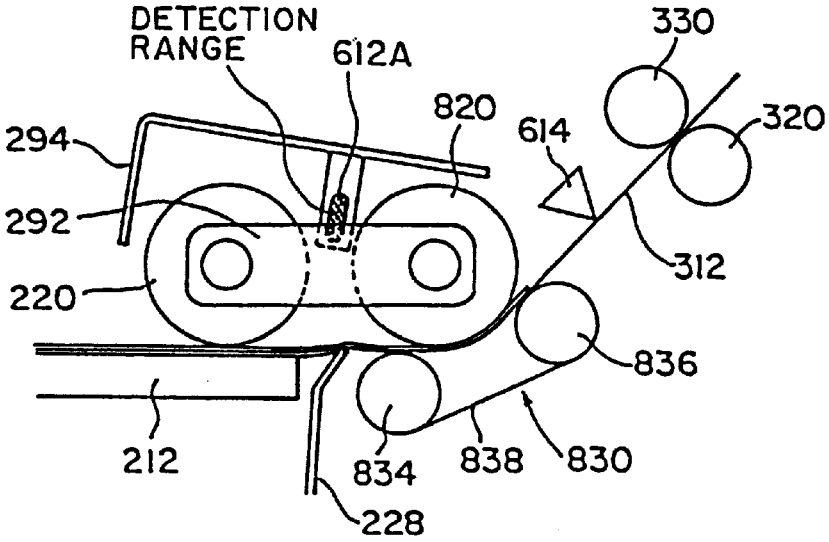
FIG. 49 is a partial side elevational view showing another form of the paper supply mechanism shown in FIG. 14 when the amount of paper sheets in the paper supply hopper is small.
Figure 50:
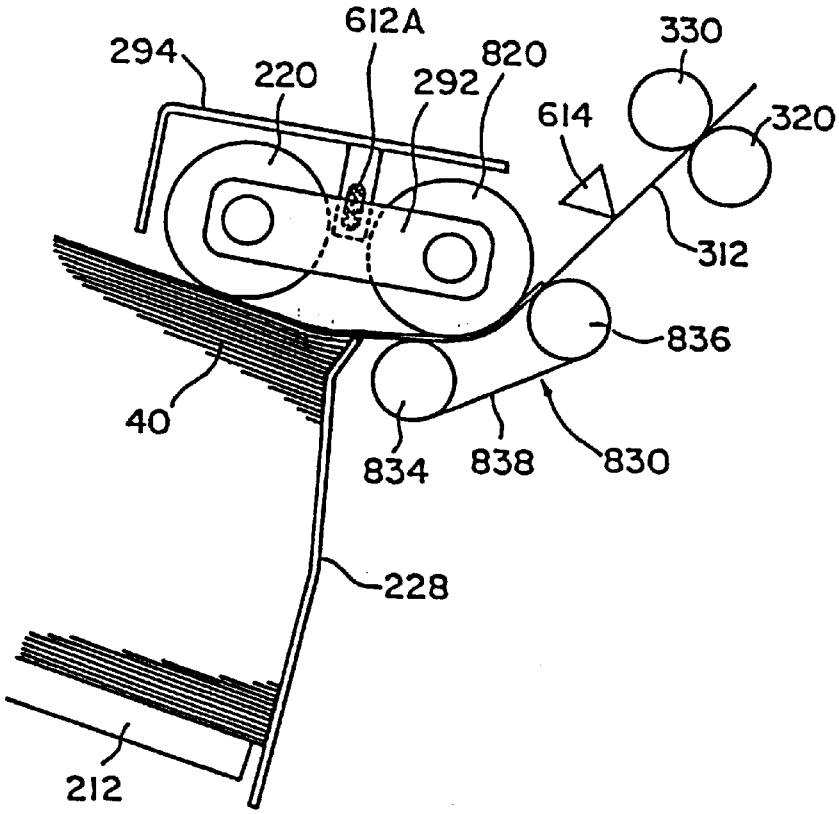
FIG. 50 is a partial side elevational view showing another form of the paper supply mechanism shown in FIG. 49 but when the amount of paper sheets in the paper supply hopper is large.

An alternative arrangement is shown in FIGS. 49 and 50, Referring to FIGS. 49 and 50, in the alternative arrangement shown, while the paper supply rollers 220 are mounted for rocking motion around the axis of the separation roller 820, the cover 294 for the paper supply rollers 220 is mounted in a stationary condition. A paper supply sensor 612A is provided on the stationary cover 294 for detecting a rocked position of the rockable arm 292 to detect a rocked condition of the paper supply rollers 220. The paper supply sensor 612A includes, for example, a large number of photo-interrupters arranged in a vertical column so that a small variation of the rocked position of the rockable arm 292 can be detected.

However, only with the construction described above, the inclined condition of the paper supply hopper 210 is not taken into consideration in detection by the paper supply sensor 612A. Therefore, means (hopper inclination detection means) (not shown) for detecting the inclined condition of the paper supply hopper 210 is provided for the paper supply hopper position control means 280, and the paper supply sensor 612A takes a result of detection of the hopper inclination detection means into consideration.

Here, taking notice of the fact that a hopper driving pulse signal corresponds to the inclined condition of the paper supply hopper 210, the hopper inclination detection means is constituted from calculation means for calculating driving pulses from a reference position (for example, the lowermost position) of the paper supply hopper 210, and the paper supply sensor 612A discriminates the paper supplying condition in accordance with information from the hopper inclination detection means.

In particular, the paper supply sensor 612A discriminates the paper supplying condition by comparing a detection value of the rocked condition of the rockable arm 292 with a discrimination reference value which is modified in response to information from the hopper inclination detection means.

For example, if the paper supply hopper 210 is at a position tilted forwardly by a great amount, the discrimination reference value is modified to a high value, and accordingly, the paper supply sensor 612A determines the paper supplying condition where the paper supply rollers 220 is at a position displaced upwardly by a great amount. Then, as the inclination of the paper supply hopper 210 decreases, the discrimination reference value is decreased. Consequently, the paper supply sensor 612A determines the paper supplying condition at a stage where the upward displacement of the paper supply rollers 220 is comparatively small.

Even with the arrangement described above, the top face of the paper sheets in the paper supply hopper 210 can always be positioned at an appropriate position and an appropriate paper supplying operation can be performed.

Figure 51:
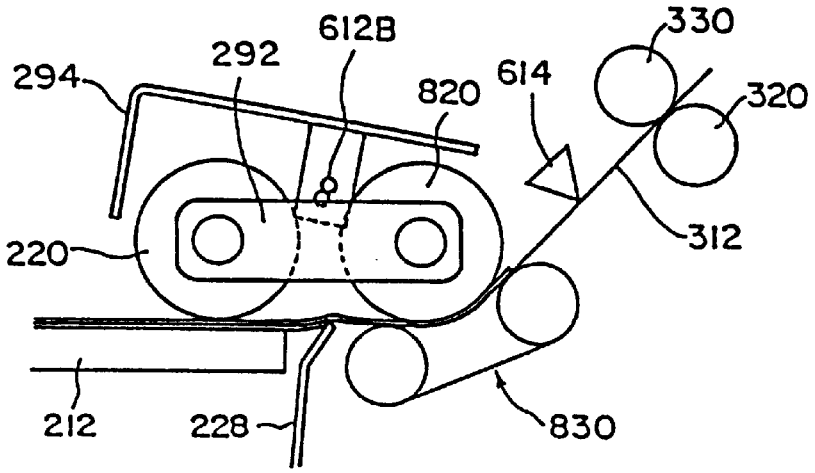
FIG. 51 is a partial side elevational view showing a further form of the paper supply mechanism shown in FIG. 14 when the amount of paper sheets in the paper supply hopper is small.
Figure 52:
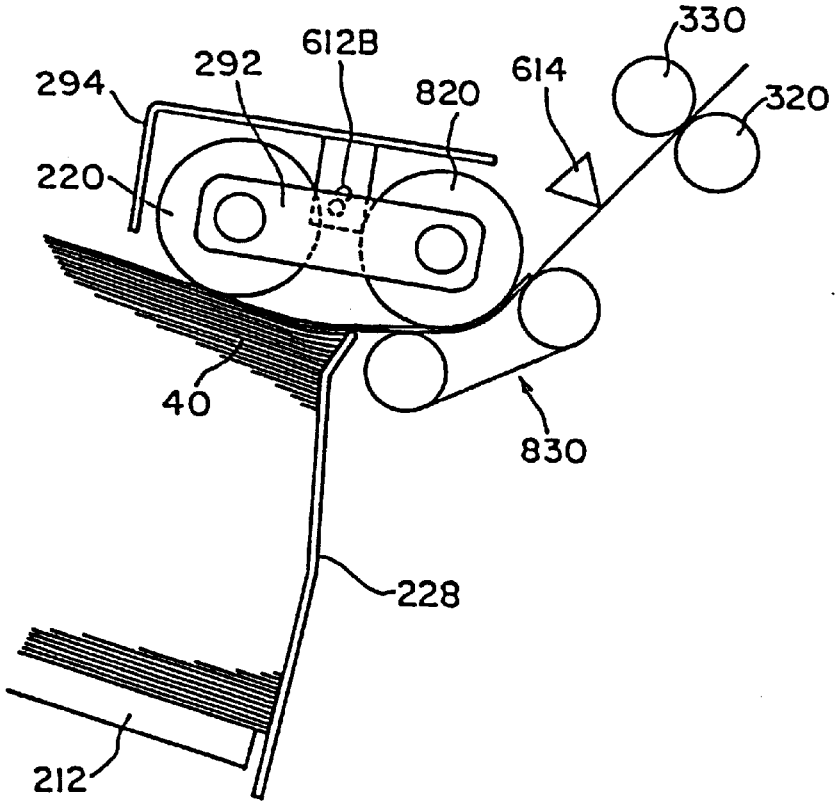
FIG. 52 is a partial side elevational view showing the paper supply mechanism shown in FIG. 51 but when the amount of paper sheets in the paper supply hopper is large.

FIGS. 51 and 52 show another alternative arrangement. Referring to FIGS. 51 and 52, similarly as in the arrangement shown in FIGS. 49 and 50, the paper supply rollers 220 is mounted for rock motion around the axis of the separation roller 820 but the cover 294 for the paper supply rollers 220 is mounted in a stationary condition, and a paper supply sensor 612B is mounted on the stationary cover 294 for detecting the rocked position of the paper supply rollers 220 based on the rocked position of the rockable arm 292.

The paper supply sensor 612B is constituted from, for example, a plurality of photo-interrupters arranged in a vertical column, and the hopper inclination detection means is provided in the paper supply hopper position control means 280.

In the paper supply sensor 612B, one of the photo-interrupters, which is at a position (vertical position) corresponding to a hopper inclination position detected by the hopper inclination detection means, is selected, and the paper supplying condition is determined if a required portion of the rockable arm 292 passes the selected photo-interrupter.

Figure 53:
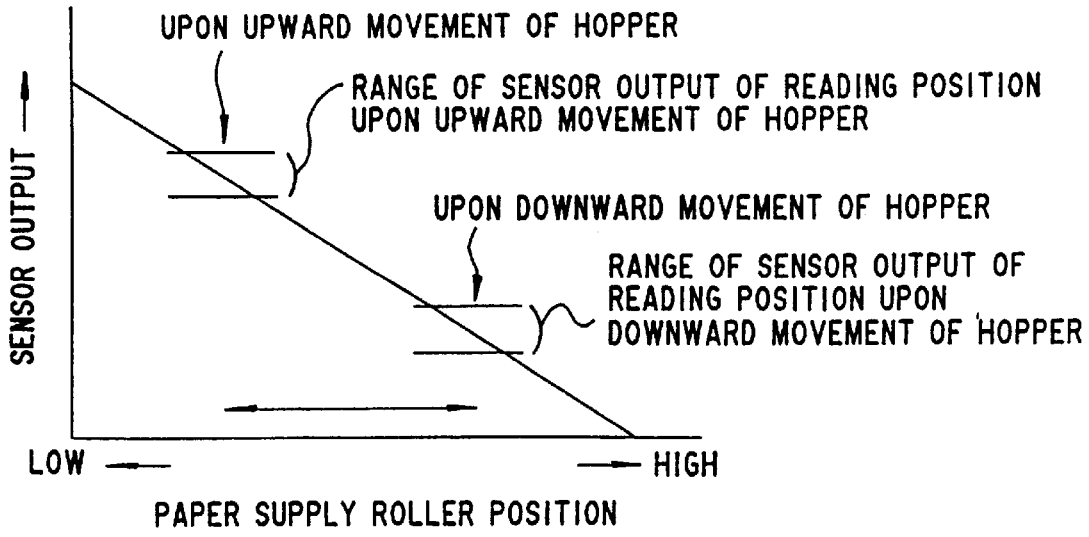
FIG. 53 is a diagrammatic view illustrating detection operation of the paper supply mechanism shown in FIG. 51.

In particular, as seen from FIG. 53, when the paper supply hopper 210 is at a low position, at which it is inclined by a great amount, one of the photo-interrupters at an upper position is selected so that the paper supplying condition is determined when the paper supply rollers 220 are moved upwardly high. However, when the paper supply hopper 210 is at a high position, at which it is inclined by a small amount, one of the photo-interrupters at a lower position is selected so that the paper supplying condition is determined when the paper supply rollers 220 is moved upwardly by a small amount.

Even with the arrangement described above, the top face of the paper sheets can always be held at an appropriate position with respect to the upper end of the gate 228 and an appropriate paper supplying operation can be performed.

Figure 54:
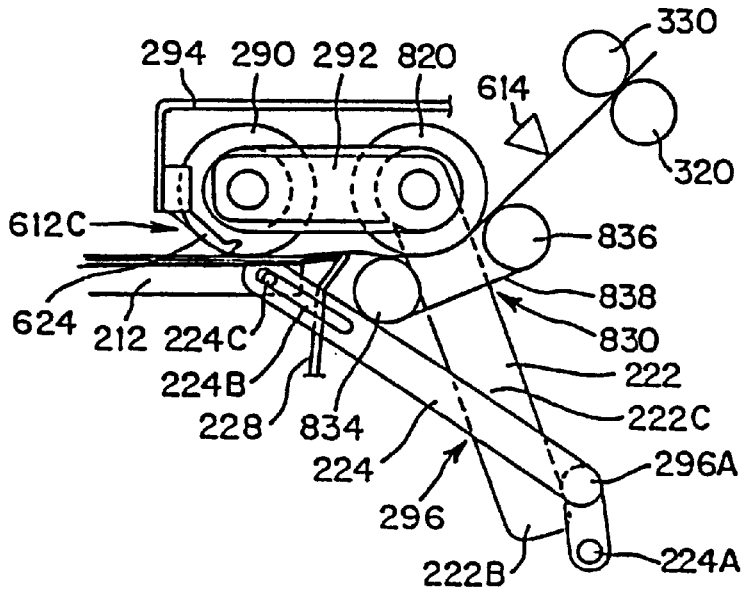
FIG. 54 is a partial side elevational view showing a still further form of the paper supply mechanism shown in FIG. 14 when the amount of paper sheets in the paper supply hopper is small.
Figure 55:
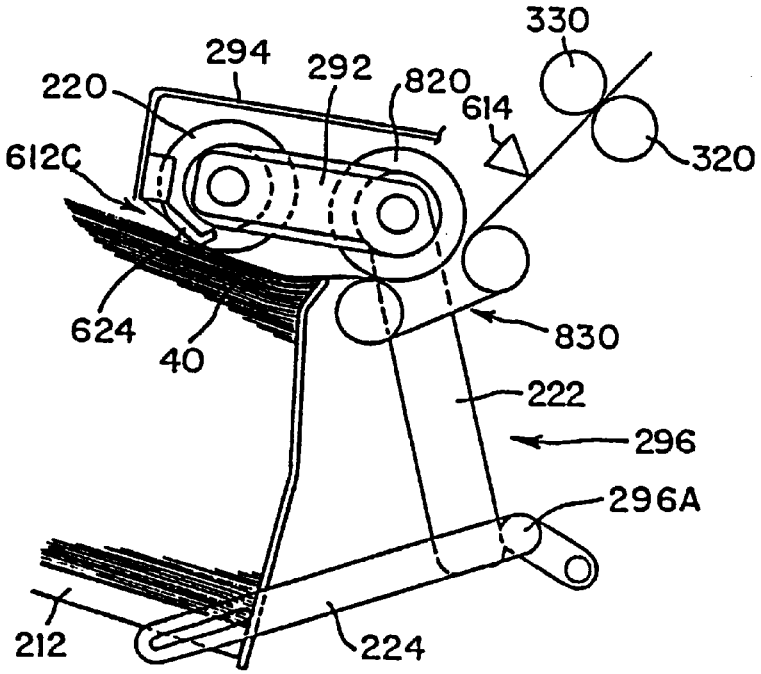
FIG. 55 is a partial side elevational view showing the paper supply mechanism shown in FIG. 54 but when the amount of paper sheets in the paper supply hopper is large.

Also such a further alternative arrangement as shown FIGS. 54 and 55 is available.

Referring to FIGS. 54 and 55, in the arrangement shown, the cover 294 is mounted for rocking motion around the axis of the separation roller 820 integrally with the paper supply rollers 220, and a paper supply sensor 612C is mounted on the cover 294. The paper supply sensor 612C includes a light-weighted rockable arm 624 mounted for pivotal motion to move a free end thereof down to the top face of the paper sheets, and a photo-interrupter not shown provided at a rocking portion of the rockable arm 624. The paper supply sensor 612C determines the paper supplying condition when the top face of the paper sheets comes to a predetermined height corresponding to the paper supply rollers 220.

Meanwhile, an interlocking mechanism 296 is provided for interlocking the height of the paper supply rollers 220, that is, the position of the rockable arm 292, with the inclined condition of the hopper table 212. The interlocking mechanism 296 is constituted from a first interlocking member 222 and a second interlocking member 224 both having similar shapes to those of the embodiment shown in FIGS. 14 and 15, and a stopper pin 296A for causing the first interlocking member 222 and the second interlocking member 224 to cooperate with each other. The position of the rockable arm 292 is controlled by the stopper pin 296A and corresponds to the inclined position of the hopper table 212.

In particular, the first interlocking member 222 has an arm portion 222C which is provided integrally with, and extends obliquely downwardly from, the rockable arm 292, on which the center of rotation of the paper supply rollers 220 is supported for rotation, so that the paper supply rollers 220 may be rocked around the axis of the separation roller 820. Thus, when the paper supply rollers 220 are rocked, also the arm portion 222C of the first interlocking member 222 is rocked by the paper supply rollers 220.

Meanwhile, the second interlocking member 224 is formed as an arm supported for pivotal motion around an arm fulcrum 224A forwardly of a lower portion of the gate 228 (in the paper supplying direction, that is, in the rightward direction in FIGS. 54 and 55) and has an elongated hole 224B formed at a rocking end portion thereof. A pin 224C provided at a front end portion of the hopper table 212, such that it extends sidewardly, is loosely fitted in the elongated hole 224B so that, when the hopper table 212 is moved upwardly or downwardly, the second interlocking member 224 is pivoted by the hopper table 212. Further, the stopper pin 296A is provided at an intermediate bent portion of the second interlocking member 224 in the proximity of the arm fulcrum 224A. An end portion of the arm portion 222C of the first interlocking member 222 is positioned for contacting engagement with an opposing side face of the stopper pin 296A.

Accordingly, when the hopper table 212 is moved upwardly to such a high position as shown in FIG. 54, the second interlocking member 224 is pivoted in the clockwise direction in FIG. 54, whereupon also the stopper pin 296A is turned in the clockwise direction in FIG. 54 around the arm fulcrum 224A until the arm portion 222C of the first interlocking mechanism 222 is contacted with, and stopped by, the stopper pin 296A at a position at which the rockable arm 292 and the paper supply rollers 220 are rocked little and are in substantially horizontal positions. On the other hand, if the hopper table 212 is moved downwardly to such a low position as shown in FIG. 55, the second interlocking member 224 is pivoted in the counterclockwise direction in FIG. 55, whereupon also the stopper pin 296A is turned in the counterclockwise direction around the arm fulcrum 224A. Accordingly, the arm portion 222C of the first interlocking member 222 will not be contacted with the stopper pin 296A unless the rockable arm 292 and the paper supply rollers 220 are rocked so that the paper supply rollers 220 is moved upwardly.

Since the height or vertical position of the paper supply rollers 220 is normally kept corresponding to the inclined position of the hopper table 212 by way of the interlocking mechanism 296 in this manner, the top face of the paper sheets can normally be held at an appropriate position with respect to the upper end of the gate 228 to assure an appropriate paper supplying operation by driving the paper supply hopper 210 to move upwardly until a detection signal of the paper supplying condition is developed from the paper supply sensor 612C.

Figure 56:
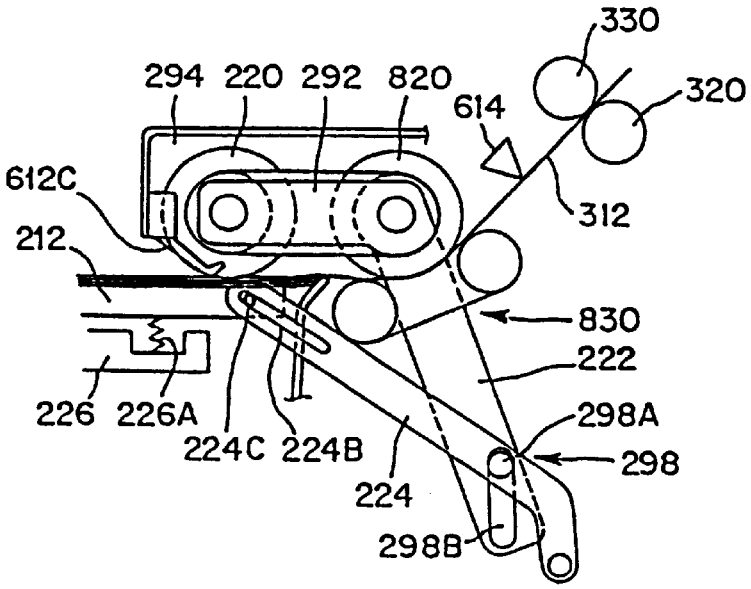
FIG. 56 is a partial side elevational view showing a yet further form of the paper supply mechanism shown in FIG. 14 when the amount of paper sheets in the paper supply hopper is small.
Figure 57:
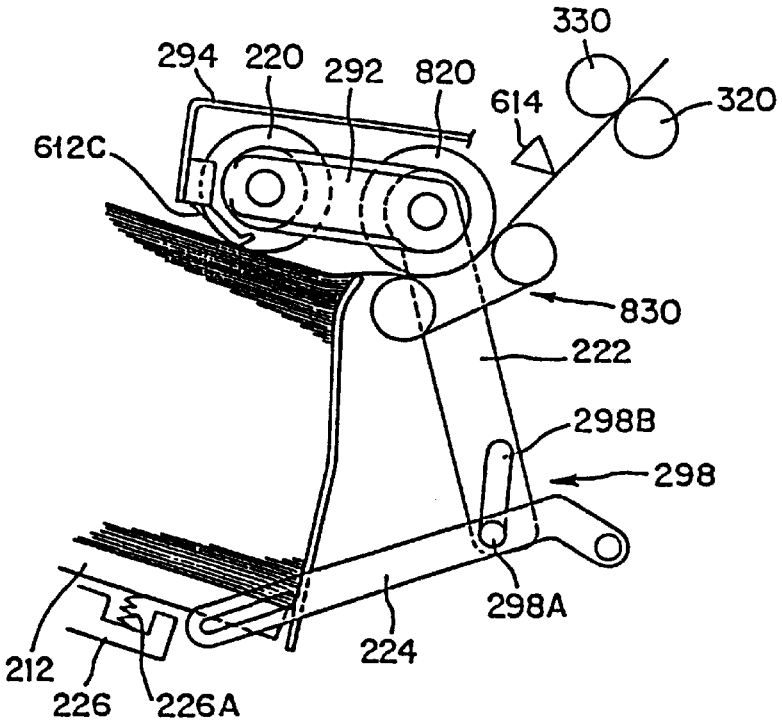
FIG. 57 is a partial side elevational view showing the paper supply mechanism shown in FIG. 56 but when the amount of paper sheets in the paper supply hopper is large.

The interlocking mechanism employed in the arrangement shown in FIGS. 54 and 55 may be modified in such a manner as shown in FIGS. 56 and 57.

Referring to FIGS. 56 and 57, the interlocking mechanism 298 shown includes a first interlocking member 222 and a second interlocking member 224 both having similar profiles to those of the interlocking mechanism in the embodiment shown in FIGS. 14 and 15 or the interlocking mechanism shown in FIGS. 54 and 55, and a pin 298A and an elongated hole 298B for interlocking the first interlocking member 222 and the second interlocking member 224 with each other. The pin 298A is provided at an intermediate bent portion of the second interlocking member 224 in the proximity of the arm fulcrum 224A while the elongated hole 298B is formed in a longitudinal direction in a suitable angle in an end portion of the arm portion 222C of the first interlocking member 222. The pin 298A is loosely fitted in the elongated hole 298B.

With the interlocking mechanism 298, due to the engagement between the elongated hole 298B and the pin 298A, when the hopper table 212 is moved, for example, upwardly as shown in FIG. 56, the second interlocking member 224 is pivoted in the clockwise direction in FIG. 56, whereupon also the pin 298A is turned in the clockwise direction around the arm fulcrum 224A while moving upwardly in the elongated hole 298B to a position at which the rockable arm 292 and the paper supply rollers 220 are rocked little and are in substantially horizontal positions. However, when the hopper table 212 is moved downwardly as shown in FIG. 57, the second interlocking member 224 is pivoted in the counterclockwise direction in FIG. 57, whereupon also the pin 298A is turned in the counterclockwise direction around the arm fulcrum 224A while moving downwardly in the elongated hole 298B to rock the rockable arm 292 and the paper supply rollers 220 in the clockwise direction to move the paper supply rollers 220 upwardly.

Since the height or vertical position of the paper supply rollers 220 is normally kept corresponding to the inclined position of the hopper table 212 by way of the interlocking mechanism 298 in this manner, the top face of the paper sheets can normally be held at an appropriate position with respect to the upper end of the gate 228 to assure an appropriate paper supplying operation by driving the paper supply hopper 210 to move upwardly until a detection signal of the paper supplying condition is developed from the paper supply sensor 612C.

It is to be noted that, in the modified arrangement shown in FIGS. 56 and 57, the hopper table 212 is resiliently supported on a base member 226 by way of a plurality of springs 226A.

Where the paper supply rollers 220 are mounted for rocking motion around the axis 822 of the separation roller 820 and the interlocking mechanism includes the first interlocking member 222 and the second interlocking member 224 while paper supply position detection means 644 is constructed so as to detect the paper supply position in response to movements of the first interlocking member 222 and the second interlocking member 224 in this manner, the paper supply position detection means 644 can be used also as means for detecting that the sheet guide 710 or 740 is not set completely or aa means for detecting that locking by the rotary shaft locking mechanism 890 is incomplete.

In particular, the following case is considered here. If, for example, paper jamming occurs, the apparatus lid 20 will be pivoted upwardly to open the paper transport path 310 between the apparatus lid 20 and the apparatus body 10, and then after the image reading apparatus is restored from the paper jamming, the apparatus lid 20 will be pivoted downwardly to put the paper transport path 310 into a closed condition (condition for use).

In this instance, since the paper supply hopper 210 during ordinary use of the image reading apparatus is at the paper supply position, before the apparatus lid 20 is pivoted upwardly, naturally the paper supply hopper 210 is at the paper supply position and consequently the paper supply sensor 610 serving as the paper supply position detection means 644 is in an on-state (paper supply position detection condition).

Then, when the apparatus lid 20 is pivoted down to put the paper transport path 310 into a closed condition again, if the apparatus lid 20 is closed appropriately, then the paper supply sensor 610 is put into an on-state (paper supply position detection condition), but if the apparatus lid 20 is not closed appropriately, then the relative positional relationship between the first interlocking member 222 and the second interlocking member 224 is different from an ordinary one, and consequently, the paper supply sensor 610 remains in an off-state. If the apparatus lid 20 is not closed appropriately, then the sheet guides 710 and 740 are not set completely. Accordingly, if the paper supply sensor 610 remains in an off-state after the apparatus lid 20 and the apparatus body 10 are closed with each other, then it can be determined that the sheet guides 710 and 740 are not set completely.

If it is detected by the paper supply position detection means 644 (paper supply sensor 610) that the sheet guides 710 and 740 are not set completely in this manner, then this may be notified to an operator by displaying an error message, or the like, on the liquid crystal display unit 922D or lighting an error indication lamp or sounding an alarm. The operator thus can reset the image reading apparatus so that an appropriate paper transporting condition and a correct color reference can be obtained.

Also when the locking by the rotary shaft locking mechanism 890 is incomplete, the relative positional relationship between the first interlocking member 222 and the second interlocking member 224 is different from an ordinary one and the paper supply sensor 610 reacts with this, and accordingly, the incomplete locking of the rotary shaft locking mechanism 890 can be detected. Also in this instance, the detection of the incomplete locking can be notified to an operator so that the image reading apparatus may be reset to establish a correct locking condition of the rotary shaft locking mechanism 890 by the operator.

4-4. Paper Supply Hopper

Figure 58:
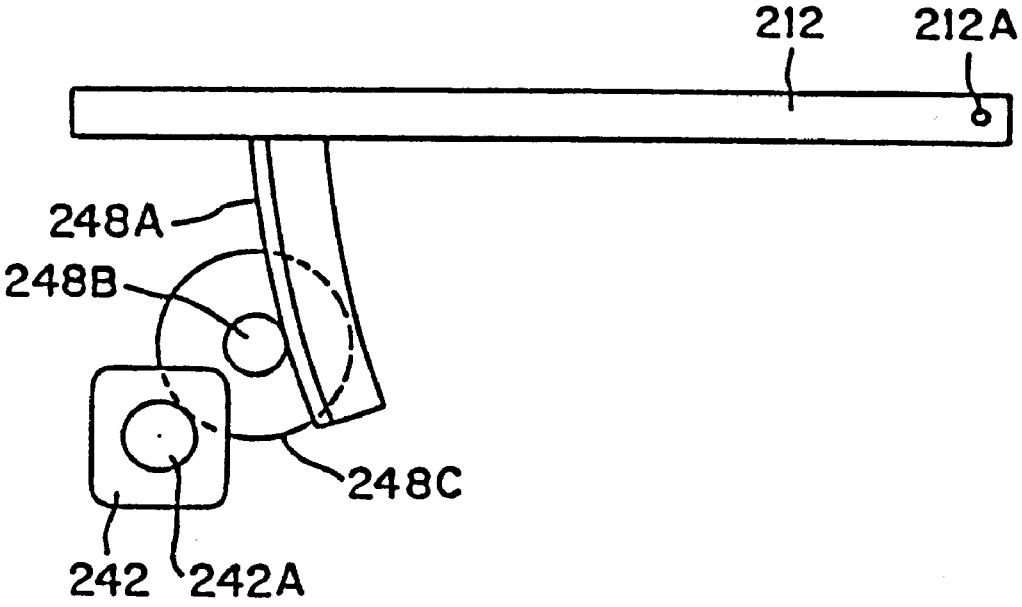
FIG. 58 is a schematic side elevational view showing yet another form of a paper supply hopper driving mechanism of the image reading apparatus of FIG. 4.

The paper supply hopper driving mechanism 240 may be modified such that the hopper motor 242 and the pinion 248B is coupled directly to each other by way of a gear mechanism as shown in FIG. 58. In particular, referring to FIG. 58, a gear 242A is provided on the rotary shaft of the hopper motor 242 while another gear 248C for meshing engagement with the gear 242A is provided on the rotary shaft of the pinion 248B. The modified arrangement allows compact construction of the paper supply hopper driving mechanism 240.

4-5. Paper Skew Prevention Means

Figure 59:
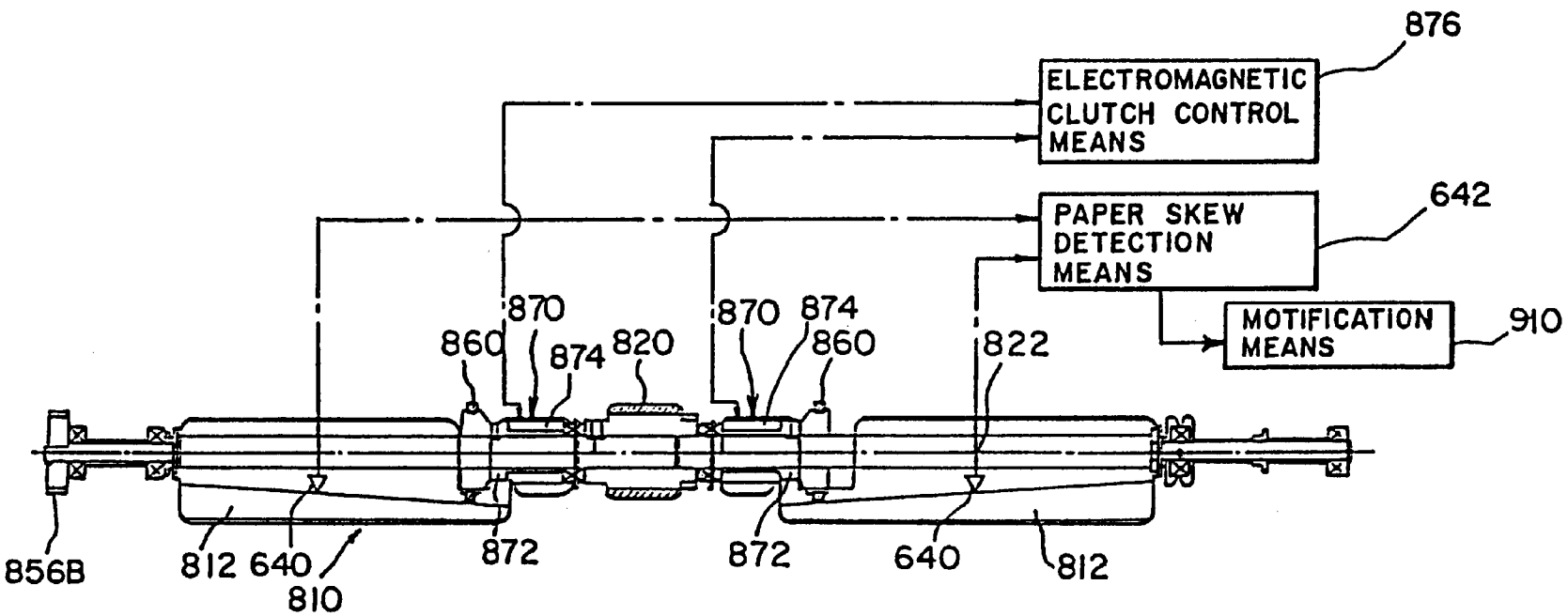
FIG. 59 is a plan view showing another form of a separation roller driving system of the image reading apparatus of FIG. 4.
Figure 60:
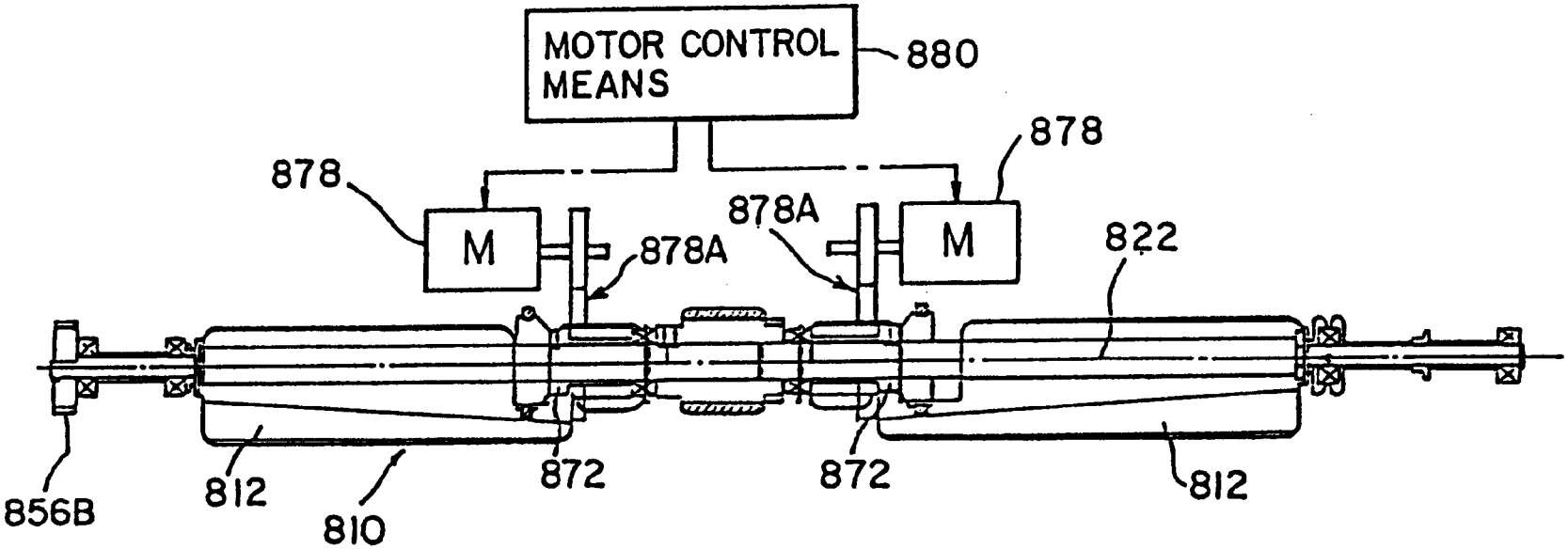
FIG. 60 is a plan view showing a further form of the separation roller driving system of the image reading apparatus of FIG. 4.

The paper skew prevention means may alternatively have such a construction as shown in FIG. 59 or 60. It is to be noted that FIGS. 59 and 60 correspond to FIG. 17(A).

Referring first to FIG. 59, in the paper skew prevention means of the construction shown, the auxiliary rollers 860 are loosely fitted on and coaxial with the axis 822 of the separation roller 820, and an electromagnetic clutch 874 is provided in each of the driving systems 870 for the auxiliary rollers 860. The paper skew prevention means further includes paper guiding condition detection means 640 for detecting paper guiding conditions of the movable guide members 812, and paper skew detection means 642 for detecting a paper skew condition from a difference between the paper guiding conditions of the movable guide members 812 detected by the paper guiding condition detection means 640. The paper skew prevention means further includes electromagnetic clutch control means 876 for controlling the electromagnetic clutches 874 by on/off control in response to a result of the detection by the paper skew detection means 642. Further, a pair of one-way clutches 872 are provided in series in addition to the electromagnetic clutches 874.

In the paper skew prevention means of the construction described above, if a paper skew condition occurs with a paper sheet being transported, differential movements can be provided to the left and right auxiliary rollers 860 thereby to positively correct the paper sheet from the paper skew condition to a correct paper condition. Consequently, a paper skew problem can be prevented.

It is to be noted that the paper guiding condition detection means 640 may be constituted from a pair of photo-sensors which detect passage of an end of a paper sheet. In this instance, if there is a time lag between passages of an end of a paper detected by the left and right photo-sensors, how much skew the paper sheet has, that is, a paper skew condition, can be determined from a magnitude of the time lag by the paper skew detection means 642.

Further, the paper skew prevention means may further include notification means 910 for notifying, when a paper skew occurs, such occurrence of a paper skew based on detection by the paper skew detection means 642. While the notification means 910 may be considered unnecessary if such means for positively correcting a paper skew condition as the electromagnetic clutch control means 876 is provided, if such a case that correction of a paper skew cannot be performed sufficiently by the paper skew correction means is taken into consideration, it is effective to additionally provide the notification means 910 to the paper skew prevention means. It is to be noted that concrete notification means may be, for example, to sound an alarm, to light an alarming lamp or to display a message.

Referring now to FIG. 60, the paper skew prevention means shown includes a pair of motors 878 and associated gear mechanisms 878A for individually driving the auxiliary rollers 860, and, in place of the electromagnetic clutches 874 shown in FIG. 59, motor control means 880 for controlling operation of the motors 878.

In this instance, the motor control means 880 controls the speeds of rotation of the motors 878 of the auxiliary rollers 860 in response to a result of detection by the paper skew detection means 642. Consequently, control to prevent a paper skew can always be performed so that a paper skew condition may not occur.

It is to be noted that also the present paper skew prevention means may additionally include notification means 910 for notifying, when a paper skew occurs, occurrence of such paper skew.

4-6. Backing Portion for a Sheet Guide

The backing portion 712 or 752 of the sheet guide 710 or the auxiliary sheet guide 750 provided along the inclined transport path 312 in an opposing relationship to the image reading unit 410 may have such different forms as shown, for example, in FIGS. 61 to 70. It is to be noted that, while the different forms are described as different forms of the sheet guide 710 in the following description, they may be applied also as different forms of the auxiliary sheet guide 750.

Figure 61:
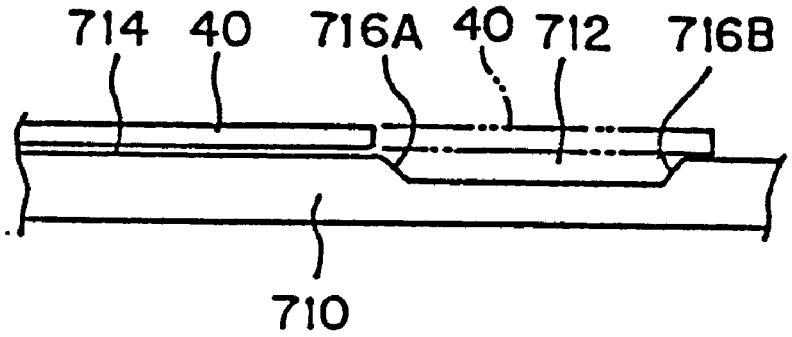
FIG. 61 is a schematic side elevational sectional view showing another form of a backing element and an adjacent member of the image reading apparatus of FIG. 4.

Referring first to FIG. 61, the backing portion 712 for providing a color reference to a paper sheet 40 is concaved with respect to the paper guiding portion 714 for guiding a paper sheet, similarly as in the embodiment described hereinabove. In the present form, however, the backing portion 712 is concaved by providing a pair of steps 716A and 716B, similarly as in the auxiliary sheet guide 750, and the paper guiding portion 714 is formed forwardly and rearwardly of the backing portion 712. Due to the construction, the backing portion 712 does not contact directly with a paper sheet. Further, the steps 716A and 716B are inclined at obtuse angles with respect to the backing portion 712 and the paper guiding portion 714, and consequently, particularly when a paper sheet 40 passes the step 716B on the downstream side (right side in FIG. 61) in the transporting direction, even if, for example, the leading end 46A of the paper sheet 40 contacts with the step 716B, it is guided by the inclined face of the step 716B so that the paper sheet 40 is transported smoothly along the step 716B.

Figure 62:
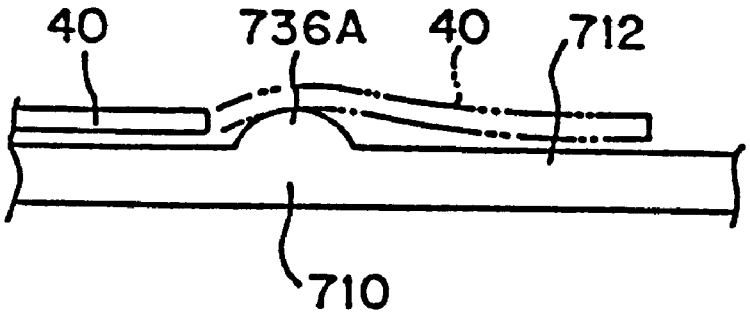
FIG. 62 is a schematic side elevational sectional view showing a further form of the backing element and adjacent member of the image reading apparatus of FIG. 4.
Figure 63:
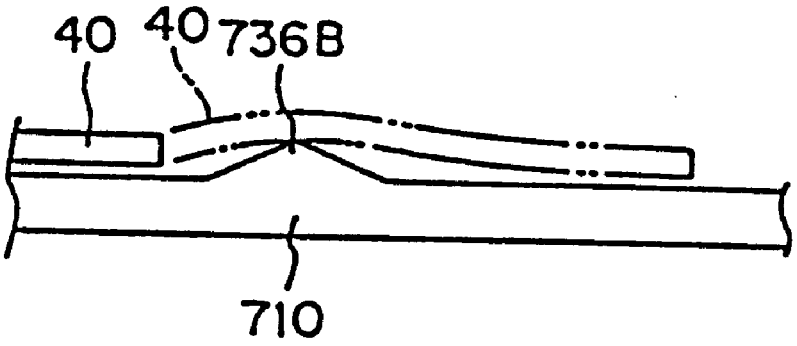
FIG. 63 is a schematic side elevational sectional view showing a still further form of the backing element and adjacent member of the image reading apparatus of FIG. 4.

Meanwhile, in the forms of the backing portion 712 shown in FIGS. 62 and 63, a protrusion 736A or 736B is provided on the paper guiding portion 714 immediately forwardly of the backing portion 712. The shape of the protrusion may be such a curved face shape as shown in FIG. 62 or such a roof-like shape as shown in FIG. 63. A paper sheet 40 is guided by the protrusion 736A or 736B such that it is not contacted directly with the backing portion 712.

Figure 64:
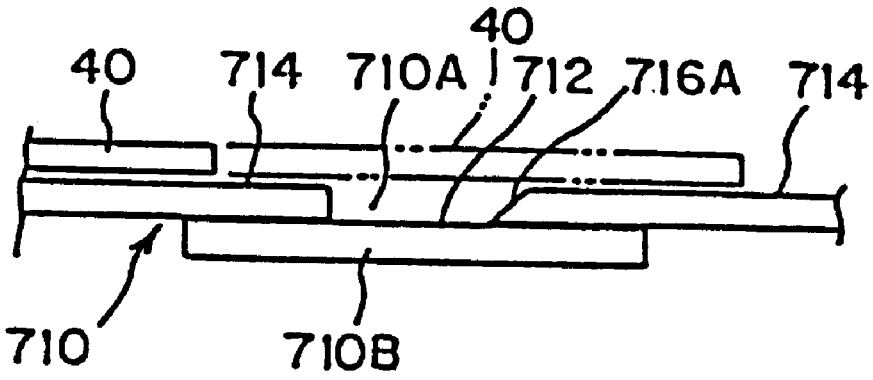
FIG. 64 is a schematic side elevational sectional view showing a yet further form of the backing element and adjacent member of the image reading apparatus of FIG. 4.

Or, the backing portion 712 may be concaved in such a manner as shown in FIG. 64 wherein a slit 710A is formed in the sheet guide 710 and a backing portion 710B of another member is securely mounted on the rear side of the slit 710A. Also in this instance, a step 716A of the backing portion 710B on the downstream side (right side in FIG. 64) in the transporting direction is formed in an obtuse angle so that a paper sheet 40 may be transported smoothly along the same.

In any of the forms described hereinabove, such a construction as described above prevents the backing portion 712 from contacting directly with a paper sheet and prevents sticking of paper powder or soiling substance to the backing portion 712. Consequently, the backing portion 712 can provide an appropriate color reference for a long period of time, which assures high performances and high reliability of the image apparatus and provides advantage in maintenance.

Meanwhile, in the forms shown in FIGS. 65 to 68, a slit 710A is formed in the sheet guide 710, and a backing member 720 formed as a tubular rotary member is provided on the rear side of the slit 710A. In any of the forms, the backing member 720 in the form of a rotary member provides, at an outer circumferential face 720A thereof, a color reference to a paper sheet 40, and is supported for rotation so that the circumferential face 720A thereof may move in the paper transporting direction.

Figure 65:
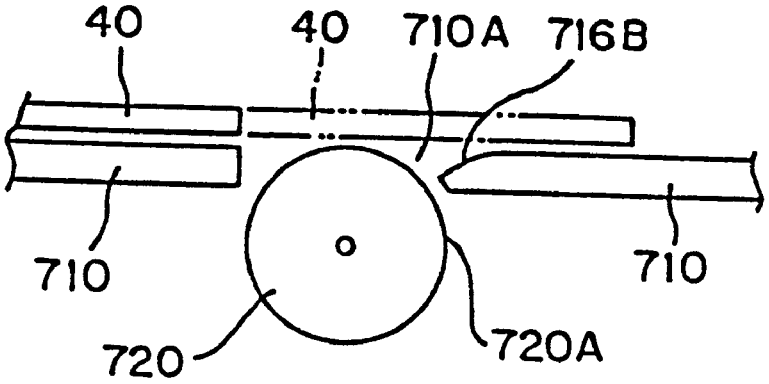
FIG. 65 is a schematic side elevational sectional view showing a yet further form of the backing element and adjacent member of the image reading apparatus of FIG. 4.

In particular, in the form shown in FIG. 65, no particular driving means is provided, but the backing member 720 is supported for smooth rotation so that, when a paper sheet 40 being transported is contacted with the circumferential face 720A of the backing member 720, the circumferential face 720A is moved readily in the paper transporting direction by the paper sheet 40. Accordingly, the paper sheet 40 being transported does not contact with the circumferential face 720A of the backing member 720. Consequently, otherwise possible sticking of paper powder or soiling substance to the circumferential face 720A, which provides a color reference, is reduced, and accordingly, the backing member 720 can provide an appropriate color reference for a long period of time, which assures high performances and high reliability of the image apparatus and provides advantage in maintenance.

Figure 66:
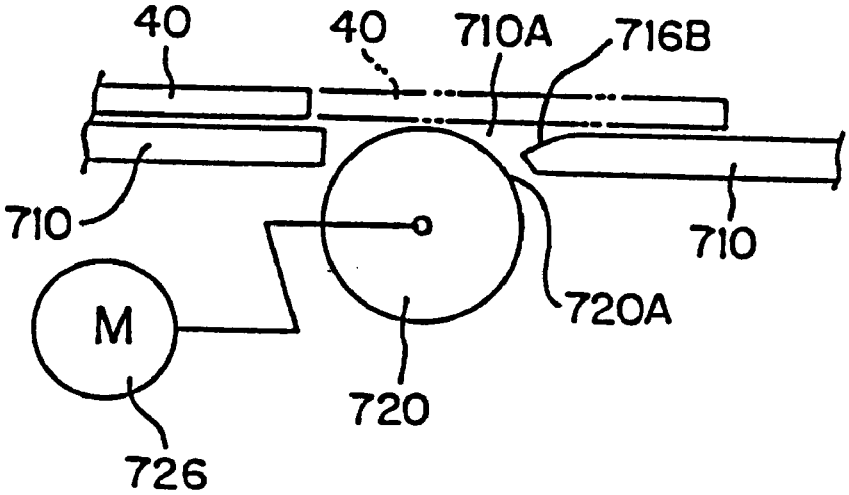
FIG. 66 is a schematic side elevational sectional view showing a yet further form of the backing element and adjacent member of the image reading apparatus of FIG. 4.
Figure 67:
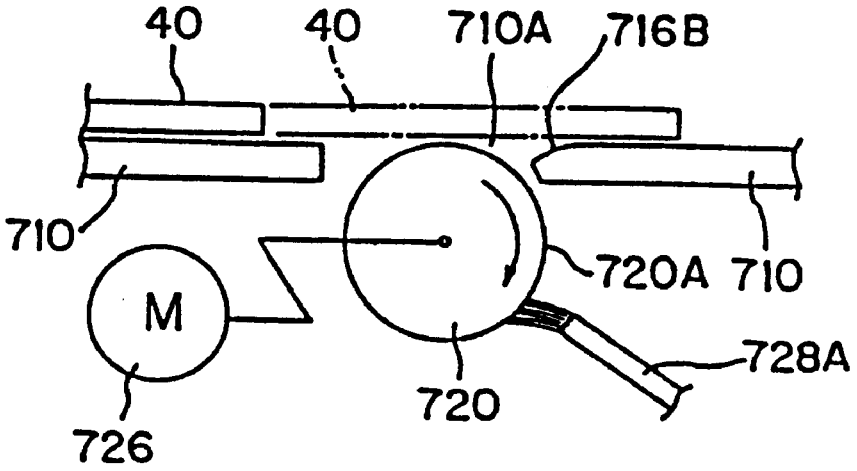
FIG. 67 is a schematic side elevational sectional view showing a yet further form of the backing element and adjacent member of the image reading apparatus of FIG. 4.
Figure 68:
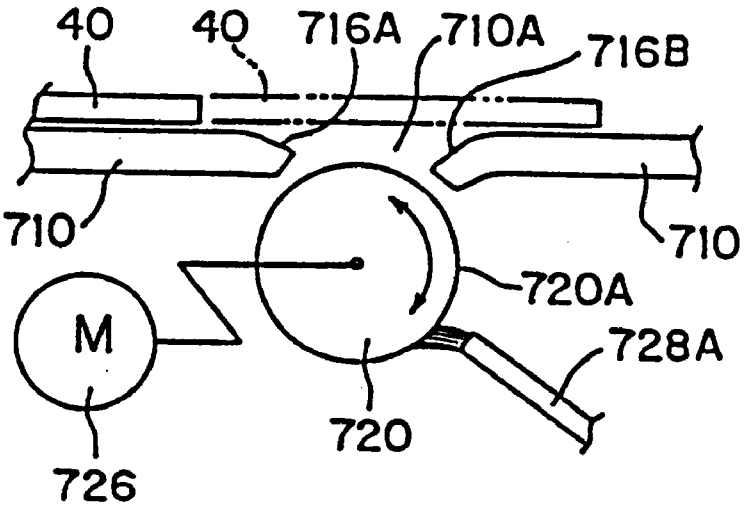
FIG. 68 is a schematic side elevational sectional view showing a yet further form of the backing element and adjacent member of the image reading apparatus of FIG. 4.

On the other hand, the forms shown in FIGS. 66 to 68 include a motor 726 for driving the backing member 720 to rotate. In particular, at least in the forms shown in FIGS. 66 and 67, the motor 726 drives the backing member 720 to rotate such that the speed of movement of the backing member 720 may coincide with the transportation speed of a paper sheet 40 being transported. Accordingly, also in those forms, the paper sheet 40 being transmitted does not contact with the circumferential face 720A of the backing member 720. Consequently, otherwise possible sticking of paper powder or soiling substance to the circumferential face 720A which provides a color reference is reduced, and accordingly, the backing member 720 can provide an appropriate color reference for a long period of time, which assures high performances and high reliability of the image apparatus and provides advantage in maintenance.

Particularly in the form shown in FIG. 67, a brush 728A is provided for sliding contact with the circumferential face 720A of the backing member 720 so that paper powder or soiling substance sticking to the circumferential face 720A may be automatically removed by the brush 728A when the backing member 720 rotates. Consequently, the backing member 720 can provide an appropriate color reference for a longer period of time, which assures higher performances and higher reliability of the image apparatus and provides higher advantage in maintenance.

Meanwhile, in the form shown in FIG. 68, the backing member 720 is provided in a suitably spaced relationship from the inclined transport path 312 so that the circumferential face 720A thereof may not contact with a paper sheet 40 being transported. Also the backing member 720 is driven to rotate by a motor 726. In this instance, however, the backing member 720 need not specifically be driven to rotate such that the speed of movement of the circumferential face 720A thereof coincides with the transportation speed of a paper sheet 40 being transported. The reason why the backing member 720 is driven to rotate here is that it is intended to allow paper powder or soiling substance sticking to the circumferential face 720A of the backing member 720 being rotated to be automatically removed by a brush 728A provided for sliding contact with the circumferential face 720A of the backing member 720 similarly as in the several forms described above. In the form of the construction just described, since the circumferential face 720A of the backing member 720 does not contact with a paper sheet 40 being transported, soiling to the circumferential face 720A is naturally little, and besides, paper powder or soiling substance sticking to the circumferential face 720A is automatically removed by the brush 728A. Accordingly, the backing member 720 can provide an appropriate color reference for a very long period of time, which assures high performances and high reliability of the image apparatus and provides high advantage in maintenance.

Further, in the form shown in FIGS. 69(A) to 69(C) or 70(A) to 70(C), a backing member 722 or 724 is constructed for movement in an interlocking relationship with an opening or closing movement of the apparatus lid 20 by way of an interlocking mechanism 730 or 732. Also a brush 728B or 728C is provided for cleaning the backing member 722 or 724 in response to a movement of the backing member 722 or 724. Each of the backing members 722 and 724 is provided on the rear side of a slit 710A formed in the sheet guide 710.

Figure 69A:
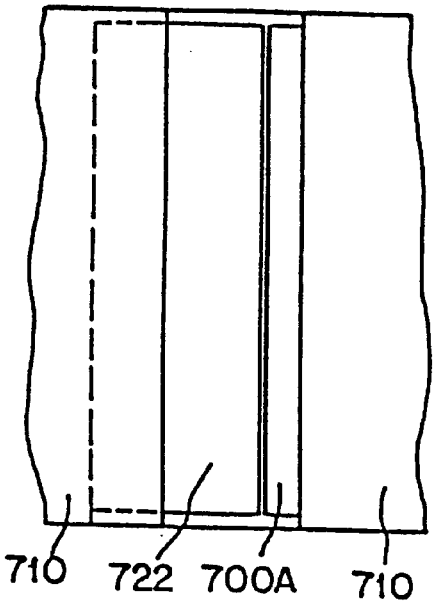
FIG. 69(A) is a schematic plan view showing a yet further form of the backing element and adjacent member of the image reading apparatus of FIG. 4 and FIGS. 69(B) and 69(C) are schematic side elevational sectional views the backing element and adjacent member shown in FIG. 69(A)
Figure 69B:
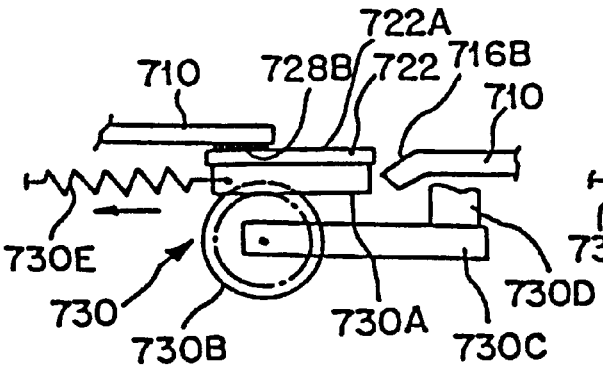
Figure 69C:
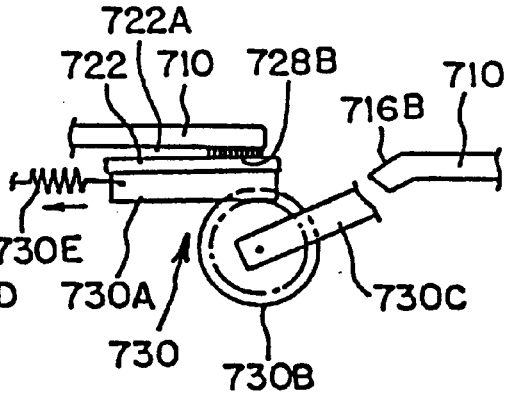

In particular, in the form shown in FIGS. 69(A) to 69(C), the backing member 722 provides, at a surface (upper face) 722A thereof formed as a plate, a color reference to a paper sheet.

The interlocking mechanism 730 for moving the backing member 722 includes a rack-and-pinion mechanism including a rack 730A provided on the rear face of the backing member 722 and a pinion 730B secured at a position at which it meshes for rotation with the rack 730A, an arm 730C provided integrally with the pinion 730B, a stopper 730D for contacting with an end portion of the arm 730C, and a spring 730E for biasing the backing member 722 in its opening (non-use) direction.

In the present form, the backing member 722 is used at such a position at which it covers over the slit 710A as seen from FIGS. 69(A) and 69(B). This position of the backing member 722 is realized by restricting pivotal motion of the arm 730C by means of the stopper 730D. In particular, the stopper 730D is provided on and for integral displacement with the apparatus lid 20. Here, when the apparatus lid 20 is closed so that the image reading apparatus may be used, the stopper 730D is displaced downwardly as seen in FIG. 69(B), but when the apparatus lid 20 is opened, the stopper 730D is displaced upwardly in FIG. 69(B) by the apparatus lid 20.

If the stopper 730D is displaced upwardly in this manner, then pivotal motion of the arm 730C is not restricted any more, and consequently, the arm 730C is rocked upwardly by the biasing force of the spring 730E, whereupon the pinion 730B is rotates in the counterclockwise direction in FIG. 69(B) to move the backing member 722 in the leftward direction in FIG. 69(B) to its opening position (non-use condition) as shown in FIG. 69(C).

On the contrary, if the apparatus lid 20 in the non-use condition is closed, then the stopper 730D is returned downwardly to displace the backing member 722 from the non-use condition shown in FIG. 69(C) to the use condition shown in FIG. 69(B).

The brush 728B is provided on the rear face of the sheet guide 710 for sliding contact with the surface 722A of the backing member 722 so that, when the backing member 722 is moved between the use condition and the non-use condition in this manner, it removes soiling substance to the surface 722A of the backing member 722.

Figure 70A:
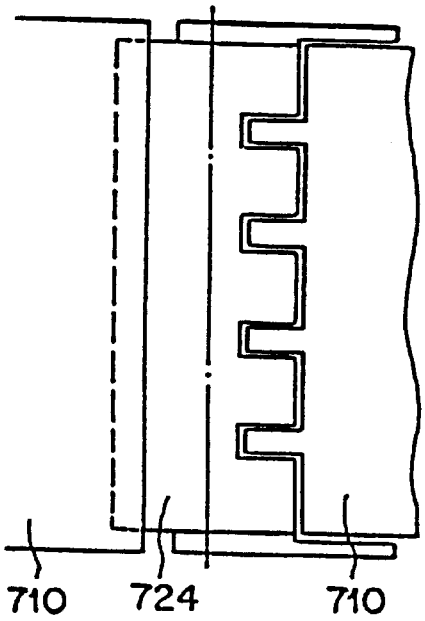
FIG. 70(A) is a schematic plan view showing a yet further form of the backing element and adjacent member of the image reading apparatus of FIG. 4 and FIGS. 70(B) and 70(C) are schematic side elevational sectional views the backing element and adjacent member shown in FIG. 70(A)
Figure 70B:
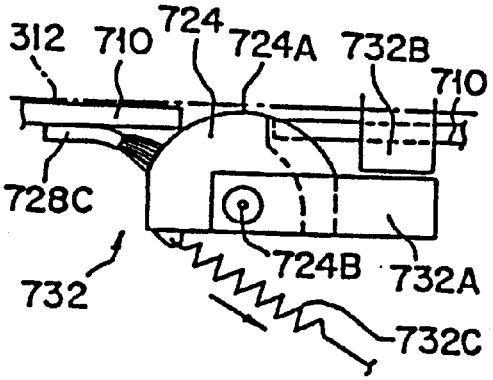

Meanwhile, in the form shown in FIGS. 70(A) to 70(C), the backing member 724 is constructed as a rotary member which has a semi-cylindrical circumferential face 724A and rotates around a shaft 724B, and it provides, at the circumferential face 724A thereof, a color reference to a paper sheet.

The interlocking mechanism 732 for moving the backing member 724 includes an arm 732A provided integrally with the backing member 724, a stopper 732B for contacting with an end portion of the arm 732A, and a spring 732C for biasing the backing member 724 to its non-use condition.

With the interlocking mechanism 732, the backing member 724 assumes its use condition in a posture in which the circumferential face 724A thereof is directed toward the slit 710A as seen in FIGS. 70(A) and 70(B). In this instance, the stopper 732B restricts pivotal motion of the arm 732A to hold the use condition of the backing member 724. In particular, the stopper 732B is provided on the apparatus lid 20 for integral displacement with the apparatus lid 20. Here, when the apparatus lid 20 is closed so that the image reading apparatus may be used, the stopper 732B is displaced downwardly, as seen in FIG. 70(B), but when the apparatus lid 20 is opened, the stopper 732B is displaced upwardly in FIG. 70(B) by the apparatus lid 20.

If the stopper 732B is displaced upwardly in this manner, pivotal motion of the arm 732A is not restricted any more, and consequently, the arm 732A is rocked upwardly in FIG. 70(B) by the biasing force of the spring 732C to rotate the backing member 724 in the counterclockwise direction in FIG. 70(B).

On the other hand, if the apparatus lid 20 in the open condition is closed, then the stopper 732B is returned downwardly to displace the backing member 724 from the non-use condition shown in FIG. 70(C) to the use condition shown in FIG. 70(B).

It is to be noted that, as shown in FIG. 70(A), the backing member 724 and the sheet guide 710 have, at end faces adjacent the slit 710A thereof, complementary concave and convex portions which alternately enter each other so that a paper sheet 40 may be transported smoothly at a boundary location between the backing member 724 and the sheet guide 710 on the downstream side.

The brush 728C is provided on the rear face of the sheet guide 710 for sliding contact with the circumferential face 724A of the backing member 724 so that, when the backing member 724 moves between the use condition and the non-use condition in this manner, it may remove soiling substance from the circumferential face 724A of the backing member 724.

Figure 70:
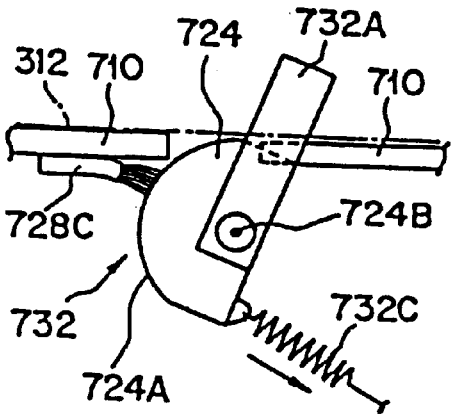

In this manner, with any of the forms shown in FIGS. 69 and 70, each time the apparatus lid 20 is opened and closed, paper powder or soiling substance sticking to the surface 722A, or the circumferential face 724A of the backing member, is automatically removed by the brush 728B or 728C. Accordingly, the backing member can provide an appropriate color reference for a very long period of time, which assures high performances and high reliability of the image apparatus and provides high advantage in maintenance.

Figure 71:
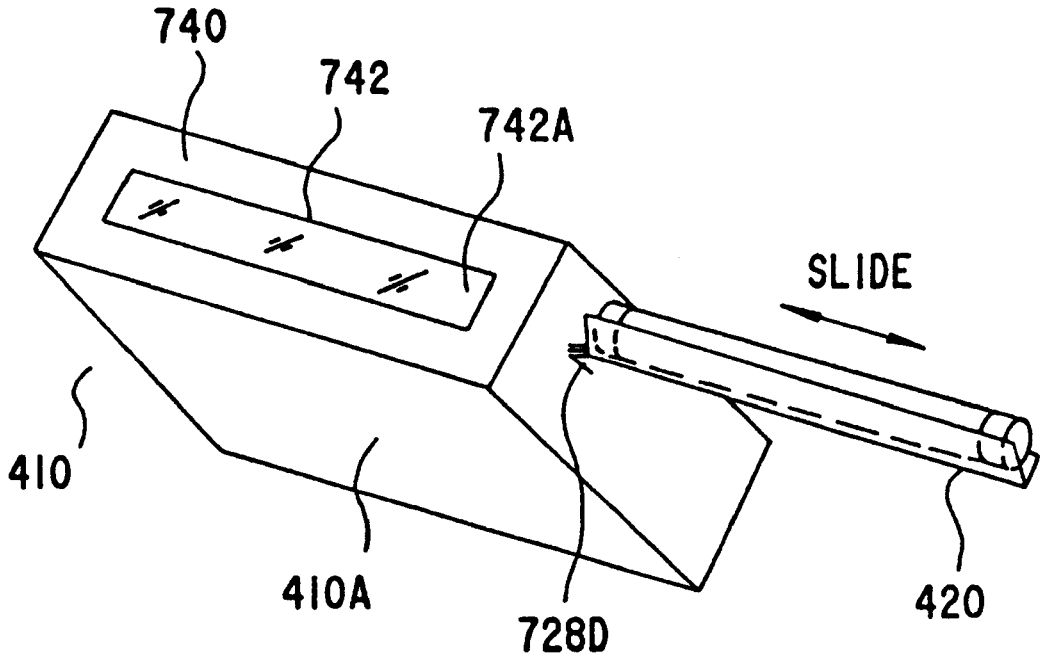
FIG. 71 is a perspective view of a form of a cleaning structure for a sheet guide with an opening of the image reading apparatus of FIG. 4.

Meanwhile, the image reading unit 410 may possibly be constructed such that, as shown in FIG. 71, a sheet guide 740 having an opening 742 is provided integrally with a casing 410A of the image reading unit 410 and a glass plate 742A is provided in the opening 742. In this instance, the lamp unit 420 has a socket element which is structured so as to allow the socket element to be pulled out from the casing 410A in order to replace a lamp. With the structure, however, when the inner side of the glass plate 742A is soiled, the soil cannot be removed readily.

Therefore, in this instance, a brush 728D is provided at an interior end portion of the socket element such that it may slidably contact with the inner side of the glass plate 742A. Thus, when the socket element is pulled out from the casing 410A in order to replace the lamp, the inner side face of the glass plate 742A is automatically cleaned by the brush 728D. Consequently, an appropriate color reference can be provided for a very long period of time, which assures high performance and high reliability of the image apparatus and provides high advantage in maintenance. In this instance, the brush 728D is located such that, when the socket element is set in position in the casing 410A, it does not make an obstacle to image reading.

4-7. Structure of the Paper Discharge Roller and Associated Elements

Figure 72:
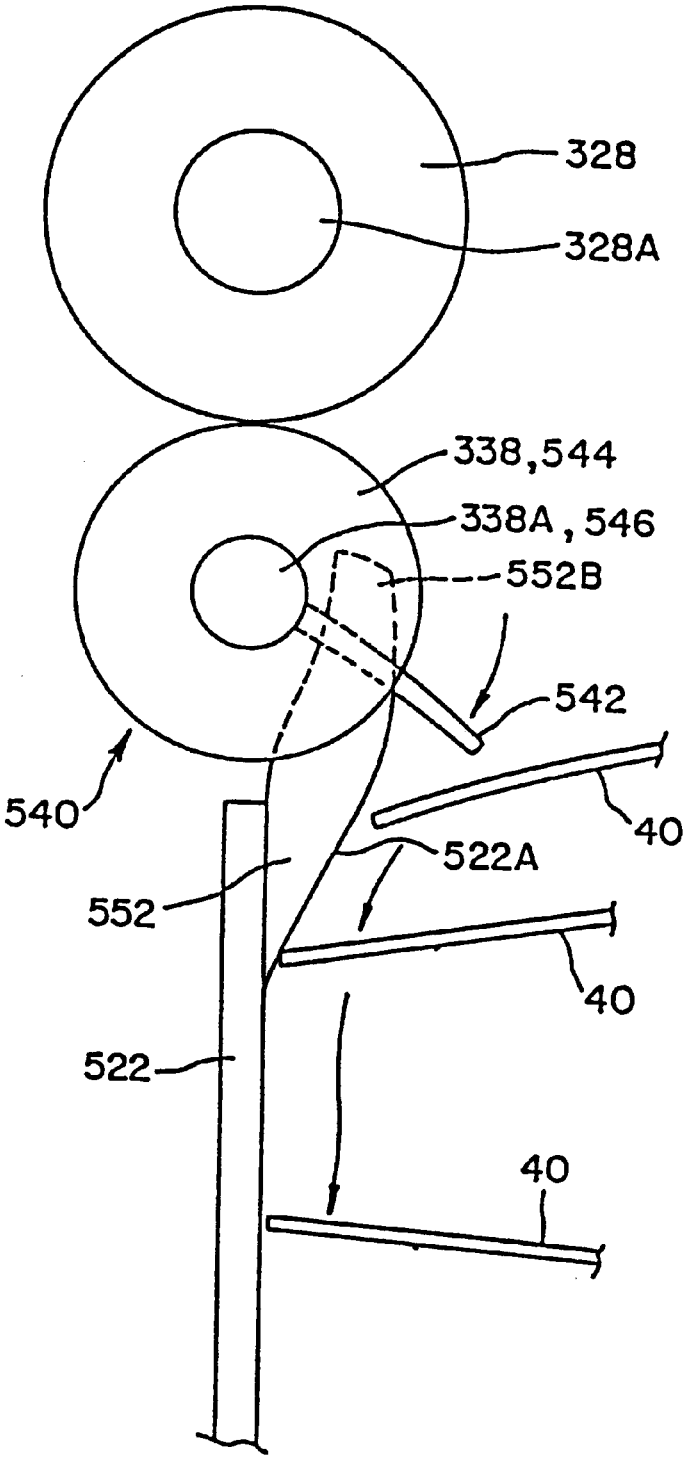
FIG. 72 is a schematic side elevational view showing another construction of the paper discharge roller mechanism in the image reading apparatus of FIG. 4.

While the paper discharge roller 544 of the paper discharge roller mechanism 540 in the embodiment is provided on the common shaft to the paper discharging roller 328, the paper discharge roller 544 may otherwise be provided on the common shaft to the idler roller 338, as shown, for example, in FIG. 72.

In particular, referring to FIG. 72, the rotary shaft 338A of the idler roller 338 serves also as the rotary shaft 546 of the paper discharge roller 544 so that the paper discharge roller 544 may be rotated integrally with the idler roller 338.

The paper discharge roller 544 is provided between each adjacent ones of a plurality of idler rollers 338 disposed in a suitably spaced relationship from each other on the rotary shaft 338A and has a projection 542 extending outwardly. The projection 542 is in the form of a tab extending outwardly farther than the outer peripheries of the idler rollers 338 and is made of a resilient flexible material so that it may be resiliently yielded when it is contacted with the opposing paper discharging roller 328 or the end frame 522.

Meanwhile, the paper trailing end guide members 552 are formed such that upper end portions 552B thereof extend by such a great extent as to project between gaps between the paper discharge roller 544 and the idler roller 338.

Due to the structure described above, the projections 542 project into the paper reversing transport path 314 of the paper transport path 310 so that, when a paper sheet 40 being transported comes there, they push up the trailing end of the paper sheet 40 to guide it so that it may be discharged into the paper stacking mechanism 500. Further, the thus discharged paper sheet 40 is guided at the trailing end thereof by the projections 542 and the guide face 552A of the paper trailing end guide member 552 so that it moves down along the end frame 522 as seen in FIG. 72. Consequently, the paper sheet 40 is stacked regularly on the paper stacker 510.

4-8. Image Reading Unit System

The discrimination mark 50 may be constructed in such a manner as described below.

In particular, the discrimination mark 50 may be constituted from a combination of a plurality of marks. In this instance, for example, when information on a read face of a paper sheet is read, some other information such as, for example, read area information can be read simultaneously. Consequently, reading of image information can be performed efficiently, and an increase in processing speed in image reading can be promoted while assuring the reliability.

Meanwhile, the discrimination mark 50 may be marked in a drop-out color which cannot be read by the optical image reading units 412 and 414. In this instance, an optical discrimination mark image reading unit 470 (refer to a chain line block in FIG. 7) for exclusive use for reading the discrimination mark 50 of the drop-out color may be provided so that control by the image information extraction control means 440 may be performed based on detection information of the optical discrimination mark image reading unit 470.

Where the construction just described is employed, since image information to be read originally, which does not include image information of a discrimination mark, is read by the optical image reading unit 410, appropriate image information can be obtained. Further, where a pair of such optical discrimination mark image reading units 470 are provided on the upstream side of the optical image reading units 412 and 414 along the paper transport path 310 as seen in FIG. 7, a discrimination mark can be read before a paper sheet 40 advances into the optical image reading unit 412 or 414. Consequently, it is advantageous also in that image information extraction control can be performed appropriately.

Naturally, the image information extraction control is performed based not only on a discrimination mark but also on a result of selection by the paper reading selection means 924L.

Further, while it depends upon setting of an indication of a discrimination mark, such optical discrimination mark image reading unit 470 may be provided on one side or both sides of the optical image reading unit 412 side and the optical image reading unit 414 side with respect to the paper transport path 310.

4-9. Paper Stacking Mechanism

Subsequently, alternative forms of the paper stacking mechanism 500 will be described.

Figure 73:
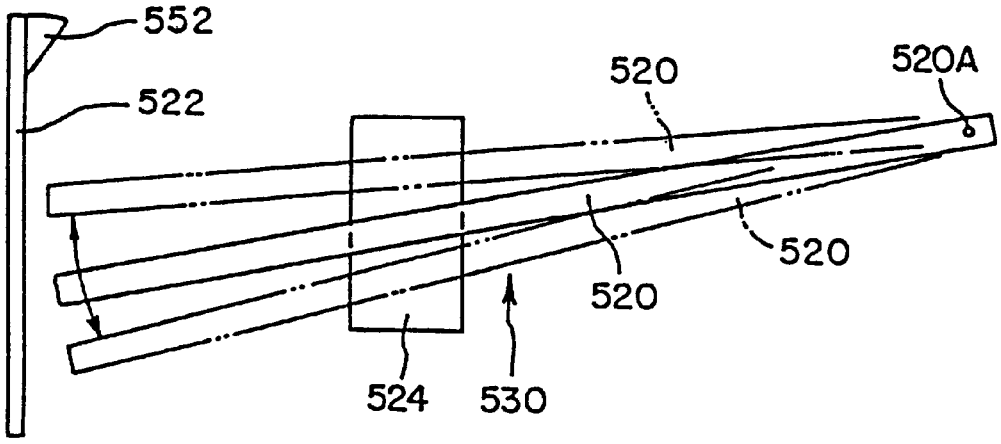
FIG. 73 is a schematic side elevational view showing another form of a paper stacking mechanism in the image reading apparatus of FIG. 4.

The paper stacking mechanism 500 in the embodiment includes the paper stacker position variation mechanism 530 in which the position of the paper stacker 510 is adjusted manually by selecting the insertion holes 522A into which the fitting projections 526 should be inserted. However, the paper stacker position variation mechanism 530 may be modified in such a manner as shown in FIG. 73 wherein the stacker table 520 of the paper stacker 510 is supported, at a base end portion (right end portion in FIG. 73) thereof, for pivotal motion around a fulcrum 520A such that a front end portion of the stacker table 520 may be moved upwardly or downwardly thereby to allow manual adjustment of the paper stacker 510.

In this instance, a latch mechanism 524 may be provided which allows a downward movement of the stacker table 520 but does not allow an upward movement of the stacker table 520 unless the stacker table 520 is unlatched from the latch mechanism 524. Thus, if the front end portion of the stacker table 520 is manually pushed downwardly, the stacker table 520 is moved down and thereafter held at the lowered position. Then, if the stacker table 520 is unlatched from the latch mechanism 524, the stacker table 520 is returned to its uppermost position. The construction just described is advantageous in that the stacker table 520 can be moved down to a suitable position readily by a simple operation.

Although the position of the paper stacker 510 can be adjusted in advance with the paper stacker position variation mechanism 530 of the embodiment or the paper stacker position variation mechanism 530 described just above, the amount of paper sheets which can be stacked in the paper stacker 510 varies depending upon the position of the paper stacker 510 adjusted in advance in this manner.

Thus, such a situation should be eliminated that the amount of paper sheets stacked in the paper stacker 510 exceeds the amount of paper sheets which can be stacked on the paper stacker 510 at the position adjusted in advance and some paper sheets may overflow from the paper stacker 510.

Figure 74:
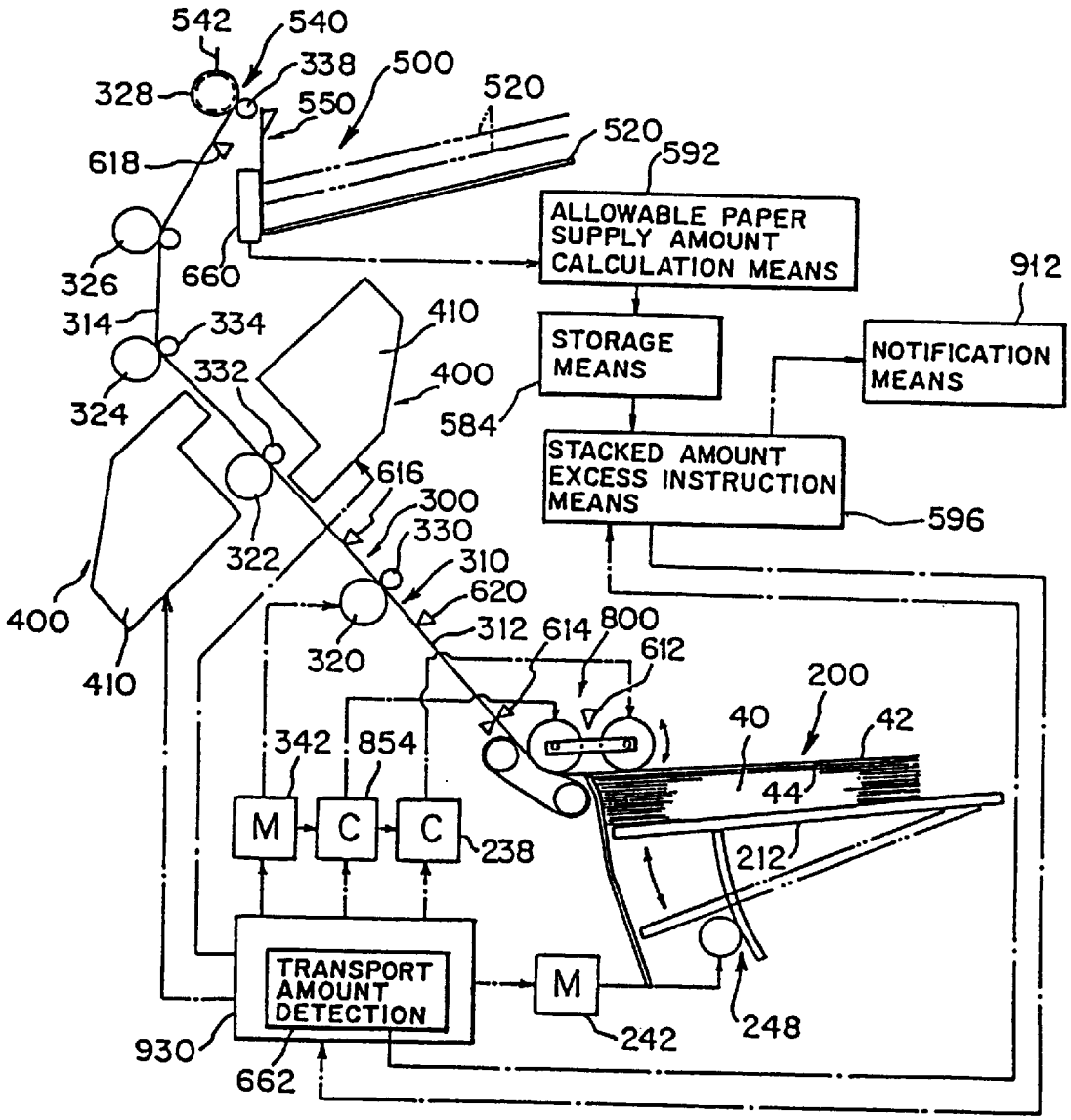
FIG. 74 is a schematic diagrammatic view showing a control system where the paper stacking mechanism shown in FIG. 73 is employed.

To this end, the image reading apparatus may additionally include, for example, as shown in FIG. 74, paper stacker position detection means 660 for detecting the position of the paper stacker 510, allowable paper supply amount detection means 592 for calculating, based on a result of detection of the paper stacker position detection means 660, an allowable paper supply amount by which paper sheets can be supplied from the paper stacker 510 at the adjusted position, storage means 584 for storing the allowable paper supply amount calculated by the allowable paper supply amount detection means 592, transportation amount detection means 662 for detecting a transportation amount of paper sheets 40, and stacked amount excess instruction means 596 for comparing a detection amount detected by the transportation amount detection means 662 with the allowable paper supply amount stored in the storage means 584 and developing, when the detection amount exceeds the allowable paper supply amount, an instruction to render the notification means 912 operative to notify such excess and another instruction to stop transportation of paper sheets 40.

It is to be noted that the transportation amount of paper sheets can be detected, for example, by counting the number of transported paper sheets based on paper passage information from various sensors, such as the transportation sensors 614 and 616 and the discharge sensor 618, or by counting the number of issued start commands for paper transportation, or the like. Such a counter device, which is generally provided in the control section 930 as mention above, can be employed as the transportation amount detection means 662.

Generally, the allowable paper supply amount detection means 592, the storage means 584 and/or the stacked amount excess instruction means 596 are incorporated in the control section 930.

Due to the means described above, such a disadvantage that paper sheets overflow from the paper stacker 510 is eliminated.

The means described above may be modified such that, if the detection amount detected by the transportation amount detection means 662 exceeds a value smaller than the allowable paper supply amount stored in the storage means 584 (for example, available paper supply amount×0.9), this is notified from the stacked amount excess instruction means 596 by way of the notification means 912, and, when the detection amount detected by the transportation amount detection means 662 thereafter reaches the allowable paper supply amount stored in the storage means 584, an instruction to stop transportation is developed.

Where the stacked amount excess instruction means 596 is constructed in such a manner described just above, if the paper stacking mechanism 500 is constructed such that the stacker table 520 can be moved downwardly to adjust its position readily by a simple operation (refer to FIG. 73) also while paper sheets are stacked on the stacker table 520, then if an operator manually adjusts the stacker table 520 in response to a notification from the notification means 912, the allowable paper supply amount increases at this stage. Consequently, the disadvantage that paper sheets overflow from the paper stacker 510 can be eliminated without stopping operation of the image reading apparatus. In this instance, a transportation amount from starting of the operation is compared with the new allowable paper supply amount, and if a required condition is reached, then the notification means 912 is rendered operative again.

Alternatively, the transportation amount detection means 662 described above may be replaced by hopper vertical movement amount detection means 664 for detecting a vertical movement amount of the paper supply hopper 210 (a vertical movement amount of the hopper table 212) such that the paper stacker 510 is controlled in response to an amount of vertical movement of the paper supply hopper 210 detected by the hopper vertical movement amount detection means 664.

Figure 75:
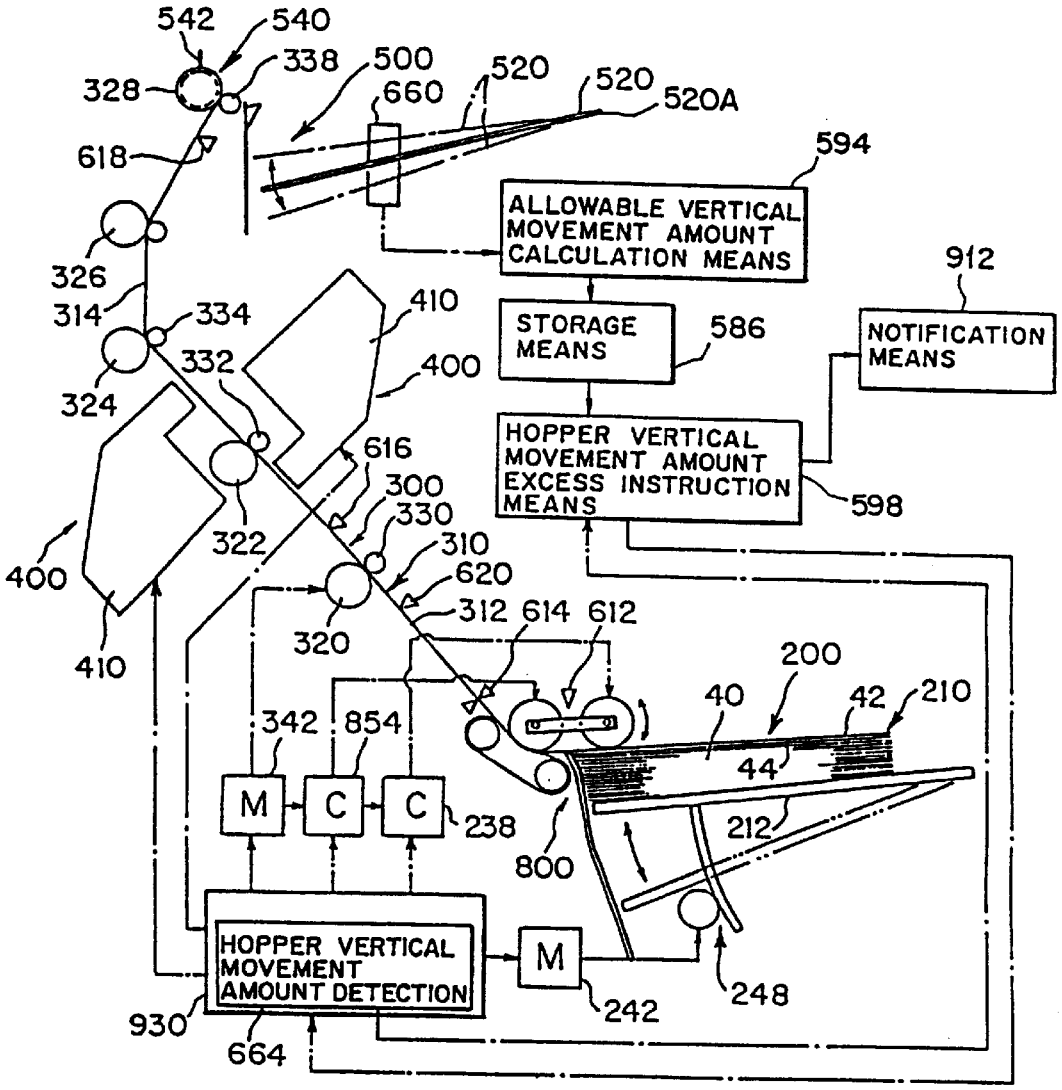
FIG. 75 is a similar view but showing another control system where the paper stacking mechanism shown in FIG. 73 is employed.

In particular, the image reading apparatus includes, as shown in FIG. 75, paper stacker position detection means 660 for detecting the position of the paper stacker 510, allowable verticle movement amount calculation means 594 for calculating an allowable vertical movement amount of the paper supply hopper 210 corresponding to the position of the paper stacker 510 based on a result of detection by the paper stacker position detection means 660, storage means 586 for storing the allowable vertical movement amount calculated by the allowable vertical movement amount calculation means 594, hopper vertical movement amount detection means 664 for detecting a vertical movement amount of the hopper table 212 of the paper supply hopper 210, and hopper vertical movement amount excess instruction means 598 for comparing a detection amount detected by the hopper vertical movement amount detection means 664 and the allowable vertical movement amount stored in the storage means 586 and developing, when the detection amount exceeds the allowable vertical movement amount, an instruction to render the notification means 912 operative to notify such excess and another instruction to stop transportation of a paper sheet.

It is to be noted that, since the vertical movement amount of the paper supply hopper 210 can be obtained by counting hopper vertical movement pulses outputted from the control section 930, such a counting function section which is generally provided in the control section 930 can be used as the hopper vertical movement amount detection means 664.

Further, the allowable vertical movement amount calculation means 594, the storage means 586 and/or the hopper vertical movement amount excess instruction means 598 are generally incorporated in the control section 930.

Due to the construction, such a disadvantage that paper sheets overflow from the paper stacker 510 is eliminated.

Also in this instance, the image reading apparatus may be constructed such that the notification means 912 is rendered operative at a stage before the vertical movement amount of the paper stacker 510 reaches the allowable vertical movement amount and then transportation of a paper sheet is stopped after the allowable vertical movement amount is reached. Where the construction just described is employed, the disadvantage that paper sheets overflow from the paper stacker 510 can be eliminated without stopping operation of the image reading apparatus.

By the way, while, in the various forms described above, the paper stacker position variation mechanism 530 is constructed such that the position of the stacker table 520 can be moved upwardly and downwardly by manual operation, the paper stacker position variation mechanism 530 may otherwise be constructed so as to operate automatically.

Figure 76:
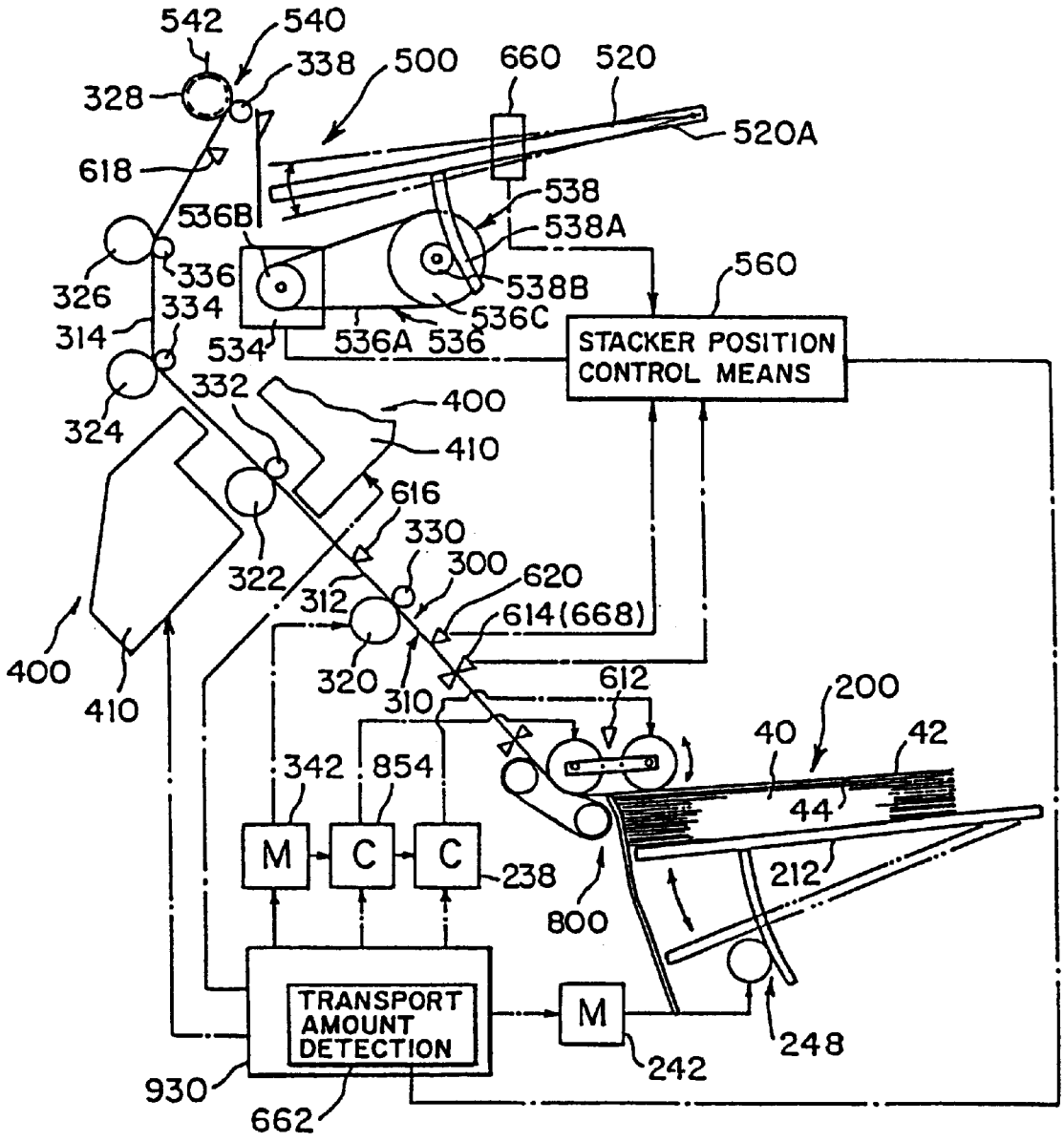
FIG. 76 is a similar view but showing a further form of the paper stacking mechanism in the image reading apparatus of FIG. 4 and a control system for the paper stacking mechanism.

For example, the paper stacker position variation mechanism 530 may be constructed in a similar manner to the paper supply hopper driving mechanism 240 as shown in FIG. 76. In particular, referring to FIG. 76, the paper stacker position variation mechanism 530 is constructed such that the stacker table 520 is mounted for pivotal motion around a fulcrum 520A at a rear or trailing end portion thereof in the paper discharging direction (at a right end portion in FIG. 76), and a driving motor (stacker motor) 534 serving as a stacker table pivoting driving mechanism for driving the stacker table 520 to pivot is provided.

A stepper motor may be employed as the driving motor 534, and the driving motor 534 and the stacker table 520 are connected to each other by way of a belt-and-pulley mechanism 536 including a belt 536A and a pair of pulleys 536B and 536C, and a rack-and-pinion mechanism 538 including a rack 538A and a pinion 538B. In particular, the pulley 536B is mounted on a rotary shaft of the driving motor 534 while the other pulley 536C is mounted on a rotary shaft of the pinion 538B, and the rack 538A is provided on the stacker table 520. It is to be noted that, similarly as in the form of the paper supply hopper driving mechanism 240 described hereinabove with reference to FIG. 58, the rotary shaft of the driving motor 534 and the rotary shaft of the pinion 538B may be connected to each other by way of a gear mechanism.

The paper stacker position variation mechanism 530 which employs the driving motor 534 described above requires means (stacker position control means) for controlling operation of the mechanism paper stacker position variation mechanism 530. The control means may be constructed, for example, in such a manner as shown in FIG. 76.

In particular, referring to FIG. 76, the control means shown includes paper stacker position detection means 660 for detecting the position of the paper stacker 510, that is, the vertical position of the stacker table 520, transportation amount detection means 662 for detecting a transportation amount of paper sheets 40, paper size detection means 620 for detecting the size of a paper sheet 40 transported, and paper thickness detection means 668 for detecting the thickness of a transported paper sheet 40. The stacker position control means 560 thus controls the driving motor 534 of the paper stacker position variation mechanism 530 in response to results of detection of the detection means 660, 662, 620 and 668 so that the vertical position of the stacker table 520 may be a suitable position corresponding to the paper transport amount, the paper size and the paper thickness.

It is to be noted that the paper thickness detection means 668 may include a light transmission sensor and detect an approximate thickness of a paper sheet from an amount of transmission light detected by the light transmission sensor. Further, the stacker position control means 560 is normally incorporated in the control section 930.

Meanwhile, in control based on the size of a paper sheet, for example, when the size of a paper sheet is small, a paper sheet discharged likely "dances", and if the plane onto which the thus discharged paper sheet is to be stacked (the plane corresponds to the top face of paper sheets stacked already; the plane will be hereinafter referred to as stack plane) is excessively low with respect to the discharging position of the paper sheet from the discharge roller, the paper sheet is not in most cases stacked in position. Therefore, where paper sheets of a small size are used, the stacker table 520 is adjusted to a comparatively high position so that the stack plane may be located near to the discharging position.

In contrast, when paper sheets of a large size are used, if the plane (stack plane) onto which a discharged paper sheet is to be stacked is near to the discharging position, the discharge paper sheet is acted upon by a sliding resistance from the stack plane and is not stacked well in position. Therefore, where the size of paper sheets used is large, the stacker table 520 is adjusted to a comparatively low position so that the stack plane may be spaced by a great distance from the discharging position.

Naturally, in any case, the stacker table 520 is controlled to be moved down based on the thickness of a paper sheet and the number of transported paper sheets so that the stack plane may always be positioned suitably for the size of paper sheets with respect to the discharging position.

In particular, since the stack plane, that is, the top face of paper sheets stacked on the stacker table 520, rises as paper sheets are successively stacked, in order to keep the stack plane at a predetermined position, the stacker table 520 should be moved down by a distance corresponding to a total thickness of paper sheets stacked on the stacker table 520 from its initial position.

Since the total thickness of paper sheets stacked on the stacker table 520 is calculated as a product of the thickness of a single paper sheet (paper thickness) and the number (transportation paper number) of paper sheets stacked on the stacker table 520, the stacker table 520 can be controlled to be moved down appropriately in response to the thickness of a paper sheet and the transportation paper number.

With the paper stacker position variation mechanism 530 of the construction described above, a paper sheet discharged can always be stacked smoothly for various paper sizes from a small size to a large size.

It is to be noted that, since standard paper sheets having a standard thickness which is not particularly thick nor particularly thin are generally used, if this is presupposed, even if position control of the stacker table 520 based on the transport paper number is performed without taking the paper thickness into consideration, discharged paper sheets can be stacked sufficiently well.

Further, also with regard to the paper size, if paper sheets used do not have an extremely large or small size, discharged paper sheets can be stacked sufficiently well even if position control of the stacker table 520 is performed without taking the paper size into consideration.

Figure 77:
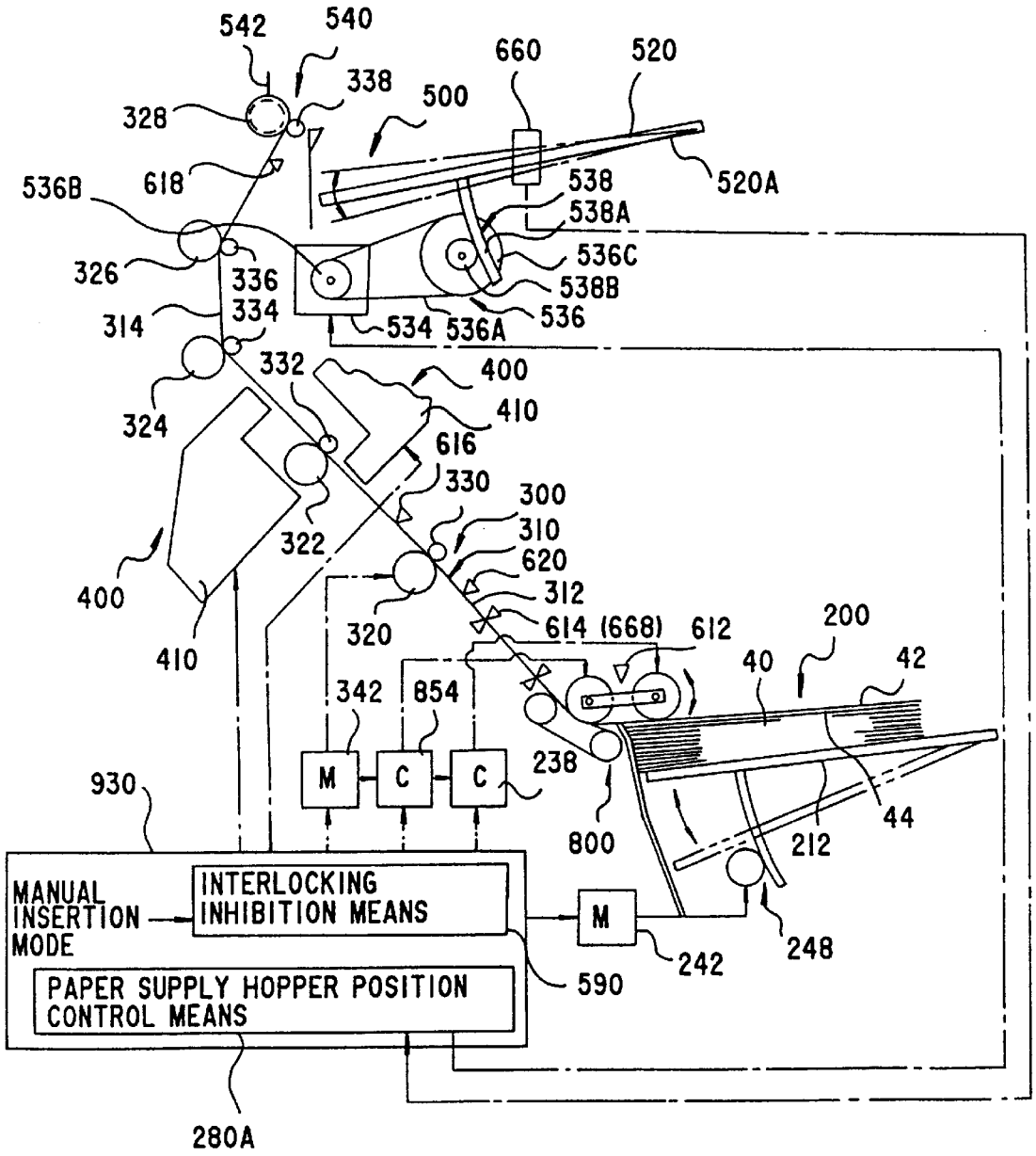
FIG. 77 is a similar view showing the paper stacking mechanism shown in FIG. 76 and another form of the control system for the paper stacking mechanism.

Further, the image reading apparatus may include, as shown in FIG. 77, interlocking means 580 for interlocking the position control of the stacker table 520 with a paper supply position adjusting operation of the paper supply mechanism 200 to operate the paper stacker position variation mechanism 530.

In particular, referring to FIG. 77, the paper supply mechanism 200 raises the position of the hopper table 212 as paper sheets 40 in the paper supply hopper 210 decrease. In contrast, in the paper stacking mechanism 500, as paper sheets 40 in the paper supply hopper 210 decrease, the paper sheets are stacked into the paper stacker 510. Accordingly, the position of the stacker table 520 should be moved down in response to the movement of the position of the hopper table 212.

Here, paper supply hopper position control means 280A outputs to the hopper motor 242 a control signal to raise the position of the hopper table 212 and outputs to the driving motor 534 another control signal to lower the position of the stacker table 520. Thus, the interlocking means 580 is constituted from the paper supply hopper position control means 280A.

Also the position control of the stacker table 520 may be performed in response to an actual stacker position detected by the paper stacker position detection means 660.

By the way, while the amount of the upward movement of the hopper table 212 and the amount of the downward movement of the stacker table 520 have a relationship to each other, the weight of paper sheets stacked on the stacker table 520 when air is included between the paper sheets is considerably greater than the weight of the paper sheets which were originally accommodated in the hopper table 212. Such difference in paper weight can be eliminated by setting the amount of downward movement of the stacker table 520 considerably greater than the amount of upward movement of the hopper table 212.

It is to be noted that the interlocking means 580 may be modified such that the paper stacker 510 is driven simultaneously with the paper supply hopper 210 by the hopper motor 242. In particular, the hopper motor 242 and the pinion 538B on the paper stacker 510 side are connected to each other by way of, for example, a gear mechanism so that, when the paper supply hopper 210 is moved upwardly, the paper stacker 510 is moved down at a required rate. In this instance, the driving motor 534 is eliminated naturally.

Further, while the image reading apparatus has the manual insertion mode in addition to the automatic modes in which a paper sheet is automatically supplied and transported, since, in the manual insertion mode, the position adjustment of the hopper table 212 is not performed and the top face of the hopper table 212 is kept at a prescribed height, if position control of the stacker table 520 is performed in an interlocking relationship with a paper supply position adjustment operation, then also the position of the stacker table 520 is kept fixed. However, also in the manual insertion mode, paper sheets are successively stacked onto the stacker table 520. Accordingly, it is inconvenient if the position of the stacker table 520 is fixed. Therefore, such interlocking means 580 includes interlocking inhibition means 590 for inhibiting an interlocking operation in the manual insertion mode.

In the manual insertion mode, the position of the stacker table 520 may be adjusted manually as in the image reading apparatus of the embodiment described above, or the position of the stacker table 520 may be automatically controlled in response to a transportation number of paper sheets as described above or additionally taking the thickness or the size of a paper sheet into consideration.

Figure 78:
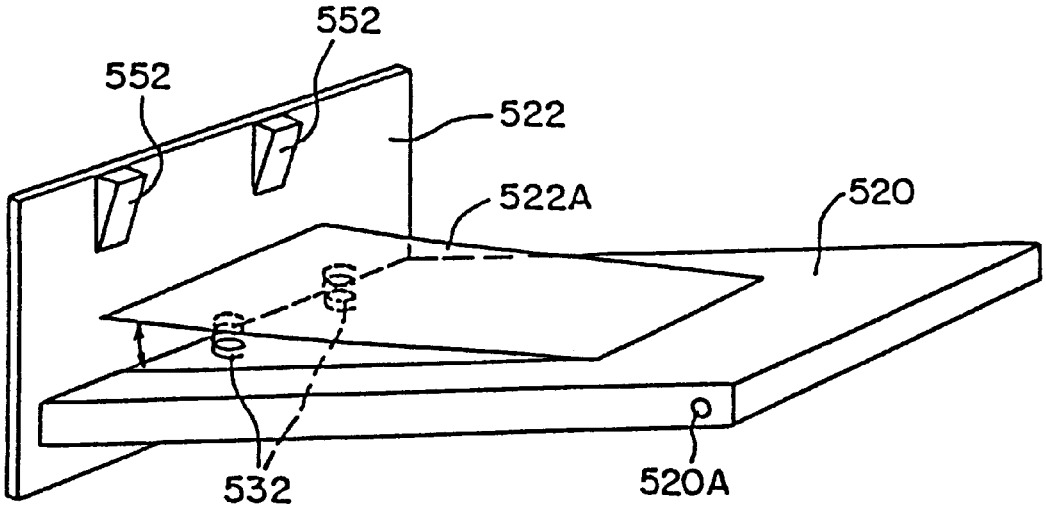
FIG. 78 is a schematic perspective view showing a still further form of the paper stacking mechanism in the image reading apparatus of FIG. 4.

Further, the stacker table 520 may be constructed so as to be partially or entirely movable by way of a resilient member 532 (FIG. 78).

For example, as shown in FIG. 78, a central portion of the stacker table 520 on the front end side is divisionally formed as a movable table 520B of a small size. The movable table 520B is, for example, supported at a rear end thereof for pivotal motion and is normally biased upwardly by a pair of spring (resilient members) 532 provided on the lower face of a front end portion of the movable table 520B.

With the stacker table 520 of the construction just described, when the amount of paper sheets stacked thereon is small, the movable table 520B is positioned at an upward position by the biasing forces of the springs 532, but when the amount of stacked paper sheets increases, the movable table 520B is moved down by the weight of the thus stacked paper sheets against the biasing forces of the springs 532. When the movable table 520B is moved down to its lowermost position, the movable table 520B cooperates with a stacker table body 520C, which is the remaining portion of the stacker table 520, to present a flat upper face.

Accordingly, the plane on which a paper sheet is to be stacked (the top face of stacked paper sheets) can be maintained at an optimum position by suitably setting the springs 532.

Figure 79:
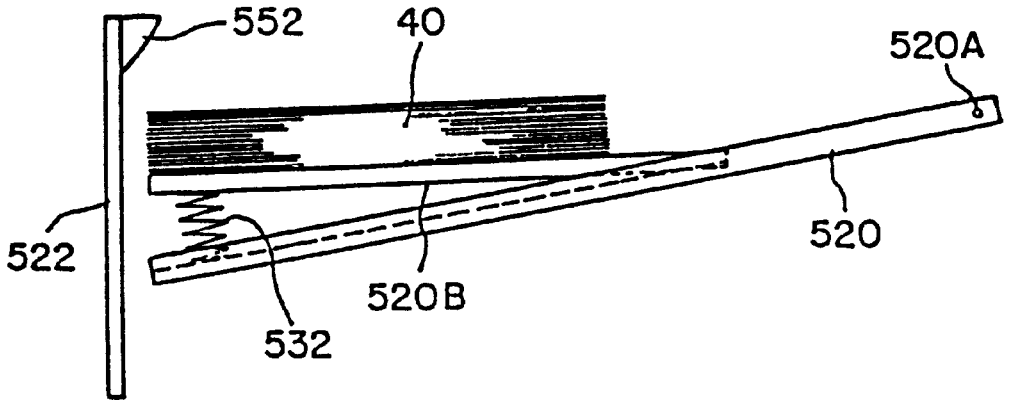
FIG. 79(A) is a schematic side elevational view of the paper stacking mechanism shown in FIG. 78 when it accommodates paper sheets of a small size.
FIG. 79(B) is a similar view but showing the paper stacking mechanism when it accommodates paper sheets of a large size.
Figure 79:
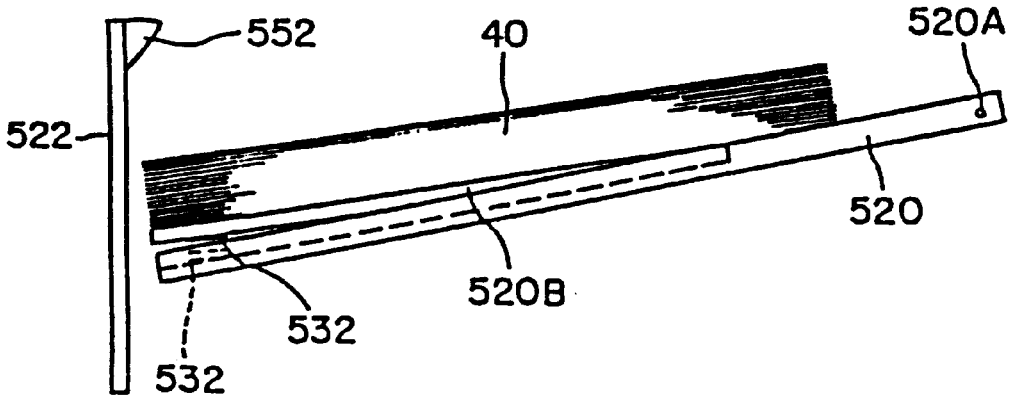

Further, as described above, when the paper size is small, the stack plane should be high, but when the paper size is large, the stack plane should be low. With the resilient supporting structure of the movable table 520B described above, if the size of a paper sheet itself is small (here it is considered that the paper thickness is fixed), even if the number of stacked paper sheets increases, the amount of downward movement of the movable table 520B is small as seen in FIG. 79(A), but if the size of a paper sheet itself is large (here it is considered that the paper thickness is fixed), the movable table 520B moves down by a great amount as the number of stacked paper sheets increases as seen in FIG. 79(B).

Accordingly, there is an advantage in that also adjustment of the height of the stacked plane takes place automatically in response to a paper size.

Naturally, a similar moving down operation can be obtained even where the entire stacker table 520 is supported resiliently.

Further, if the resilient supporting structure for the movable table 520B or the movable stacker table 520 is combined with the paper stacker position variation mechanism 530, which includes the driving motor 534, since adjustment of the height of the stacker plane in response to a paper size is performed automatically by the resilient supporting structure, only if operation of the paper stacker position variation mechanism 530 is performed in response to the transportation paper number, the height of the stack plane can be performed suitably for both of the paper size and the transportation paper number.

4-10. Other Forms of the Paper Supply Mechanism (Paper Supply Apparatus) System

By the way, while, in the embodiment described above, the paper supply rollers 220 are provided by a pair on the left and the right, when the paper supply rollers 220 are hereinafter identified between the left and the right, they are individually represented as left paper supply roller 220L and right paper supply roller 220R.

Figure 85:
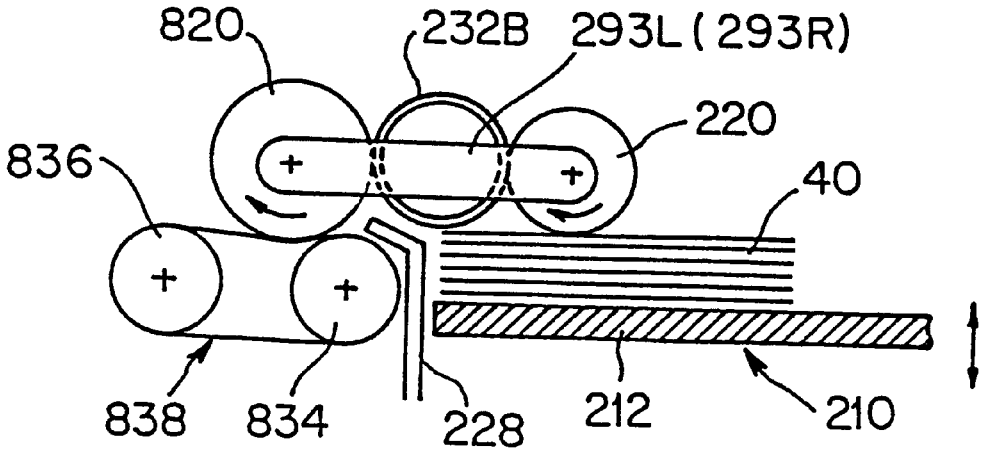
FIG. 85 is a schematic side elevational view as viewed in the direction indicated by an arrow mark A2 in FIG. 86 showing a paper supply apparatus proposed in the course of development of the paper supply apparatus of FIG. 82.
Figure 86:
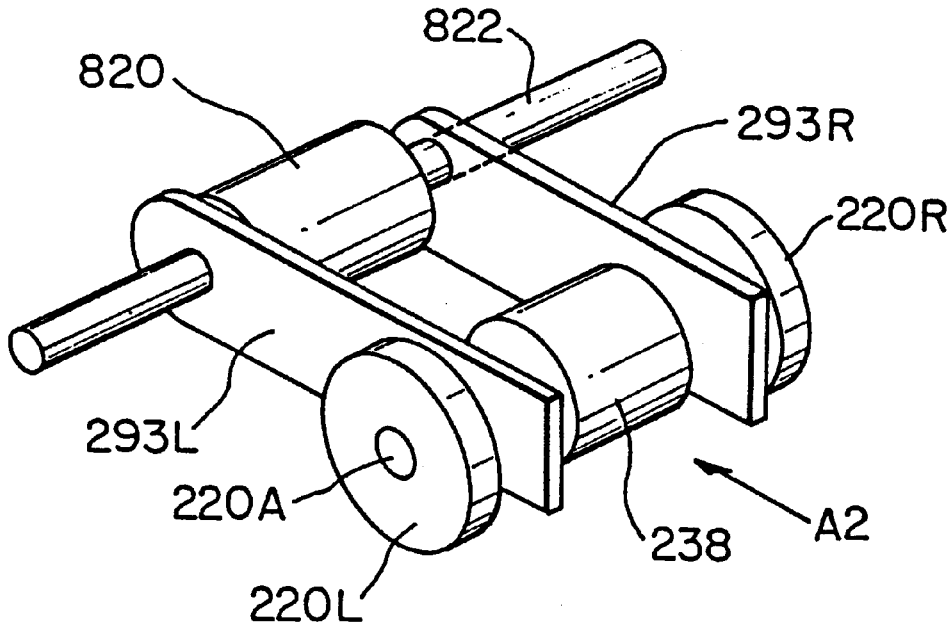
FIG. 86 is a perspective view schematically showing the paper supply apparatus of FIG. 85.

While the paper supply rollers 220L and 220R in the embodiment described hereinabove are supported for rocking motion around the axis of the separation roller 820 which will be hereinafter described by way of the rockable arms 292, they may be supported by such another structure as shown in FIGS. 85 and 86. In particular, referring to FIGS. 85 and 86, as an alternative to the rockable arms 292, a pair of left and right arm members 293L and 293R are supported at base ends thereof for pivotal motion around a rotary shaft 822 on the opposite sides of the separation roller 820 and a roller shaft 220A for the paper supply rollers 220L and 220R is supported for rotation by way of the arm members (frame guides) 293L and 293R.

If the arm members 293L and 293R are supported for individual rocking motion independently of each other, the paper supply rollers 220L and 220R are supported for rotation in a substantially independent suspension condition of each other. It is a matter of course that, since the paper supply rollers 220L and 220R are supported for rotation on the same one roller shaft 220A, they are not completely independent of each other on the left and the right, but the arm members 293L and 293R are rocked separately from each other while, for example, inclining the roller shaft 220A.

Since the paper supply rollers 220L and 220R can be moved upwardly and downwardly independently of each other on the left and the right in this manner, even if, for example, paper sheets are deformed such that they are inclined upwardly or downwardly (in the paper thicknesswise direction) or swollen partially so that the vertical positions (positions in the paper thicknesswise direction) of a left portion of a paper to be contacted with the left paper supply roller 220L and a right portion of the paper sheet to be contacted with the right paper supply roller 220R are different from each other, a sufficient degree of freedom for the paper supply rollers 220L and 220R to follow up the paper sheet 40 is assured.

With the structure just described, however, although the paper supply rollers 220L and 220R can be moved upwardly and downwardly independently of each other on the left and the right and can apply a load to a paper sheet independently of each other on the left and the right, it sometimes occurs that the loads (picking up pressures) to a paper sheet become different between the left and the right due to an imbalance between the left and right loads arising from, for example, a clutch or a part on the roller shaft, and this results in a disadvantage of occurrence of paper skew when the paper sheet 40 is fed. Further, also arising from vibrations of the paper supply rollers 220L and 220R by rotation, the picking up pressure sometimes becomes different on the left and the right, resulting in occurrence of paper skew.

Therefore, it is desired to eliminate paper skew upon paper supply while assuring a degree of freedom sufficient for the paper supply rollers 220L and 220R to be movable independently of each other to some degree.

Here, basic principles which do not cause paper skew when a paper sheet is sent out are summarized as follows:

(1) The paper supply rollers 220L and 220R be contacted horizontally on the left and the right with a paper sheet;

(2) The forces of the paper supply rollers 220L and 220R, when they are contacted with a paper sheet, act uniformly between the left and the right; and (3) Rotational vibrations or the like of the paper supply rollers 220L and 220R, and so forth, be prevented from having an influence thereof on a contacting condition of them with a paper sheet so as to maintain the condition wherein the paper supply rollers 220L and 220R are contacted horizontally on the left and the right with the paper sheet under the uniform forces on the left and the right.

Thus, as an apparatus which can assure the principles (1) to (3) listed above while assuring a degree of freedom sufficient for the paper supply rollers 220L and 220R to be movable independently of each other to some degree, the following construction is reached.

Figure 82:
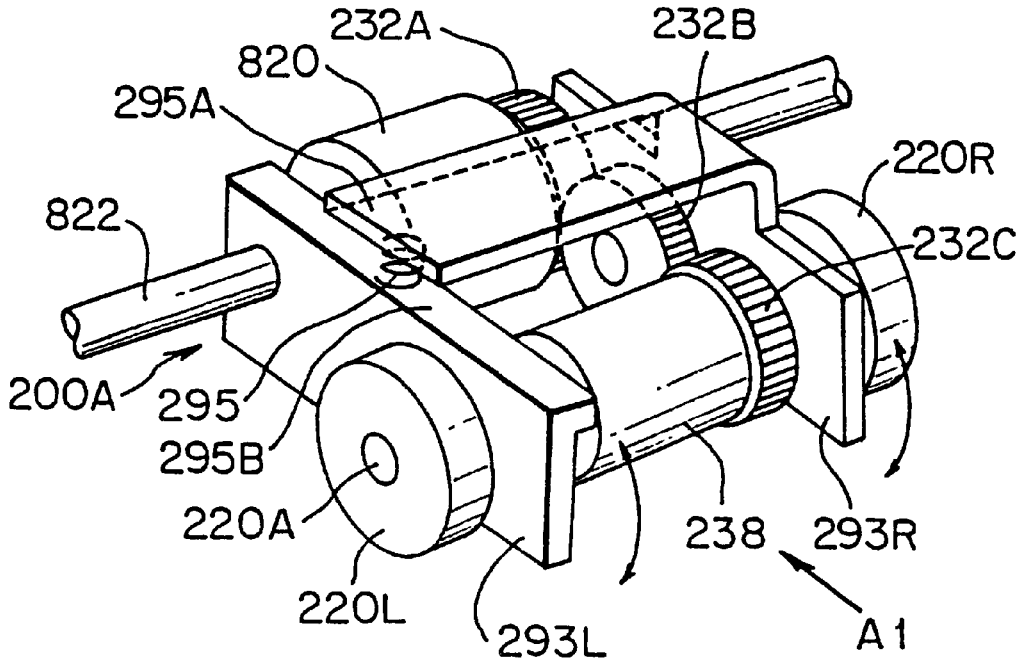
FIG. 82 is a perspective view schematically showing part of a paper supply apparatus to which the present invention is applied.
Figure 83:
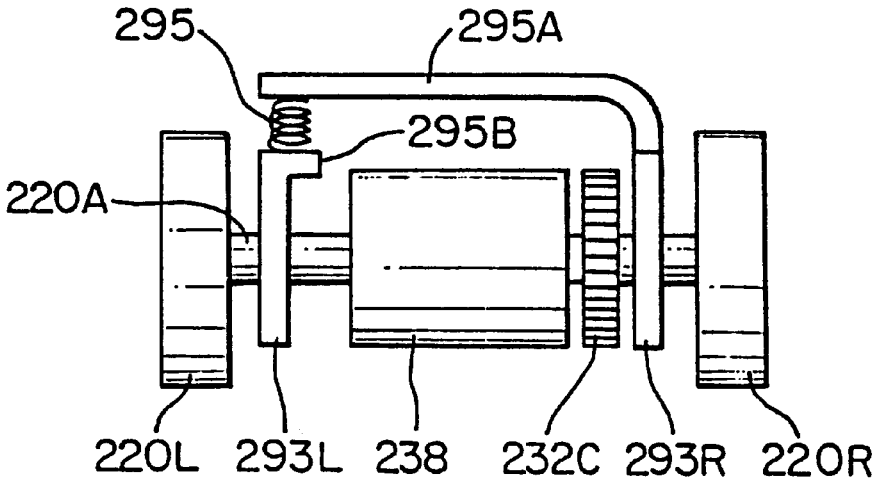
FIG. 83 is a front elevational view of the paper supply apparatus of FIG. 82 as viewed in the direction indicated by an arrow mark Al in FIG. 82.

In particular, referring to FIGS. 82 and 83, a paper supply apparatus 200A includes a pair of left and right arm members (frame guides) 293L, and 293R mounted at base ends thereof for pivotal motion on the rotary shaft 822 on the left and the right of the separation roller 820, and the roller shaft 220A of the paper supply rollers 220L and 220R is supported for rotation by way of the arm members 293L and 293R. While the arm members 293L and 293R are thus rockable to move free end portions thereof in the paper thicknesswise direction independently of each other, a resilient member 295 is interposed between the left arm member 293L and the right arm member 293R and exerts a resilient force against relative movement of the free end portions of the arm members 293L and 293R in the paper thicknesswise direction. Here, a coil spring is used as the resilient member 295. However, some other spring such as, for example, a leaf spring, may be used instead, or a resilient member of rubber, or the like, having a sufficient elasticity may be used as the resilient member 295.

Anyway, the resilient member 295 is provided in a space between an end portion of an extension (stopper metal member) 295A, which is provided such that it extends from one of the arm members 293L and 293R (in the arrangement shown, the right arm member 293R) toward the other (in the arrangement shown, the left arm member 293), and an opposing face 295B of the other of the arm members 293L and 293R (the left arm member 293) such that it exerts a resilient force in the vertical direction (paper thicknesswise direction).

It is to be noted that reference characters 232A, 232B and 232C denote gears constituting the third gear mechanism 232 as described hereinabove.

Accordingly, relative movement of the free end portions of the left and right arm members 293L and 293R in the vertical direction (thicknesswise direction of a paper sheet being transported) is resiliently controlled by the resilient force of the resilient member 295 in the compressing direction or the extending direction.

Accordingly, a left-right imbalance, or the like, of the picking up pressure upon a paper sheet, which arises from an imbalance between the left and right loads provided, for example, by a clutch or parts on the roller shaft, or the like, is suppressed. Further, also the force provided by a moment, which is produced when a gear is connected by an operation of the clutch to pick up a paper sheet, is absorbed, and also vibrations, which are instantaneously produced thereupon, are absorbed. Particularly since a primary delay system is formed by the arm members 293L and 293R and the resilient member 295, such a disadvantage that the left and right paper supply rollers 220L and 220R are brought out of contact with a paper sheet separately from each other by the self control of simple primary delay system mechanism control is automatically suppressed.

In this manner, paper skew upon paper supply can be eliminated while assuring a degree of freedom sufficient for the paper supply rollers 220L and 220R to be movable independently of each other to some degree.

Figure 84:
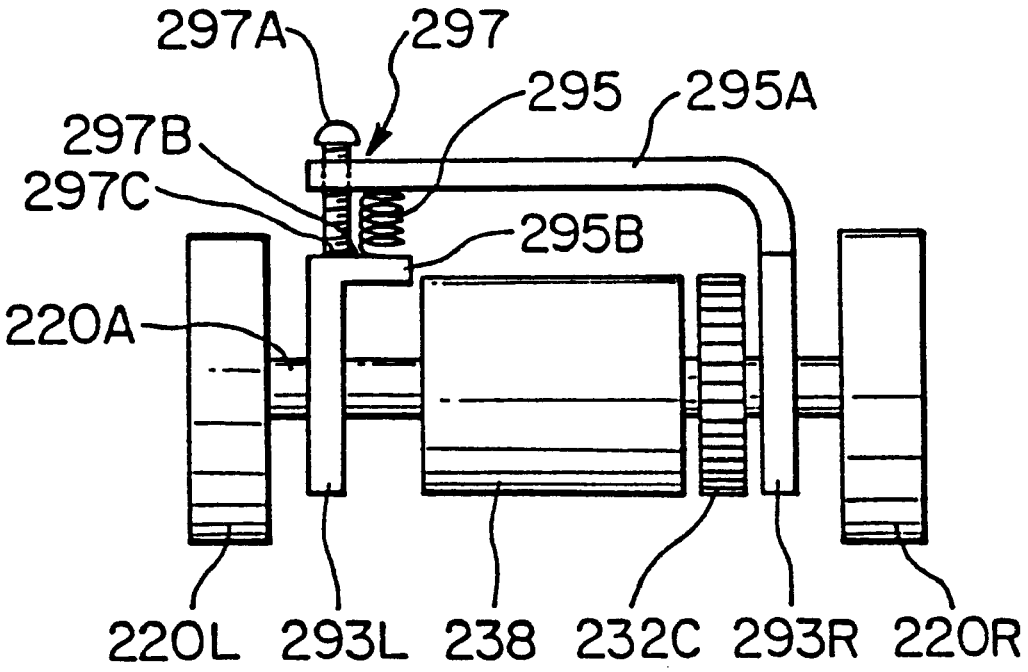
FIG. 84 is a similar view but showing a modified paper supply apparatus.

Further, a relative position controlling mechanism 297 for controlling the relative positions of the free end portions of the arm members 293L and 293R in the paper thicknesswise direction may be interposed between the left and right arm members 293L and 293R as shown in FIG. 84.

The relative position controlling mechanism 297 includes an adjustment screw 297A provided on one of the left and right arm members 293L and 293R (in the arrangement shown, the right arm member 293R), and a contacting face 297B provided on the other of the arm members 293L and 293R (in the arrangement shown, the left arm member 293L). Here, the adjustment screw 297A is provided on a stopper metal member 295A provided on the right arm member 293R such that the position thereof can be adjusted in the paper thicknesswise direction, and as the free end (contacting end) 297C of the adjustment screw 297A is contacted with the contacting face 297B, the free end portions of the left and right arm members 293L and 293R in the paper thicknesswise direction are controlled.

The relative position controlling mechanism 297 is provided together with the resilient member 295. In this instance, the resilient member 295 is mounted in an extended condition so that it may exert a biasing force (in the compressing direction) to contact the contacting end 297C of the adjustment screw 297A with the contacting face 297B.

The free end portions of the left and right arm members 293L and 293R cannot make relative movement, in the direction in which the contacting end 297C approaches the contacting face 297B, farther than the position where the contacting end 297C contacts with the contacting face 297B. However, in the direction in which the stopper action of the adjustment screw 297A is not exhibited (that is, in the direction in which the contacting end 297C of the adjustment screw 297A is spaced away from the contacting face 297B), the end portions of the left and right arm members 293L and 293R can make relative movement. However, also, this is resiliently controlled by the resilient member (compression spring) 295 which exerts a biasing force in the compressing direction.

Since the adjustment screw 297A can be accurately adjusted readily, even where the left and right paper supply rollers 220L and 220R are not balanced in positional relationship with each other due to an error in manufacture of parts, an error in assembly, or the like, the left and right paper supply rollers 220L and 220R can be adjusted so that they may be contacted horizontally on the left and the right with a paper sheet by adjusting the adjustment screw 297A.

It is a matter of course that, if the adjustment screw 297A is adjusted so that the free end portions of the left and right arm members 293L and 293R can make relative movement to some degree, then paper skew upon paper supply can be eliminated remarkably while assuring a degree of freedom sufficient for the paper supply rollers 220L and 220R to be movable independently of each other to some degree.

FIGS. 89(A) to 94 show details of a different arrangement of such resilient member 295 and relative position controlling mechanism 297 as described above.

Figure 89A:
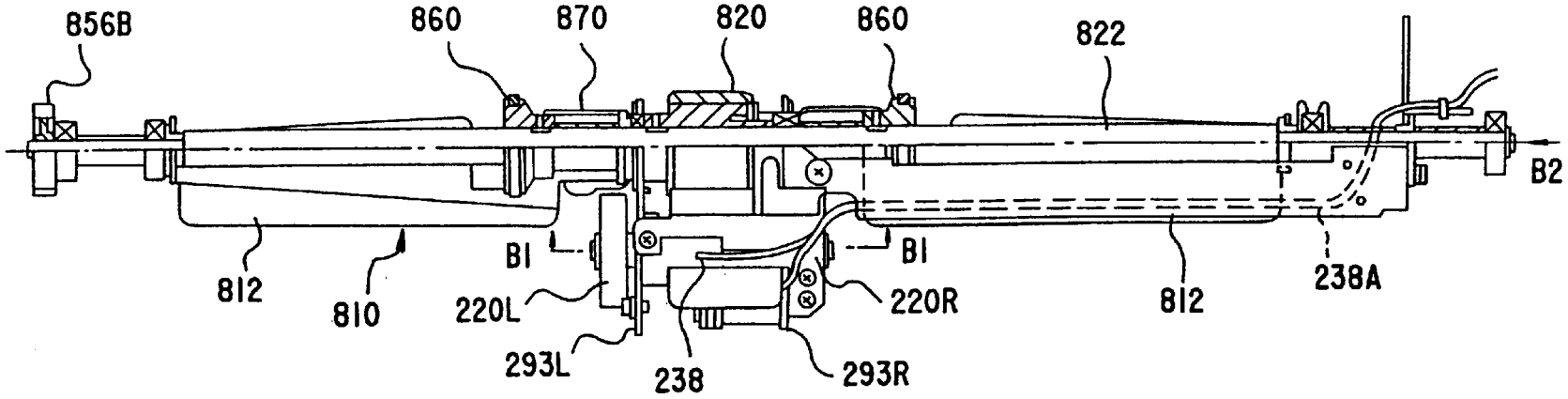
FIG. 89(A) is a plan view schematically showing another paper supply apparatus to which the present invention is applied.
Figure 89B:
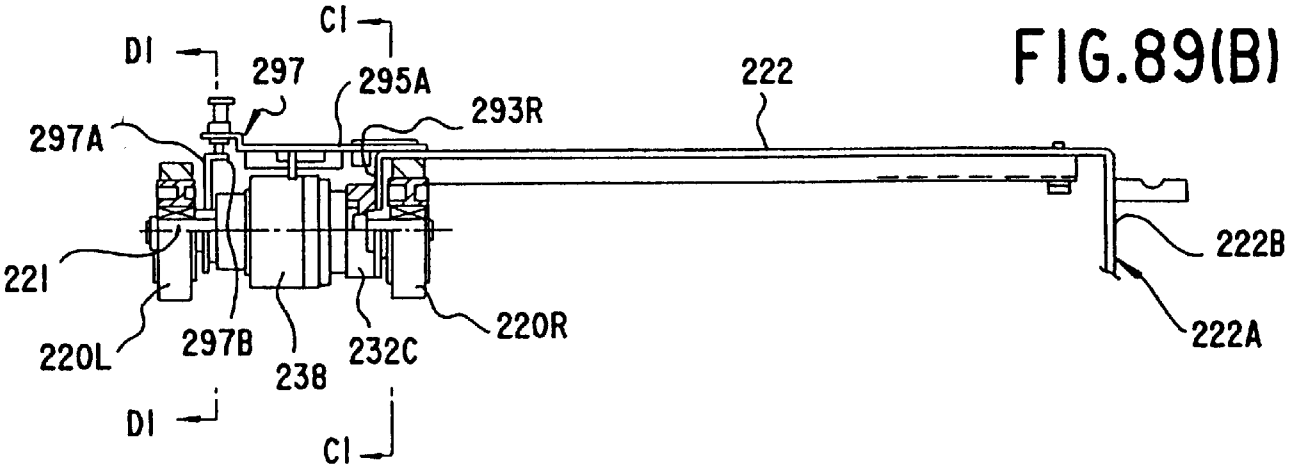
FIG. 89(B) is a front elevational sectional view taken along line B1—B1 of FIG. 89(A)

Referring first to FIGS. 89(A) and 89(B), a paper skew prevention mechanism 810 includes a pair of paper transport path members 812 provided below the rotary shaft 822 on the opposite left and right sides of the separation roller 820 and extending toward the paper passage reference plane 316 (refer to FIG. 17(B)). A gear 856B constitutes the second gear mechanism 856 for driving the separation roller 820. A pair of auxiliary rollers 860 are provided on the left and right sides of the separation roller 820 and are driven by way of an auxiliary roller driving system 870.

A first interlocking member 222 is connected to the paper supply rollers 220 such that it is moved in an interlocking relationship with a rocking movement (tilting condition) of the paper supply rollers 220. The first interlocking member 222 has a switch arm 222A at an end portion thereof. A photo-interrupter switch 290 is switched on when the switch arm 222A reaches an optical axis of the photo-interrupter switch 290, but exhibits an off-state when the switch arm 222A is not on the optic axis. A gear 232C constitutes the third gear mechanism 232 for driving the paper supply rollers 220L and 220R.

Electric power is suitably supplied to the pick clutch 238 of the paper supply roller driving mechanism 230 by way of a lead 238A to render the pick clutch 238 operative or inoperative.

Figure 92:
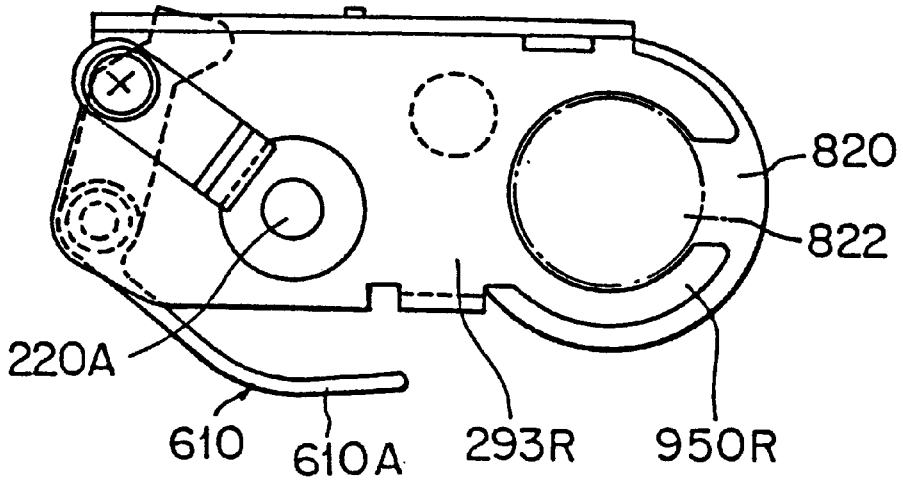
FIG. 92 is a view as viewed in the direction indicated by an arrow mark C1 in FIG. 89(B) showing a detailed construction of another part of the paper supply apparatus shown in FIGS. 89(A) and 89(B)
Figure 93:
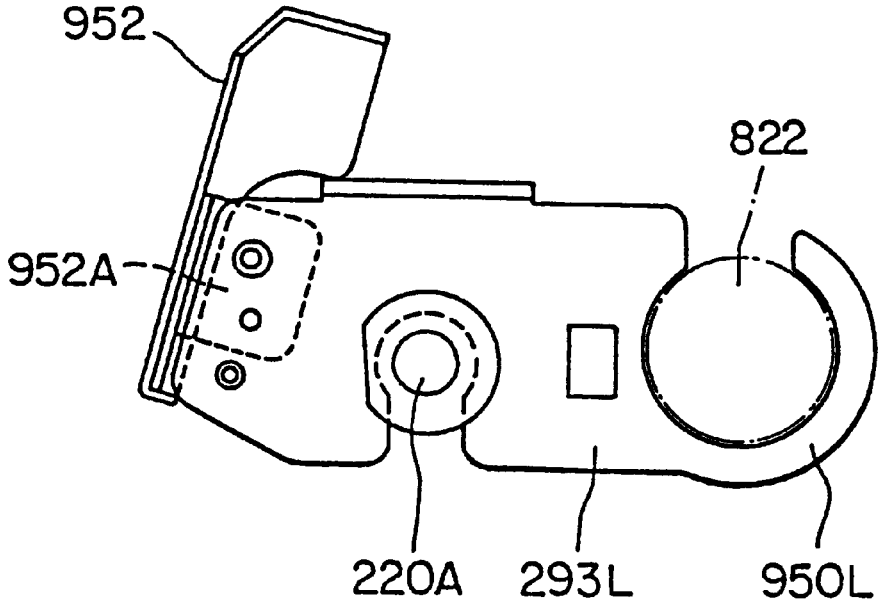
FIG. 93 is a view as viewed in the direction indicated by an arrow mark D1 in FIG. 89(B) showing a detailed construction of a further part of the paper supply apparatus shown in FIGS. 89(A) and 89(B)

As shown in FIGS. 92 and 93, the left and right arm members 293L and 293R have partially opened annular loosely fitting holes 950L and 950R formed at base portions thereof, respectively, so that the rotary shaft 822 for the separation roller 820 may be fitted for rotation therein.

Referring back to FIGS. 89(A) and 89(B), an extension (stopper metal member) 295A is provided at an upper portion of the right arm member 293R such that it extends toward the left arm member 293L, and the adjustment screw 297A of the relative position controlling mechanism 297 is provided at an end portion of the stopper metal member 295A such that it extends downwardly (in the paper thicknesswise direction).

Meanwhile, the left arm member 293L has a contacting face 297B formed at an upper portion thereof for contacting with a contacting end 297C of the relative position controlling mechanism 297. Naturally, the adjustment screw 297A is movable forwardly and backwardly in the paper thicknesswise direction so that the position of the contacting end 297C thereof can be adjusted freely.

Figure 90:
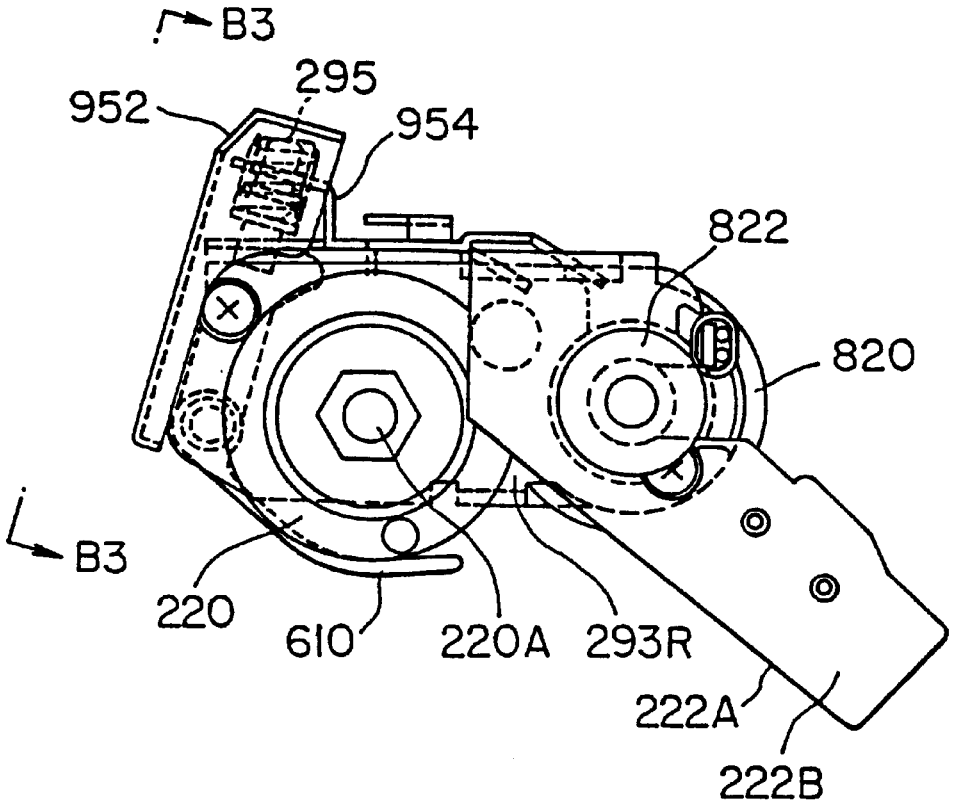
FIG. 90 is a detailed side elevational view of the paper supply apparatus shown in FIGS. 89(A) and 89(B) as viewed in the direction indicated by an arrow mark B2 in FIG. 89(A)

A cover 952 is provided at the free ends of the arm members 293L and 293R as seen from FIGS. 90 and 93. The cover 952 is secured, at a mounting portion 952A formed thereon such that it extends inwardly, to the left arm member 293L by means of a screw or some other suitable means. In other words, the cover 952 is mounted for rocking motion together with the left arm member 293L.

Figure 91:
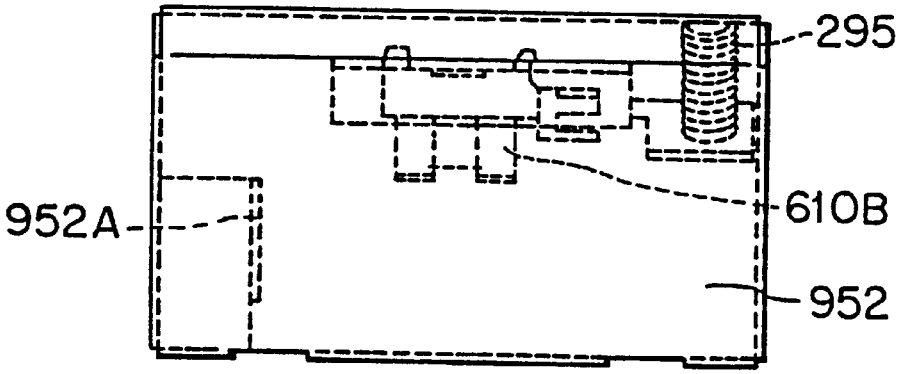
FIG. 91 is a view as viewed in the direction indicated by an arrow mark B3 in FIG. 90 showing a detailed construction of part of the paper supply apparatus shown in FIGS. 89(A) and 89(B)

The coil spring 295 as a resilient member is interposed in an extended condition between a lower face of an upper portion of the cover 952 and an upper face of the right arm member 293R, as seen in FIGS. 90 and 91, so that it may exert a compressing force.

In this manner, the resilient member 295 and the relative position controlling mechanism 297 may be provided at any locations such that they are provided separately at positions spaced away from each other or provided at near locations to each other, as seen in FIG. 84. In short, the resilient member 295 or the relative position controlling mechanism 297 may be provided at any location only if it exerts a resilient force or a controlling force at least in the paper thicknesswise direction (in the direction in which it acts as a picking up pressure to a paper sheet).

It is to be noted that, in FIGS. 91 to 93, reference numeral 610 denotes a hopper empty sensor, which includes, as described hereinabove, a rockable arm 610A which can move down an end portion thereof into a groove not shown formed, for example, in the hopper table 212, and a photo-interrupter 610B provided at a base portion of a rocking portion of the rockable arm 610A. The photo-interrupter 610B is disposed such that it is switched on (closed) when the end portion of the rockable arm 610A is moved down.

Figure 94:
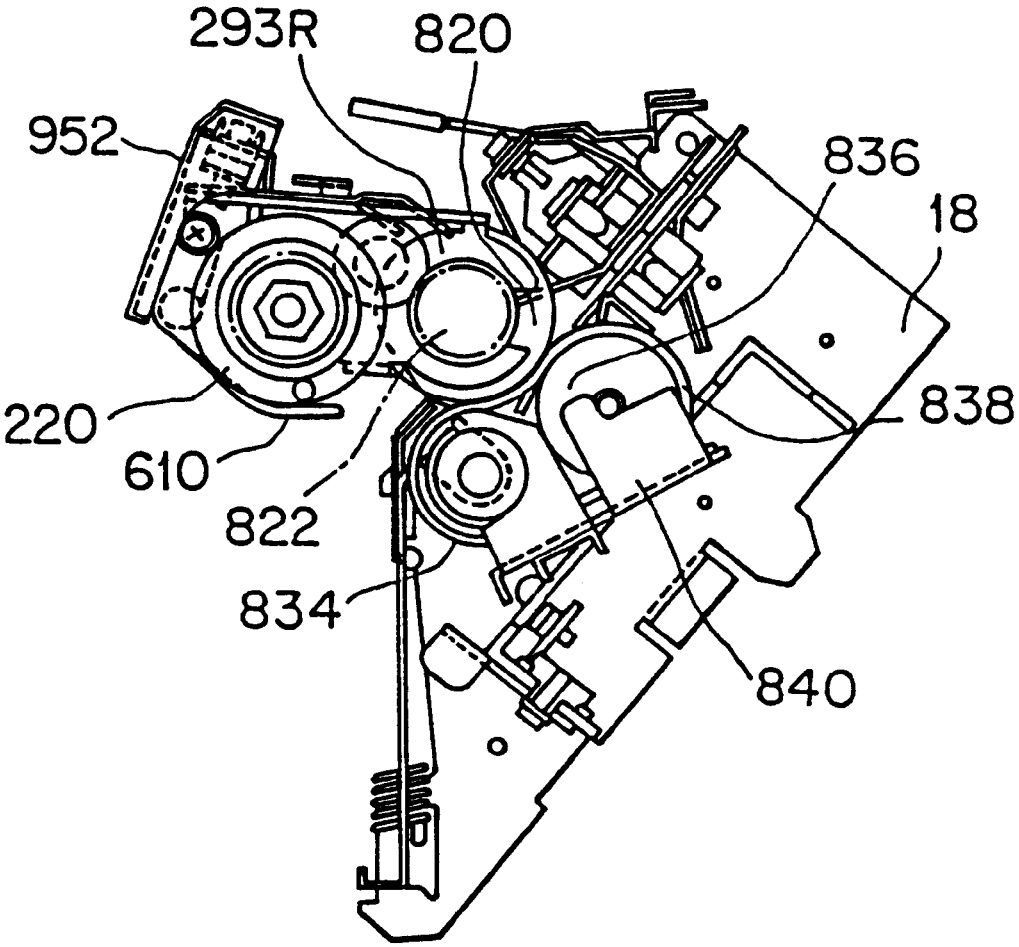
FIG. 94 is a side elevational view showing the paper supply apparatus of FIGS. 89(A) and 89(B) when mounted on a body of an image reading apparatus

The separation roller 820, the arm members 293L and 293R, the paper supply rollers 220 and the pulleys 834 and 836 constituting the rotary member 830 are supported in such a condition, as seen in FIG. 94 (which shows the resilient member 295 and the relative position controlling mechanism 297 in a mounted condition as viewed from the right end) on a pair of end brackets 18 of the apparatus body 10. Naturally, the resilient member 295 and the relative position controlling mechanism 297 are supported at the opposite left and right end locations by such end brackets.

Also with the construction described above, paper skew upon paper supply can be eliminated while assuring a degree of freedom sufficient for the paper supply rollers 220L and 220R to be movable independently of each other to some degree.

Here, the paper skew eliminating effect provided by installation of such resilient member 295 and relative position controlling mechanism 297, as described above, will be described based on results of experiments.

Figure 87A:
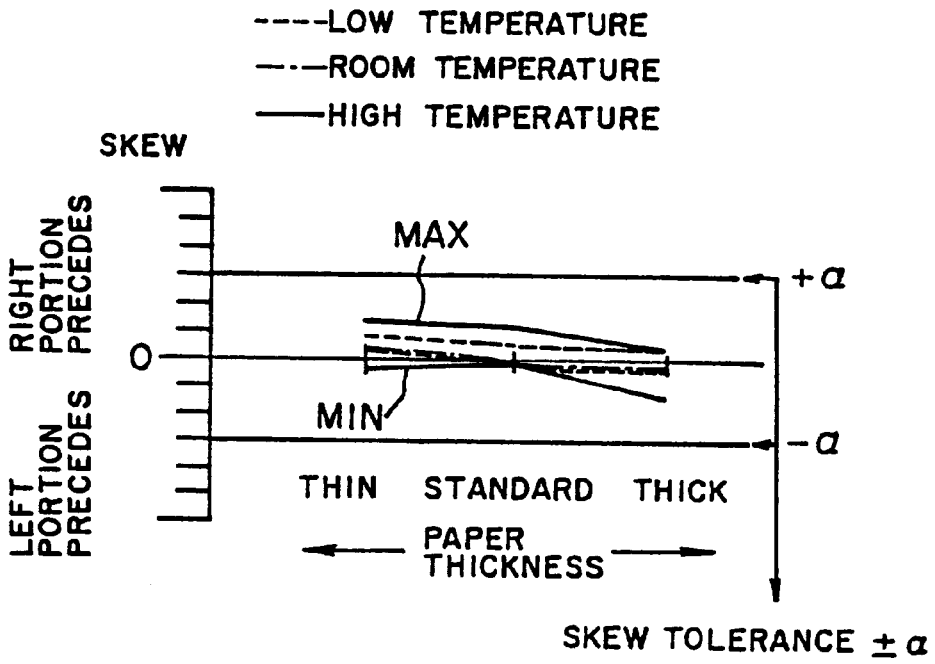
FIG. 87(A) and 87(B) are diagrammatic views illustrating advantages of the paper supply apparatus of FIGS. 82 or 84 when paper sheets of a large size and a small size are used, respectively.
Figure 87B:
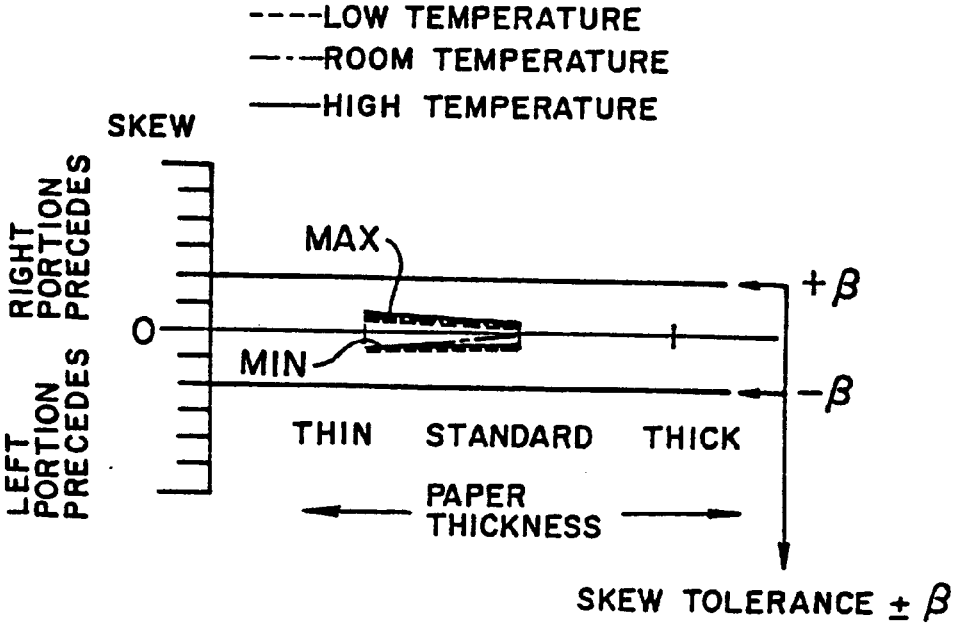
Figure 88A:
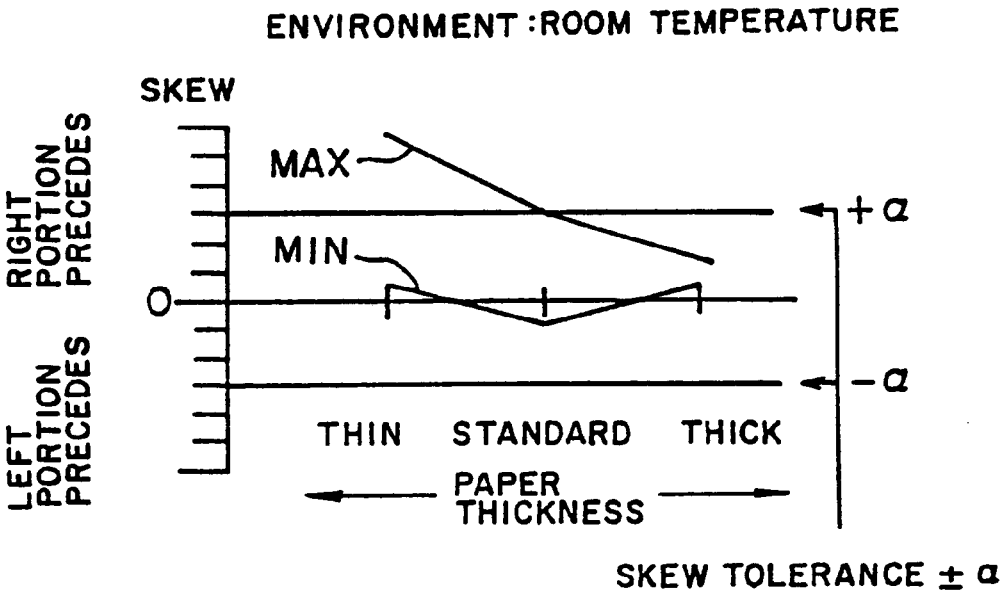
FIG. 88(A) and 88(B) are diagrammatic views illustrating different advantages of the paper supply apparatus of FIGS. 82 or 84 where paper sheets of a large size and a small size are used, respectively.
Figure 88B:
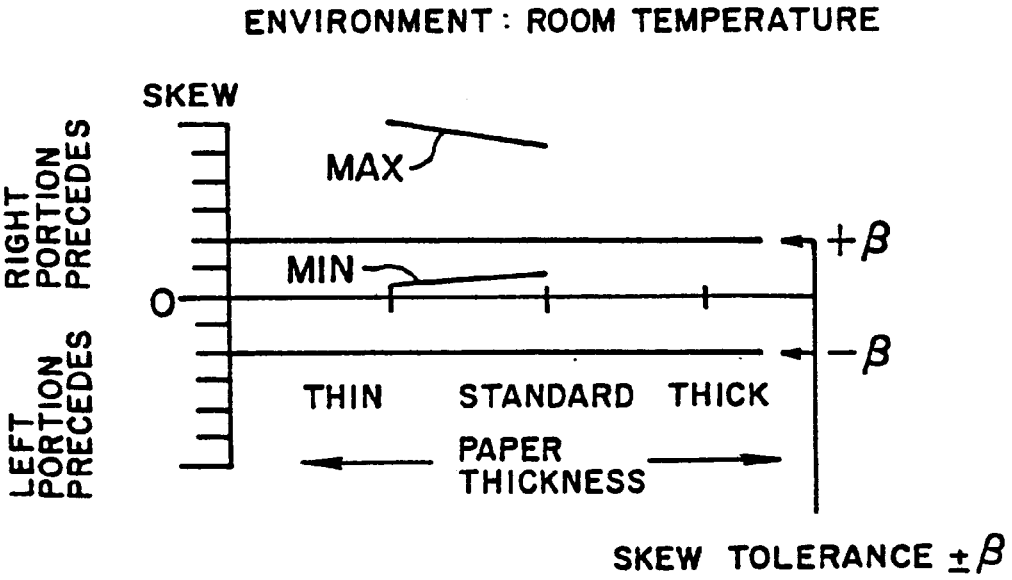

FIGS. 87(A) and 87(B) show results of experiments conducted with a paper supply mechanism, which includes the resilient member 295 and the relative position controlling mechanism 297, while FIGS. 88(A) and 88(B) show results of experiments conducted with another paper supply mechanism which does not include the resilient member 295 or the relative position controlling mechanism 297, as shown in FIGS. 84 and 85. Further, FIGS. 87(A) and 88(A) show the results of the experiments conducted with paper sheets of a large size (for example, paper sheets of the A4 size transported in a lateral condition) whereas FIGS. 87(B) and 88(B) show the results of the experiments conducted with paper sheets of a small size (for example, paper sheets of the A8 size transported in a lateral condition), and in those figures, the axis of abscissa represents the thickness of a paper sheet while the axis of ordinate represents a skew amount wherein the amount greater than O indicates paper skew when the right portion of the paper sheet precedes whereas the amount smaller than O indicates paper skew when the left portion of the paper sheet precedes. Further, in FIGS. 87(A) to 88(B), the tolerance of the skew is indicated as $\pm\alpha$ for paper sheets of the large size but as $\pm\beta$ for paper sheets of the small size (generally $\beta<\alpha$). Further, only the results of experiments conducted at a room temperature (for example, the air temperature: 23° C., and the humidity: 60%) are shown in FIGS. 88(A) and 88(B), but in FIGS. 87(A) and 87(B), the results of experiments conducted in a low temperature, low humidity condition (for example, the air temperature: 0° C., and the humidity: 5%) are indicated by broken lines; the results of experiments conducted at a room temperature (for example, the air temperature: 23° C., and the humidity: 60%) are indicated by chain lines; and the results of experiments conducted in a high temperature, high humidity condition (for example, the air temperature: 40° C., and the humidity: 80%) are indicated by solid lines.

As seen from FIGS. 87(A) to 88(B), where the resilient member 295 or the relative position controlling mechanism 297 is not provided, the maximum skew amount represented as MAX in FIGS. 88(A) and 88(B) exceeds the skew tolerance for both of paper sheets of the large size and the small size. On the other hand, where the resilient member 295 and the relative position controlling mechanism 297 are provided, the maximum skew amount represented as MAX in FIGS. 87(A) and 87(B) sufficiently remains within the skew tolerance for both of paper sheets of the large size and the small size. In this manner, the skew amount is reduced remarkably to approximately ⅕ to 1/10 by the resilient member 295 and the relative position controlling mechanism 297.

Further, in the experiments, double feeding wherein two or more paper sheets are fed at a time was eliminated completely where the resilient member 295 or the relative position controlling mechanism 297 is provided. In other words, it was proved that paper sheets can be supplied and transported one-by-one in an appropriate posture with certainty.

It is to be noted that, where the construction of the paper supply apparatus (paper supply mechanism) of any form described hereinabove is applied, in addition to an image reading apparatus, to any other apparatus which is required to supply a paper sheet such as, for example, a printer apparatus, it assures a paper sheet to be supplied in an appropriate posture with certainty, which facilitates an increase in speed of transportation and can contribute to improvement in performances of the apparatus.

The present invention is not limited to the specifically described embodiment, and variations and modifications may be made without departing from the scope of the present invention.

What is claimed:

1. A paper supply apparatus for successively supplying paper sheets accommodated therein to a paper transport mechanism, comprising:

a paper supply hopper for accommodating paper sheets therein;

a paper supply roller located at a central location in a widthwise direction of and above said paper supply hopper for forwarding one of the paper sheets accommodated in said paper supply hopper;

a paper supply roller driving mechanism for driving said paper supply roller to rotate;

a separation roller located on the downstream side in transportation of a paper sheet with respect to said paper supply roller for preventing two or more paper sheets forwarded by said paper supply roller from being sent to said paper transport mechanism;

said paper supply roller including a left paper supply roller and a right paper supply roller paired with each other;

a left arm member supported for rocking movement to move an end portion thereof in a thicknesswise direction of a paper sheet and having said left paper supply roller for rotation at the end thereof;

a right arm member supported for rocking movement to move an end portion thereof in the thicknesswise direction of the paper sheet and having said right paper supply roller for rotation at the end thereof; and a resilient member interposed between said left arm member and said right arm member for exerting a resilient force to the relative motion of the end portions of said left arm member and said right arm member in the thicknesswise direction of the paper sheet.

2. A paper supply apparatus as claimed in claim 1 further comprising said left arm member supported on a rotary shaft for said separation roller, and said right arm member supported on said rotary shaft for said separation roller.

3. A paper supply apparatus as claimed in claim 2 further comprising said right arm member supported on said rotary shaft for said separation roller for rocking movement to move an end portion thereof in the thicknesswise direction of the paper sheet independently of the rocking movement of said left arm member.

* * * * *